US008335456B2

(12) United States Patent
Kawasaki et al.

(10) Patent No.: US 8,335,456 B2
(45) Date of Patent: Dec. 18, 2012

(54) IMAGE FORMING APPARATUS, IMAGE FORMING METHOD, AND PROCESS CARTRIDGE

(75) Inventors: Yoshiaki Kawasaki, Susono (JP); Yoshiki Yanagawa, Numazu (JP); Mitsuaki Hirose, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 846 days.

(21) Appl. No.: 11/736,258

(22) Filed: Apr. 17, 2007

(65) Prior Publication Data

US 2007/0297836 A1 Dec. 27, 2007

(30) Foreign Application Priority Data

Apr. 17, 2006 (JP) ..... 2006-112933
Sep. 13, 2006 (JP) ..... 2006-248132
Sep. 13, 2006 (JP) ..... 2006-248507

(51) Int. Cl.
*G03G 15/00* (2006.01)

(52) U.S. Cl. ..... 399/159; 430/58.7; 430/66

(58) Field of Classification Search ..... 399/159; 430/58.7, 66
See application file for complete search history.

(56) References Cited

U.S. PATENT DOCUMENTS

| | | | | |
|---|---|---|---|---|
| 4,889,784 | A | 12/1989 | Champ et al. | |
| 4,943,501 | A | 7/1990 | Kinoshita et al. | |
| 5,339,138 | A | 8/1994 | Mishima et al. | |
| 5,411,827 | A | 5/1995 | Tamura et al. | |
| 5,496,671 | A | 3/1996 | Tamura et al. | |
| 5,830,614 | A | 11/1998 | Pai et al. | |
| 6,068,960 | A * | 5/2000 | Pai et al. | 430/132 |
| 6,521,387 | B2 | 2/2003 | Kawasaki | |
| 6,558,863 | B2 | 5/2003 | Rokutanzono et al. | |
| 6,824,939 | B2 | 11/2004 | Kurimoto et al. | |
| 6,853,823 | B2 | 2/2005 | Sugino et al. | |
| 6,853,834 | B2 | 2/2005 | Kurimoto et al. | |
| 7,031,650 | B2 | 4/2006 | Kurimoto et al. | |
| 7,177,583 | B2 | 2/2007 | Kurimoto et al. | |
| 2004/0151999 | A1 | 8/2004 | Mishra et al. | |
| 2004/0234875 | A1 | 11/2004 | Toda et al. | |
| 2004/0248024 | A1 | 12/2004 | Suzuki et al. | |
| 2005/0106482 | A1 * | 5/2005 | Kami et al. | 430/57.2 |
| 2005/0141919 | A1 | 6/2005 | Kitajima et al. | |
| 2005/0158641 | A1 | 7/2005 | Yanagawa et al. | |
| 2005/0158644 | A1 | 7/2005 | Kondo et al. | |
| 2005/0181291 | A1 | 8/2005 | Kami et al. | |
| 2005/0221210 | A1 | 10/2005 | Suzuki et al. | |
| 2005/0266325 | A1 | 12/2005 | Yanagawa et al. | |
| 2005/0266328 | A1 | 12/2005 | Yanagawa et al. | |
| 2005/0282075 | A1 | 12/2005 | Ikuno et al. | |
| 2005/0287452 | A1 | 12/2005 | Tamura et al. | |
| 2006/0051688 | A1 | 3/2006 | Toda et al. | |
| 2006/0110668 | A1 | 5/2006 | Kawasaki et al. | |
| 2007/0009818 | A1 | 1/2007 | Yanagawa et al. | |

FOREIGN PATENT DOCUMENTS

| | | |
|---|---|---|
| JP | 56-48637 | 5/1981 |
| JP | 64-1728 | 1/1989 |
| JP | 4-281461 | 10/1992 |
| JP | 2001-175016 | 6/2001 |
| JP | 3194392 | 6/2001 |
| JP | 3262488 | 12/2001 |
| JP | 2002-139859 | 5/2002 |
| JP | 2002-207308 | 7/2002 |
| JP | 2004-302450 | 10/2004 |
| JP | 2004-302451 | 10/2004 |
| JP | 2004-302452 | 10/2004 |
| JP | 2005-115353 | 4/2005 |
| JP | 2005-189821 | 7/2005 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

U.S. Appl. No. 08/939,123, filed Sep. 26, 1997, Kazuya Ishida, et al.

U.S. Appl. No. 12/030,886, filed Feb. 14, 2008, Toda, et al.

* cited by examiner

*Primary Examiner* — Christopher Rodee

(74) *Attorney, Agent, or Firm* — Oblon, Spivak, McClelland, Maier & Neustadt, L.L.P.

(57) ABSTRACT

The present invention provides an image forming apparatus which is equipped with at least a latent electrostatic image forming unit, a developing unit, a transferring unit, and a fixing unit, wherein the transferring unit is configured to apply a positive electric potential to a visible image formed on the latent electrostatic image bearing member via a recording medium, the latent electrostatic image member has a surface layer which comprises a hardened material hardened by irradiating at least a trifunctional or more radical polymerizable compound having no charge transporting structure, a radical polymerizable compound having a charge transporting structure, and a reactive silicone compound having any one of an acryloyloxy group and a methacryloyloxy group, and the concentration of the reactive silicone compound is varied in between the surface part and the innerlayer part of the surface layer.

7 Claims, 6 Drawing Sheets

Original document

Residual negative image

IMAGE FORMING APPARATUS, IMAGE FORMING METHOD, AND PROCESS CARTRIDGE

BACKGROUND OF THE INVENTION

1. Field of the Invention

The present invention relates to an image forming apparatus, an image forming method, and a process cartridge each of which allows for stably forming high-resolution images over a long period of time while preventing occurrences of abnormal images that would be caused by repetitive use in high-speed operation by using a latent electrostatic image bearing member (may be hereinafter referred to as "photoconductor" and "electrophotographic photoconductor") which has a surface layer and a photosensitive layer each having high-abrasion resistance, high-durability and excellent electric properties.

2. Description of the Related Art

In recent years, technologies of information processing system machines using an electrophotographic method have been remarkably advanced. In particular, performance of laser printers and digital copiers of which information is converted into digital signals to record the information by means of laser has been significantly enhanced in terms of printing quality and reliability. These laser printers and digital copiers which are widely used further require higher-quality imaging, higher-recording speed as well as down-sizing. Further, recently, demands for full-color laser printers and full-color digital copiers allowing for printing full-color images have become bulged rapidly. When an image is printed in full-color, at least four color toner-images should be superimposed, and thus further importance is placed particularly on technologies allowing for higher-recording speed and down-sizing of apparatuses.

To achieve higher-recording speed and down-sizing of these apparatuses, the photosensitivity of electrophotographic photoconductors used for these apparatuses must be enhanced, and such electrophotographic photoconductors must be down-sized. In particular, in case of a tandem-type image forming apparatus, which is effectively used for achieving both imaging in full-color and high-speed operation, at least four photoconductors are incorporated into the image forming apparatus, and thus the request for down-sizing of such a photoconductor is significantly high.

With advancement in technologies of making photoconductors have smaller diameters, photoconductors cannot avoid being used under harsher environments. Therefore, with conventional photoconductors, the exchange rate thereof is drastically increased, and a further serious problem may be caused particularly in high-speed machines. Consequently, giving photoconductors used together with image forming apparatuses not only higher-photosensitivity but also a remarkable degree of high-durability is essential to achieve higher-speed recording and down-sizing of those apparatuses.

In image forming apparatus which are operated at high-speed, a method in which a toner image formed on a photoconductor is directly transferred onto a recording medium is often employed as a transferring unit. In the method, a recording medium is conveyed using a belt to make it contact with the photoconductor surface or is conveyed to a proximate position to the photoconductor surface, and the toner image is transferred from the photoconductor surface to the recording medium by applying a sufficient amount of bias to the recording medium from the back side thereof. An image forming apparatus configured to operate at high-speed must be operated at high-linear velocity because of its design of the machine, and to increase the transferring rate, the transfer bias should be substantially increased. As the result, hazard applied to corresponding regions the toner developed on a photoconductor and other regions of the photoconductor significantly influences image-formation even via a recording medium, thereby causing abnormal images. For example, when the polarity of a transfer bias is inverse to the charge polarity of the photoconductor and the photoconductor is charged to the extent of a polarity which is inverse to the charge polarity of the photoconductor, the electric potential cannot be cancelled by removal of electricity, and the previous history of the latent electrostatic image remains on the photoconductor surface to cause a residual negative image.

To give higher-photosensitivity to a photoconductor, which is required to give high-speed processing performance to image forming apparatus, a charge generating material having a large quantum efficiency is essential. In organic high-photosensitive photoconductors, titanyl phthalocyanine having at least a maximum diffraction peak (±0.2°) of Bragg angle 2θ in XRD (CuKα ray) (wavelength: 1.542 angstroms) at 27.2 is widely used.

To give higher-durability to a photoconductor, stability of quality of images should be enhanced, in particular, occurrences of background smear should be prevented. For the mechanism of occurrences of background smear, it is considered that such a phenomenon is attributable to the following, i.e., when a charge is applied to a photoconductor, the charge is induced to a conductive substrate, another charge having a polarity which is inverse to the polarity of the above-noted charge is leaked locally and infused to the photosensitive layer and further infused to the surface of the photoconductor, and then the sites are easily developed. As two major factors that affect quality of images in repetitive use of a photoconductor, static charge fatigue of the photoconductor and abrasion of the photoconductor surface are exemplified. With respect to the former, a fatigue of a photoconductor is worse due to repetitive charging and exposing of the photoconductor at the time of forming an image, and reductions in electric potential of charge caused by the fatigue or increases in electric potential caused by the fatigue result in degradation of quality of images. In particular, a reduction in electric potential of charge further increases influence of the leaked charge from the conductive substrate to cause background smear. With respect to the latter, the surface layer of the photoconductor is worn away due to friction with a cleaning member or the like, and then the film thickness of the photoconductor surface layer is reduced, consequently, degradation of quality of images is caused due to an increased charge intensity and increased scratches on the photoconductor surface, and the like. Particularly when the electric field is increased by a reduction in film thickness, occurrences of background smear increases conspicuously.

For the reason, a charge transporting layer or a protective layer to be formed at the outermost surface of a photoconductor has been designed to improve the abrasion resistance.

For technologies to improve abrasion resistance of a photosensitive layer, (i) a photoconductor using a curable binder for a crosslinked charge transporting layer (for example, see Japanese Patent Application Laid-Open (JP-A) No. 56-48637), (ii) a photoconductor using a polymer charge transporting material (for example, see Japanese Patent Application Laid-Open (JP-A) No. 64-1728), and (iii) a photoconductor of which an inorganic filler is dispersed in a crosslinked charge transporting layer (for example Japanese Patent Application Laid-Open (JP-A) No. 4-281461) are exemplified. Since changes in electric intensity with time can be reduced by enhancing abrasion resistance of a photoconductor, a particularly high-effect can be obtained for preventing occurrences of background smear.

However, among these photoconductors, (i) the photoconductor using a curable binder is insufficient in solubility with charge transporting materials, and thus a residual charge potential tends to be increased due to effect of impurities such as polymerization initiator and unreacted residues to thereby cause degradation in image density. Further, (ii) the photoconductor using a polymer charge transporting material makes it possible to improve abrasion resistance thereof to some extent, however, the photoconductor has not yet attained the level to satisfactorily satisfy durability required for organic photoconductors. In addition, since it is difficult to polymerize and refine a polymer charge transporting material and it is hard to obtain a highly pure polymer charge transporting material, the electric properties are rarely stabilized in the material. Further, a problem in production may be caused, for example, a coating solution using a polymer charge transporting material has high viscosity. (iii) the photoconductor in which an organic filler is dispersed in a crosslinked charge transporting layer can exert high-abrasion resistance as compared to a typical photoconductor in which a low-molecular weight charge transporting material is dispersed in an inactive polymer, however, residual electric potential tends to be easily increased due to charge traps residing on the inorganic filler surface to thereby cause degradation in image density. When the degree of convexoconcave or irregularity induced to the inorganic filler and a binder resin of the photoconductor surface is great, cleaning defects may occur to cause toner filming and image deletion. Thus, with the use of the photoconductors of (i), (ii), and (iii), there are still problems with residual electric potential and surface cleaning property, which may cause image defects, and the proposed photoconductors have not yet attained the level to satisfy the required durability.

Further, as a technology of using a curable resin, a photoconductor is known in which a hardened material of a polyfunctional acrylate monomer is contained to improve abrasion resistance and scratch resistance (see, Japanese Patent (JP-B) No. 3262488). However, the invention described that the hardened material of the polyfunctional acrylate monomer is contained in a protective layer formed on a photosensitive layer, however, only described that a charge transporting material may be contained in the protective layer and there is no further detailed description. In addition, when a low-molecular weight charge transporting material was simply contained in a crosslinked charge transporting layer, there was a difficulty with solubility with the hardened material, and insufficient solubility with the hardened material actually causes precipitation of the low-molecular weight charge transporting material and white turbidity phenomenon to cause increases in electric potential in exposed regions. The increases in electric potential result in not only a degraded image density but also a degraded mechanical strength. Specifically, in the photoconductor, a monomer is reacted in a condition where a polymer binder is contained, and therefore, a three-dimensional (3D) network is not sufficiently formed and the crosslink density is sparse, and thus the photoconductor has not yet attained the level of exerting remarkable abrasion resistance.

As an alternative technology for improving abrasion resistance of a photosensitive layer, a technology is known in which a charge transporting layer is formed by using a coating solution composed of a monomer having a carbon-carbon double bond, a charge transporting material having a carbon-carbon double bond, and a binder resin (for example, see Japanese Patent (JP-B) No. 3194392). The binder resin is considered to play a role in improving adhesiveness between a charge generating layer and a hardened charge transporting layer and further alleviating internal stress of a film when the film is thickened and hardened, and such binder resin is broadly classified into a binder resin having a carbon-carbon double bond and having reactivity to the charge transporting material, and a binder resin which does not have a carbon-carbon double bond nor reactivity. The photoconductor allows for achieving both abrasion resistance and excellent electric properties and draws attention, however, when a binder resin having no reactivity is used, the solubility between the binder resin and a hardened material prepared by reacting the monomer with the charge transporting material is poor, layer separation occurs in the crosslinked charge transporting layer, which may cause scratches of the photoconductor surface, and adhesion of external additives and paper powder in a toner. As described above, a three-dimensional (3D) network is not sufficiently formed and the crosslink density is sparse, and accordingly the photoconductor has not yet attained the level of exerting remarkable abrasion resistance. Monomers exemplified as the monomer to be used for the photoconductor are bifunctional monomers, and in view of the above, the photoconductor has not yet attained the level to satisfy required abrasion resistance. Even when a binder resin having reactivity is used, although the molecular mass of the hardened material is increased, the number of crosslinked molecules is also small, it is difficult to achieve both sufficient bonding amount and sufficient crosslink density of the charge transporting material, and it cannot be said that the photoconductor meets a satisfactory level of electric property and abrasion resistance.

To solve the above-noted problems, a propose is known in which a layer hardened by irradiating a radical polymerizable monomer having no charge transporting structure and a radical polymerizable monomer having a charge transporting structure with an optical energy by means of an optical energy irradiating unit is provided as a protective layer (for example, see Japanese Patent Application Laid-Open (JP-A) No. 2004-302451). As the photoconductor does not contain a binder resin in the protective layer, a three-dimensional (3D) network is sufficiently formed and the crosslink density is substantially increased. For the reason, the photoconductor enables to exert abrasion resistance remarkably. Further, it is possible to achieve both satisfactory abrasion resistance and satisfactory electric properties because the charge transporting material is crosslinked.

Furthermore, a photoconductor is proposed which achieves continuation of low-surface energy of a photosensitive layer and improvement in transferring property and surface cleaning property over a long period of time by forming a surface layer which is hardened by irradiating a radical polymerizable monomer having no charge transporting structure, a radical polymerizable compound having a charge transporting structure, and further a reactive silicone compound having a radical polymerizable functional group and having a dimethylsiloxane structure as a repeating unit with a light energy through the use of an optical energy irradiation unit (see Japanese Patent Application Laid-Open (JP-A) No. 2005-115353).

However, it is known that the ability to retain a positive charge is significantly reduced on the surface layer of the above-noted photoconductor by repeatedly performing charging and exposing processes as compared to a typically used film in which a charge transporting material is dispersed in a binder resin. The cause is not yet clearly revealed, and the reason is assumed that the crosslinked film is deteriorated by some factors. When the photoconductor having the crosslinked film is positively charged by a transfer bias stated above, the positive charge is not retained on the photoconductor surface and is infused into the inside of the photosensitive layer. Most of the positive charge is trapped in mid of the photosensitive layer and when the photoconductor is next negatively charged, the positive charge is moved to the photoconductor surface to offset the negative charge generated on the photoconductor. As the result, the charge potential is reduced at the sites, and a residual negative image is generated after exposure of the photoconductor surface to thereby develop an abnormal image. It is known that the positive charge retention ability is reduced in proportion to the number of repeating times of charging and exposing. For deterioration of the crosslinked film, it can be considered that not only the outermost surface layer of the surface layer but also the inside of the surface layer are gradually deteriorated. When the inside of the surface layer is exposed outside, the inside of the crosslinked film has already been deteriorated, and residual negative images increasingly occur.

BRIEF SUMMARY OF THE INVENTION

The present invention aims to solve the various conventional problems and achieve the following objects. Namely, the present invention aims to provide an image forming apparatus, an image forming method, a process cartridge each of which allows for stably forming high-resolution images over a long period of time while preventing occurrences of abnormal images that would be caused by repetitive use in high-speed operation by using a latent electrostatic image bearing member having a surface layer and a photosensitive layer each having high-abrasion resistance, high-durability and excellent electric properties.

As a result of keen examinations provided by the present inventors in view of the above noted problems to solve the conventional problems, the present inventors could find the following. Namely, the present inventors found that it is possible to obtain an image forming apparatus which is highly durable and allows for stably forming high-resolution images over a long period of time while preventing occurrences of abnormal images attributable to residual negative images that would be formed on a latent electrostatic image bearing member by the effect of transfer bias generated from a transferring unit when the latent electrostatic image bearing member is repeatedly charged and exposed in high-speed operation in the image forming apparatus; the image forming apparatus allows for high-speed operation and employing a method of which a visible image formed on the latent electrostatic image bearing member is transferred onto a recording medium by applying a positive electric potential to a visible image formed on the latent electrostatic image bearing member; the latent electrostatic image bearing member has a photosensitive layer and a surface layer, the surface layer contains a hardened material composed of a trifunctional or more radical polymerizable compound having no charge transporting structure, a radical polymerizable compound having a charge transporting structure, and a reactive silicone compound, and the concentration of the reactive silicone compound is varied in between the surface part of the surface layer and the innerlayer part of the surface layer to thereby obtain the above-noted latent electrostatic image bearing member. Further, the present inventors found that by setting the concentration of the reactive silicone compound at the innerlayer part of the surface layer to be higher than the concentration thereof at the surface part of the surface layer, occurrences of abnormal images can be significantly prevented even when the surface layer is gradually worn away. These findings led to the completion of the present invention.

The present invention A is based on the findings of the present inventors, and the means to solve the above-noted problems are as follows.

<1> An image forming apparatus having at least a latent electrostatic image bearing member, a latent electrostatic image forming unit configured to form a latent electrostatic image on the latent electrostatic image bearing member, a developing unit configured to develop the latent electrostatic image using a toner to form a visible image, and a transferring unit configured to transfer the visible image onto a recording medium, and a fixing unit configured to fix the transferred image on the recording medium, wherein the transferring unit is configured to apply a positive electric potential to the visible image formed on the latent electrostatic image bearing member via the recording medium; the latent electrostatic image bearing member comprises a substrate and at least a photosensitive layer and a surface layer formed in this order on the substrate, the surface layer contains a hardened material containing at least (i) a trifunctional or more radical polymerizable compound having no charge transporting structure, (ii) a radical polymerizable compound having a charge transporting structure, and (iii) a reactive silicone compound having any one of an acryloyloxy group and a methacryloyloxy group, and the concentration of (iii) the reactive silicone compound in the surface layer is varied in between the surface part and the innerlayer part of the surface layer.

<2> The image forming apparatus according to the item <1>, wherein the concentration of (iii) the reactive silicone compound at the innerlayer part of the surface layer of the latent electrostatic image bearing member is higher than the concentration thereof at the surface part of the surface layer.

<3> The image forming apparatus according to any one of the items <1> to <2>, wherein (ii) the radical polymerizable compound having a charge transporting structure in the surface layer of the latent electrostatic image bearing member is a monofunctional compound.

<4> The image forming apparatus according to any one of the items <1> to <3>, wherein the functional group of (i) the trifunctional or more radical polymerizable compound having no charge transporting structure in the surface layer of the latent electrostatic image bearing member is any one of an acryloyloxy group and a methacryloyloxy group.

<5> The image forming apparatus according to any one of the items <1> to <4>, wherein the functional group of (ii) the radical polymerizable compound having a charge transporting structure in the surface layer of the latent electrostatic image bearing member is any one of an acryloyloxy group and a methacryloyloxy group.

<6> The image forming apparatus according to any one of the items <1> to <5>, wherein the charge transporting structure of (ii) the radical polymerizable compound having a charge transporting structure in the surface layer of the latent electrostatic image bearing member is a triarylamine structure.

<7> The image forming apparatus according to any one of the items <3> to <6>, wherein (ii) the radical polymerizable compound having a charge transporting structure is at least one selected from compounds represented by any one of the following Structural Formula (1) and Structural Formula (2), Structural Formula (1)

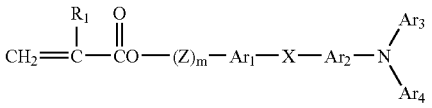

Structural Formula (2)

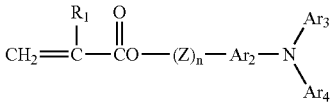

where $R_1$ represents any one of a hydrogen atom, a halogen atom, a cyano group, a nitro group, an alkyl group that may have a substituent group, an aralkyl group that may have a substituent group, an aryl group that may have a substituent group, an alkoxy group, —$COOR_7$ ($R_7$ represents a hydrogen atom, an alkyl group that may have a substituent group, an aralkyl group that may have a substituent group, or an aryl group that may have a substituent group), a halogenated carbonyl group, and —$CONR_8R_9$ ($R_8$ and $R_9$ may be same to each other or different from each other and respectively represent a hydrogen atom, a halogen atom, an alkyl group that may have a substituent group, an aralkyl group that may have a substituent group, or an aryl group that may have a substituent group); $Ar_1$ and $Ar_2$ may be same to each other or different from each other and respectively represent an allylene group that may have a substituent group; $Ar_3$ and $Ar_4$ may be same to each other or different from each other and respectively represent an aryl group that may have a substituent group; X represents any one of a single bond, an alkylene group that may have a substituent group, a cycloalkylene group that may have a substituent group, an alkylene ether group that may have a substituent group, an oxygen atom, a sulfur atom, and a vinylene group; Z represents any one of an alkylene group that may have a substituent group, an alkylene ether divalent group that may have a substituent group, and an alkylene oxycarbonyl divalent group; and "m" and "n" are respectively an integer of 0 to 3.

<8> The image forming apparatus according to any one of the items <1> to <7>, wherein (ii) the radical polymerizable compound having a charge transporting structure in the surface layer of the latent electrostatic image bearing member is at least one selected from compounds represented by the following Structural Formula (3), Structural Formula (3)

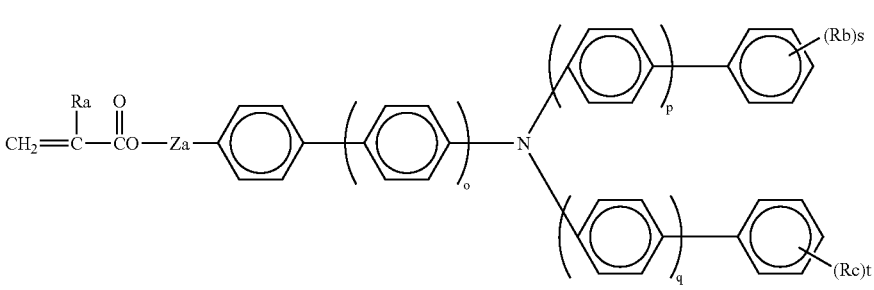

wherein "o", "p", and "q" are respectively an integer of 0 or 1; Ra represents a hydrogen atom or a methyl group; Rb and Rc may be same to each other or different from each other and respectively represent an alkyl group having 1 to 6 carbon atoms; "s" and "t" are respectively an integer of 0 to 3; and Za represents a single bond, a methylene group, an ethylene group, or a substituent group represented by any one of the following structural formulas.

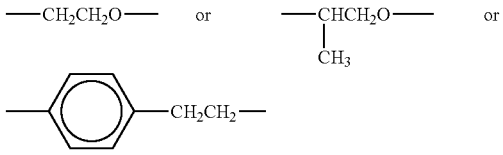

<9> The image forming apparatus according to any one of the items <1> to <8>, wherein the photosensitive layer of the latent electrostatic image bearing member contains a charge generating material, and the charge generating material contains titanylphthalocyanine.

<10> The image forming apparatus according to the item <9>, wherein the titanylphthalocyanine has a crystal form having major diffraction peaks specified by Bragg angle 2 θ, in the X-ray diffraction spectrum using Cu—Kα ray, of at least 9.6°±0.2°, 24.0°±0.2°, and 27.2°±0.2°.

<11> The image forming apparatus according to any one of the items <1> to <10>, wherein the surface layer of the latent electrostatic image bearing member is formed by applying a surface layer coating solution containing (i) the trifunctional or more radical polymerizable compound having no charge transporting structure, (ii) the radical polymerizable compound having a charge transporting structure, and (iii) the reactive silicone compound over the surface of the photosensitive layer by spray-coating.

<12> The image forming apparatus according to the item <11>, wherein the surface layer is formed by applying a plurality of surface layer coating solutions over the surface of the photosensitive layer by multiple spray-coating, and the concentration of (iii) the reactive silicone compound in the surface layer coating solutions used for the spray-coating is varied to each other.

<13> The image forming apparatus according to the item <12>, wherein the surface layer of the latent electrostatic image bearing member is hardened by irradiating the plurality of surface layer coating solutions after completion of the spray-coating of the plurality of the surface layer coating solutions.

<14> The image forming apparatus according to any one of the items <1> to <13>, wherein the transferring unit is any one of a transfer roller and a transferring belt.

<15> The image forming apparatus according to any one of the items <1> to <14>, wherein the linear velocity of the latent electrostatic image bearing member at the time of forming an image is 300 mm/sec or more.

<16> An image forming method which includes forming a latent electrostatic image on a latent electrostatic image bearing member, developing the latent electrostatic image using a toner to form a visible image, transferring the visible image onto a recording medium, and fixing the transferred image on the recording medium, wherein in the transferring, the visual image formed on the latent electrostatic image bearing member is applied with a positive electric potential via the recording medium; the latent electrostatic image bearing member has a substrate and at least a photosensitive layer and a surface layer formed in this order on the substrate, and the surface layer contains a hardened material containing at least (i) a trifunctional or more radical polymerizable compound having no charge transporting material, a radical polymerizable compound having a charge transporting material, and (iii) a reactive silicone compound having any one of an acryloyloxy group and a methacryloyloxy group, and the concentration of (iii) the reactive silicone compound in the surface layer is varied in between the surface part and the innerlayer part of the surface layer.

<17> The image forming method according to the item <16>, wherein the transferring unit is any one of a transfer roller and a transferring belt.

<18> A process cartridge having a latent electrostatic image bearing member, a latent electrostatic image forming unit configured to form a latent electrostatic image on the latent electrostatic image bearing member, and at least one selected from a developing unit configured to develop the latent electrostatic image using a toner to form a visible image, a transferring unit configured to transfer the visible image onto a recording medium, and a cleaning unit configured to remove a toner remaining on the latent electrostatic image bearing member so as to be detachably mounted to a main body of an image forming apparatus, wherein the transferring unit is configured to apply a positive electric potential to the visible image formed on the latent electrostatic image bearing member via the recording medium; the latent electrostatic image bearing member has a substrate and at least a photosensitive layer and a surface layer formed in this order on the substrate, and the surface layer contains a hardened material containing at least (i) a trifunctional or more radical polymerizable compound having no charge transporting material, a radical polymerizable compound having a charge transporting material, and (iii) a reactive silicone compound having any one of an acryloyloxy group and a methacryloyloxy group, and the concentration of (iii) the reactive silicone compound in the surface layer is varied between the surface part and the innerlayer part of the surface layer.

The present invention B is based on the findings of the present inventors, and the means to solve the above-noted problems are as follows.

<1> An image forming apparatus having at least a latent electrostatic image bearing member, a latent electrostatic image forming unit configured to form a latent electrostatic image on the latent electrostatic image bearing member, a developing unit configured to develop the latent electrostatic image using a toner to form a visible image, a transferring unit configured to transfer the visible image on a recording medium, and a fixing unit configured to fix the transferred image on the recording medium, wherein the transferring unit is configured to apply a positive electric potential to the visible image formed on the latent electrostatic image bearing member via the recording medium, the latent electrostatic image bearing member has a layer configuration in which at least a photosensitive layer and a surface layer are formed in this order in a laminate structure on a substrate, the surface layer comprises a hardened material which is hardened by irradiating at least (i) a trifunctional or more radical polymerizable monomer having no charge transporting layer, (ii) a radical polymerizable compound having a charge transporting structure, and (iv) a compound having both of a hindered phenol structure and a hindered amine structure through the use of an optical energy irradiation unit, and the concentration of (iv) the compound having both of a hindered phenol structure and a hindered amine structure is varied in between the surface part and the innerlayer part of the surface layer.

<2> The image forming apparatus according to the item <1>, wherein the concentration of (iv) the compound having both of a hindered phenol structure and a hindered amine structure at the innerlayer part of the surface layer is higher than the concentration thereof at the surface part of the surface layer.

<3> The image forming apparatus according to any one of the items <1> to <2>, wherein (ii) the radical polymerizable compound having a charge transporting structure is a monofunctional compound.

<4> The image forming apparatus according to any one of the items <1> to <3>, wherein (i) the trifunctional or more radical polymerizable monomer having no charge transporting structure is a trifunctional or more radical polymerizable monomer having no charge transporting structure and having functional groups of an acryloyloxy group and/or a methacryloyloxy group.

<5> The image forming apparatus according to any one of the items <1> to <3>, wherein (ii) the radical polymerizable compound having a charge transporting structure is a radical polymerizable compound having a charge transporting structure and having functional groups of an acryloyloxy group and/or a methacryloyloxy group.

<6> The image forming apparatus according to any one of the items <1> to <3>, wherein (ii) the radical polymerizable compound having a charge transporting structure is a radical polymerizable compound having a triarylamine structure.

<7> The image forming apparatus according to any one of the items <1> and <6>, wherein (ii) the radical polymerizable compound having a charge transporting structure is one or more radical polymerizable compounds represented by any one of the following Structural Formula (1) and Structural Formula (2), Structural Formula (1)

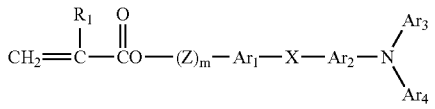

Structural Formula (2)

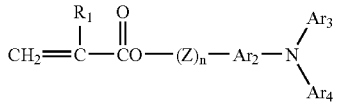

where $R_1$ represents any one of a hydrogen atom, a halogen atom, a cyano group, a nitro group, an alkyl group that may have a substituent group, an aralkyl group that may have a substituent group, an aryl group that may have a substituent group, an alkoxy group, —$COOR_7$ ($R_7$ represents a hydrogen atom, an alkyl group that may have a substituent group, an aralkyl group that may have a substituent group, or an aryl group that may have a substituent group), a halogenated carbonyl group, and —$CONR_8R_9$ ($R_8$ and $R_9$ may be same to each other or different from each other and respectively represent a hydrogen atom, a halogen atom, an alkyl group that may have a substituent group, an aralkyl group that may have a substituent group, or an aryl group that may have a substituent group); $Ar_1$ and $Ar_2$ may be same to each other or different from each other and respectively represent an allylene group that may have a substituent group; $Ar_3$ and $Ar_4$ may be same to each other or different from each other and respectively represent an aryl group that may have a substituent group; X represents any one of a single bond, an alkylene group that may have a substituent group, a cycloalkylene group that may have a substituent group, an alkylene ether group that may have a substituent group, an oxygen atom, a sulfur atom, and a vinylene group; Z represents any one of an alkylene group that may have a substituent group, an alkylene ether divalent group that may have a substituent group, and an alkylene oxycarbonyl divalent group; and "m" and "n" are respectively an integer of 0 to 3.

<8> The image forming apparatus according to any one of the items <1> to <7>, wherein (ii) the radical polymerizable compound having a charge transporting structure is one or more radical polymerizable compounds represented by the following Structural Formula (3), Structural Formula (3)

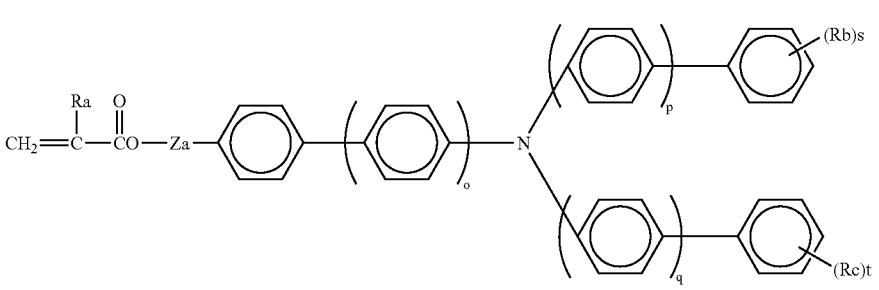

wherein "o", "p", and "q" are respectively an integer of 0 or 1; Ra represents a hydrogen atom or a methyl group; Rb and Rc may be same to each other or different from each other and respectively represent an alkyl group having 1 to 6 carbon atoms; "s" and "t" are respectively an integer of 0 to 3; and Za represents a single bond, a methylene group, an ethylene group, or a substituent group represented by any one of the following structural formulas.

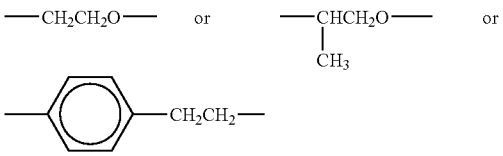

<9> The image forming apparatus according to any one of the items <1> to <8>, wherein the photosensitive layer contains titanylphthalocyanine as a charge generating material.

<10> The image forming apparatus according to the item <9>, wherein the titanylphthalocyanine has a crystal form having major diffraction peaks specified by Bragg angle 2 θ, in the X-ray diffraction spectrum using Cu—Kα ray, of at least 9.6°±0.2°, 24.0°±0.2°, and 27.2°±0.2°.

<11> The image forming apparatus according to any one of the items <1> to <10>, wherein the surface layer is formed by spray-coating.

<12> The image forming apparatus according to the item <11>, wherein the surface layer is formed by applying a plurality of surface layer coating solutions each having a different concentration of (iv) the compound having both of a hindered phenol structure and a hindered amine structure over the surface of the photosensitive layer by multiple spray-coating.

<13> The image forming apparatus according to any one of the items <1> and <12>, wherein the surface layer of the electrophotographic photoconductor is hardened by irradiating the plurality of surface layer coating solutions after completion of the spray-coating of the plurality of the surface layer coating solutions.

<14> The image forming apparatus according to any one of the items <1> to <13>, wherein the linear velocity of the electrophotographic photoconductor at the time of forming an image is 300 mm/sec or more.

<15> The image forming apparatus according to any one of the items <1> to <14>, equipped with a process cartridge which is detachably mounted to a main body of an image forming apparatus, wherein in the process cartridge, the electrophotographic photoconductor and at least one unit selected from the latent electrostatic image forming unit, the developing unit, and the cleaning unit are integrally combined to form a unit.

The present invention C is based on the findings of the present inventors, and the means to solve the above-noted problems are as follows.

<1> An image forming apparatus having at least a latent electrostatic image bearing member, a latent electrostatic image forming unit configured to form a latent electrostatic image on the latent electrostatic image bearing member, a developing unit configured to develop the latent electrostatic image using a toner to form a visible image, a transferring unit configured to transfer the visible image on a recording medium, and a fixing unit configured to fix the transferred image on the recording medium, wherein the transferring unit is configured to apply a positive electric potential to the visible image formed on the latent electrostatic image bearing member via the recording medium, the latent electrostatic image bearing member has a layer configuration in which at least a photosensitive layer and a surface layer are formed in this order in a laminate structure on a substrate, the surface layer comprises a hardened material which is hardened by irradiating at least (i) a trifunctional or more radical polymerizable monomer having no charge transporting layer and (ii) a radical polymerizable compound having a charge transporting structure through the use of an optical energy irradiation unit, and the concentration of (ii) the radical polymerizable compound having a charge transporting structure is varied in between the surface part and the innerlayer part of the surface layer.

With the configurations described above, images can be output in stable conditions with keeping high-resistance to abrasion even when the electrophotographic photoconductor is repeatedly used at high-speed and without substantially causing abnormal images that would be caused by background smear.

<2> The electrophotographic photoconductor according to the item <1>, wherein the contact type transferring unit is based on a roller method or a belt method and is configured to apply a positive electric potential to the electrophotographic photoconductor.

With the use of the transferring unit based on a roller method or a belt method, a visible image can be transferred onto a recording medium in stable conditions by applying a positive electric potential to the visible image formed on the electrophotographic photoconductor even when the electrophotographic photoconductor is repeatedly used at high-speed.

<3> The electrophotographic photoconductor according to any one of the items <1> to <2>, wherein the concentration of (ii) the radical polymerizable compound having a charge transporting structure is varied in the film thickness direction of the surface layer so as to be more reduced from the surface of the surface layer toward the inside of the surface layer.

By generating a concentration gradient of (ii) the radical polymerizable compound having a charge transporting structure in the film thickness direction as described above, a visible image can be transferred onto a recording medium in stable conditions without causing degradation of photosensitivity and increases in residual electric potential even when the electrophotographic photoconductor is repeatedly used.

<4> The electrophotographic photoconductor according to any one of the items <1> to <3>, wherein (ii) the radical polymerizable compound having a charge transporting structure is a monofunctional compound.

With the use of a radical polymerizable compound having a charge transporting structure, it is possible to prevent occurrences of exfoliation, abrasion, and cracks of the hardened resin formed by a crosslinking reaction, and electric properties such as photosensitivity and residual electric potential can be maintained in excellent conditions.

<5> The electrophotographic photoconductor according to any one of the items <1> to <4>, wherein the functional group of (ii) the radical polymerizable compound having a charge transporting structure is an acryloyloxy group and/or a methacryloyloxy group.

<6> The electrophotographic photoconductor according to any one of the items <1> and <2>, wherein the functional group of (i) the trifunctional or more radical polymerizable compound having no charge transporting structure is an acryloyloxy group and/or a methacryloyloxy group.

With the use of an electrophotographic photoconductor according to any one of the items <5> to <6>, the components can be easily crosslinked by irradiation of an optical energy to form a hardened resin, and it is possible to form a surface layer which is capable of maintaining high-durability even when the electrophotographic photoconductor is repeatedly used at high-speed and allows for obtaining high-quality image.

<7> The electrophotographic photoconductor according to any one of the items <1> to <5>, wherein (ii) the radical polymerizable compound having a charge transporting structure contains a triarylamine structure in a molecule thereof.

With the use of a compound containing a triarylamine structure in a molecule thereof, a surface layer exhibiting high-charge transporting effect can be formed.

<8> The electrophotographic photoconductor according to the item <7>, wherein (ii) the radical polymerizable compound having a charge transporting structure containing a triarylamine structure is represented by any one of the following Structural Formula (1) and Structural Formula (2), Structural Formula (1)

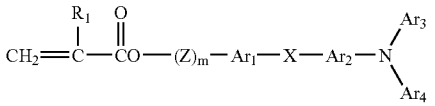

where $R_1$ represents any one of a hydrogen atom, a halogen atom, a cyano group, a nitro group, an alkyl group that may have a substituent group, an aralkyl group that may have a substituent group, an aryl group that may have a substituent group, an alkoxy group, —$COOR_7$ ($R_7$ represents a hydrogen atom, an alkyl group that may have a substituent group, an aralkyl group that may have a substituent group, or an aryl group that may have a substituent group), a halogenated carbonyl group, and —$CONR_8R_9$ ($R_8$ and $R_9$ may be same to each other or different from each other and respectively represent a hydrogen atom, a halogen atom, an alkyl group that may have a substituent group, an aralkyl group that may have a substituent group, or an aryl group that may have a substituent group); $Ar_1$ and $Ar_2$ may be same to each other or different from each other and respectively represent an allylene group that may have a substituent group; $Ar_3$ and $Ar_4$ may be same to each other or different from each other and respectively represent an aryl group that may have a substituent group; X represents any one of a single bond, an alkylene group that may have a substituent group, a cycloalkylene group that may have a substituent group, an alkylene ether group that may have a substituent group, an oxygen atom, a sulfur atom, and a vinylene group; Z represents any one of an alkylene group that may have a substituent group, an alkylene ether divalent group that may have a substituent group, and an alkylene oxycarbonyl divalent group; and "m" is an integer of 0 to 3, Structural Formula (2)

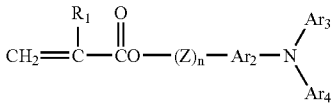

where $R_1$ represents any one of a hydrogen atom, a halogen atom, a cyano group, a nitro group, an alkyl group that may have a substituent group, an aralkyl group that may have a substituent group, an aryl group that may have a substituent group, an alkoxy group, —$COOR_7$ ($R_7$ represents a hydrogen atom, an alkyl group that may have a substituent group, an aralkyl group that may have a substituent group, or an aryl group that may have a substituent group), a halogenated carbonyl group, and —$CONR_8R_9$ ($R_8$ and $R_9$ may be same to each other or different from each other and respectively represent a hydrogen atom, a halogen atom, an alkyl group that may have a substituent group, an aralkyl group that may have a substituent group, or an aryl group that may have a substituent group); $Ar_1$ and $Ar_2$ may be same to each other or different from each other and respectively represent an allylene group that may have a substituent group; $Ar_3$ and $Ar_4$ may be same to each other or different from each other and respectively represent an aryl group that may have a substituent group; X represents any one of a single bond, an alkylene group that may have a substituent group, a cycloalkylene group that may have a substituent group, an alkylene ether group that may have a substituent group, an oxygen atom, a sulfur atom, and a vinylene group; Z represents any one of an alkylene group that may have a substituent group, an alkylene ether divalent group that may have a substituent group, and an alkylene oxycarbonyl divalent group; and "n" is an integer of 0 to 3.

<9> The electrophotographic photoconductor according to the item <7>, wherein (ii) the radical polymerizable compound having a charge transporting structure containing a triarylamine structure is represented by the following Structural Formula (3), Structural Formula (3)

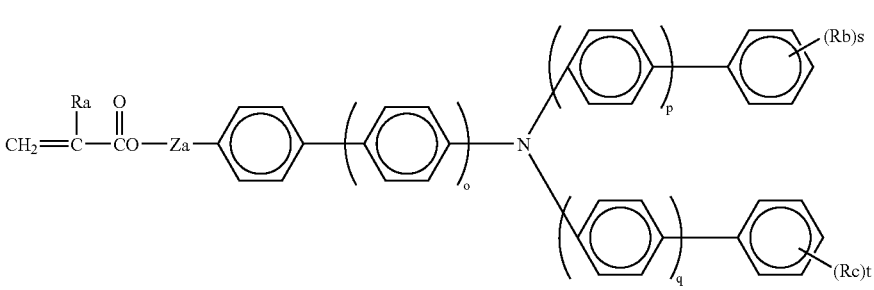

wherein "o", "p", and "q" are respectively an integer of 0 or 1; Ra represents a hydrogen atom or a methyl group; Rb and Rc may be same to each other or different from each other and respectively represent an alkyl group having 1 to 6 carbon atoms; "s" and "t" are respectively an integer of 0 to 3; and Za represents a single bond, a methylene group, an ethylene group, or a divalent group represented by any one of the following structural formulas.

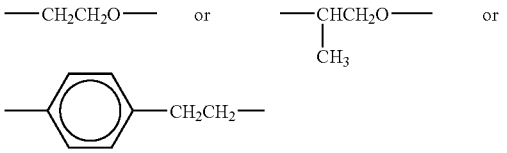

<10> The electrophotographic photoconductor according to any one of the items <1> to <9>, wherein the crosslinked bond in the hardened resin is formed by irradiation of an optical energy.

Since (i) the trifunctional or more radical polymerizable compound having no charge transporting structure and (ii) the radical polymerizable compound having a charge transporting structure respectively have radical polymerizability, the components can be easily crosslinked by irradiation of an optical energy to thereby form the hardened resin. The irradiation of an optical energy can be carried out by using an optical energy irradiation unit configured to apply a light beam having a wavelength region allowing for radical polymerization.

With the use of an electrophotographic photoconductor according to any one of the items <7>, <8>, <9>, and <10>, both abrasion resistance and electric properties can be achieved in well balanced conditions, and the electric properties can be maintained in preferable conditions without causing degradation of photosensitivity and increases in residual electric potential even when the electrophotographic photoconductor is repeatedly used.

<11> The electrophotographic photoconductor according to any one of the items <1> to <10>, wherein the photosensitive layer contains titanylphthalocyanine as a charge generating material.

<12> The electrophotographic photoconductor according to the item <11>, wherein the titanylphthalocyanine has a crystal form having major diffraction peaks specified by Bragg angle 2 θ, in the X-ray diffraction spectrum using Cu—Kα ray, of at least 9.6°±0.2°, 24.0°±0.2°, and 27.2°±0.2°.

By using the titanylphthalocyanine described in the items <11> and <12> as a charge generating material, an electrophotographic photoconductor having high-photosensitivity can be obtained.

5<13> A method for producing an electrophotographic photoconductor to be mounted in an image forming apparatus, which includes forming at least a photosensitive layer and a surface layer in this order on a conductive substrate, wherein the surface layer contains (i) a trifunctional or more radical polymerizable compound having no charge transporting structure, and (ii) a radical polymerizable compound having a charge transporting structure, and at least two coating solutions each having a different concentration of (ii) the radical polymerizable compound having a charge transporting structure are used to coat the photosensitive layer by applying the coating solutions sequentially with varying the type of the coating solutions depending on the used solution-coating method to thereby form the surface layer in which the concentration of (ii) the radical polymerizable compound having a charge transporting structure is varied in the film thickness direction of the surface layer.

<14> The method for producing an electrophotographic photoconductor according to the item <13>, wherein the concentration of (ii) the radical polymerizable compound having a charge transporting structure to be applied so as to be varied in the film thickness direction depending on the solution coating method is more reduced from the surface of the surface layer toward the inside of the surface layer.

With the use of any one of the production methods described above, it is possible to form a surface layer in which a concentration gradient of (ii) the radical polymerizable compound having a charge transporting structure is generated in the film thickness direction such that the concentration thereof is more reduced from the surface of the surface layer toward the inside of the surface layer. An electrophotographic photoconductor produced in the method can, as described above, exert excellent high-durability and electrostatic properties even when repeatedly used.

<15> The method for producing an electrophotographic photoconductor according to any one of the items <13> to <14>, wherein the solution-coating method is a spray-coating method.

<16> The method for producing an electrophotographic photoconductor according to any one of the items <13> to <15>, wherein the surface layer is formed by applying a plurality of surface layer coating solutions in which the concentration of (i) the trifunctional or more radical polymerizable compound having no charge transporting structure and the concentration of (ii) the radical polymerizable compound having a charge transporting structure are respectively varied, over the surface of the photosensitive layer by multiple spray-coating.

With the use of the spray-coating method described as in the items <15> and <16>, it is possible to excellently, easily form a surface layer in which a concentration gradient of (ii) the radical polymerizable compound having a charge transporting structure is generated in the film thickness direction such that the concentration thereof is more reduced from the surface of the surface layer toward the inside of the surface layer.

<17> An image forming apparatus equipped with at least an electrophotographic photoconductor according to any one of the items <1> to <12>.

With the use of the image forming apparatus, images can be formed in stable conditions over a long period of time even in high-speed operation because the image forming apparatus is equipped with an electrophotographic photoconductor which is excellent in abrasion resistance and electrostatic properties.

<18> The image forming apparatus according to the item <17>, wherein the linear velocity of the electrophotographic photoconductor is 300 mm/sec or more.

Since the image forming apparatus is equipped with the electrophotographic photoconductor of the present invention, high-quality images can be formed in stable conditions over a long period of time even in high-speed operation.

<19> A process cartridge having a latent electrostatic image bearing member, a latent electrostatic image forming unit configured to form a latent electrostatic image on the latent electrostatic image bearing member, and at least one selected from a developing unit configured to develop the latent electrostatic image using a toner to form a visible image, a transferring unit configured to transfer the visible image onto a recording medium, and a cleaning unit configured to remove a toner remaining on the latent electrostatic image bearing member so as to be detachably mounted to a main body of an image forming apparatus, wherein the transferring unit is configured to apply a positive electric potential to the visible image formed on the latent electrostatic image bearing member via the recording medium, the latent electrostatic image bearing member has a layer configuration in which at least a photosensitive layer and a surface layer are formed in this order in a laminate structure on a substrate, the surface layer comprises a hardened material which is hardened by irradiating at least (i) a trifunctional or more radical polymerizable monomer having no charge transporting layer and (ii) a radical polymerizable compound having a charge transporting structure through the use of an optical energy irradiation unit, and the concentration of (ii) the radical polymerizable compound having a charge transporting structure is varied in between the surface part and the innerlayer part of the surface layer.

Since the process cartridge is formed into a unit constituted by respective processing units and the electrophotographic photoconductor in a configuration ensuring high-positional precision, quality of images can be enhanced, and the electrophotographic photoconductor and the other processing units can be readily exchanged in a small amount of time.

<20> An image forming apparatus equipped with a process cartridge according to the item <19>.

The use of the process cartridge leads to enhancement of the maintenance property thereof and cost down.

<21> An image forming method which includes forming a latent electrostatic image on a latent electrostatic image bearing member, developing the latent electrostatic image using a toner to form a visual image, transferring the visual image onto a recording medium, and fixing the transferred image on the recording medium, wherein in the transferring, the visual image formed on the latent electrostatic image bearing member is applied with a positive electric potential via the recording medium; the electrostatic image bearing member has a layer configuration in which at least a photosensitive layer and a surface layer are formed in this order in a laminate structure on a substrate, the surface layer comprises a hardened material which is hardened by irradiating at least (i) a trifunctional or more radical polymerizable monomer having no charge transporting layer and (ii) a radical polymerizable compound having a charge transporting structure through the use of an optical energy irradiation unit, and the concentration of (ii) the radical polymerizable compound having a charge transporting structure is varied in between the surface part and the innerlayer part of the surface layer.

The image forming apparatus of the present invention has at least a latent electrostatic image bearing member, a latent electrostatic image forming unit configured to form a latent electrostatic image on the latent electrostatic image bearing member, a developing unit configured to develop the latent electrostatic image using a toner to form a visible image, a transferring unit configured to transfer the visible image onto a recording medium, a fixing unit configured to fix the transferred image on the recording medium, wherein the transferring unit is configured to transfer the visible image onto the recording medium to form a image at high-speed by applying a positive electric potential to the visible image formed on the latent electrostatic image bearing member via the recording medium. Here, since the latent electrostatic image bearing member contains at least a hardened material prepared by using a trifunctional or more radical polymerizable compound having no charge transporting structure, a radical polymerizable compound having a charge transporting structure, and a reactive silicone compound having any one of an acryloyloxy group and a methacryloyloxy group and has a surface layer in which the concentration of the reactive silicone compound is varied in between the surface part and the innerlayer part, the durability of the latent electrostatic image bearing member can be improved, and it is possible to stably form high-resolution images over a long period of time while preventing occurrences of abnormal images that would be caused by repetitive use in high-speed operation.

The image forming method of the present invention includes at least forming a latent electrostatic image on a latent electrostatic image bearing member, developing the latent electrostatic image using a toner to form a visible image, transferring the visible image onto a recording medium, and fixing the transferred image on the recording medium, wherein in the transferring, the visible image formed on the latent electrostatic image bearing member is applied with a positive electric potential via the recording medium. Here, since the latent electrostatic image bearing member contains at least a hardened material prepared by using a trifunctional or more radical polymerizable compound having no charge transporting structure, a radical polymerizable compound having a charge transporting structure, and a reactive silicone compound having any one of an acryloyloxy group and a methacryloyloxy group and has a surface layer in which the concentration of the reactive silicone compound is varied in between the surface part of the surface layer and the innerlayer part of the surface layer, the durability of the latent electrostatic image bearing member can be improved, and high-resolution images can be formed in stable conditions over a long period of time while preventing occurrences of abnormal images that would be caused by repetitive use of the latent electrostatic image bearing member in high-speed operation.

The process cartridge of the present invention has a latent electrostatic image bearing member and a latent electrostatic image forming unit configured to form a latent electrostatic image on the latent electrostatic image bearing member, and further has at least one selected from a developing unit configured to develop the latent electrostatic image using a toner to form a visible image, a transferring unit configured to transfer the visible image onto a recording medium, and a cleaning unit configured to remove a toner remaining on the latent electrostatic image bearing member so as to be detachably mounted on a main body of an image forming apparatus, wherein the transferring unit is configured to transfer the visible image onto the recording medium to form an image at high-speed by applying a positive electric potential to the visible image formed on the latent electrostatic image bearing member via the recording medium. Here, since the latent electrostatic image bearing member contains a hardened material prepared by using a trifunctional or more radical polymerizable compound having no charge transporting structure, a radical polymerizable compound having a charge transporting structure, and a reactive silicone compound having any one of an acryloyloxy group and a methacryloyloxy group and has a surface layer in which the concentration of the reactive silicone compound is varied in between the surface part of the surface layer and the innerlayer part of the surface layer, the durability of the latent electrostatic image bearing member can be improved, high-resolution images can be formed in stable conditions over a long period of time while preventing occurrences of abnormal images that would be caused by repetitive use in high-speed operation, and a slight amount of abrasion of the latent electrostatic image bearing member can be prevented even when the latent electrostatic image bearing member is cleaned by blade cleaning, and excellent surface cleaning property is ensured for the latent electrostatic image bearing member.

According to the present invention, it is possible to provide an image forming apparatus, an image forming method, and a process cartridge each of which allows for stably forming high-resolution images over a long period of time while preventing occurrences of abnormal images that would be caused by repetitive use thereof in high-speed operation by using a latent electrostatic image bearing member which is provided with a surface layer and a photosensitive layer each having high-abrasion resistance, high-durability, and excellent electric properties.

DETAILED DESCRIPTION OF THE INVENTION (Image Forming Apparatus and Image Forming Method)

The image forming apparatus of the present invention has at least a latent electrostatic image bearing member, a latent electrostatic image forming unit, a developing unit, a transferring unit, and a fixing unit and further has other units suitably selected in accordance with the necessity such as a charge eliminating unit, a cleaning unit, a recycling unit, and a controlling unit.

The image forming method of the present invention includes at least latent electrostatic image forming, developing, transferring, and fixing and further includes other steps suitably selected in accordance with the necessity, for example, charge eliminating, cleaning, recycling, and controlling.

The image forming method of the present invention can be favorably carried out by means of the image forming apparatus of the present invention, the latent electrostatic image forming can be carried out by means of the latent electrostatic image forming unit, the developing can be carried out by means of the developing unit, the transferring can be carried out by means of the transferring unit, the fixing can be carried out by means of the fixing unit, and the other steps can be carried out by means of the other units.

<Latent Electrostatic Image Bearing Member>

The latent electrostatic image bearing member has a substrate, and at least a photosensitive layer and a surface layer formed in this order on the substrate and further has other layers in accordance with the necessity.

A first aspect of the latent electrostatic image bearing member has a substrate, and at least a single-layered photosensitive layer formed on the substrate and a surface layer formed on the single-layered photosensitive layer, and further has other layers in accordance with the necessity.

A second aspect of the latent electrostatic image bearing member has a substrate, a photosensitive layer formed in a laminate structure which has at least a charge generating layer and a charge transporting layer formed in this order on the substrate, and a surface layer formed on the photosensitive layer formed in a laminate structure, and further has other layers in accordance with the necessity. In the second aspect of the latent electrostatic image bearing member, the charge generating layer and the charge transporting layer may be formed in the reverse order in a laminate structure.

Hereinafter, the layer configuration of the latent electrostatic image bearing member will be described with reference to the drawings.

Figure 1:
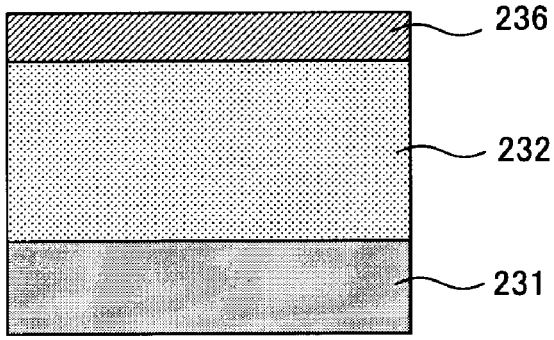
FIG. 1 is a schematic cross-sectional view showing one example of a latent electrostatic image bearing member to be set in an image forming apparatus of the present invention.

FIG. 1 is a schematic cross-sectional view showing one example of a latent electrostatic image bearing member according to the first aspect of the present invention in the image forming apparatus of the present invention. In the first aspect of the latent electrostatic image bearing member, a single-layered photosensitive layer 232 having a charge generating function as well as a charge transporting function is formed on a substrate 231, and a surface layer 236 is formed on the single-layered photosensitive layer 232.

Figure 2:
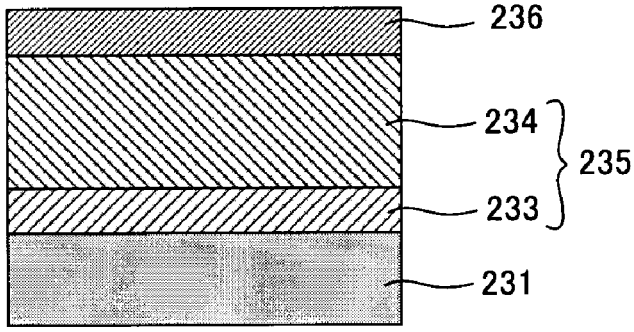
FIG. 2 is a schematic cross-sectional view showing another example of a latent electrostatic image bearing member to be set in an image forming apparatus of the present invention.

FIG. 2 is a schematic cross-sectional view showing one example of a latent electrostatic image bearing member according to the second aspect of the present invention in the image forming apparatus of the present invention. In the second aspect of the latent electrostatic image bearing member, a multi-layered photosensitive layer 235 in which a charge generating layer 233 having a charge generating function and a charge transporting layer 234 having a charge transporting function are formed in a laminate structure is formed on a substrate 231, and a surface layer 236 is formed on the multi-layered photosensitive layer 235.

[Surface Layer]

The surface layer contains a hardened material containing at least a trifunctional or more radical polymerizable compound having no charge transporting structure, a radical polymerizable compound having a charge transporting structure, and a reactive silicone compound having any one of an acryloyloxy group and a methacryloyloxy group and further contains other components in accordance with the necessity, and the concentration of the reactive silicone compound in the surface layer is varied in between the surface part of the surface layer and the inner layer part thereof.

For the surface part and the inner layer part of the surface layer, it is preferable that the thickness ratio of surface part/inner layer part satisfies 9/1 to 1/9 in the thickness direction of the surface layer.

The innerlayer part may be formed in multiple layers. In this case, it is preferable that a layer in the surface part and another layer in the innerlayer part are formed to have a substantially same thickness.

—Trifunctional or More Radical Polymerizable Compound Having No Charge Transporting Structure—

The trifunctional or more radical polymerizable compound having no charge transporting structure means a monomer which has three or more radical polymerizable functional groups, however, does not have an electron hole transporting structure such as triarylamine, hydrazone, pyrazoline, and carbazole, for example, the monomer does not have an electron transporting structure such as a condensed polycyclic quinone, a diphenoquinone, and an electron attracting aromatic ring having a cyano group or a nitro group. Such a radical polymerizable functional group is not particularly limited as long as it is a group having a carbon-carbon double bond and is radically polymerizable.

Examples of the radical polymerizable functional group include (1) 1-substituted ethylene functional group and (2) 1,1-substituted ethylene functional group described below.

Examples of (1) 1-substituted ethylene functional group include functional groups represented by the following <Formula 1>.

$$CH_2{=}CH{-}X_1{-} \qquad \text{<Formula 1>}$$

In the <Formula 1>, $X_1$ represents an allylene group that may have a substituent group such as a phenylene group and a naphthylene group; an alkenylene group that may be a substituent group, —CO— group, —COO— group, —CON($R_{10}$)— group ($R_{10}$ represents a hydrogen atom; an alkyl group such as a methyl group and an ethyl group; an aralkyl group such as a benzyl group, a naphthylmethyl group, and a phenethyl group; or an aryl group such as a phenyl group and a naphthyl group); or S-group.

Examples of substituent groups thereof include vinyl group, styryl group, 2-methyl-1,3-butadienyl group, vinylcarbonyl group, acryloyloxy group, acryloylamino group, and vinylthioether group.

Examples of (2) 1,1-substituted ethylene functional group include functional groups represented by the following <Formula 2>.

$$CH_2{=}C(Y){-}X_2{-}$$

In the <Formula 2>, Y represents an alkyl group that may have a substituent group, an aralkyl group that may have a substituent group, an aryl group that may have a substituent group such as a phenyl group and a naphthyl group; a halogen atom, an alkoxy group such as a cyano group, a nitro group, a methoxy group, and an ethoxy group, or —$COOR_{11}$ group ($R_{11}$ represents a hydrogen atom, an alkyl group that may have a substituent group such as methyl group and an ethyl group; an aralkyl group that may have a substituent group such as a benzyl group and a phenethyl group; an aryl group that may have a substituent group such as a phenyl group and a naphthyl group; or $CONR_{12}R_{13}$ ($R_{12}$ and $R_{13}$ may be same to each other or different from each other and respectively represent a hydrogen atom, an alkyl group that may have a substituent group such as a methyl group and an ethyl group, a benzyl group that may have a substituent group, an aralkyl group that may have a substituent group such as a naphthylmethyl group and a phenethyl group, or an aryl group that may have a substituent group such as a phenyl group, and a naphthyl group).

Further, $X_2$ represents a same substituent group as described for $X_1$ in the <Formula 1>, a single bond, or an alkylene group.

At least any one of Y and $X_2$ represents an oxycarbonyl group, a cyano group, an alkenylene group, or an aromatic ring.

Examples of substituent groups thereof include α-acryloyloxy chloride group, methacryloyloxy group, α-cyanoethylene group, α-cyanoacryloyloxy group, α-cyanophenylene group, and methacryloylamino group.

Examples of substituent groups further substituted by the substituent group for the $X_1$, $X_2$, or Y include a halogen atom, nitro group, cyano group; alkyl group such as methyl group and ethyl group; alkoxy group such as methoxy group and ethoxy group; aryloxy group such as phenoxy group; aryl group such as phenyl group and naphthyl group; and aralkyl group such as benzyl group and phenethyl group.

Among these radical polymerizable functional groups, acryloyloxy group and methacryloyloxy group are particularly preferable.

The compound having three or more acryloyloxy groups can be obtained, for example, by using a compound having three or more hydroxyl groups in a molecule thereof, an acrylic acid (acrylate), an acrylic halide, and an acrylic acid ester and subjecting them to an ester reaction or an ester exchange reaction. A compound having three or more methacryloyloxy groups can also be obtained in the same manner. The radical polymerizable functional groups in the monomer having three or more radical polymerizable functional groups may be same to each other or different from each other.

The trifunctional or more radical polymerizable compound having no charge transporting structure is not particularly limited and may be suitably selected in accordance with the intended use. Examples thereof include trimethylolpropane triacrylate (TMPTA), trimethylolpropane trimethacrylate, trimethylolpropane alkylene-modified triacrylate, trimethylolpropane ethyleneoxy-modified (hereinafter, may be referred to as "EO-modified") triacrylate, trimethylolpropane propyleneoxy-modified (hereinafter, may be referred to as "PO-modified") triacrylate, trimethylolpropane caprolactone-modified triacrylate, trimethylolpropane alkylene-modified trimethacrylate, pentaerythritol acrylate, pentaerythritol tetraacrylate (PETTA), glycerol triacrylate, glycerol epichlorohydrine-modified (hereinafter, may be referred to as "ECH-modified") triacrylate, glycerol EO-modified triacrylate, glycerol PO-modified triacrylate, tris(acryloxyethyl)isocyanurate, dipentaerythritol hexaacrylate (DPHA), dipentaerythritol caprolactone-modified hexaacrylate, dipentaerythritol hydroxypentaacrylate, alkylated dipentaerythritol pentaacrylate, alkylated dipentaerythritol tetraacrylate, alkylated dipentaerythritol triacrylate, dimethylolpropane tetraacrylate (DTMPTA), pentaerythritol ethoxytetraacrylate, phosphoric acid EO-modified triacrylate, 2,2,5,5-tetrahydroxymethyl cyclopentanone tetraacrylate. Each of these trifunctional or more radical polymerizable compounds having no charge transporting structure may be used alone or in combination with two or more.

Since the trifunctional or more radical polymerizable compound having no charge transporting structure can form a densely crosslinked bond in the surface layer, the proportion of the functional groups (molecular mass/the number of functional group) is preferably 250 or less. When the proportion of the functional group is more than 250, the surface layer is soft, and the abrasion resistance is degraded to some degree, and therefore, among the exemplified monomers, for a monomer having a modified group such as EO, PO, and caprolactone, it is unfavorable to use a monomer having an extremely long modified group alone.

The content of the trifunctional or more radical polymerizable compound having no charge transporting structure is preferably 20% by mass to 80% by mass and more preferably 30% by mass to 70% by mass relative to the total content of the surface layer. When the content of the trifunctional or more radical polymerizable compound having no charge transporting structure is less than 20% by mass, the three-dimensionally crosslink density of the surface layer is low, and a remarkable improvement in the abrasion resistance may not be achieved as compared to the case where a conventional thermoplastic binder resin is used. When the content of the trifunctional or more radical polymerizable compound having no charge transporting structure is more than 80% by mass, the content of the radical polymerizable compound having a charge transporting structure is reduced, which may result in degradation of electric properties of the photoconductor.

—Radical Polymerizable Compound Having a Charge Transporting Structure—

The radical polymerizable compound having a charge transporting structure is not particularly limited, may be suitably selected in accordance with the intended use, and it is also possible to use a radical polymerizable compound having a polyfunctional group, for example, a bifunctional radial polymerizable compound having a charge transporting structure, and a trifunctional or more radical polymerizable compound having a charge transporting structure, however, a monofunctional radical polymerizable compound having a charge transporting structure is particularly preferable from the perspective of film quality and electrostatic properties.

When a bifunctional or more radical polymerizable compound having a charge transporting structure is used, the charge transporting structure is fixed in a crosslinked structure via a plurality of bonds, however, because of the highly bulky charge transporting structure, distortion is formed in the hardened resin, and the internal stress of the surface layer is increased to easily cause exfoliation and abrasion of the photoconductor surface. From the perspective of electrostatic properties, when the bifunctional or more radical polymerizable compound having a charge transporting structure is used, the charge transporting structure is fixed in a crosslinked structure via a plurality of bonds, and therefore, an intermediate structure (cation radical) cannot be stably retained during transportation of a charge, the photosensitivity tends to be degraded due to a trapped charge, the residual potential is easily increased, which may cause degradation of electric properties. Consequently, the degradation of the electrostatic properties may cause image defects such as degradation of image density, and thinned characters such as numerals.

In the meanwhile, when the monofunctional radical polymerizable compound having a charge transporting structure is used, it is possible to prevent occurrences of cracks, scratches and the like and stabilize the electrostatic properties by fixing the charge transporting structure in between crosslinked bonds like a pendant.

The monofunctional radical polymerizable compound having a charge transporting structure means a compound having, for example, an electron hole transporting structure such as triarylamine, hydrozone, pyrazoline, and carbazole, and having, for example, an electron transporting structure such as a condensed polycyclic quinone, a diphenoquinone, and an electron attracting aromatic ring having a cyano group or a nitro group, and having one radical polymerizable functional group. Examples of the radical polymerizable functional group include functional groups each represented by any one of the Formulas 1 and 2.

Further, specific examples of the radical polymerizable compound include those specified as the radical polymerizable compounds exemplified above. Particularly, acryloyloxy group, and methacryloyloxy group are useful. For the charge transporting structure, a triarylamine structure is highly effectively used. Of these, when a compound having a structure represented by the following Structural Formula (1) or Structural Formula (2) is used, the electric properties such as photosensitivity and residual potential can be well retained.

Structural Formula (1)

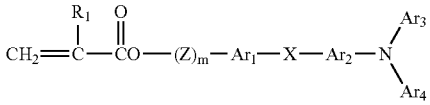

Structural Formula (2)

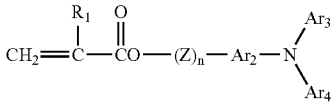

In the Structural Formulas (1) and (2), $R_1$ represents any one of a hydrogen atom, a halogen atom, an alkyl group that may have a substituent group, an aralkyl group that may have a substituent group, an aryl group that may have a substituent group, a cyano group, a nitro group, an alkoxy group, —$COOR_7$ ($R_7$ is a hydrogen atom, an alkyl group that may have a substituent group, an aralkyl group that may have a substituent group, or an aryl group that may have a substituent group), a halogenated carbonyl group, and —$CONR_8R_9$ ($R_8$ and $R_5$ may be same to each other or different from each other and respectively represent a hydrogen atom, a halogen atom, an alkyl group that may have a substituent group, an aralkyl group that may have a substituent group, or an aryl group that may have a substituent group). $Ar_1$ and $Ar_2$ may be same to each other or different from each other and respectively represent an allylene group that may have a substituent group. $Ar_3$ and $Ar_4$ may be same to each other or different from each other and respectively represent an aryl group that may have a substituent group. X represents any one of a single bond, an alkylene group that may have a substituent group, a cycloalkylene group that may have a substituent group, an alkylene ether group that may have a substituent group, an oxygen atom, a sulfur atom, and a vinylene group. Z represents any one of an alkylene group that may have a substituent group, an alkylene ether divalent group that may have a substituent group, and an alkylene oxycarbonyl divalent group, and "m" and "n" are respectively an integer of 0 to 3.

In the Structural Formulas (1) and (2), examples of the alkyl group in substituent groups of $R_1$ include methyl group, ethyl group, propyl group, and butyl group. Examples of the aryl group include phenyl group and naphthyl group. Examples of the aralkyl group include benzyl group, phenethyl group, and naphthylmethyl group. Examples of the alkoxy group include methoxy group, ethoxy group, and propoxy group. These groups may be substituted by a halogen atom, a nitro group, a cyano group; an alkyl group such as methyl group and ethyl group; an alkoxy group such as methoxy group and ethoxy group; an aryloxy group such as phenoxy group; an aryl group such as phenyl group, and naphthyl group; or an aralkyl group such as benzyl group and phenethyl group.

Among the substituent groups of $R_1$, hydrogen atom or methyl group is particularly preferable.

$Ar_3$ and $Ar_4$ are respectively an aryl group that may have a substituent group, and examples of the aryl group include condensed polycyclic hydrocarbon groups, uncondensed cyclic hydrocarbon groups, and heterocyclic groups.

For the condensed polycyclic hydrocarbon group, a group capable of fuming a ring and having 18 or less carbon atoms is preferable, and preferred examples thereof include pentanyl group, indenyl group, naphthyl group, azurenyl group, heptalenyl group, biphenylenyl group, as-indacenyl group, s-indacenyl group, fluorenyl group, acenaphthylenyl group, pleiadenyl group, acenaphthenyl group, phenalenyl group, phenantolyl group, antholyl group, fluoranthenyl group, acephenantolylenyl group, aceantolylenyl group, triphenyl group, pyrenyl group, crysenyl group, and naphthacenyl group.

Examples of the uncondensed cyclic hydrocarbon group include monovalent monocyclic hydrocarbon compound such as benzene, diphenyl ether, polyethylene diphenyl ether, diphenyl thioether, and diphenylsulfone; or monovalent group of uncondensed polycyclic hydrocarbon compound such as biphenyl, polyphenyl, diphenylalkane, diphenylalkyne, triphenylmethane, distyrylbenzene, 1,1-dipehnylcycloalkane, polyphenylalkane, and polyphenylalkane; or monovalent group of cycle-aggregation hydrocarbon compound such as 9,9-diphenylfluorene.

Examples of the heterocyclic group include carbazole, dibenzofuran, dibenzothiophene, oxadiazole, and thiadiazole.

In the Structural Formulas (1) and (2), an aryl group represented by $Ar_3$ or $Ar_4$ may have a substituent group as shown below.

(1) a halogen atom, a cyano group, and a nitro group are exemplified.

(2) a straight chain or a branched chain alkyl group having 1 to 12 carbon atoms, preferably having 1 to 8 carbon atoms, and more preferably having 1 to 4 carbon atoms, and these alkyl groups may further have a fluorine atom, a hydroxyl group, a cyano group, an alkoxy group having 1 to 4 carbon atoms, a phenyl group or a halogen atom, or a phenyl group substituted by an alkyl group having 1 to 4 carbon atoms or an alkoxy group having 1 to 4 carbon atoms. Specific examples thereof include methyl group, ethyl group, n-butyl group, i-propyl group, t-butyl group, s-butyl group, n-propyl group, trifluoromethyl group, 2-hydroxyethyl group, 2-ethoxyethyl group, 2-cyanoethyl group, 2-methoxyethyl group, benzyl group, 4-chlorobenzyl group, 4-methylbenzyl group, and 4-phenylbenxyl group.

(3) an alkoxy group (—$OR_2$). $R_2$ represents an alkyl group defined in the (2) described above. Specific examples thereof include methoxy group, ethoxy group, n-propoxy group, i-propoxy group, t-butoxy group, n-butoxy group, s-butoxy group, i-butoxy group, 2-hydroxyethoxy group, benzyloxy group, and trifluoromethoxy group.

(4) an aryloxy group. Examples of the aryloxy group include phenyl group and naphthyl group. Each of these aryloxy groups may contain an alkoxy group having 1 to 4 carbon atoms, an alkyl group having 1 to 4 carbon atoms, or a halogen atom as a substituent group. Specific examples thereof include phenoxy group, 1-naphthyloxy group, 2-naphthyloxy group, 4-methoxyphenoxy group, and 4-methylphenoxy group.

(5) an alkylmercapto group or an arylmercapto group. Specific examples thereof include methylthio group, ethylthio group, phenylthio group, and p-methylphenylthio group.

(6) a group represented by the following structural formula.

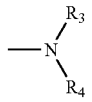

In the above structural formula, $R_3$ and $R_4$ respectively represent a hydrogen atom, or an alkyl group defined in the (2) described above, or an aryl group. Examples of the aryl group include phenyl group, biphenyl group, or a naphthyl group. Each of these aryl groups may contain an alkoxy group having 1 to 4 carbon atoms, an alkyl group having 1 to 4 carbon atoms, or a halogen atom as a substituent group. $R_3$ and $R_4$ may be bound together to form a ring.

Specific examples thereof include amino group, diethylamino group, N-methyl-N-phenylamino group, N,N-diphenylamino group, N,N-di(tolyl)amino group, dibenzylamino group, pyperidino group, morpholino group, and pyrrolidino group.

(7) a methylenedioxy group, an alkylenedioxy group such as methylenedithio group, and an alkylenedithio group are exemplified.

(8) a styryl group that may have a substituent group, a β-pheylstylyl group that may have a substituent group, a diphenylaminophenyl group, and ditolylaminophenyl group are exemplified.

Examples of the allylene group represented by the above-noted $Ar_1$ or $Ar_2$ include divalent groups derived from an aryl group represented by the $Ar_3$ or $Ar_4$.

In the Structural Formulas (1) and (2), X represents a single bond, an alkylene group that may have a substituent group, a cycloalkylene group that may have a substituent group, an alkylene ether group that may have a substituent group, an oxygen atom, a sulfur atom, or a vinylene group.

Examples of the alkylene group that may have a substituent group include a straight chain or a branched chain alkylene group having 1 to 12 carbon atoms, preferably having 1 to 8 carbon atoms, and more preferably having 1 to 4 carbon atoms. Each of these alkylene groups may further have a fluorine atom, a hydroxyl group, a cyano group, an alkoxy group having 1 to 4 carbon atoms, a phenyl group having 1 to 4 carbon atoms, or a phenyl group substituted by a halogen atom, an alkyl group having 1 to 4 carbon atoms or an alkoxy group having 1 to 4 carbon atoms. Specific examples thereof include methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzilidene group, phenylethylene group, 4-chlorophenylethylene group, 4-methylphenylethylene group, and 4-biphenylethylene group.

The cycloalkylene group that may have a substituent group is a cyclic alkylene group having 5 to 7 carbon atoms. Each of these cyclic alkylene groups may have a fluorine atom, a hydroxyl group, an alkyl group having 1 to 4 carbon atoms, or an alkoxy group having 1 to 4 carbon atoms. Specific examples thereof include cyclohexylidene group, cyclohexylene group, and 3,3-dimethylcyclohexylidene group.

The alkylene ether group that may have a substituent group represents, for example, an ethyleneoxy, a propyleneoxy, an ethylene glycol, a propylene glycol, a diethylene glycol, a tetraethylene glycol, or a tripropylene glycol. Each of these alkylene ether groups and alkylene groups may have a substituent group such as a hydroxyl group, a methyl group, an ethyl group.

For the vinylene group, groups represented by any one of the following structural formulas are exemplified.

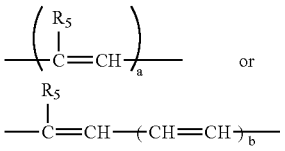

In the above structural formulas, $R_5$ represents a hydrogen atom, an alkyl group (the same as the alkyl group defined in the (2) described above) or an aryl group (the same as the alkyl group represented by the $Ar_3$ and $Ar_4$); "a" is 1 or 2; and "b" is an integer of 1 to 3.

In the Structural Formulas (1) and (2), Z represents an is alkylene group that may have a substituent group, an alkylene ether divalent group that may have a substituent group, or an alkyleneoxycarbonyl divalent group.

Examples of the alkylene group that may have a substituent group include the same ones as the alkylene groups described for the X.

Examples of the alkyleneoxycarbonyl divalent group include caprolactone-modified divalent group.

Preferred examples of the monofunctional radical polymerizable compound having a charge transporting structure include compounds represented by the following Structural Formula (3).

Structural Formula (3)

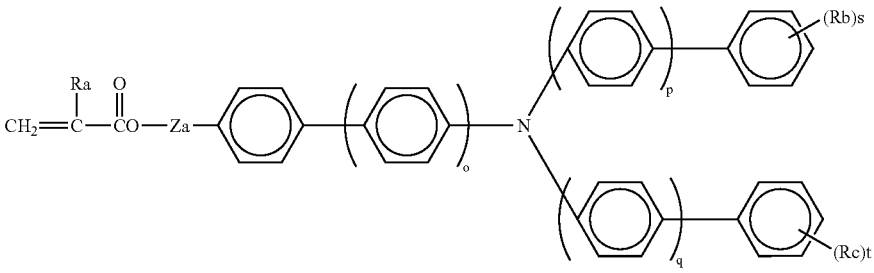

In the Structural Formula (3), "o", "p", and "q" are respectively an integer of 0 or 1; Ra represents a hydrogen atom or a methyl group; Rb and Rc respectively represent a substituent group other than hydrogen atom and an alkyl group having 1 to 6 carbon atoms, and when there are a plurality of Rb and Rc, Rb and Rc may be different from each other; "s" and "t" are respectively an integer of 0 to 3; and Za represents a single bond, a methylene group, an ethylene group, or a substituent group represented by any one of the following structural formulas.

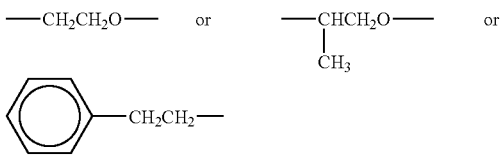

In the Structural Formula (3), a compound of which Rb and Rc are respectively a methyl group or an ethyl group is particularly preferable.

A monofunctional radial polymerizable compound having a charge transporting structure represented by the Structural Formula (1), Structural Formula (2), or Structural Formula (3) is polymerized in the state where a carbon-carbon double bond opens up to both sides thereof, and therefore, the radical polymerizable compound does not take a terminal structure, however, the charge transporting structure is incorporated into a chain-polymer, and in case of a polymer formed by crosslinking polymerization between a monofunctional radical polymerizable compound having a charge transporting structure and a trifunctional or more radical polymerizable compound, the charge transporting structure resides in main chains of the polymer and in crosslinked chains between the main chains (for the crosslinked chains, there are intermolecular crosslinked chains in which one macromolecule is crosslinked with other macromolecules, and intramolecular crosslinked chains in which a certain site of a main chain folded in one macromolecule is crosslinked with another site derived from a monomer, which is polymerized at a position away from the one site in the main chain), however, even though the charge transporting structure resides in main chains and even though the charge transporting structure resides in crosslinked chains, a triarylamine structure hanging from the chain part has at least three aryl groups disposed in the radial direction from a nitrogen atom. These three aryl groups are bulky, however, are not directly bound to the chain part. Since theses three aryl groups are hanging from the chain part via a carbonyl group or the like and are fixed in a state where the positioning thereof is sterically flexible, these three aryl groups and the triarylamine structure can be spatially disposed such that these three aryl groups and the triarylamine structure moderately contact each other in the polymer. Therefore, the monofunctional radical polymerizable compound having a charge transporting structure has less structural distortions in molecules thereof. It is assumed that the monofunctional radical polymerizable compound having a charge transporting structure can take an intramolecular structure in which disconnection of charge transporting paths is relatively escaped when the monofunctional radical polymerizable compound is used for a surface layer of a latent electrostatic image bearing member (electrophotographic photoconductor).

Specific examples of the monofunctional radical polymerizable compound having a charge transporting structure are described below, however, the monofunctional radical polymerizable compound is not limited to compounds each having any one of the following structures.

No. 1

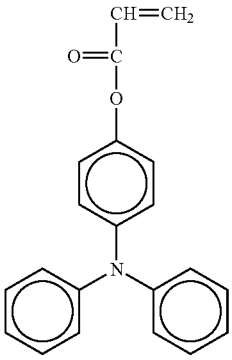

No. 2

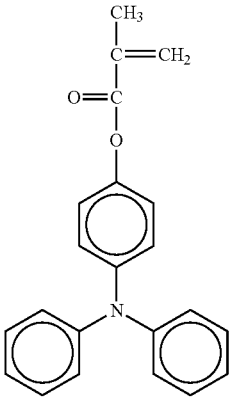

-continued

No. 3

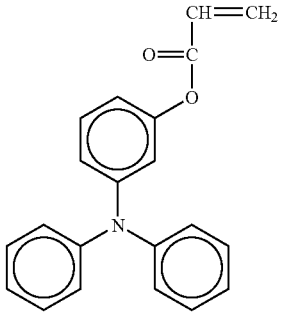

No. 4

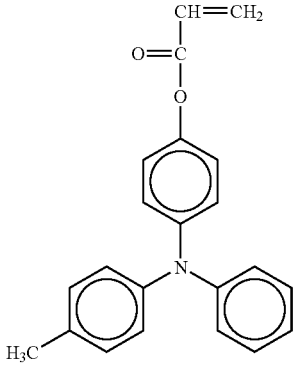

No. 5

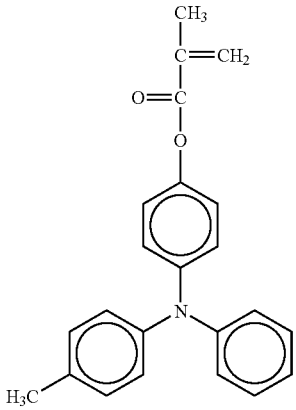

No. 6

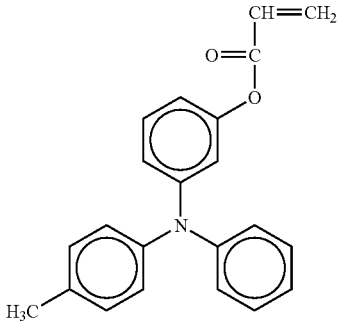

-continued
No. 7
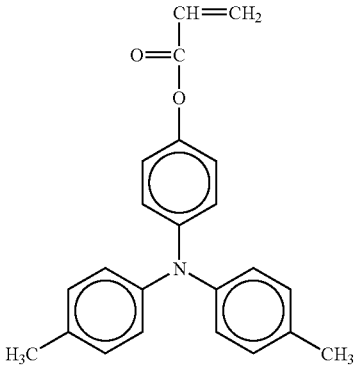
No. 8
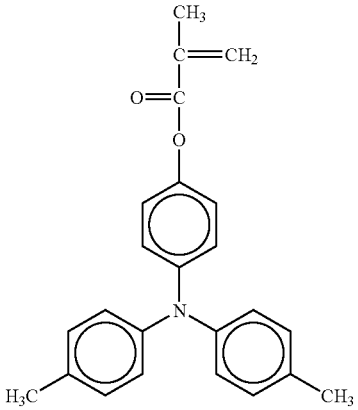
No. 9
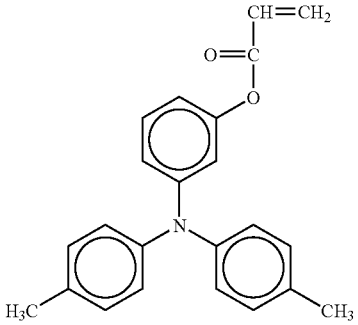
No. 10
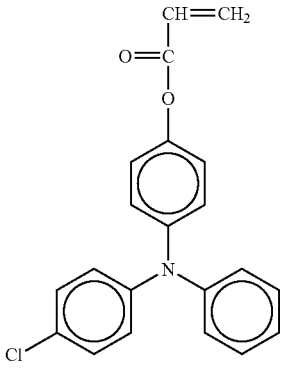
-continued
No. 11
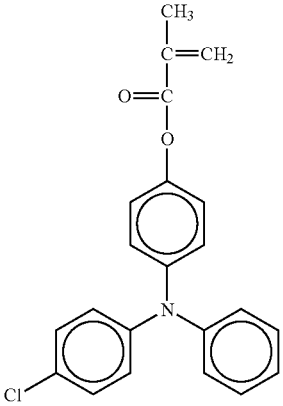
No. 12
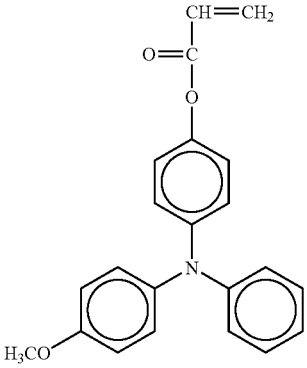
No. 13
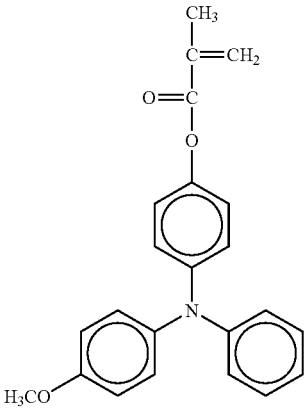
No. 14
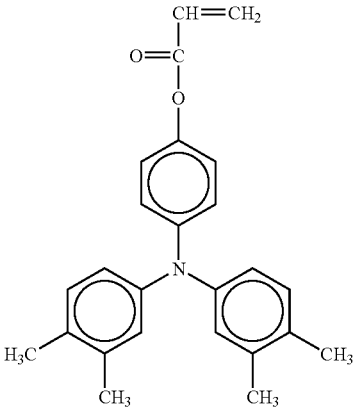

-continued
No. 15
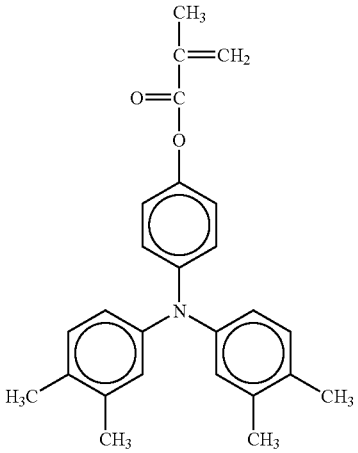
No. 16
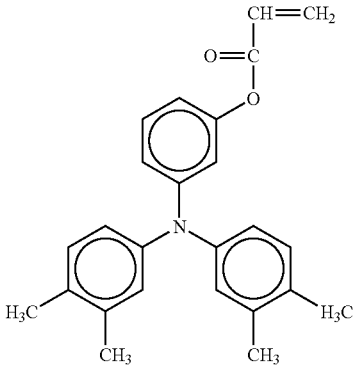
No. 17
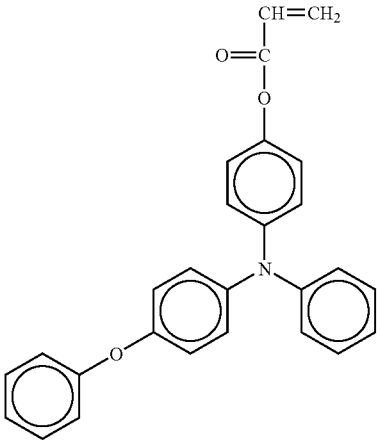
-continued
No. 18
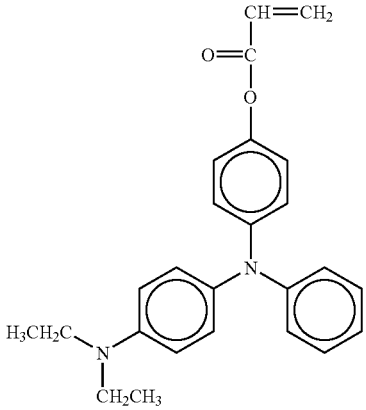
No. 19
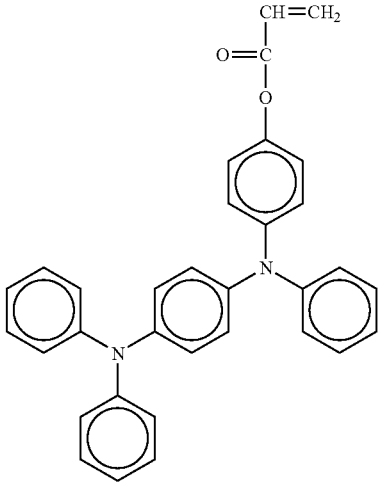
No. 20
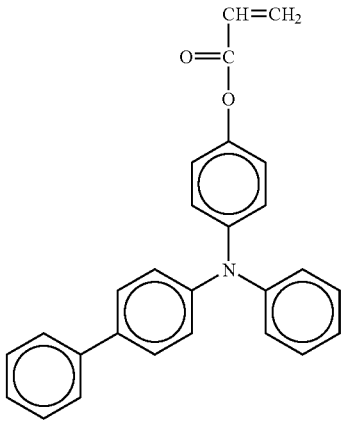

No. 21
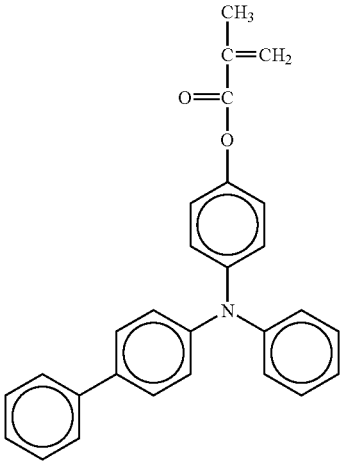
No. 22
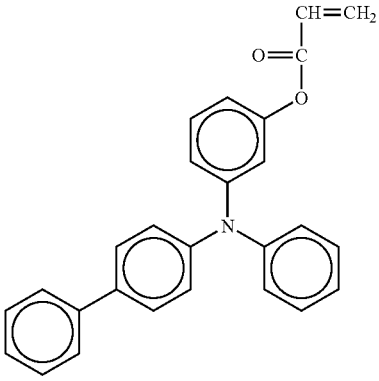
No. 23
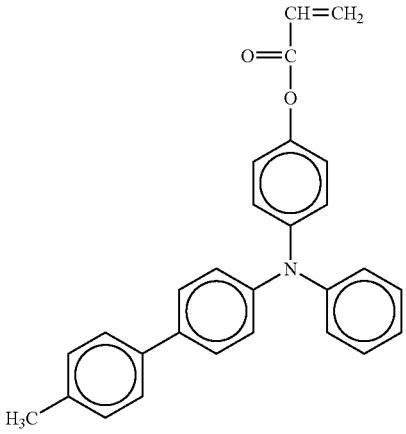
No. 24
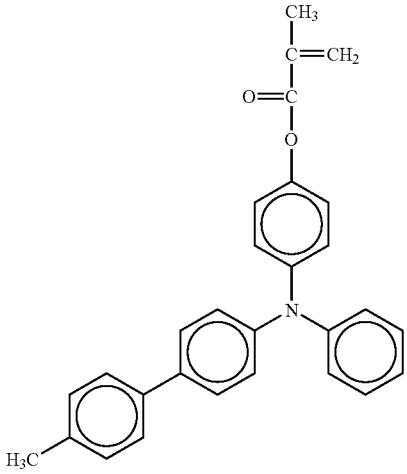
No. 25
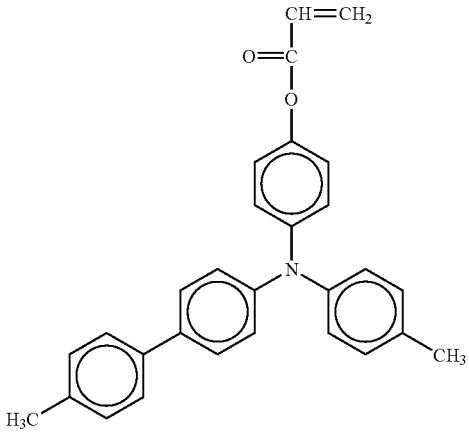
No. 26
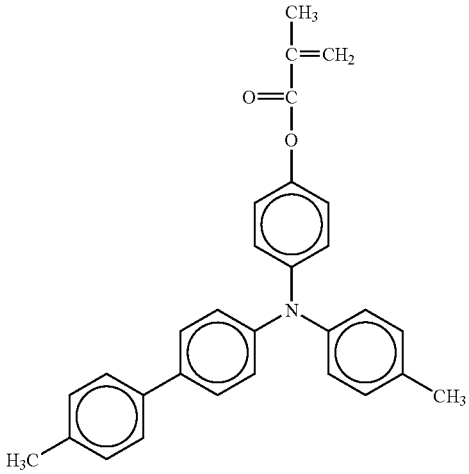

-continued
No. 27
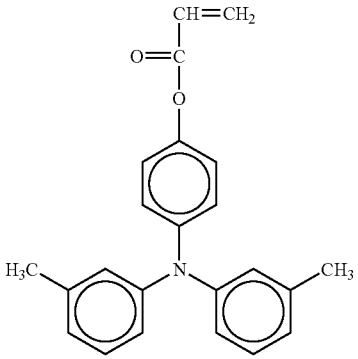
No. 28
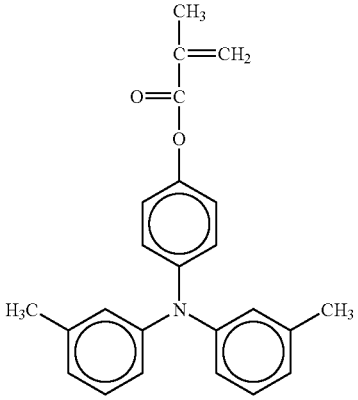
No. 29
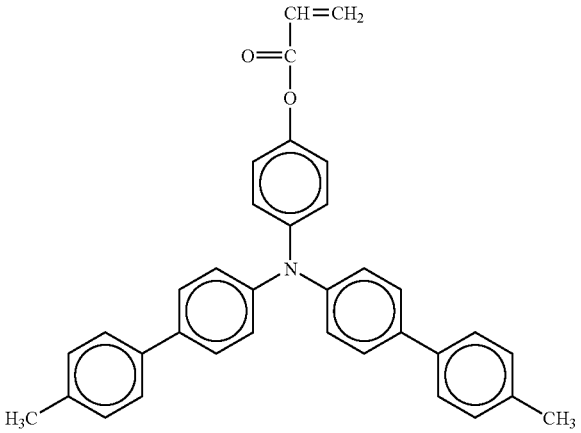
No. 30
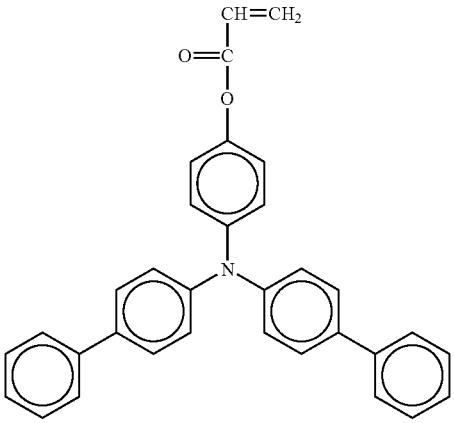
-continued
No. 31
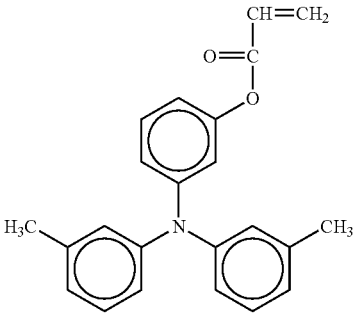
No. 32
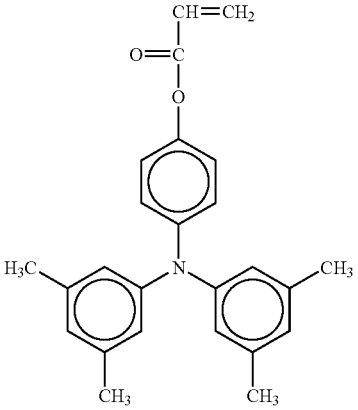
No. 33
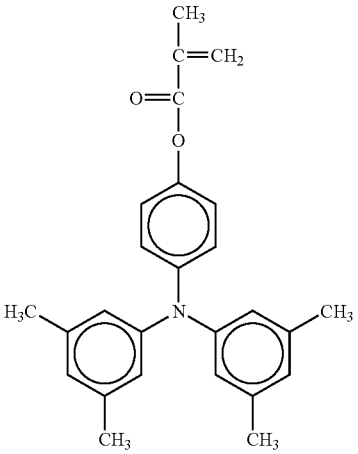
No. 34
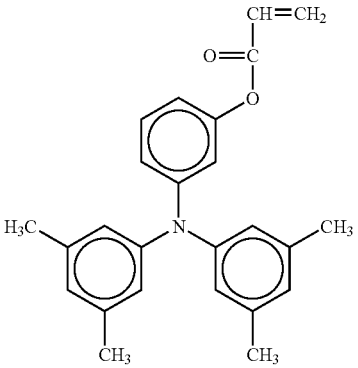

-continued
No. 35
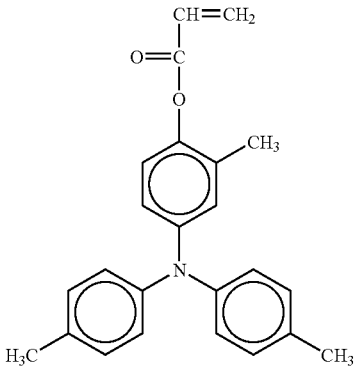
No. 36
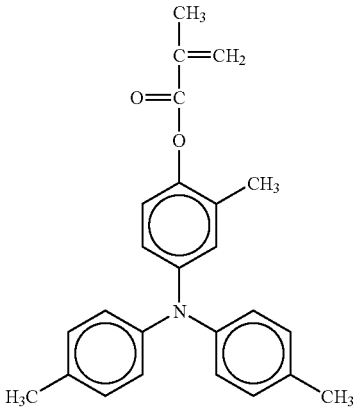
No. 37
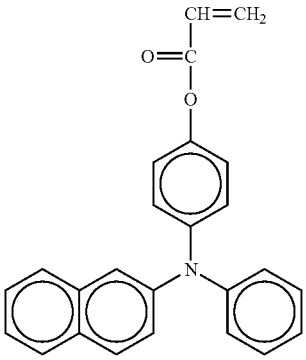
No. 38
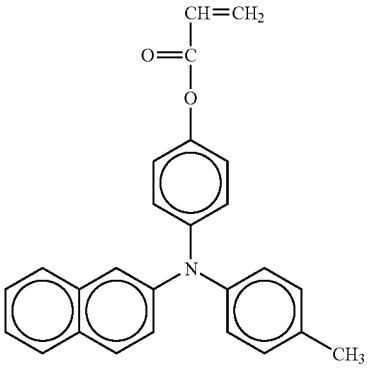
-continued
No. 39
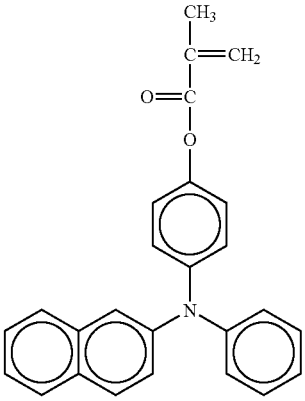
No. 40
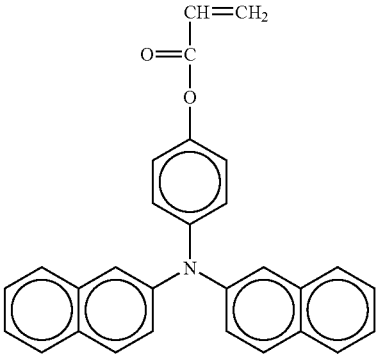
No. 41
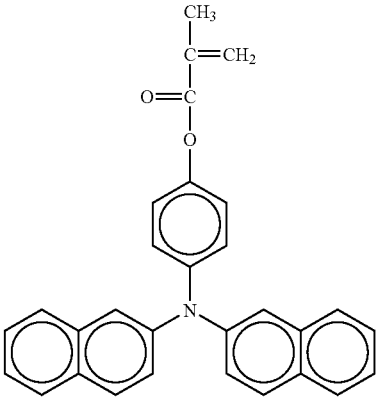
No. 42
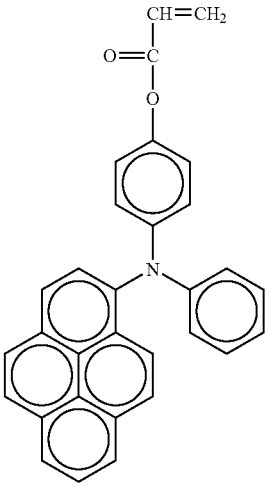

No. 43
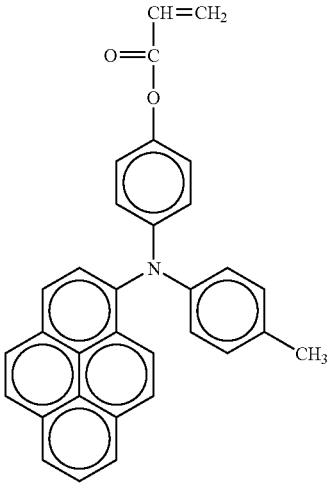
No. 44
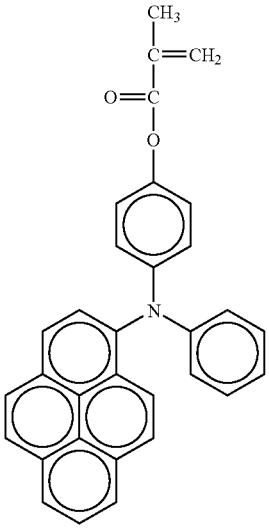
No. 45
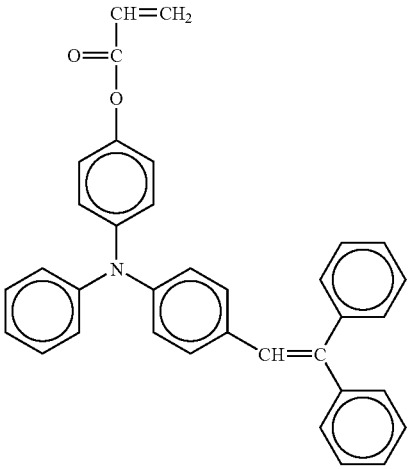
No. 46
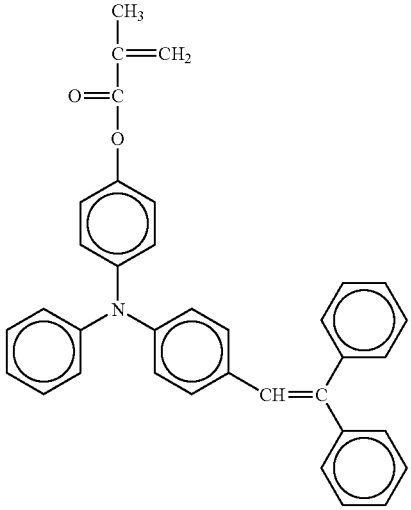
No. 47
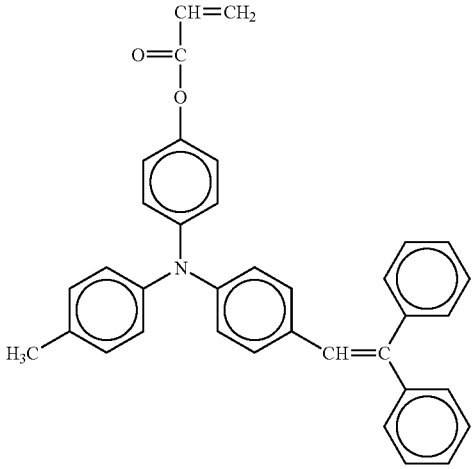
No. 48
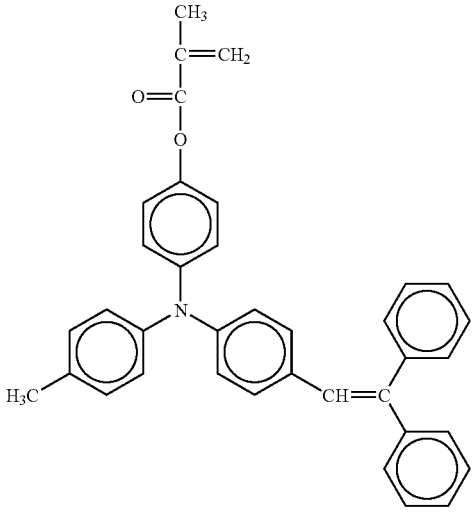

-continued
No. 49
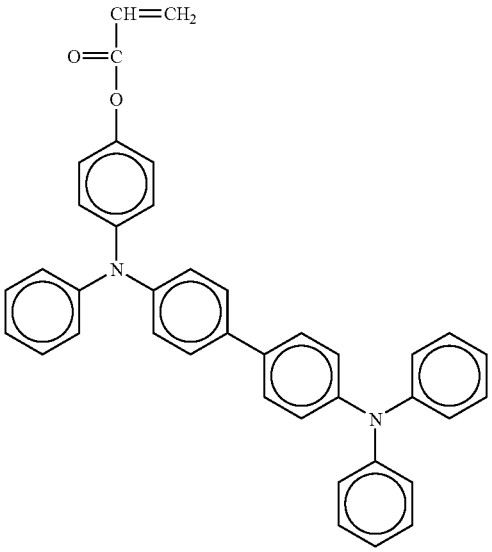
No. 50
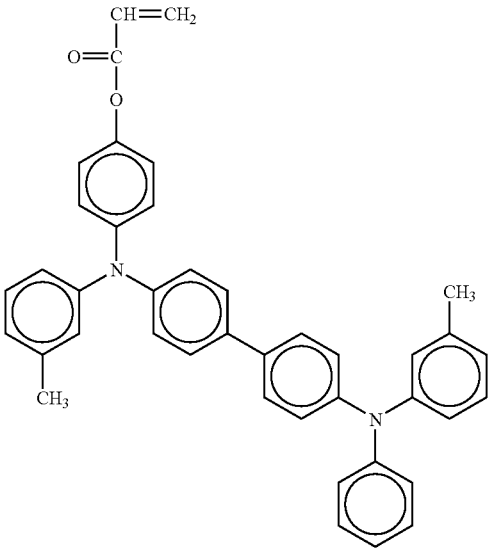
No. 51
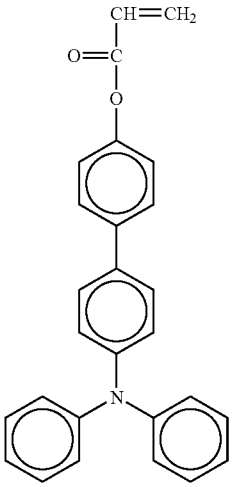
-continued
No. 52
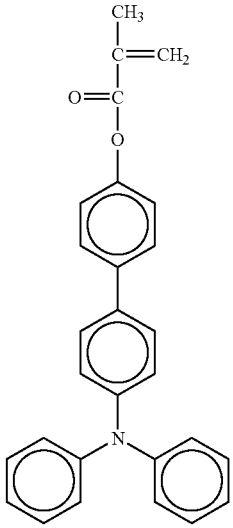
No. 53
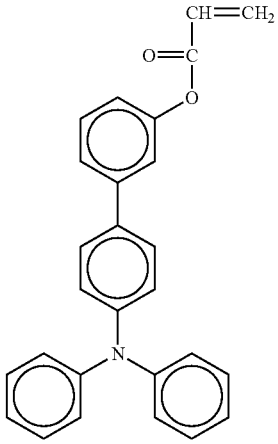
No. 54
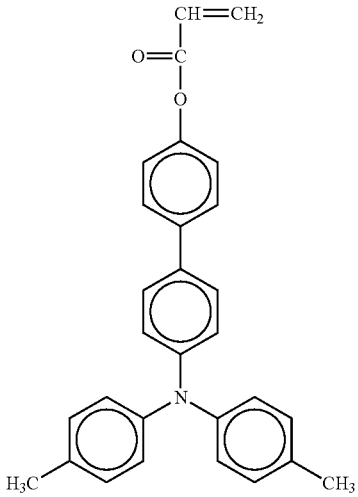

-continued
No. 55
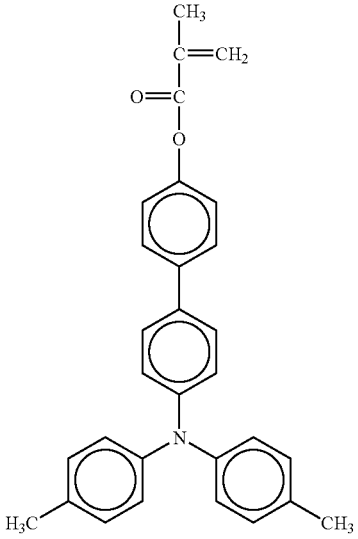
No. 56
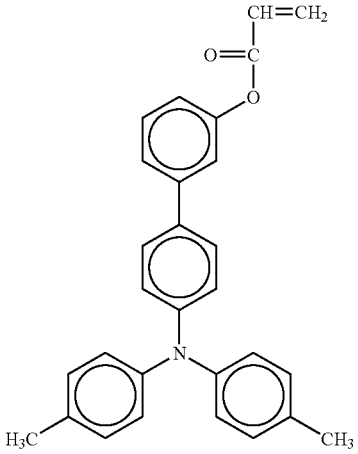
No. 57
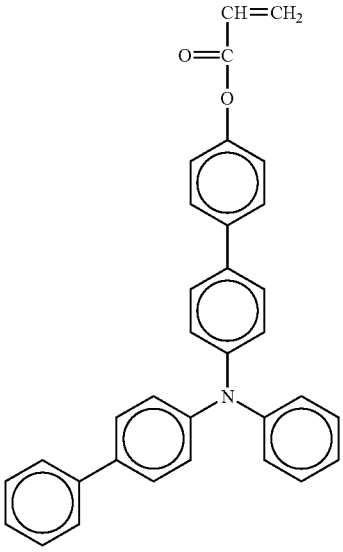
-continued
No. 58
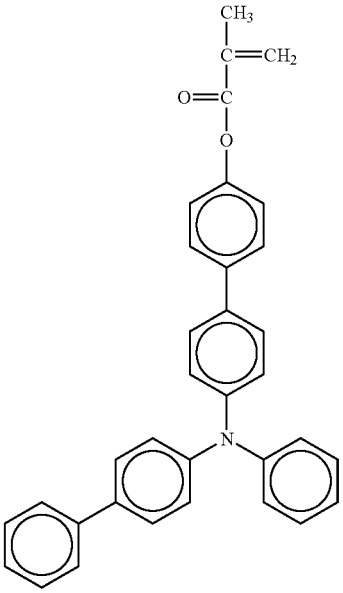
No. 59
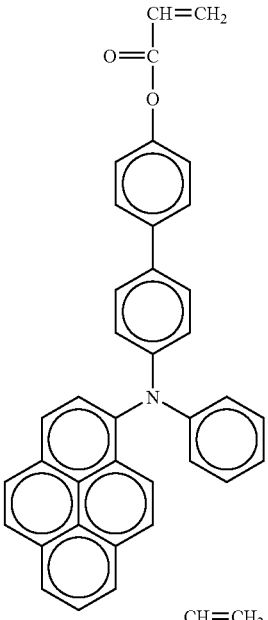
No. 60
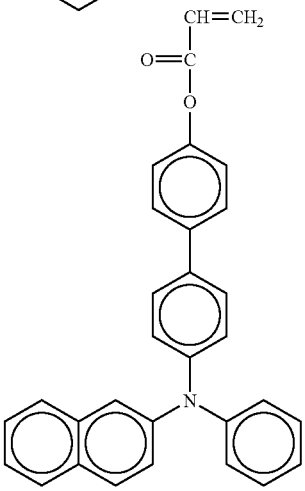

-continued
No. 61
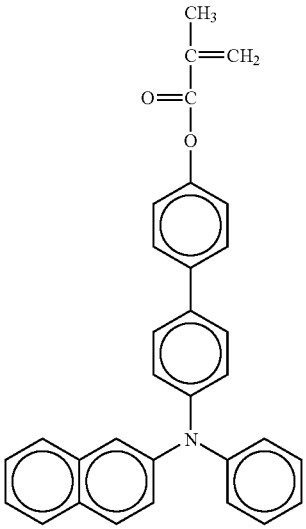
No. 62
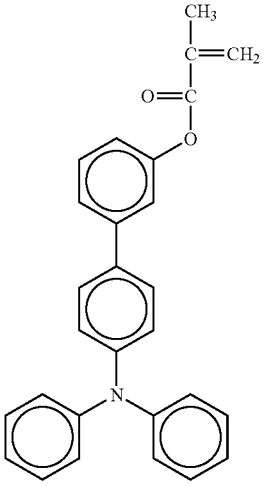
No. 63
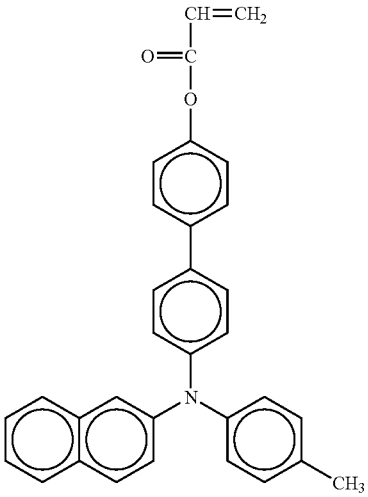
-continued
No. 64
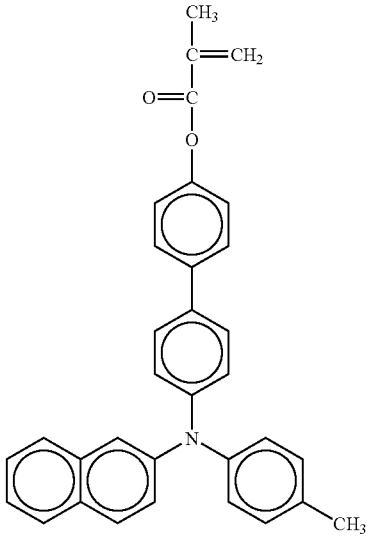
No. 65
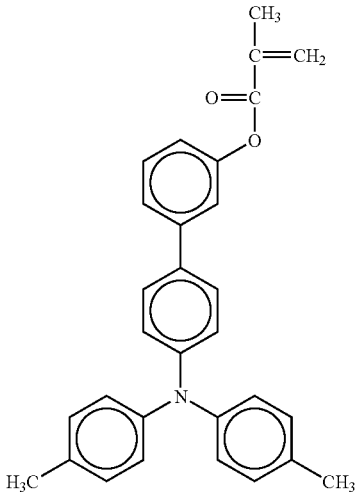
No. 66
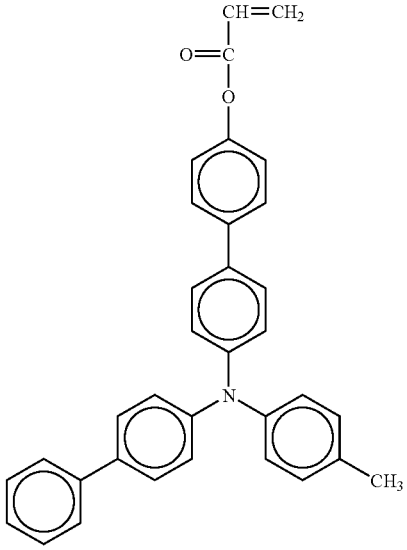

-continued
No. 67
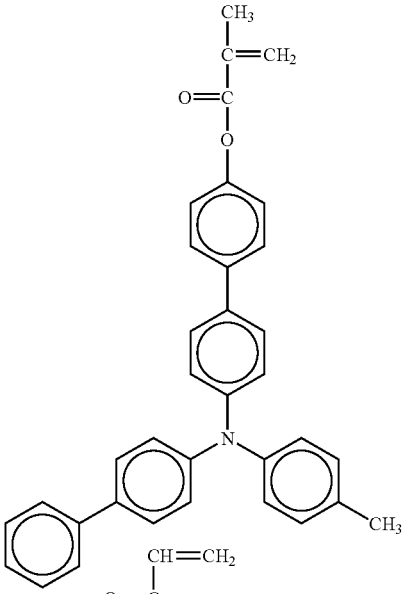
No. 68
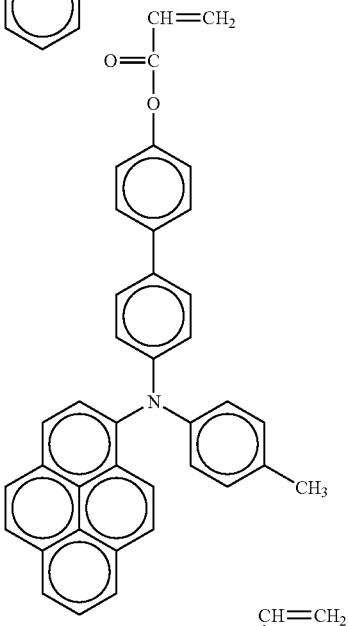
No. 69
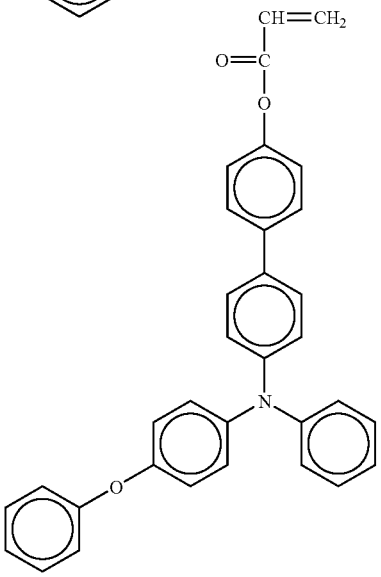
-continued
No. 70
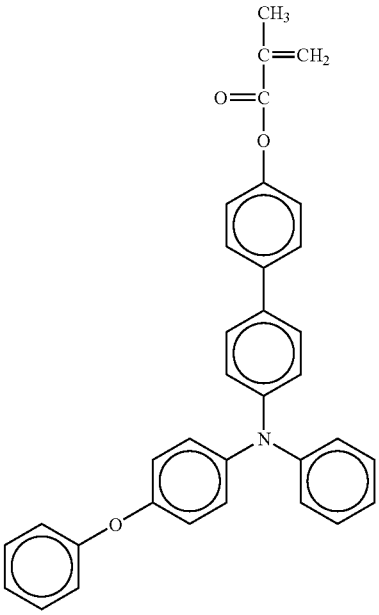
No. 71
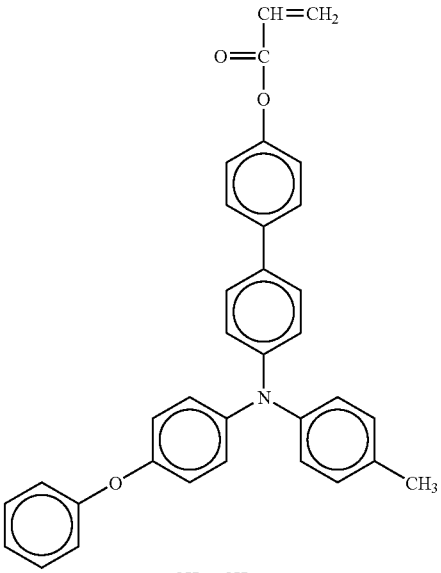
No. 72
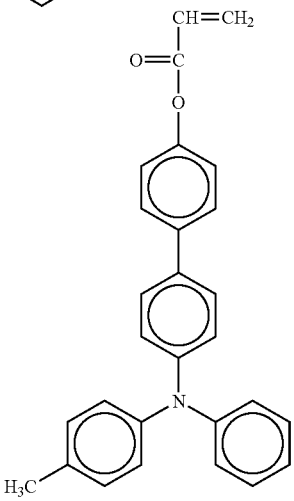

-continued
No. 73
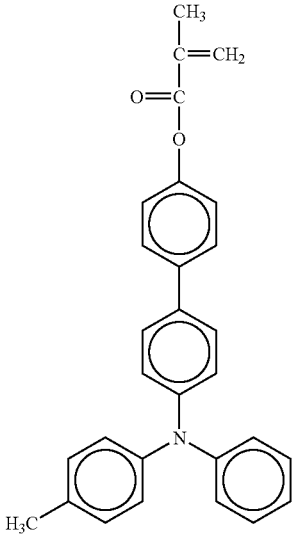
No. 74
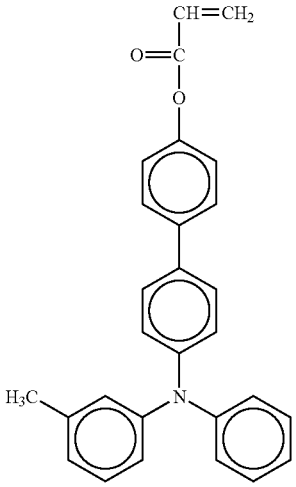
No. 75
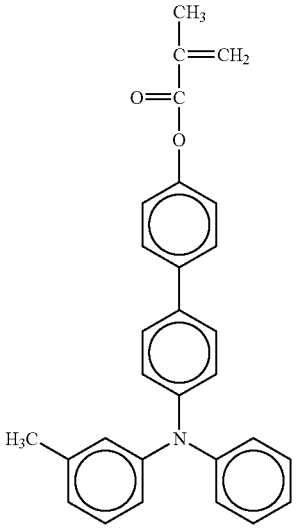
-continued
No. 76
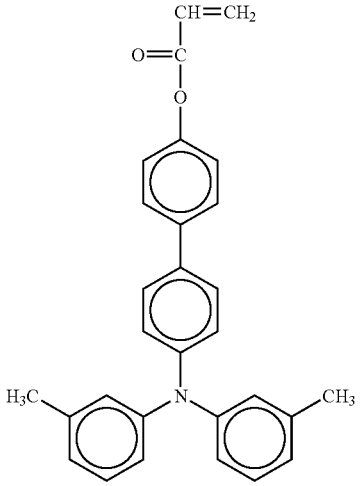
No. 77
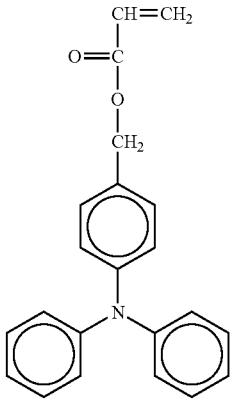
No. 78
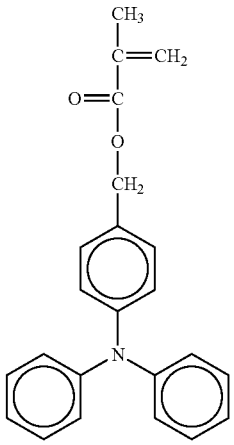

No. 79
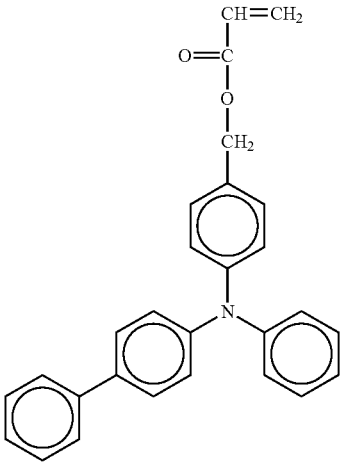
No. 80
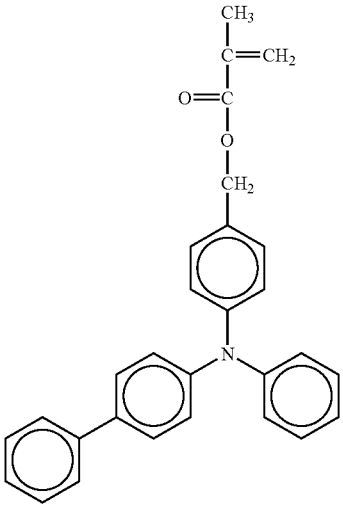
No. 81
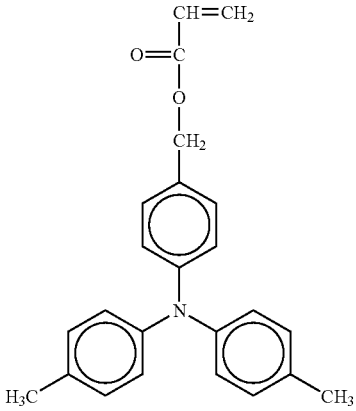
No. 82
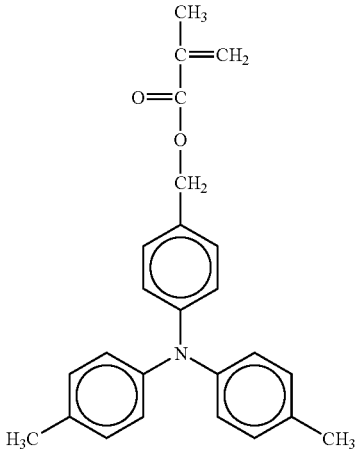
No. 83
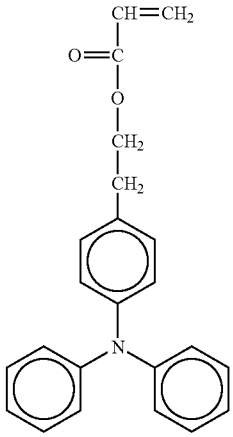
No. 84
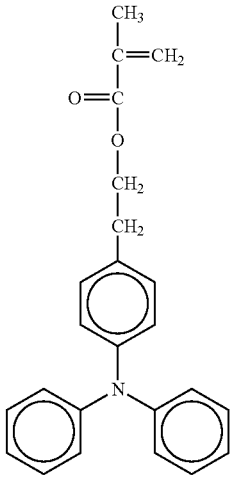

-continued
No. 85
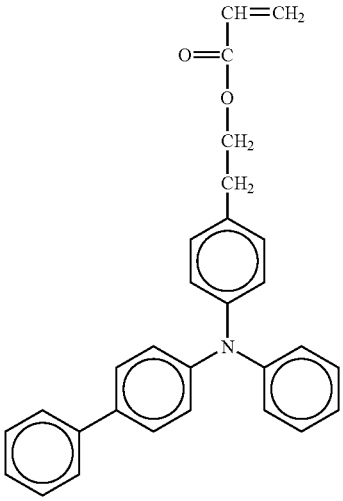
No. 86
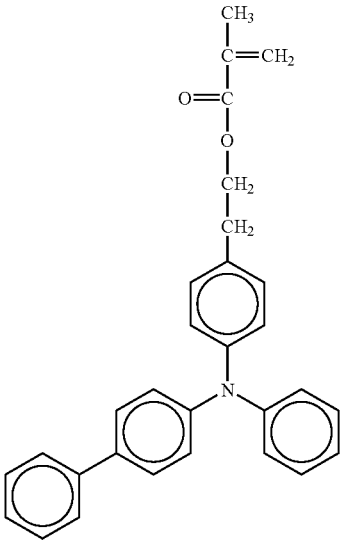
No. 87
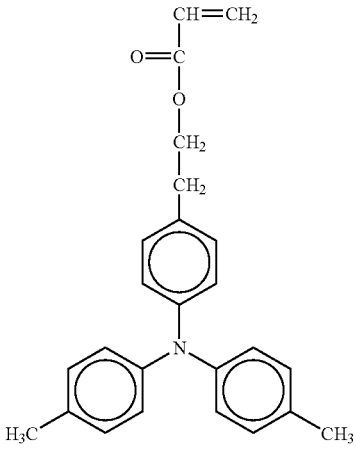
-continued
No. 88
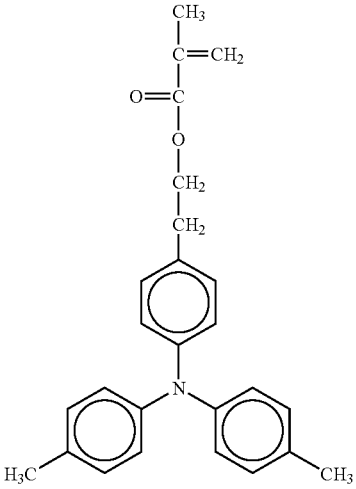
No. 89
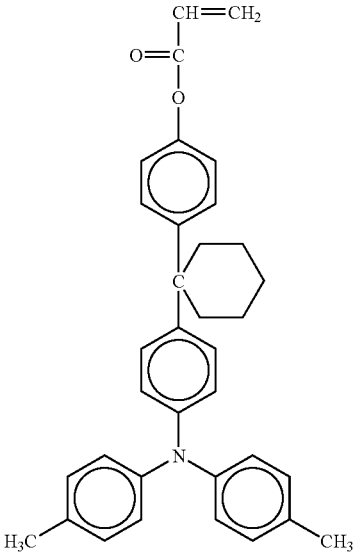
No. 90
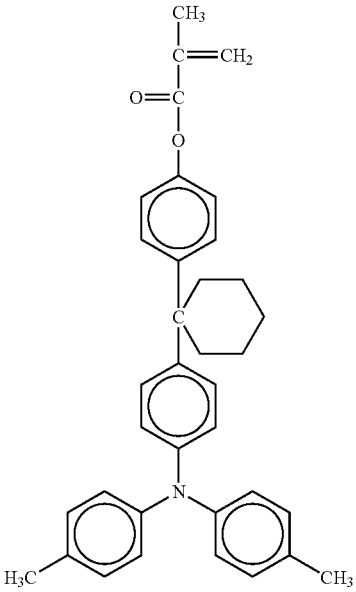

No. 91
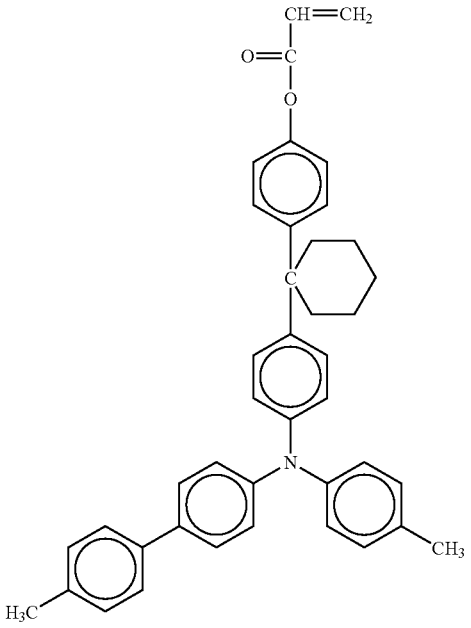
No. 92
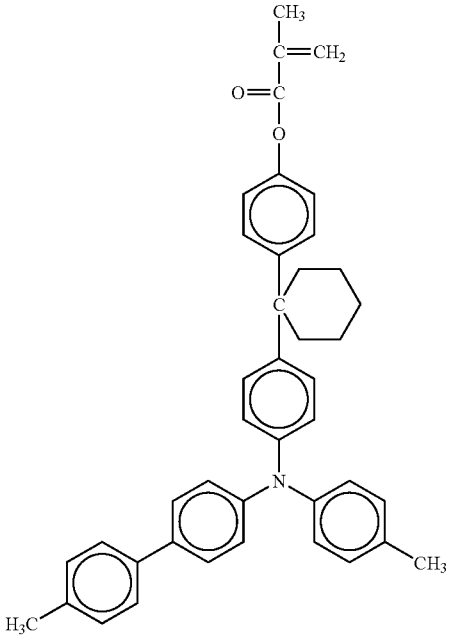
No. 93
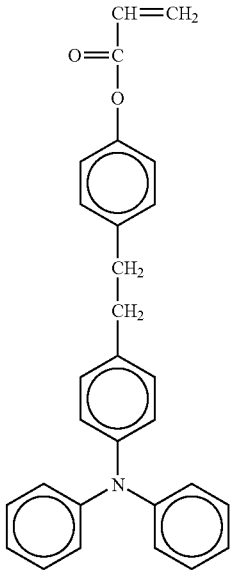
No. 94
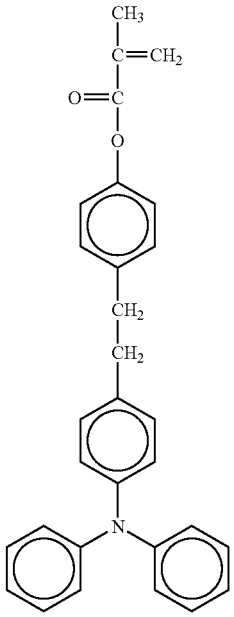

No. 95
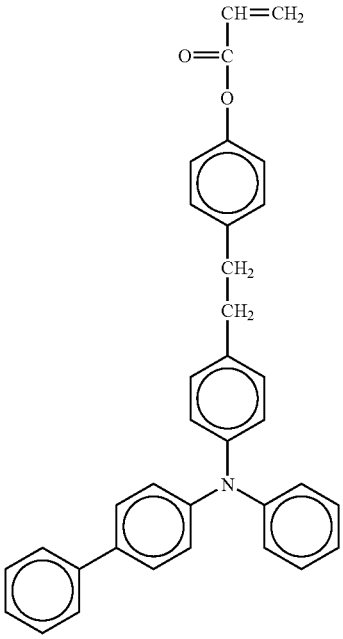
No. 96
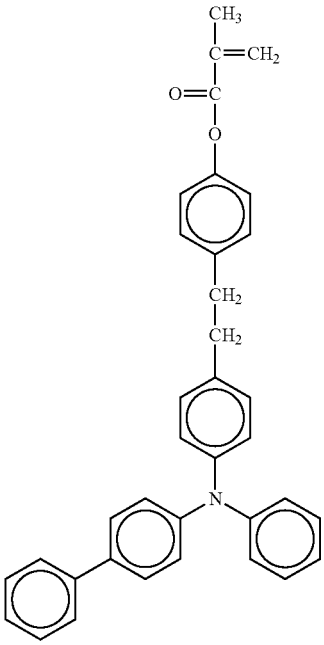
No. 97
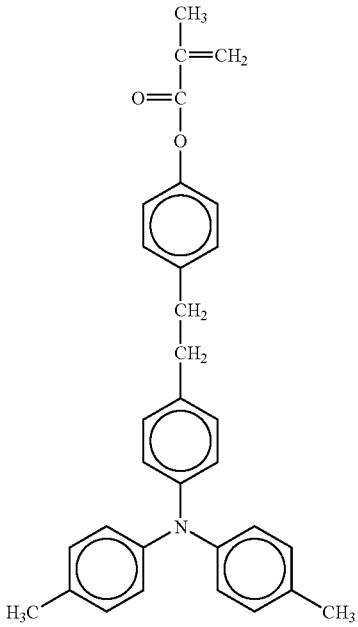
No. 98
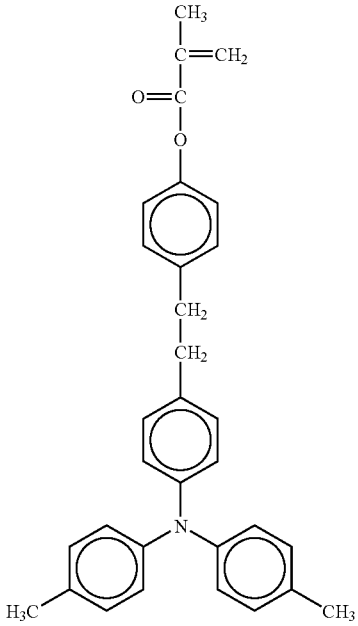

-continued
No. 99
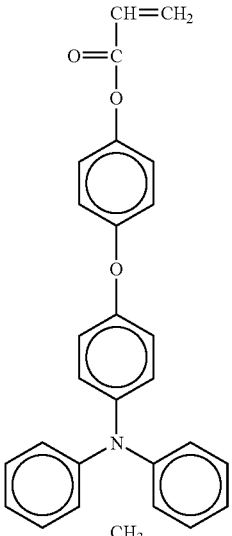
No. 100
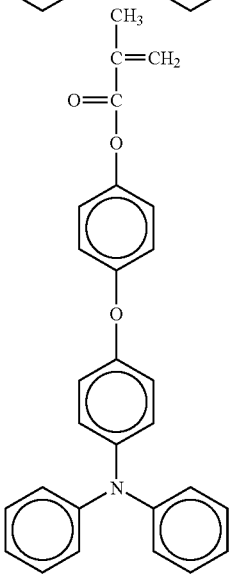
No. 101
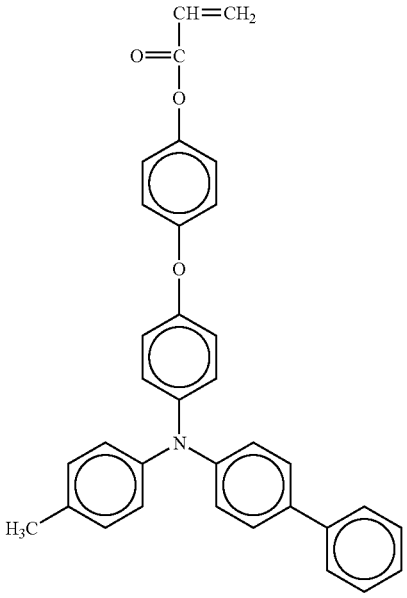
-continued
No. 102
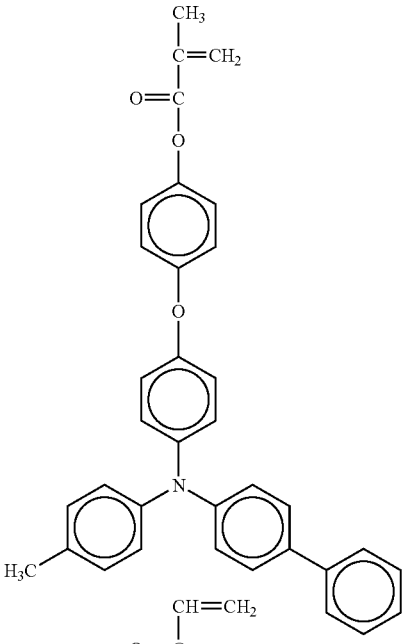
No. 103
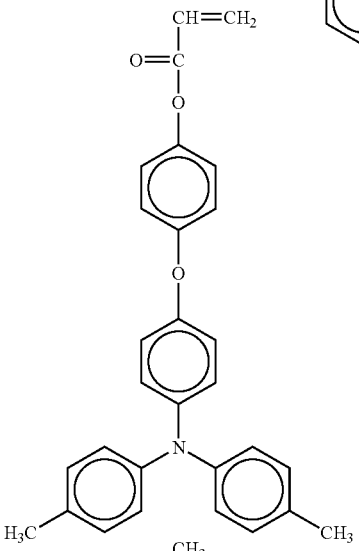
No. 104
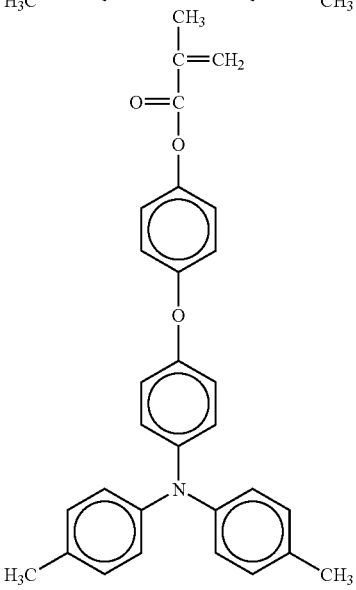

No. 105
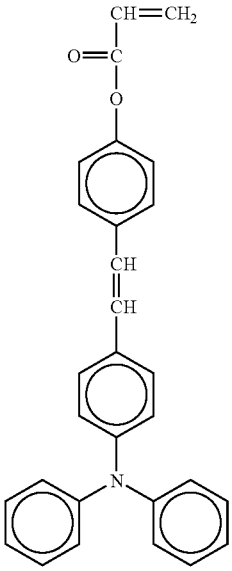
No. 106
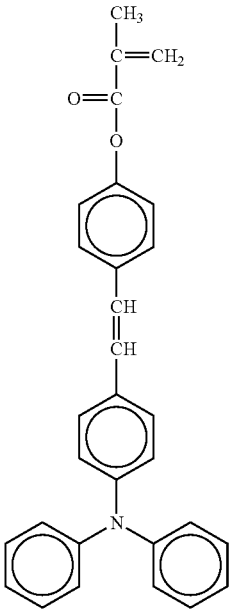
No. 107
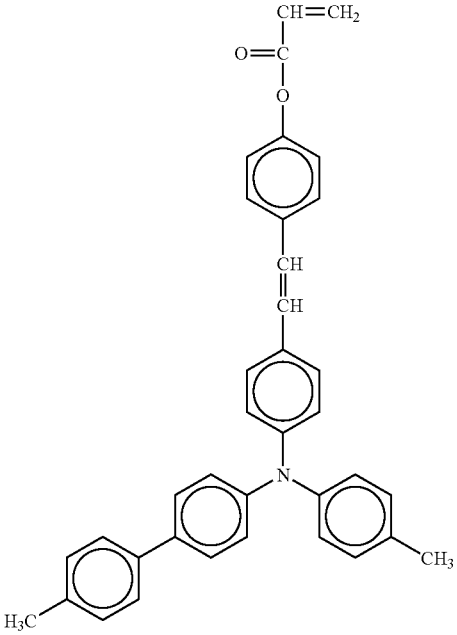
No. 108
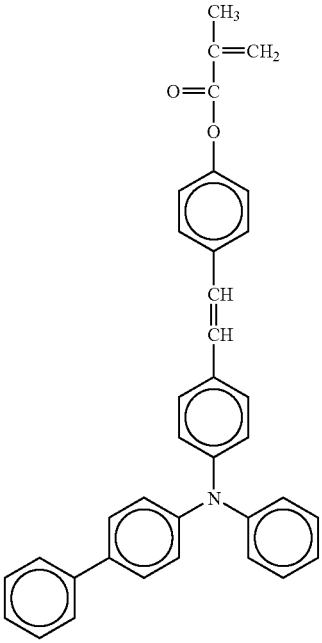

-continued
No. 109
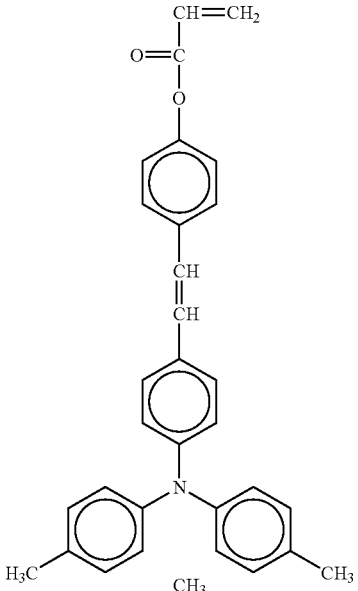
No. 110
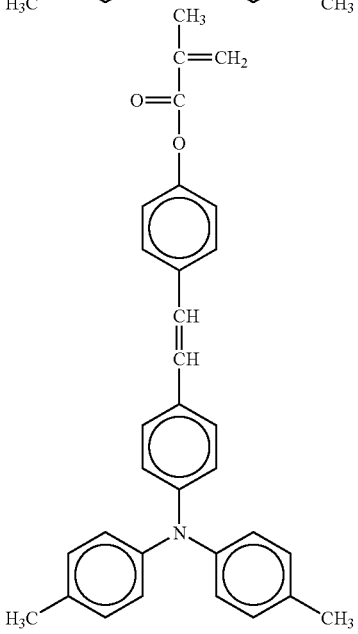
No. 111
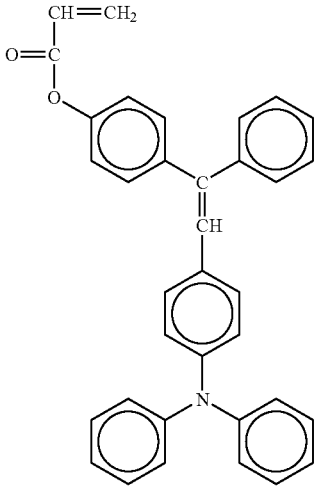
-continued
No. 112
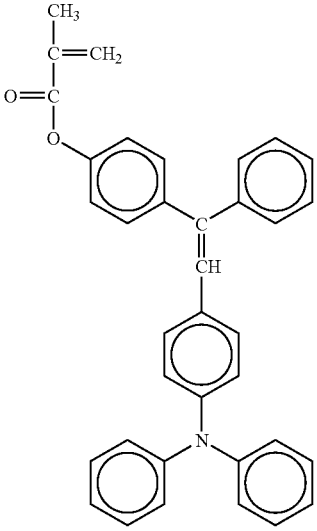
No. 113
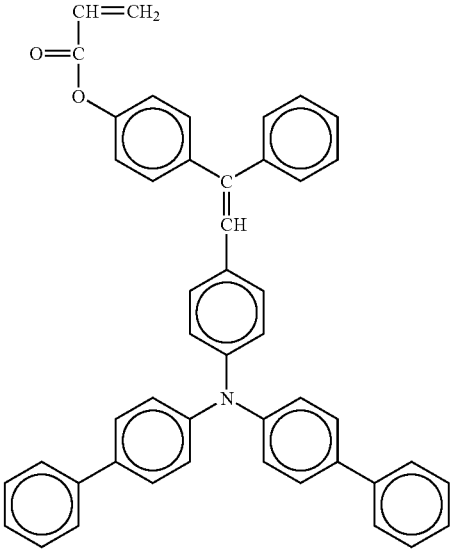
No. 114
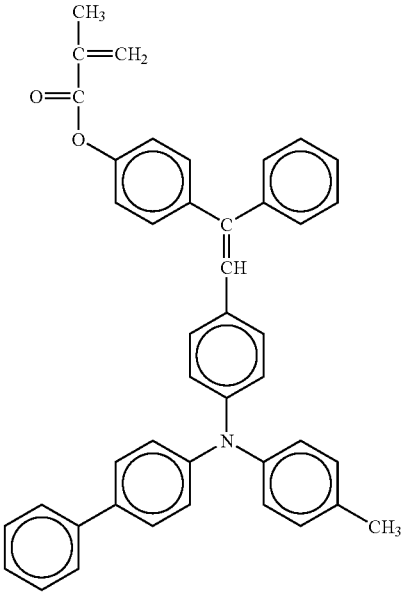

-continued
No. 115
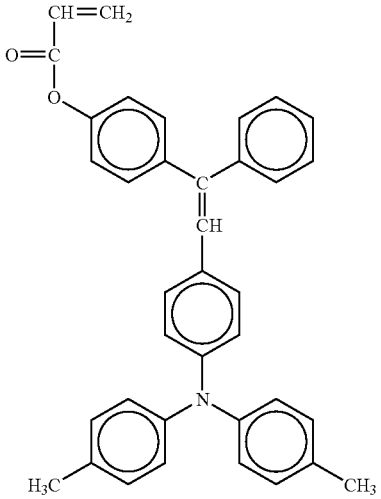
No. 116
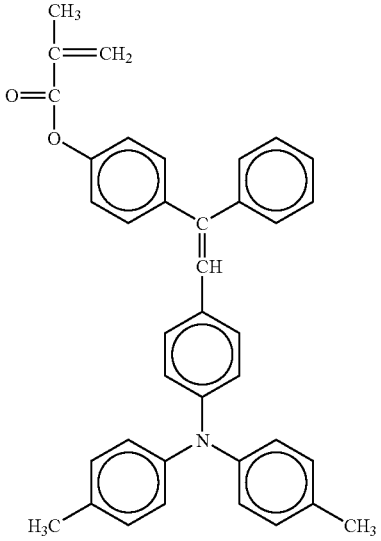
No. 117
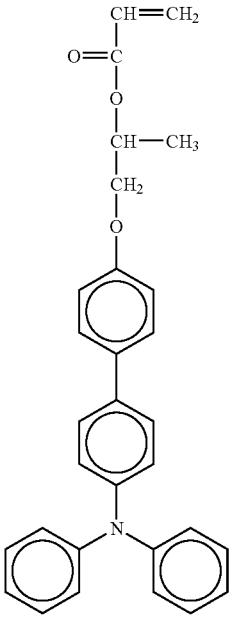
-continued
No. 118
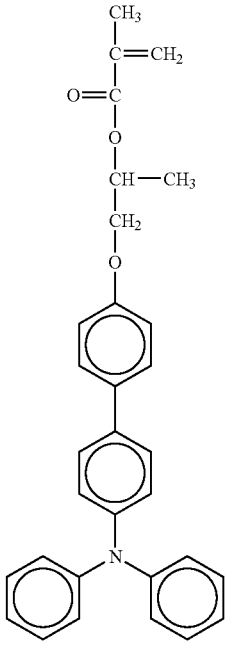
No. 119
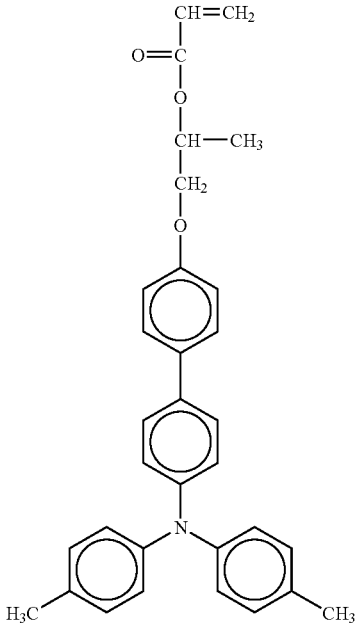

No. 120
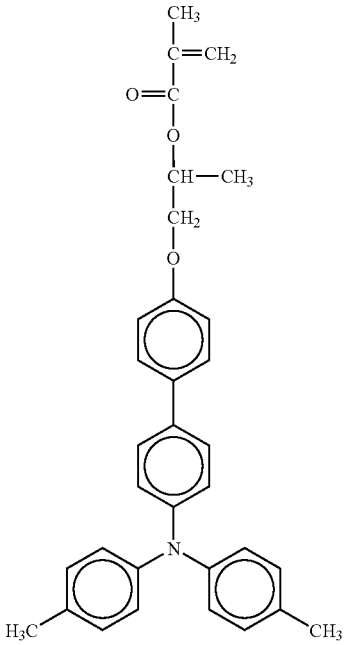
No. 121
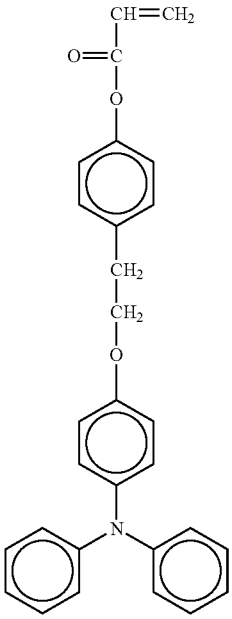
No. 122
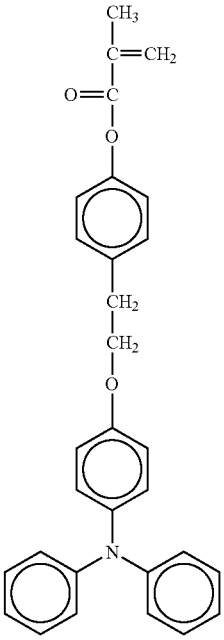
No. 123
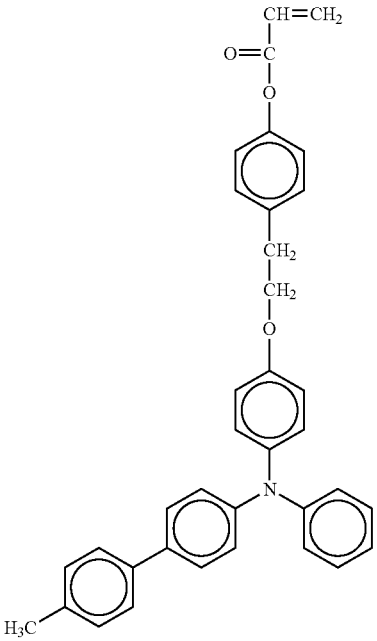

-continued
No. 124
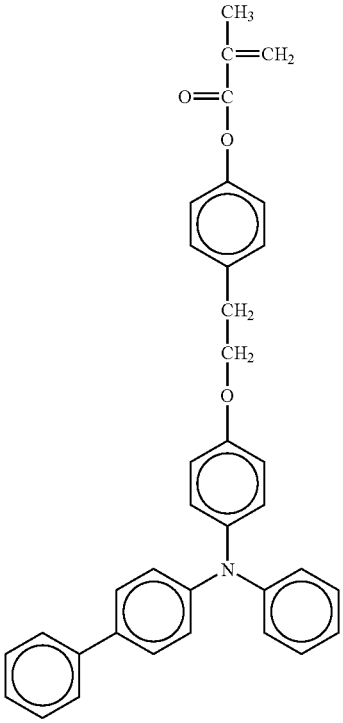
No. 125
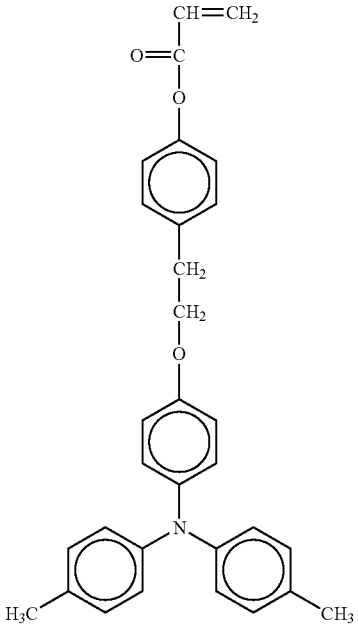
-continued
No. 126
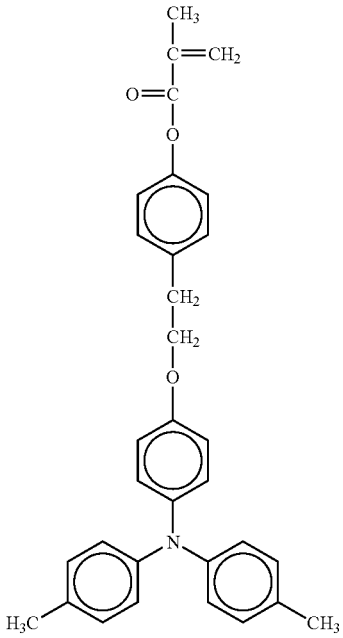
No. 127
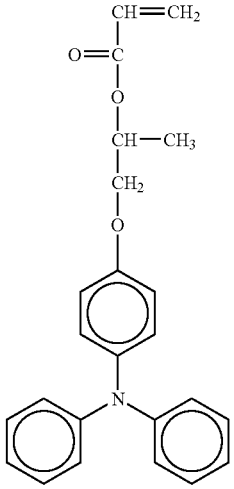
No. 128
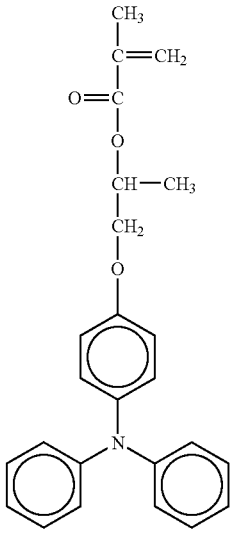

-continued
No. 129
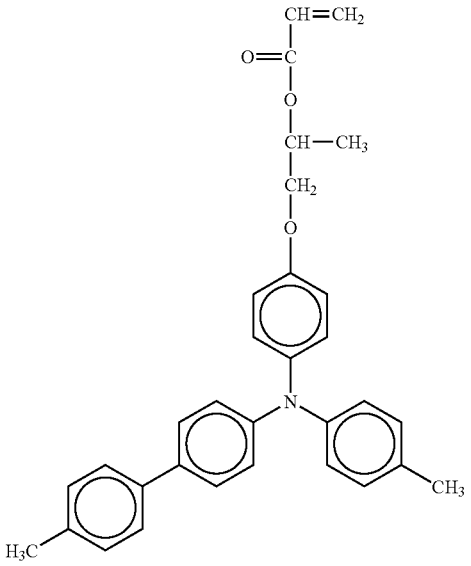
No. 130
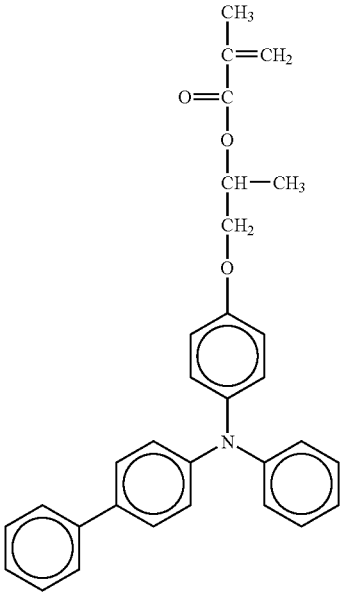
No. 131
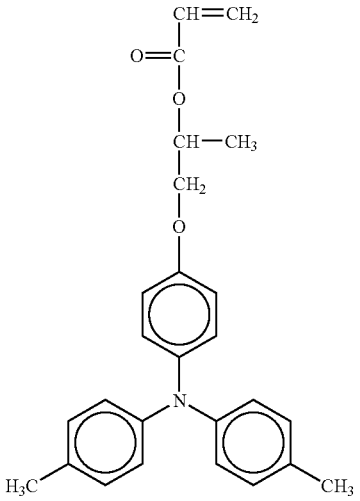
-continued
No. 132
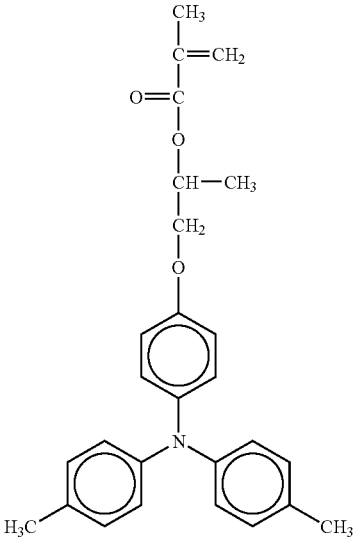
No. 133
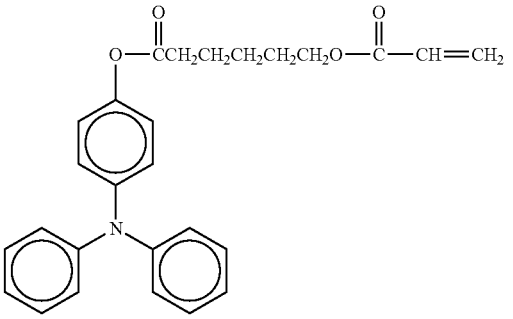
No. 134
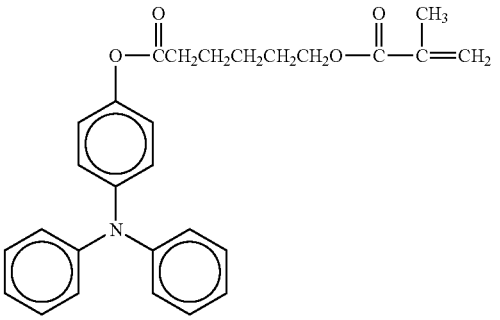
No. 135
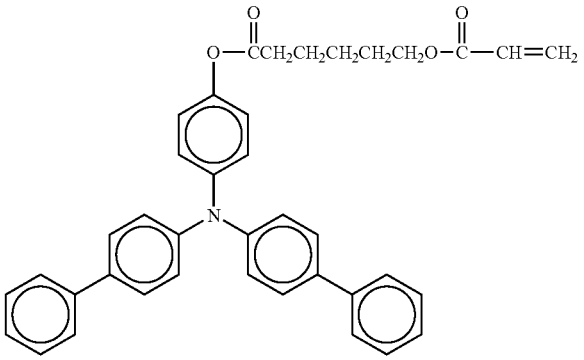

-continued
No. 136
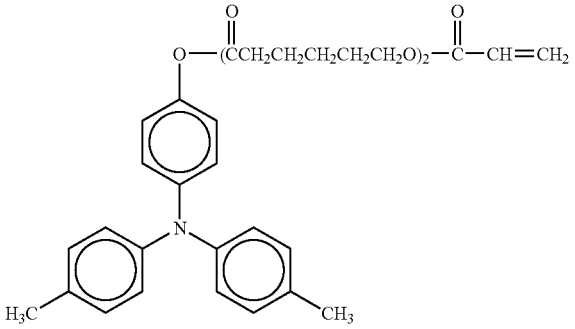
No. 137
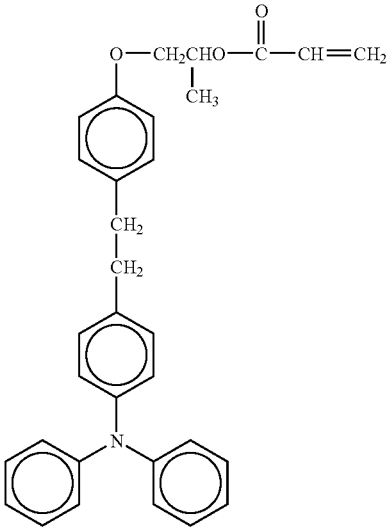
No. 138
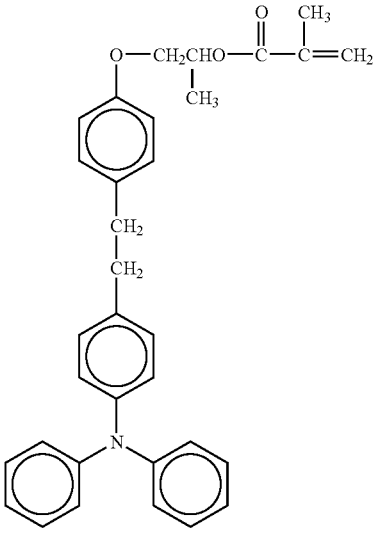
-continued
No. 139
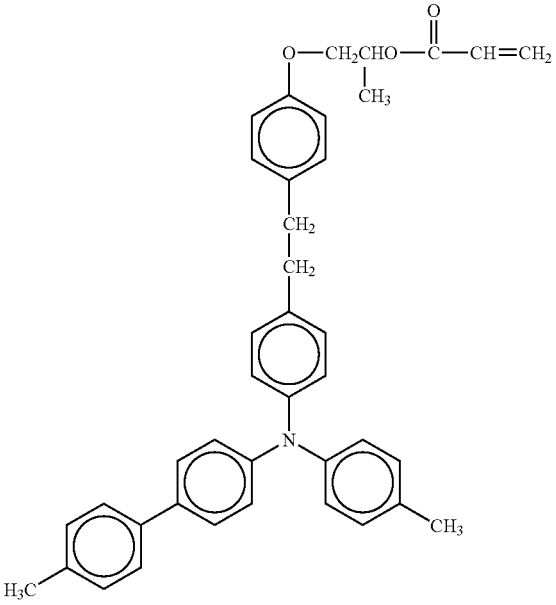
No. 140
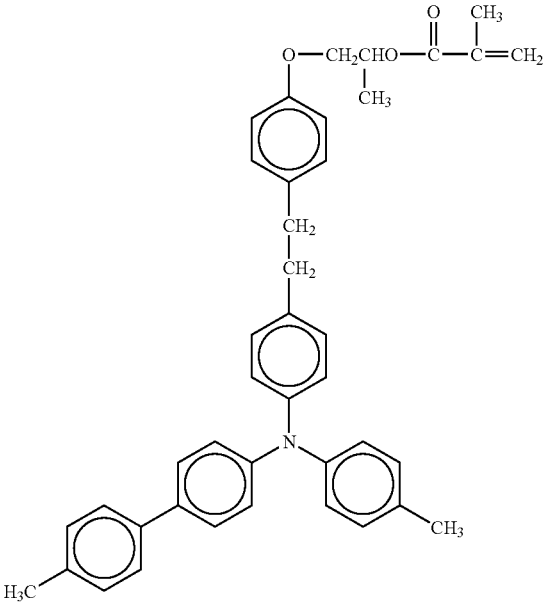

-continued
No. 141
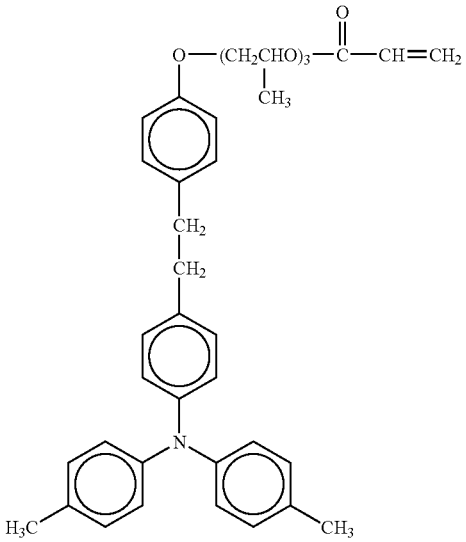
No. 142
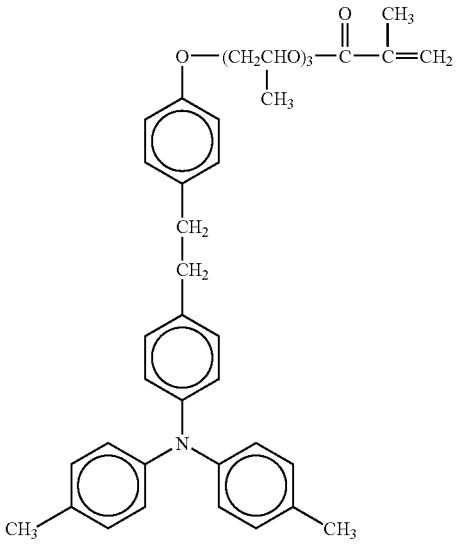
No. 143
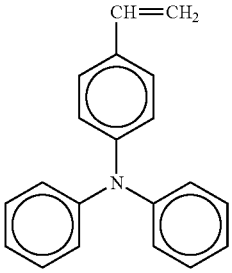
-continued
No. 144
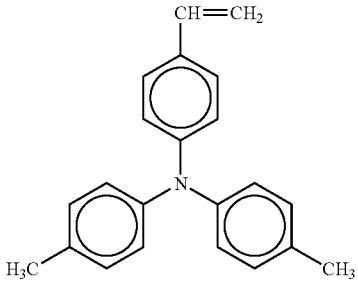
No. 145
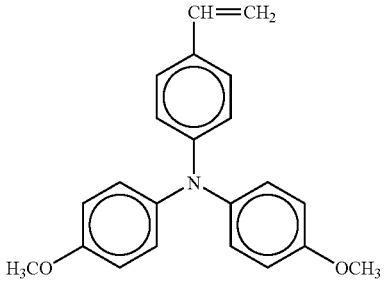
No. 146
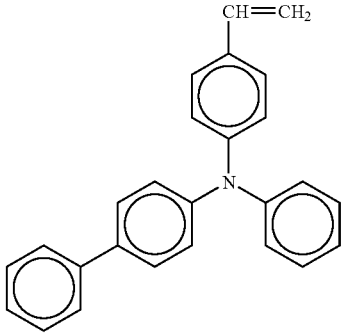
No. 147
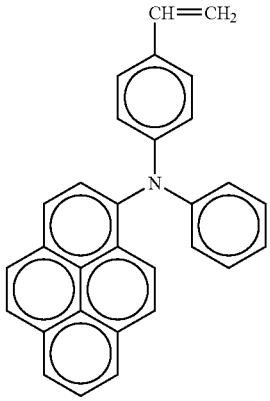
No. 148
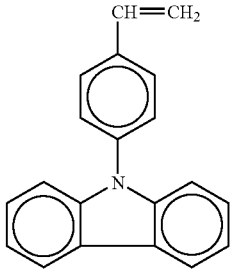

-continued
No. 149
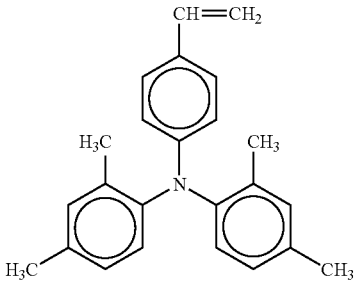
No. 150
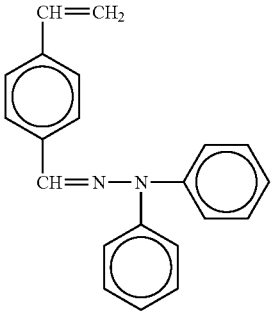
No. 151
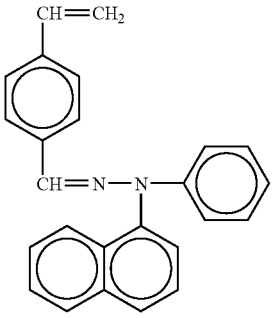
No. 152
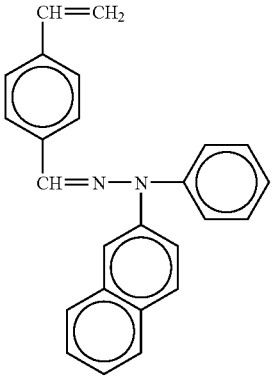
No. 153
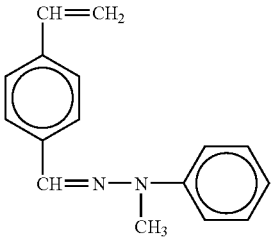
-continued
No. 154
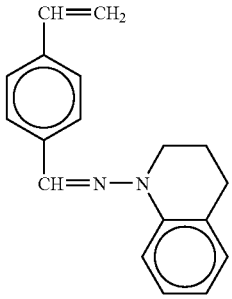
No. 155
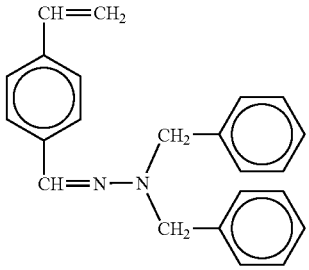
No. 156
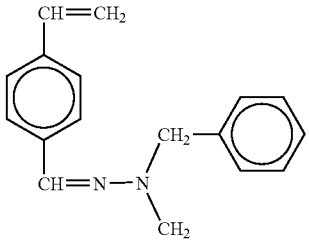
No. 157
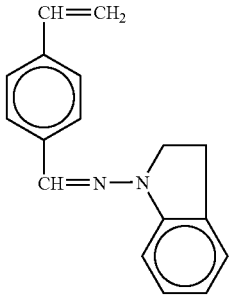
No. 158
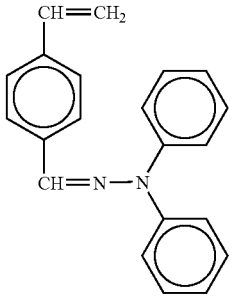

-continued
No. 159
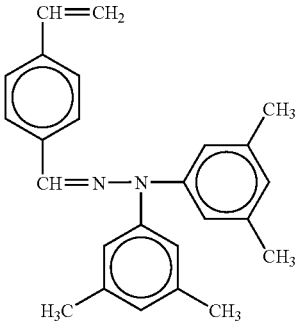
-continued
No. 160
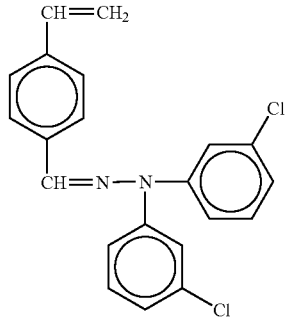
Specific examples of the radically polymerizable bifunctional compound having a charge transporting structure are described below, however, the radically polymerizable bifunctional compound having a charge transporting structure are not limited to compounds each having any one of the following structures.
No. 161
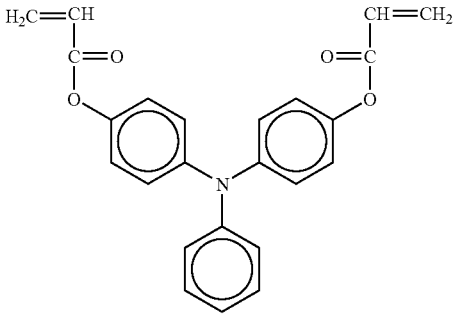
No. 162
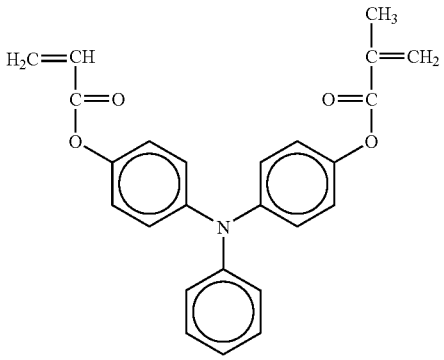
No. 163
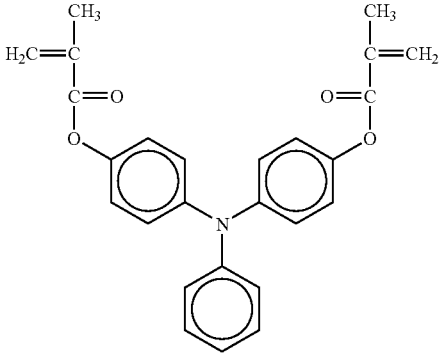
No. 164
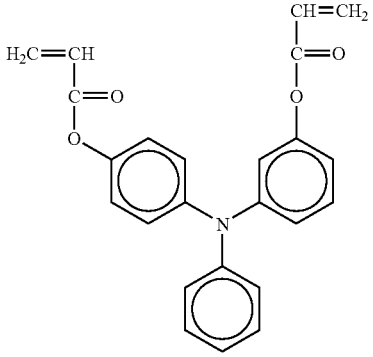
No. 165
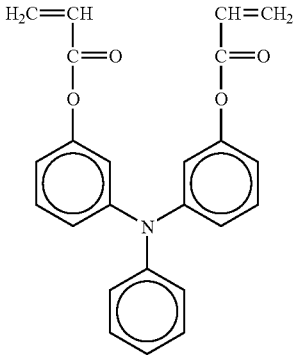
No. 166
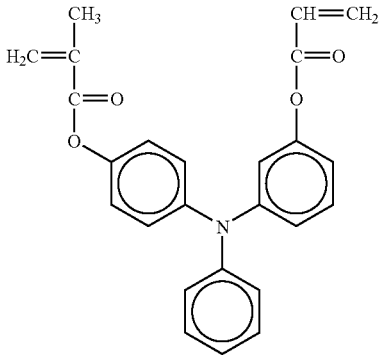

-continued
No. 167
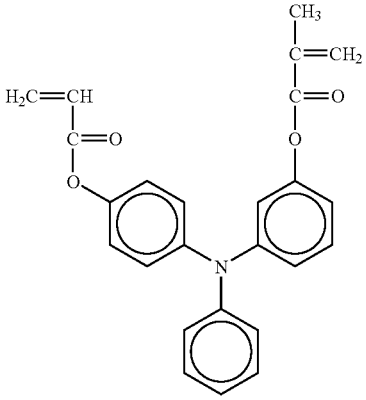
No. 168
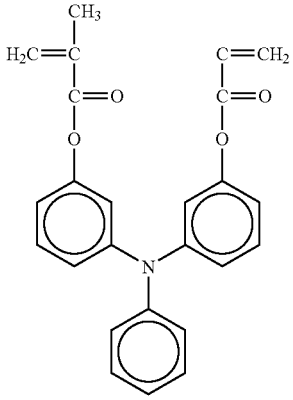
No. 169
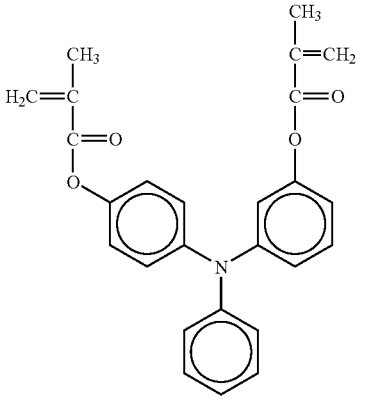
No. 170
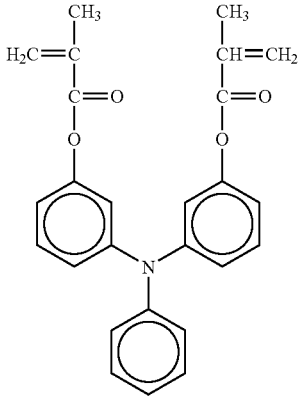
No. 171
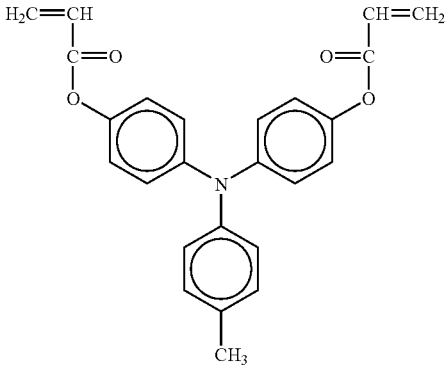
No. 172
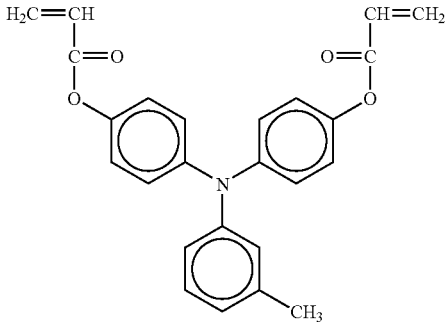
No. 173
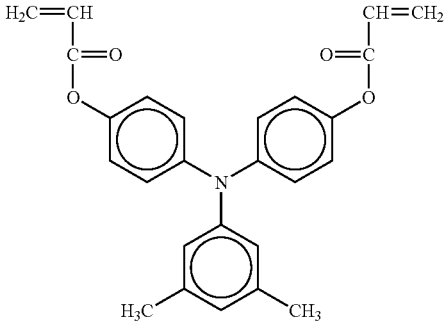
No. 174
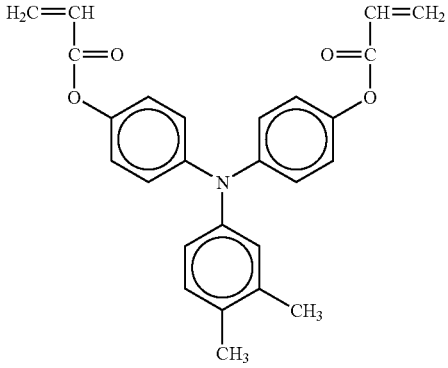

-continued
No. 175
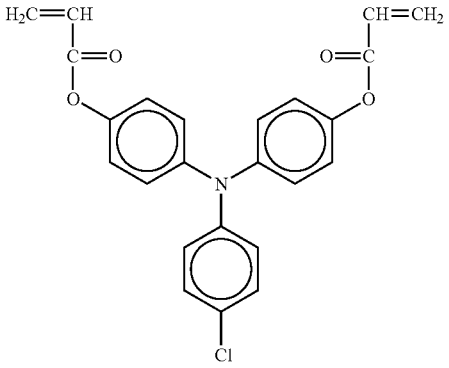
No. 176
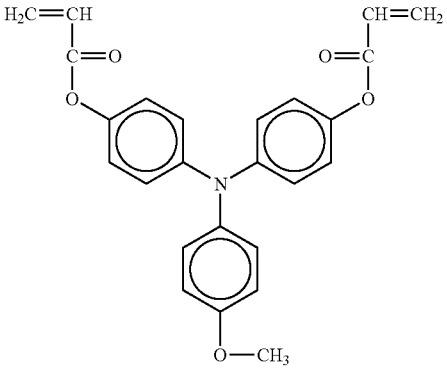
No. 177
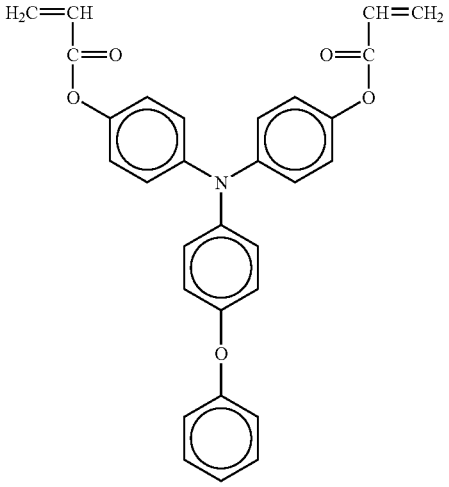
No. 178
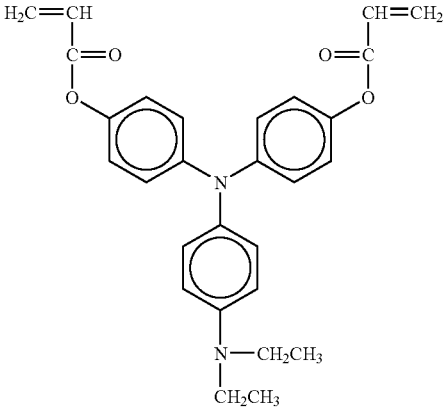
No. 179
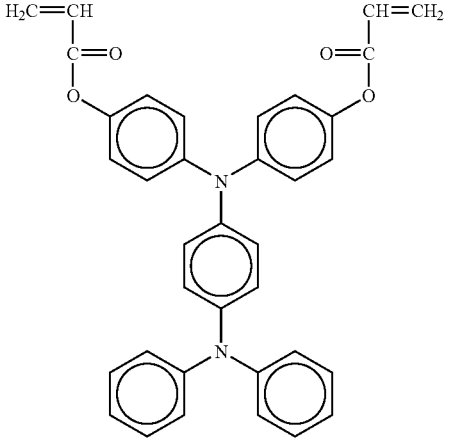
No. 180
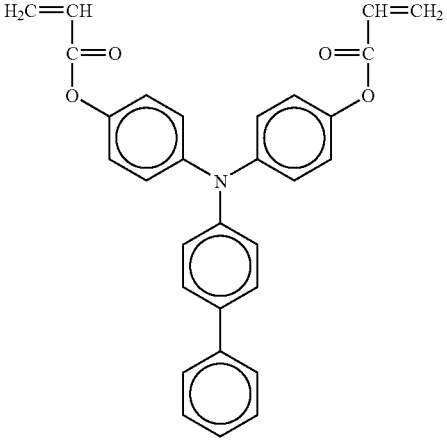

-continued
No. 181
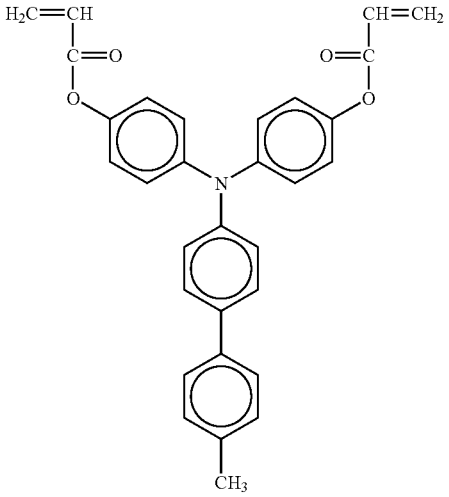
No. 182
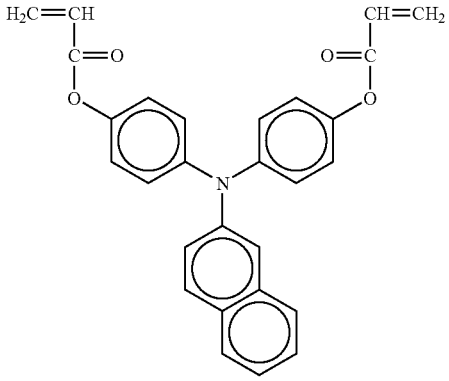
No. 183
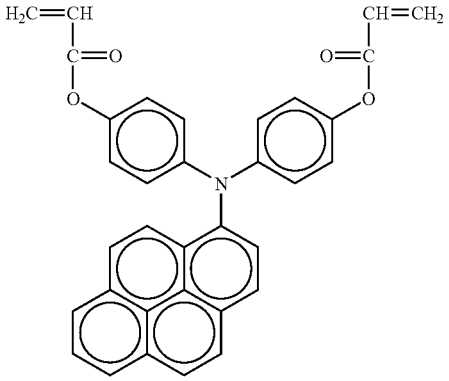
No. 184
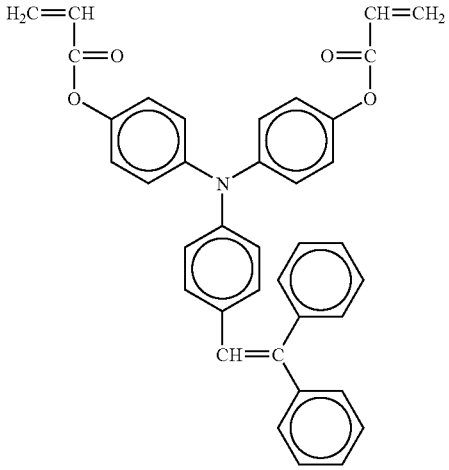
No. 185
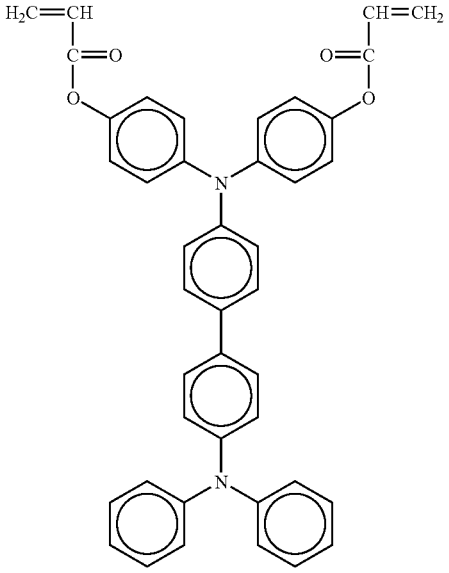
No. 186
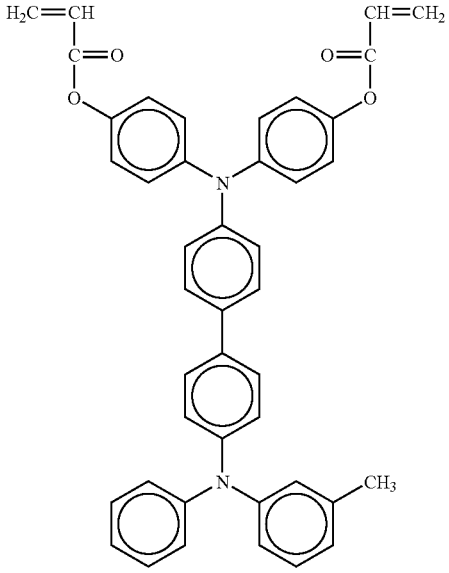

-continued
No. 187
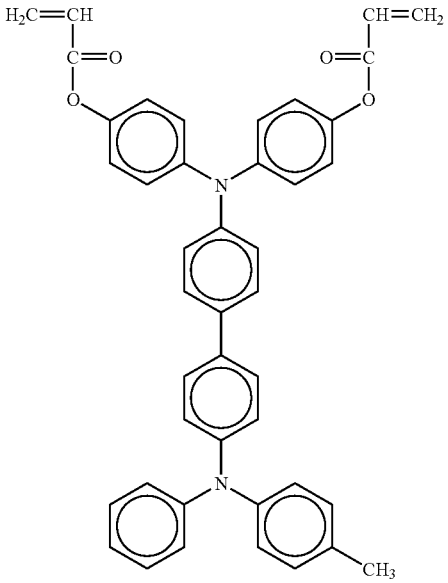
No. 188
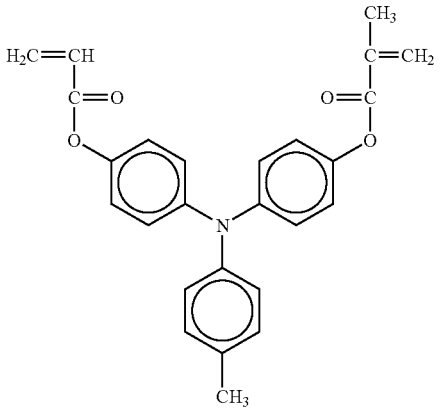
No. 189
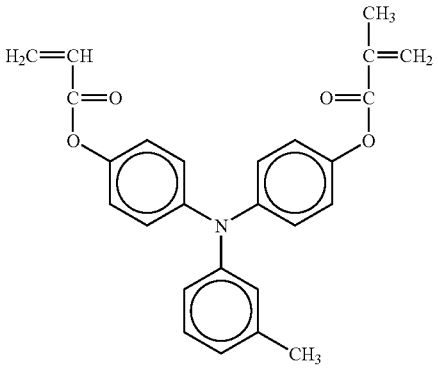
No. 190
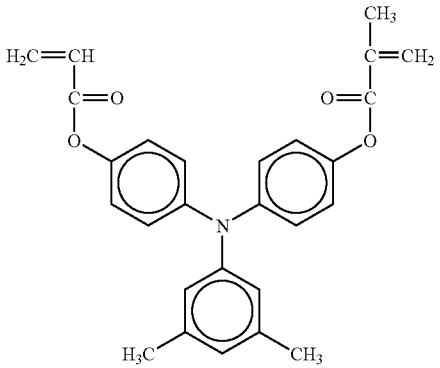
No. 191
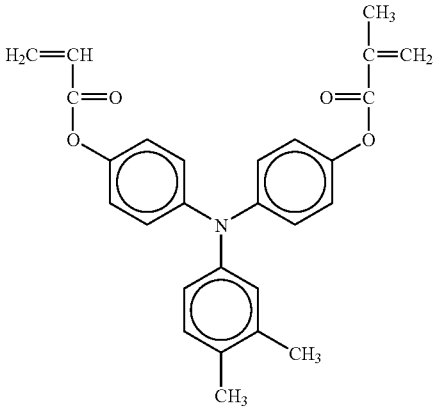
No. 192
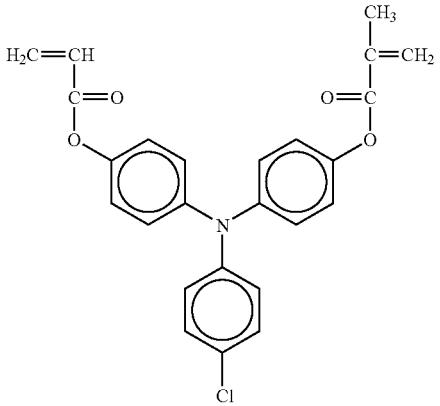

-continued
No. 193
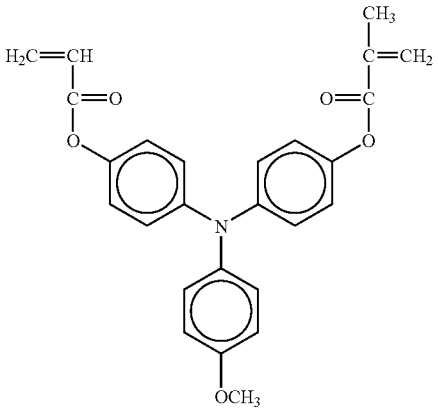
No. 194
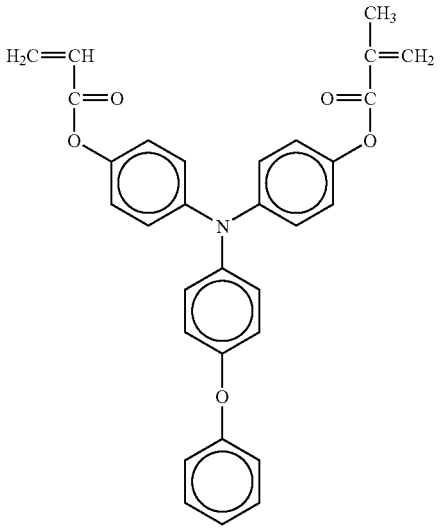
No. 195
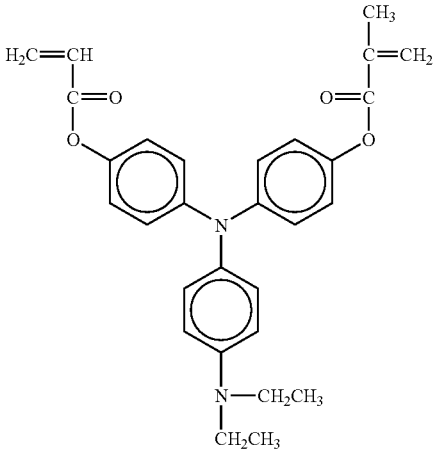
No. 196
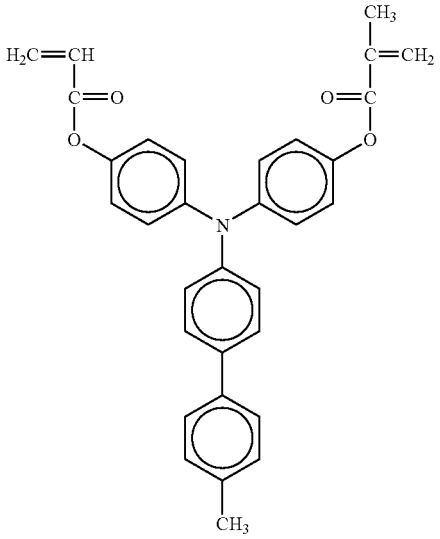
No. 197
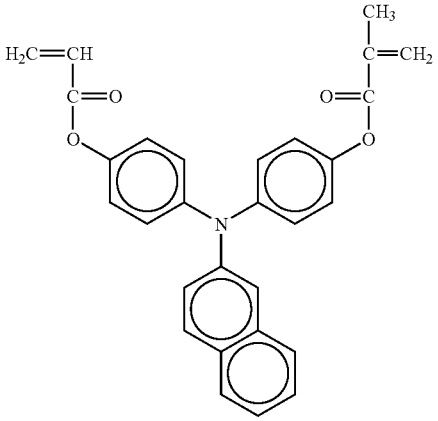
No. 198
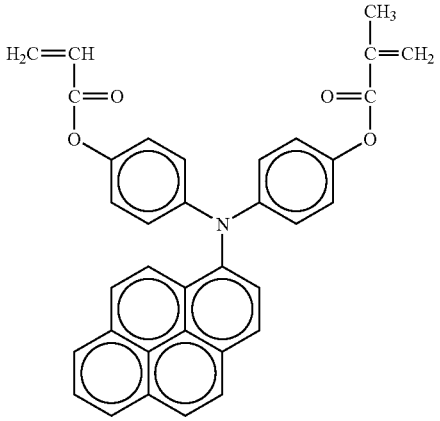

-continued
No. 199
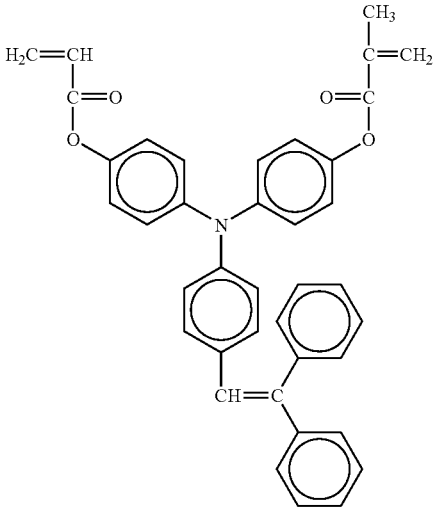
No. 200
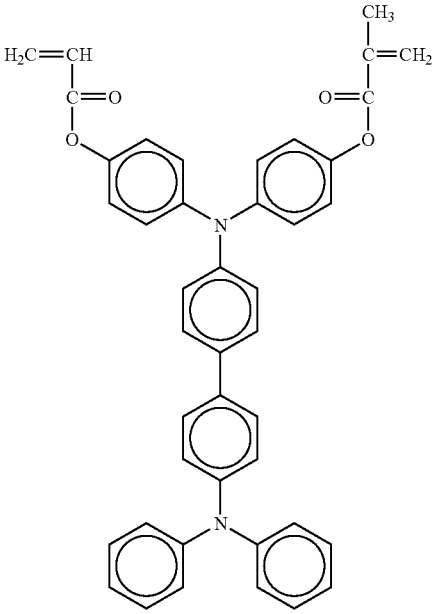
No. 201
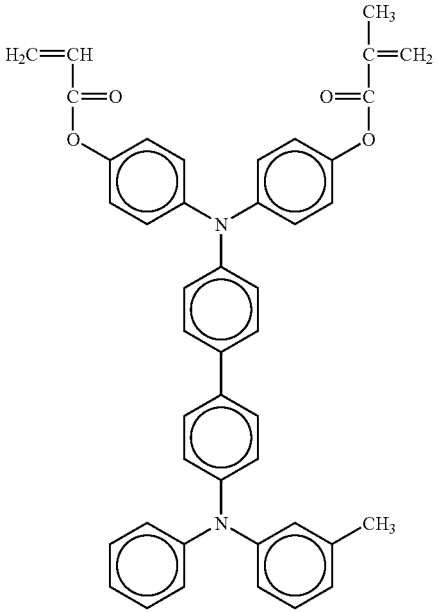
No. 202
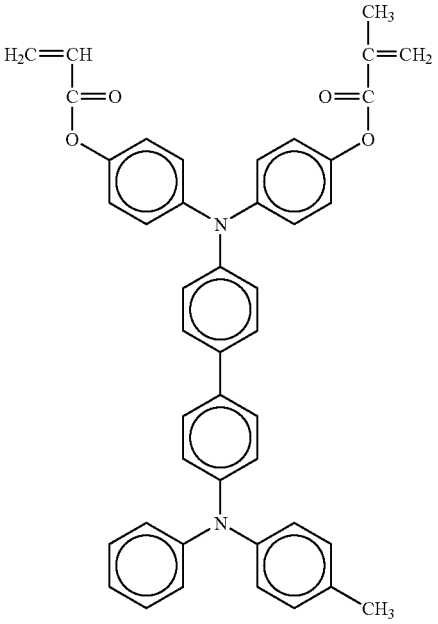
No. 203
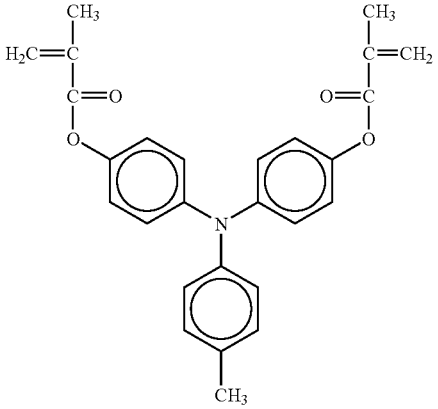
No. 204
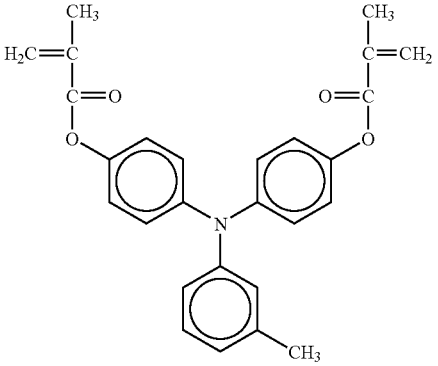

-continued
No. 205
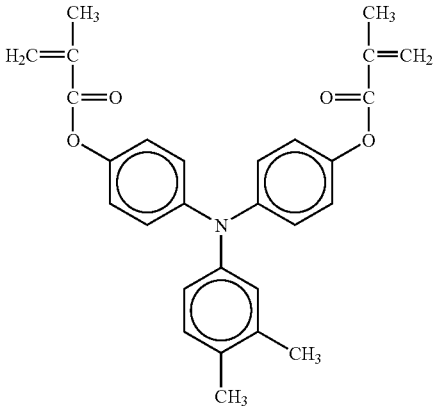
No. 206
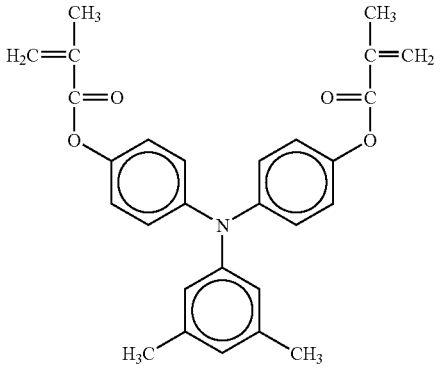
No. 207
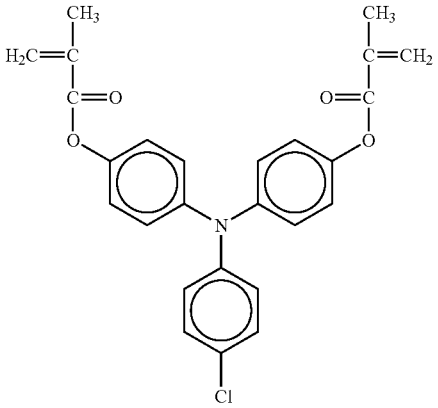
No. 208
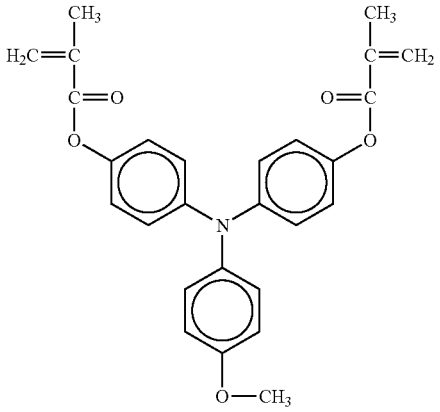
No. 209
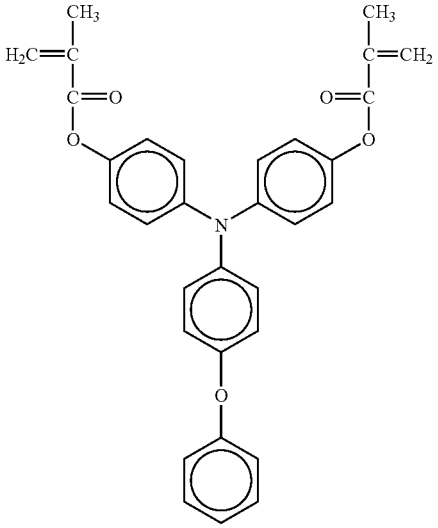
No. 210
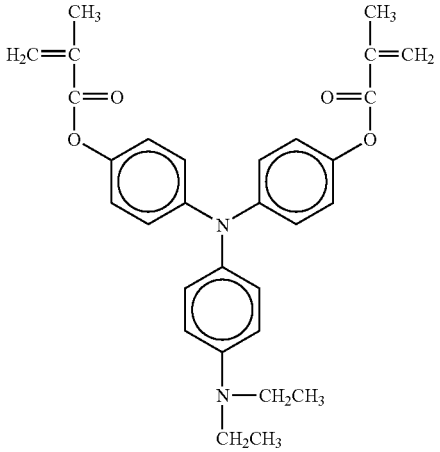

-continued
No. 211
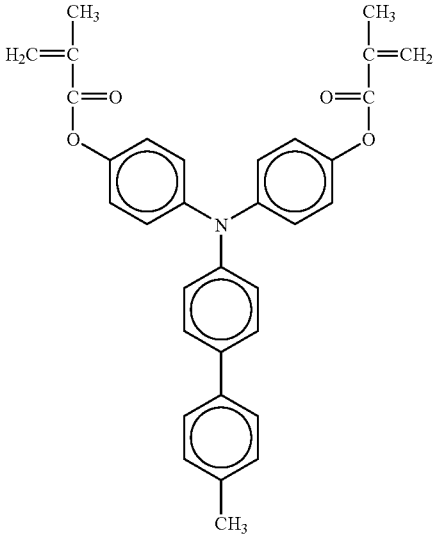
No. 212
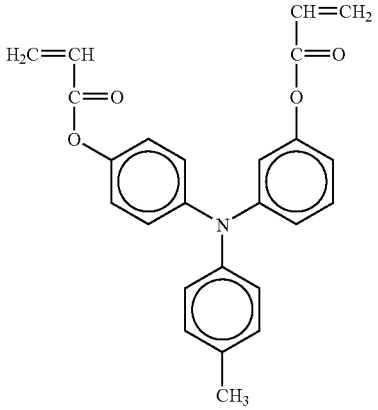
No. 213
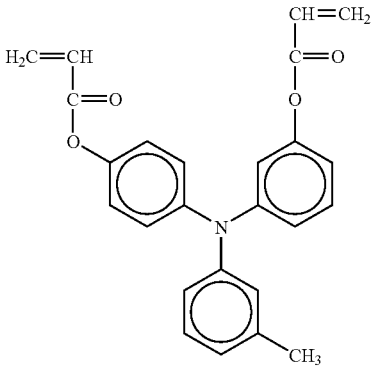
No. 214
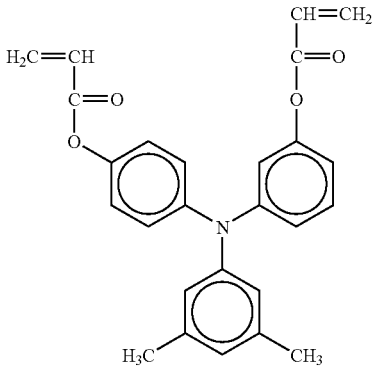
No. 215
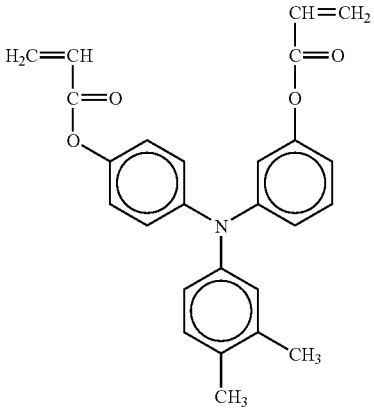
No. 216
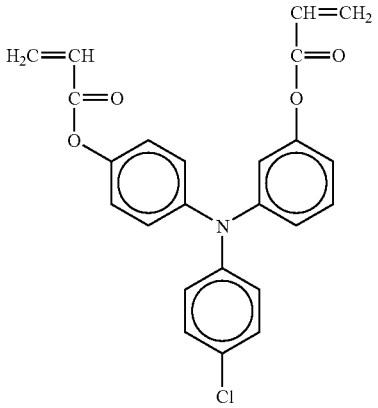

-continued
No. 217
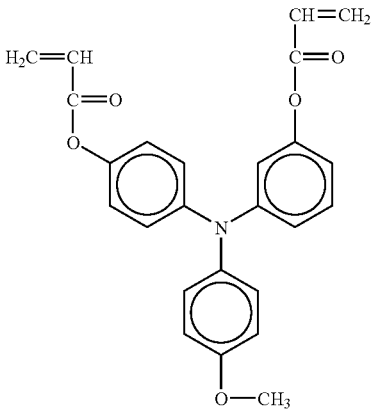
No. 218
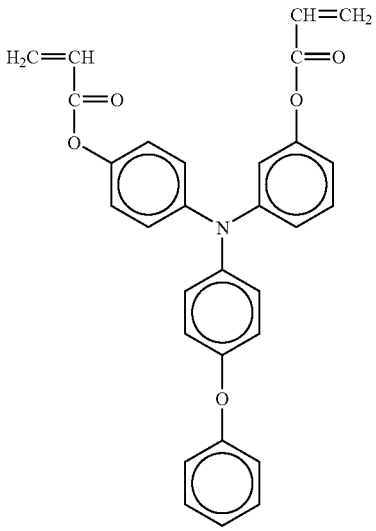
No. 219
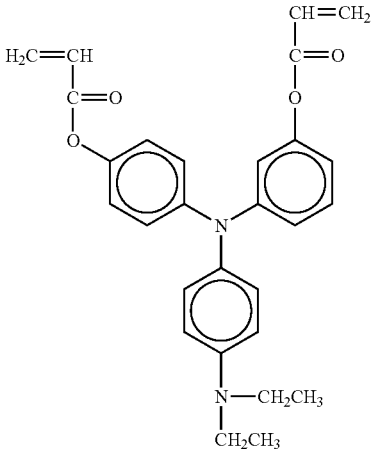
No. 220
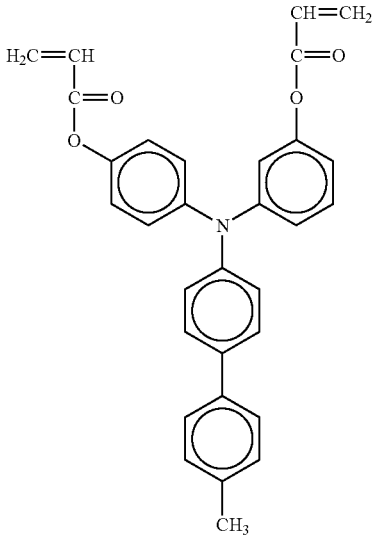
No. 221
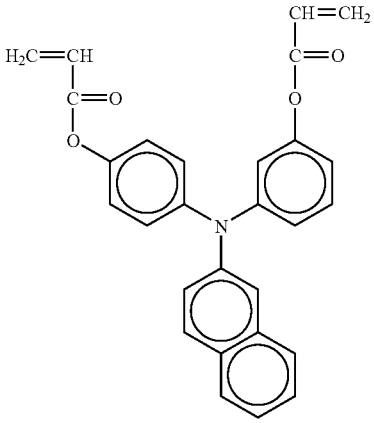
No. 222
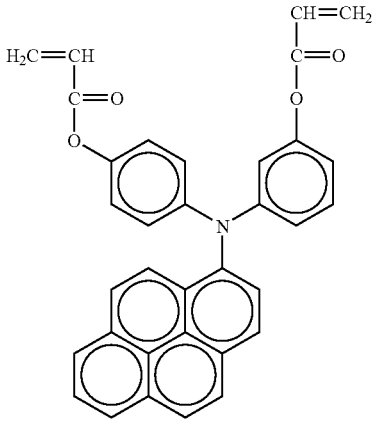

-continued
No. 223
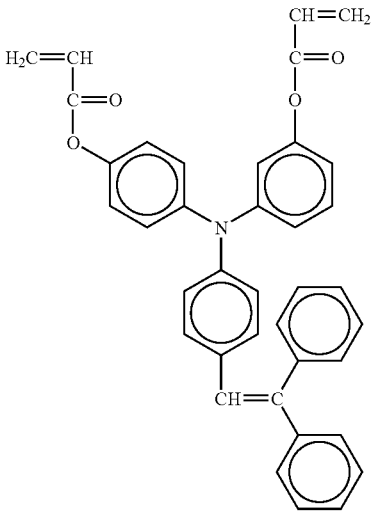
No. 224
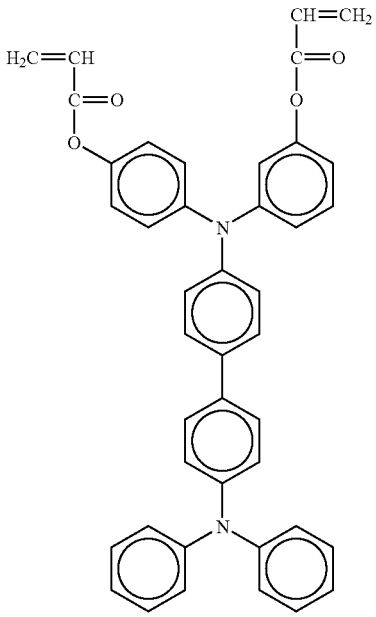
No. 225
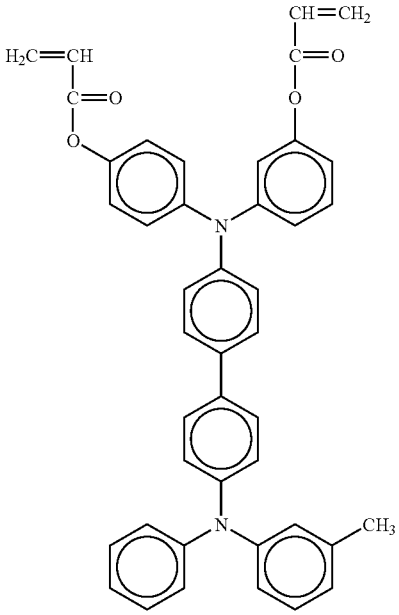
No. 226
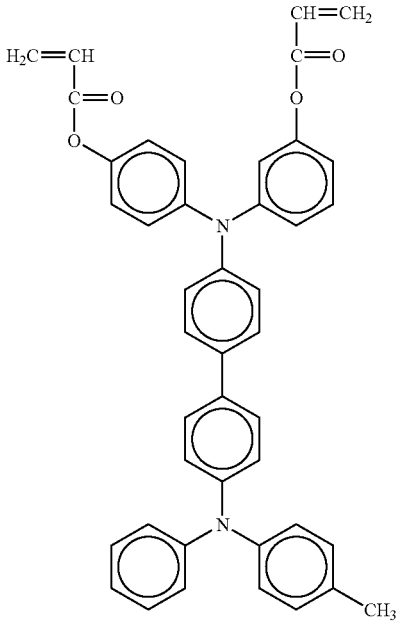
No. 227
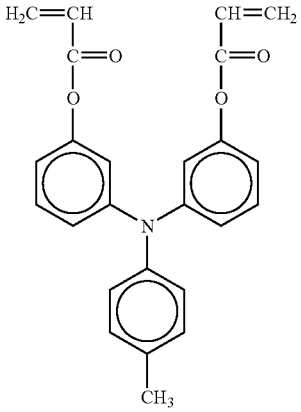
No. 228
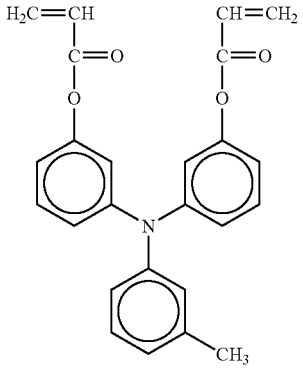

-continued
No. 229
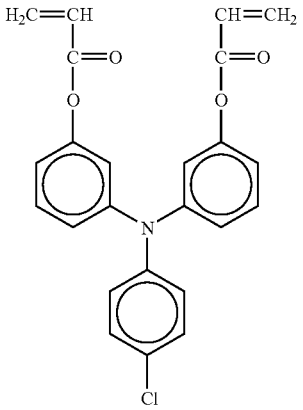
No. 230
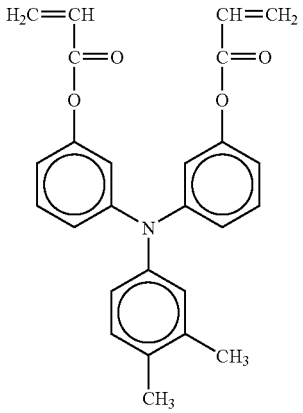
No. 231
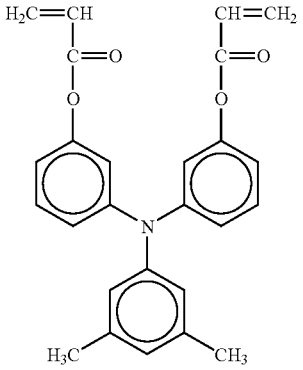
No. 232
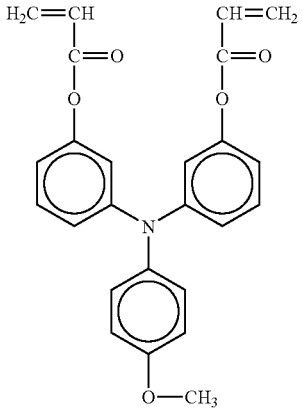
No. 233
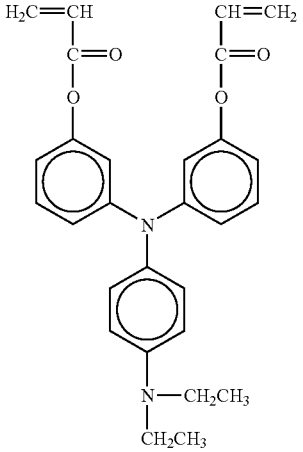
No. 234
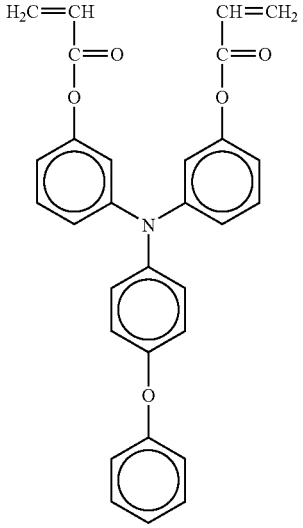

-continued
No. 235
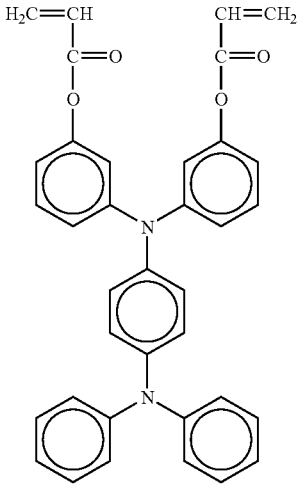
No. 236
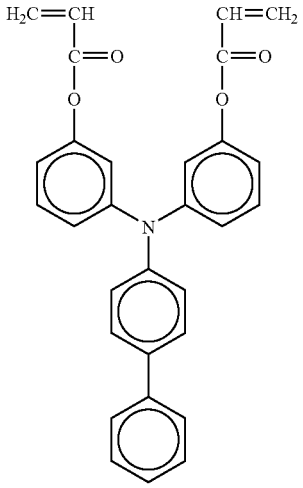
No. 237
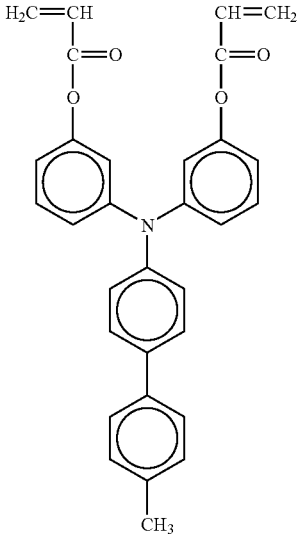
No. 238
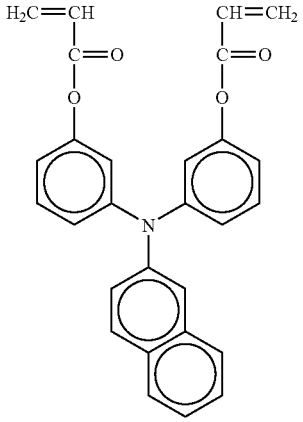
No. 239
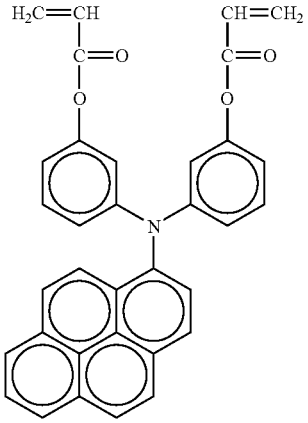
No. 240
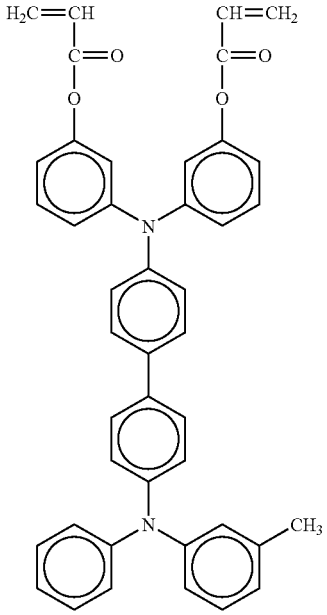

-continued
No. 241
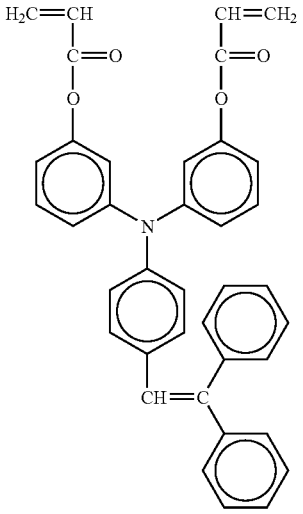
No. 242
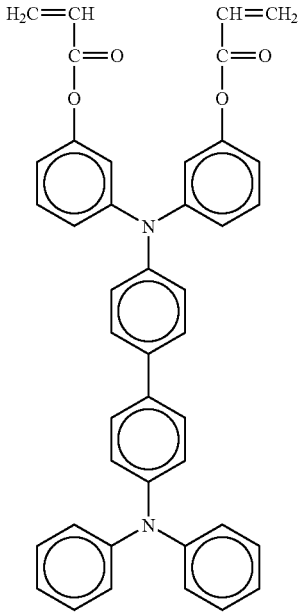
No. 243
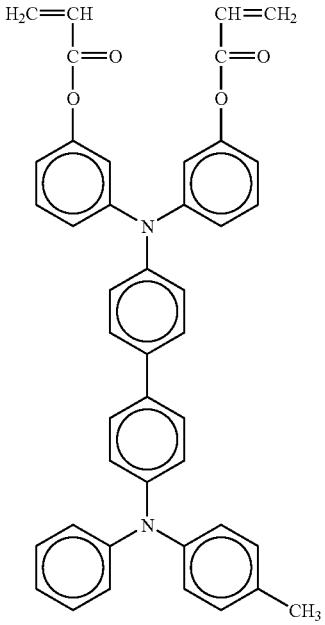
No. 244
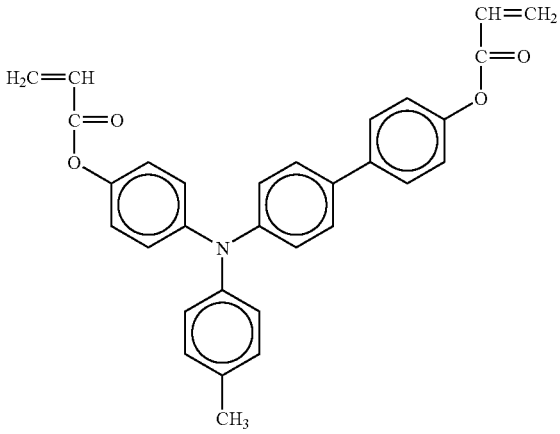
No. 245
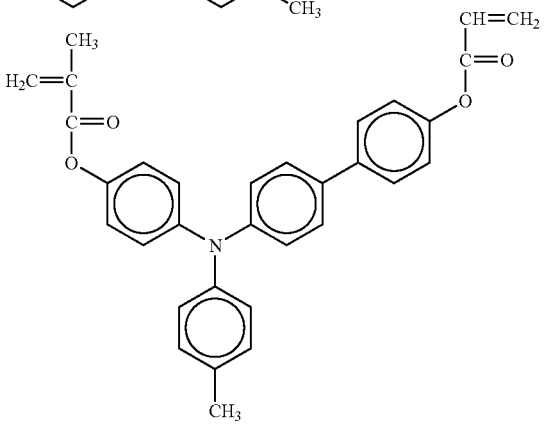
No. 246
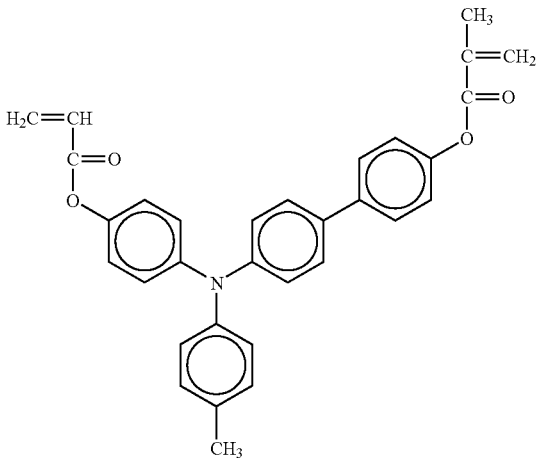

-continued
No. 247
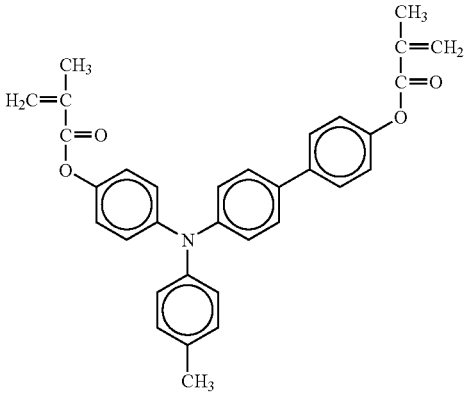
No. 248
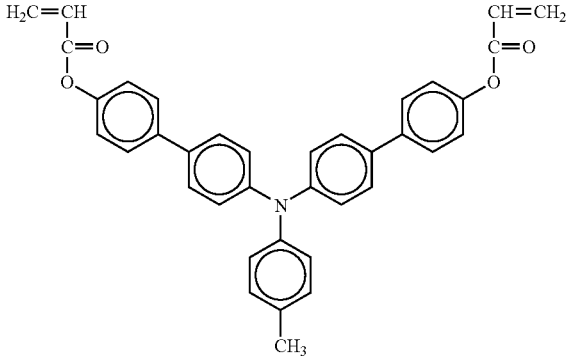
No. 249
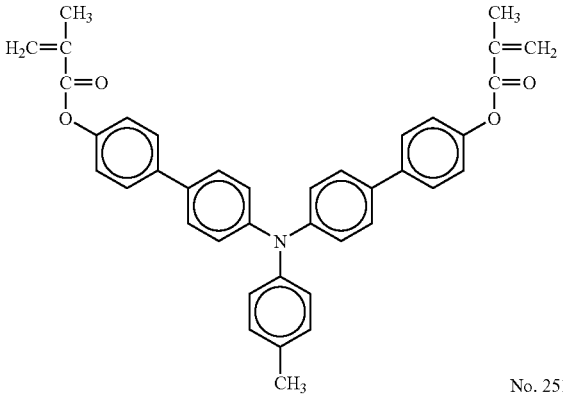
No. 250
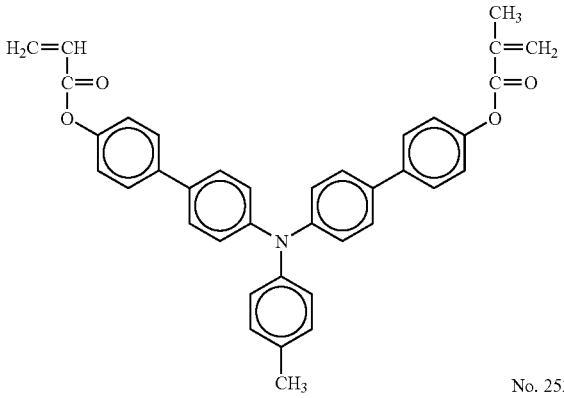
No. 251
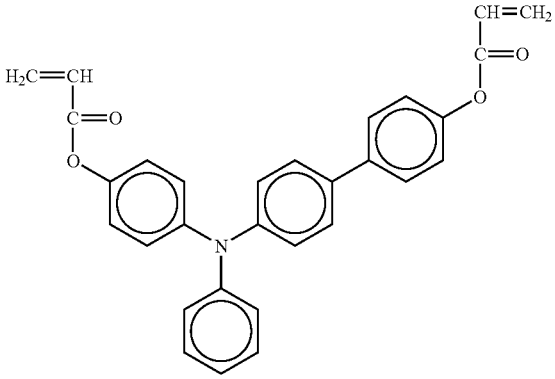
No. 252
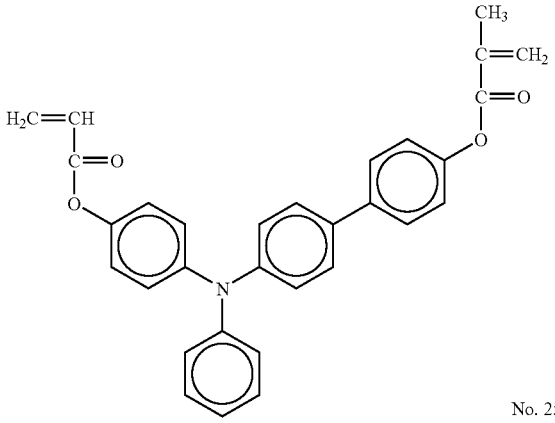
No. 253
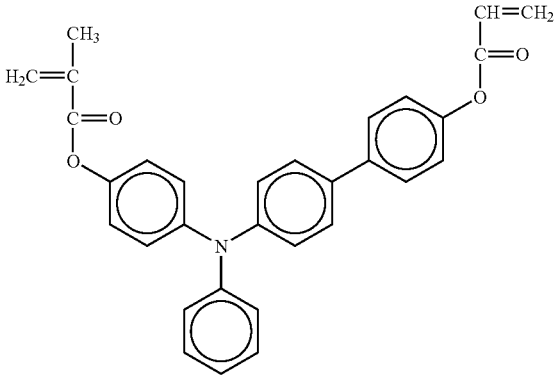
No. 254
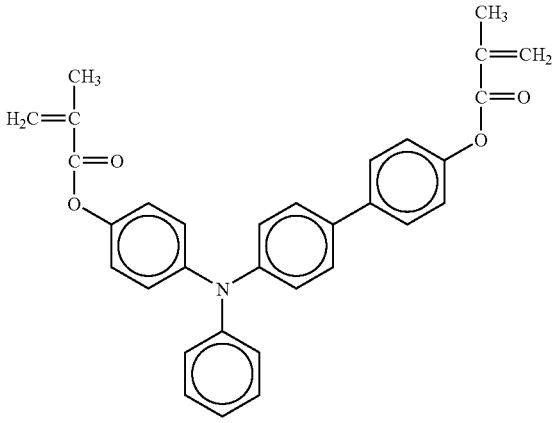

-continued
No. 255
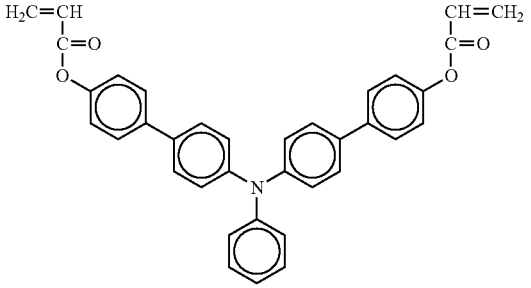
No. 256
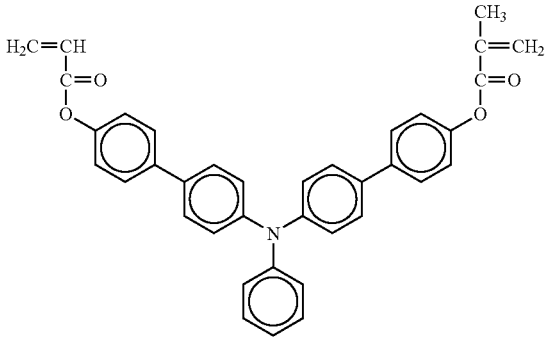
No. 257
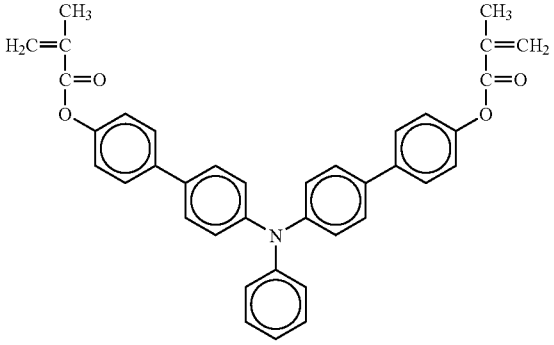
No. 258
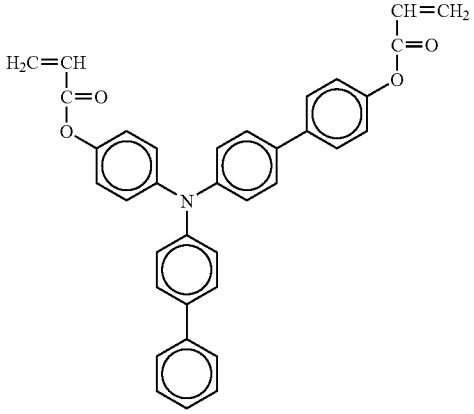
No. 259
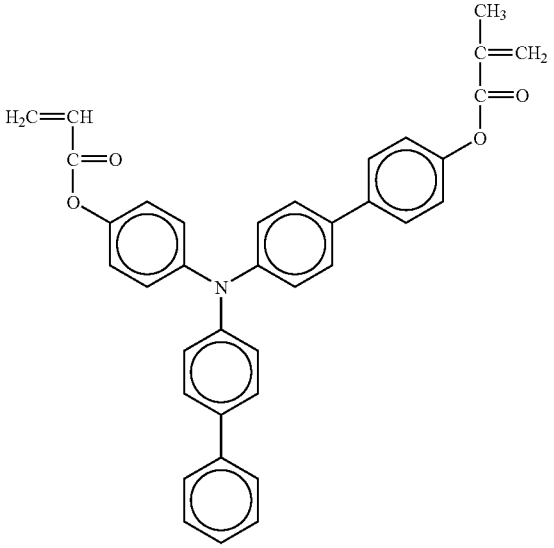
No. 260
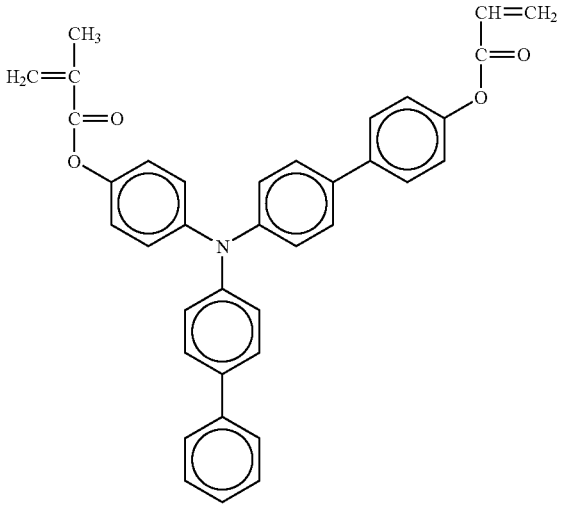

-continued
No. 261
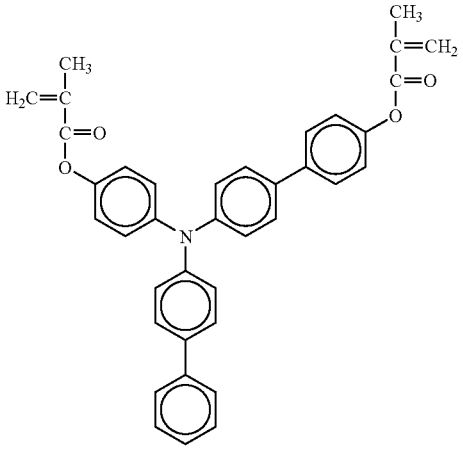
No. 262
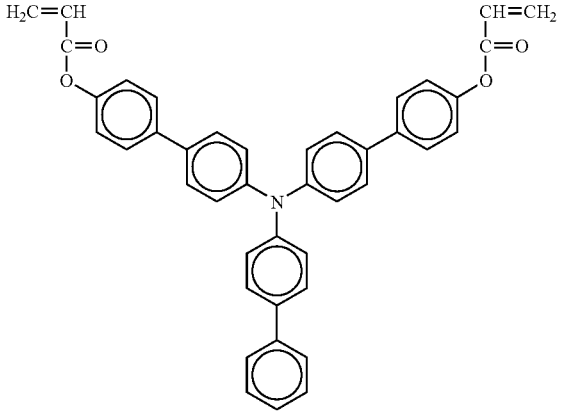
No. 263
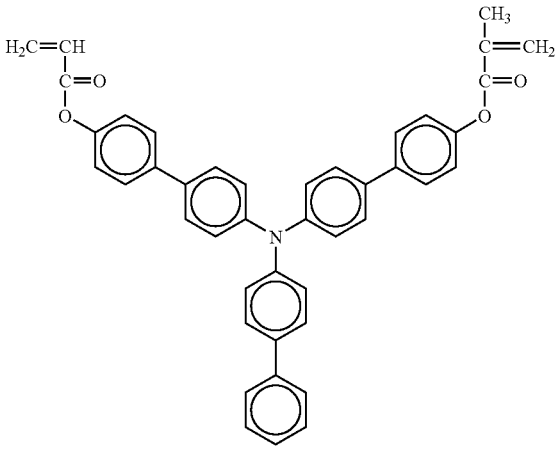
No. 264
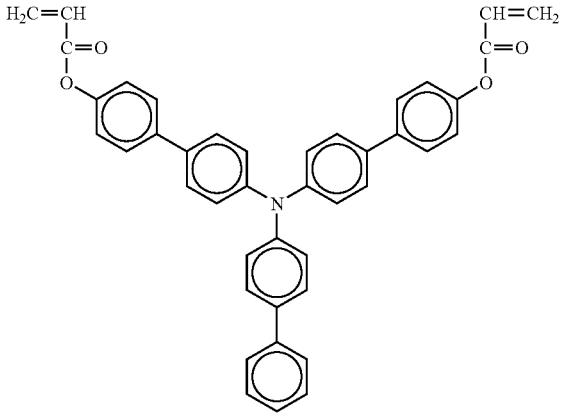
No. 265
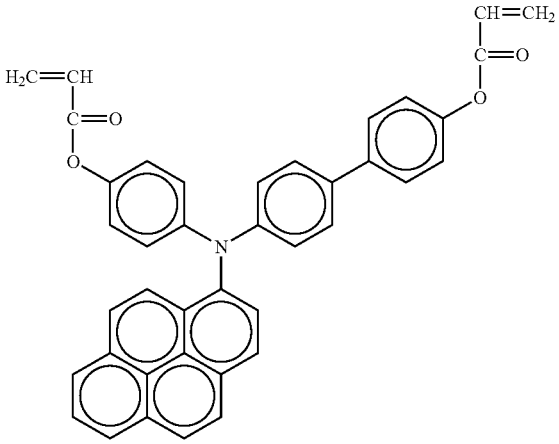
No. 266
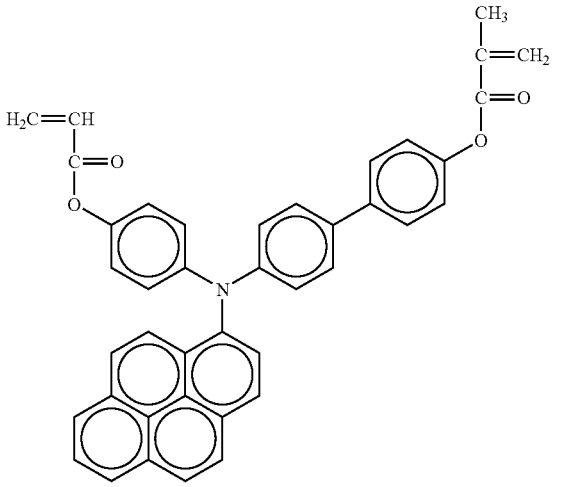

-continued
No. 267
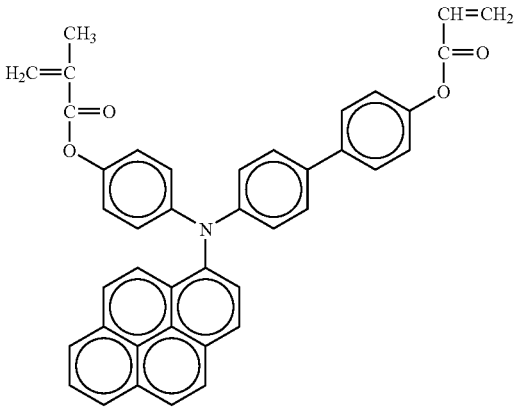
No. 268
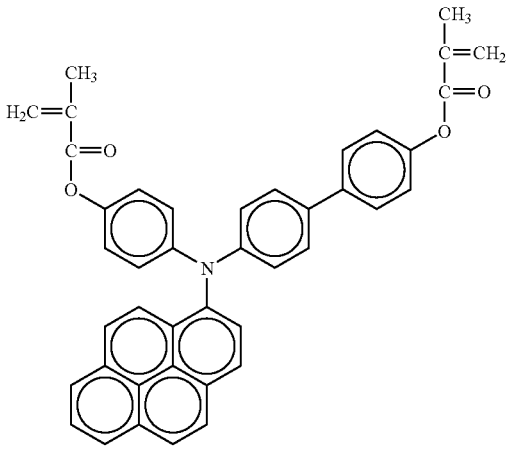
No. 269
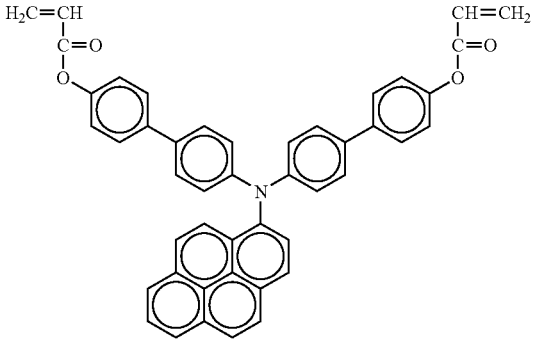
No. 270
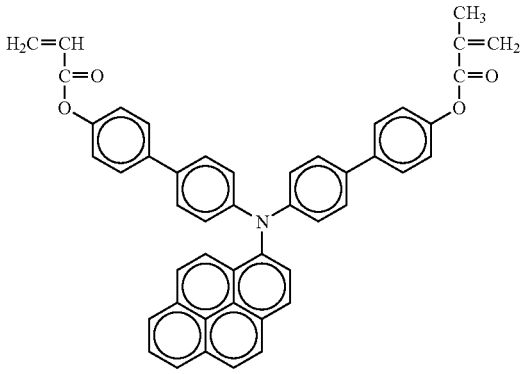
No. 271
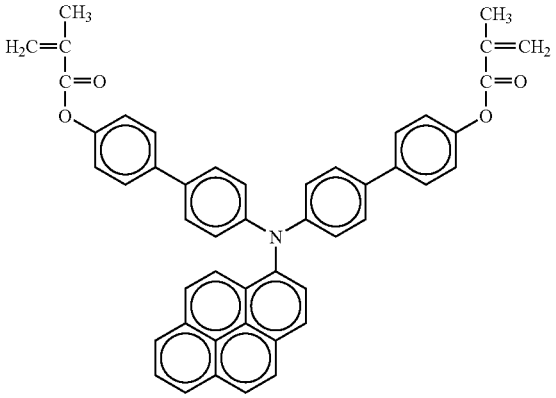
No. 272
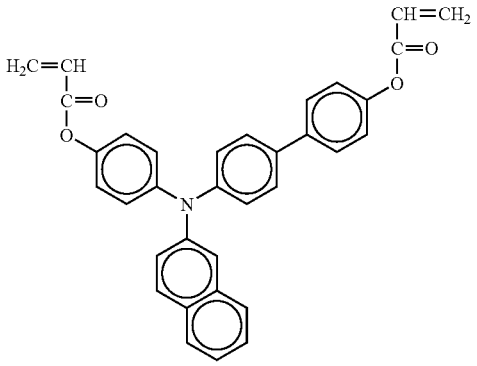

-continued
No. 273
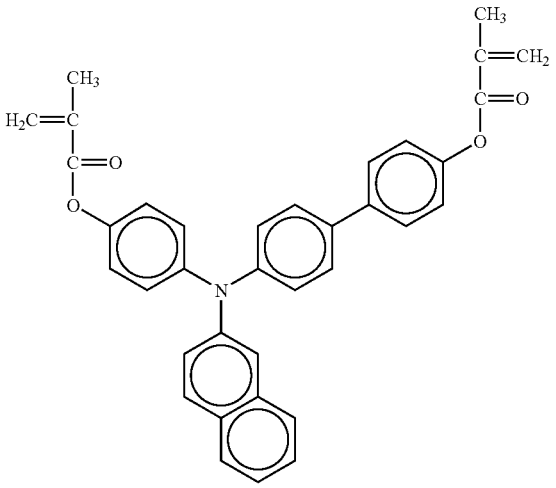
No. 274
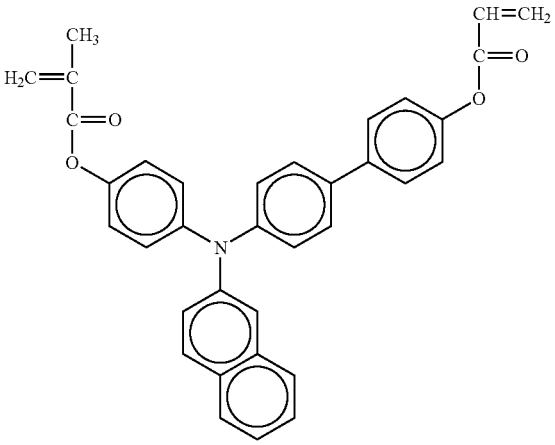
No. 275
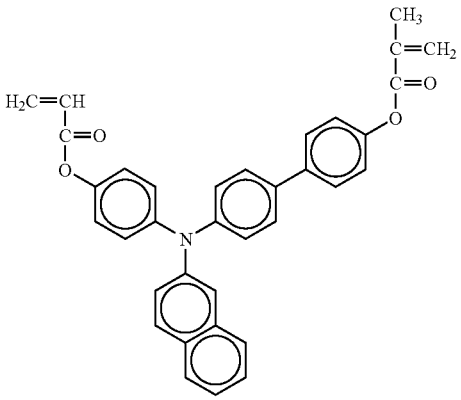
No. 276
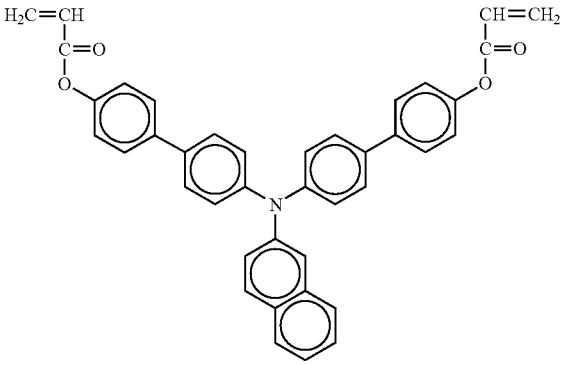
No. 277
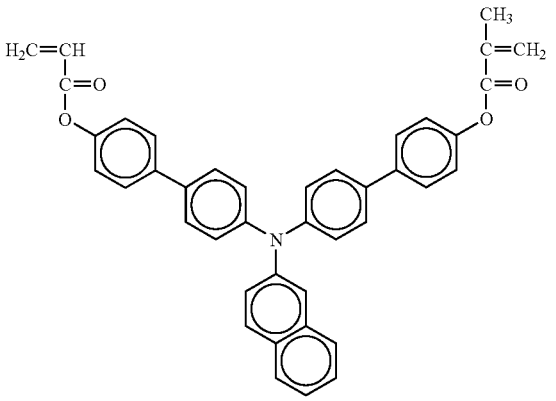
No. 278
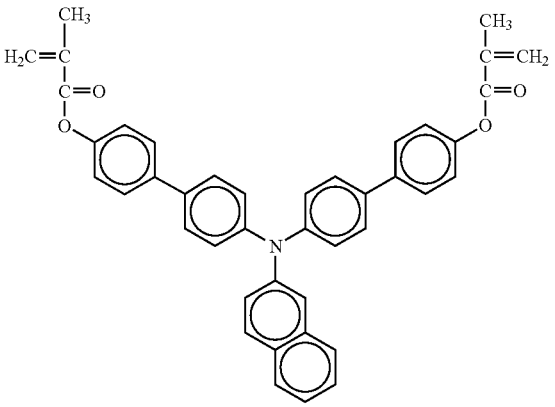

-continued
No. 279
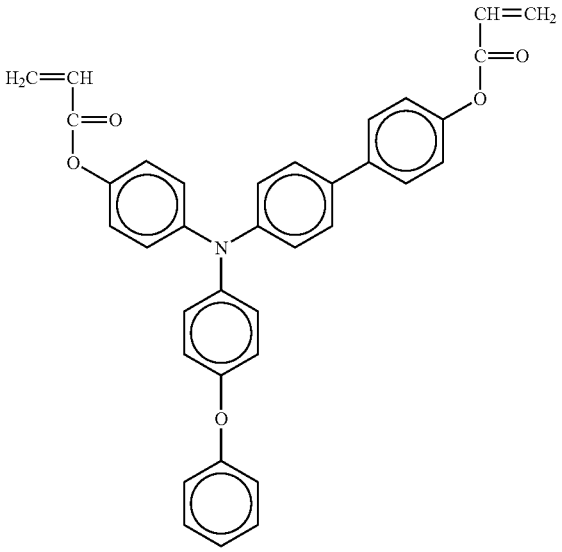
No. 280
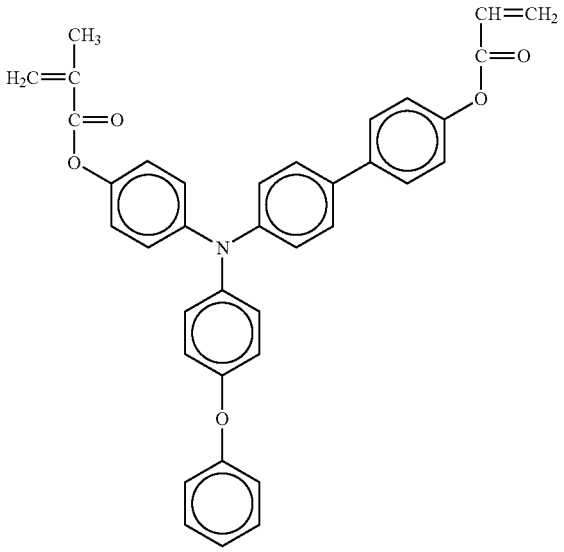
No. 281
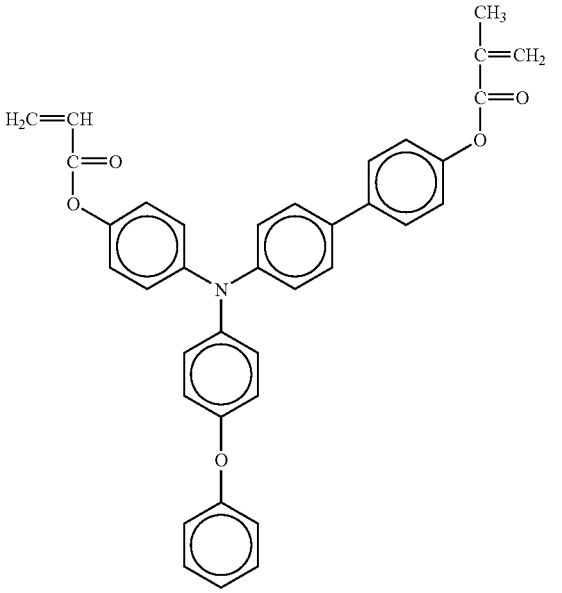
No. 282
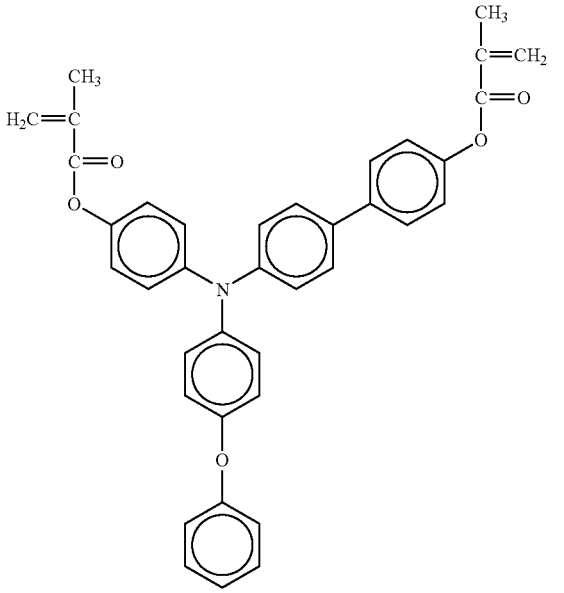
No. 283
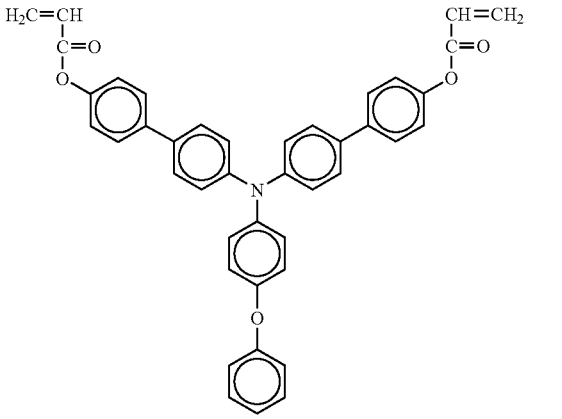
No. 284
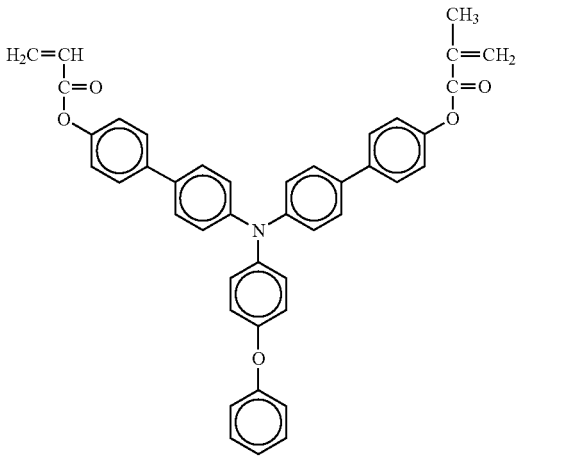

-continued
No. 285
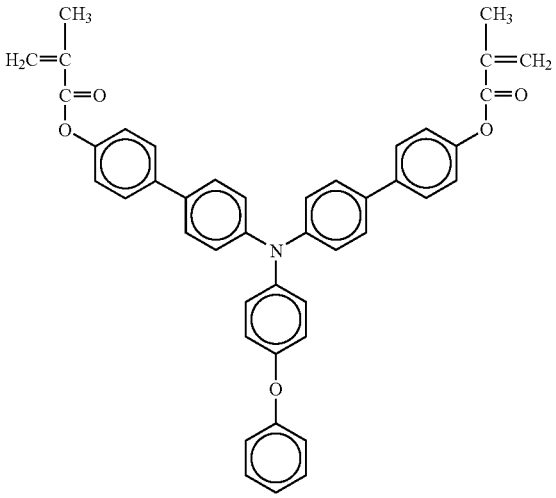
No. 286
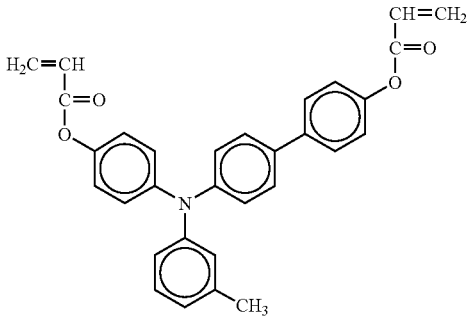
No. 287
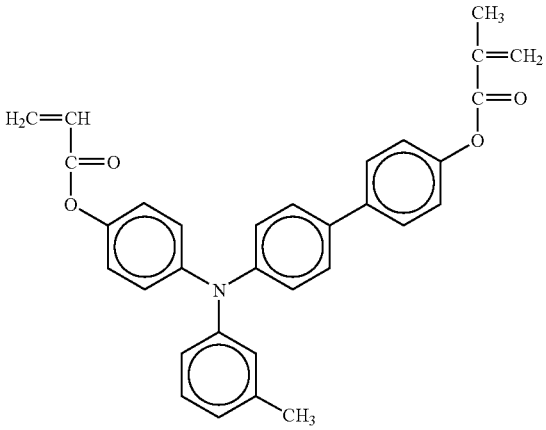
No. 288
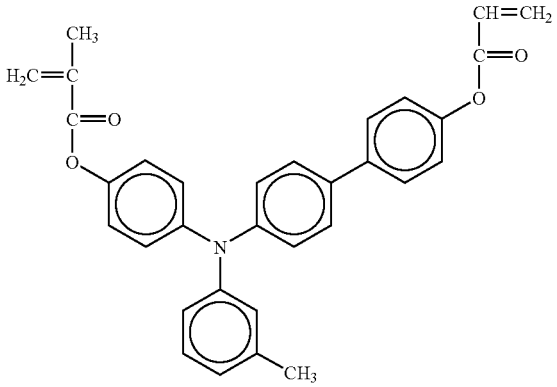
No. 289
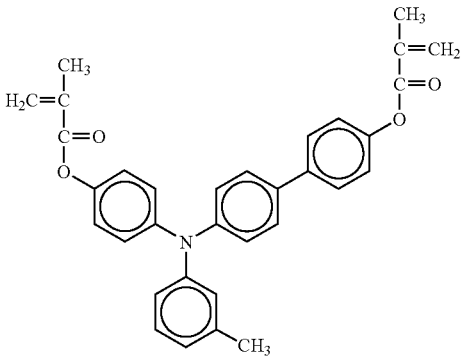
No. 290
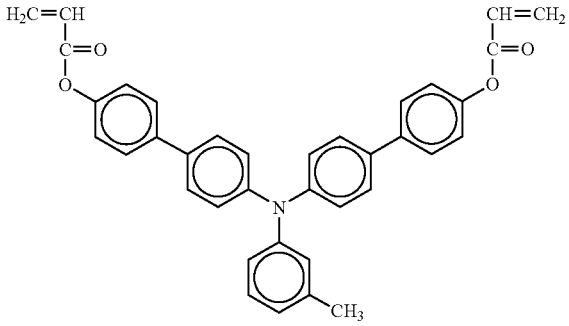

-continued
No. 291
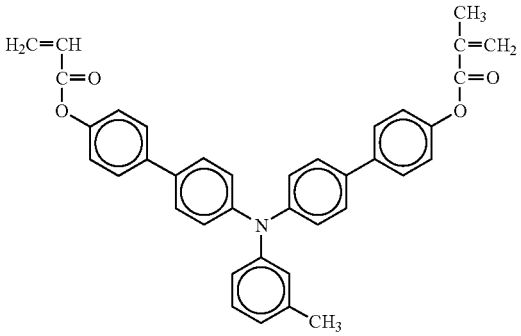
No. 292
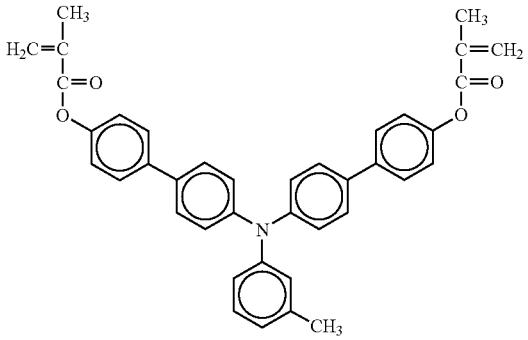
No. 293
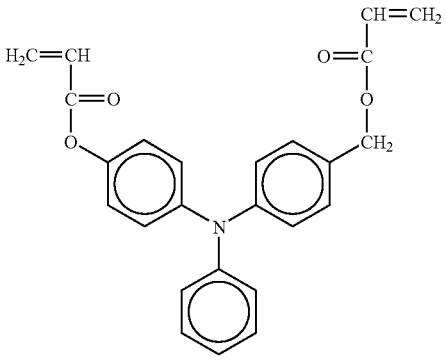
No. 294
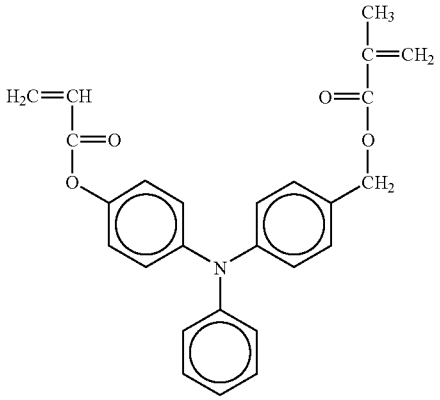
No. 295
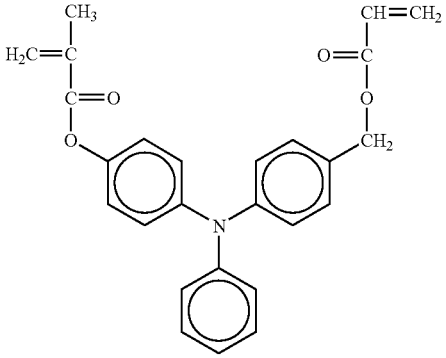
No. 296
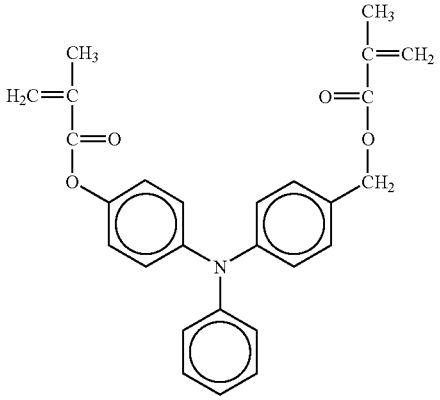
No. 297
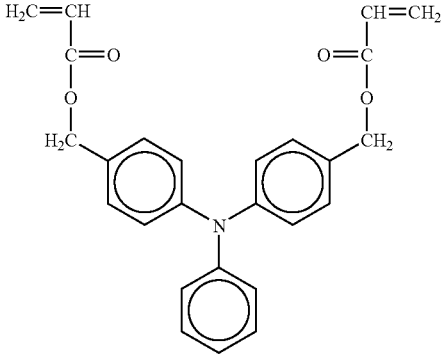
No. 298
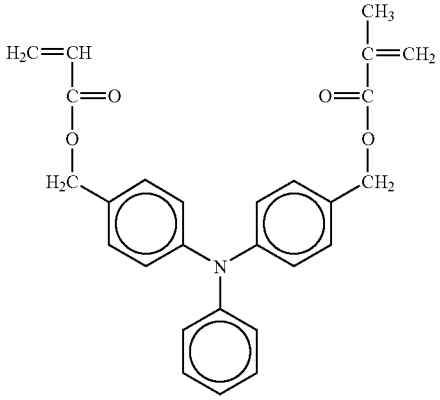

-continued
No. 299
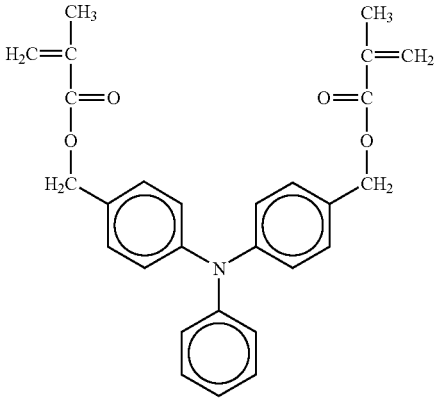
No. 300
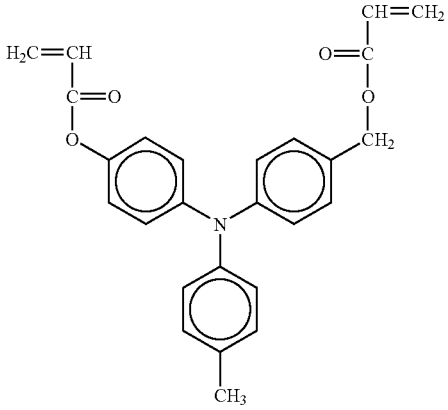
No. 301
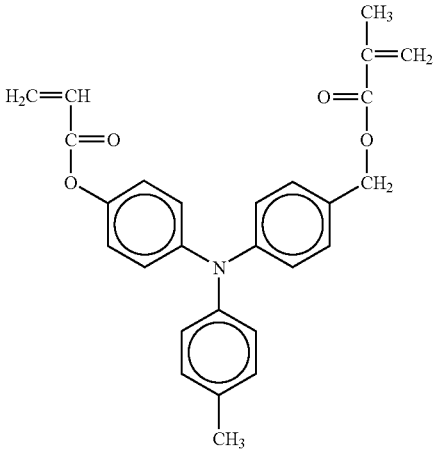
No. 302
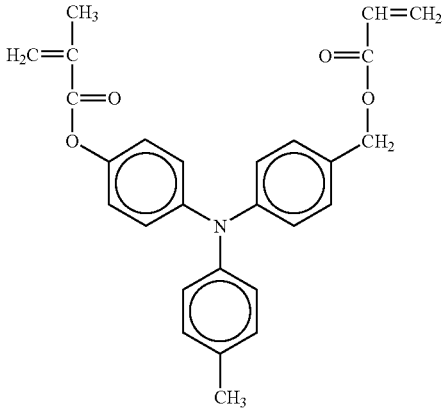
No. 303
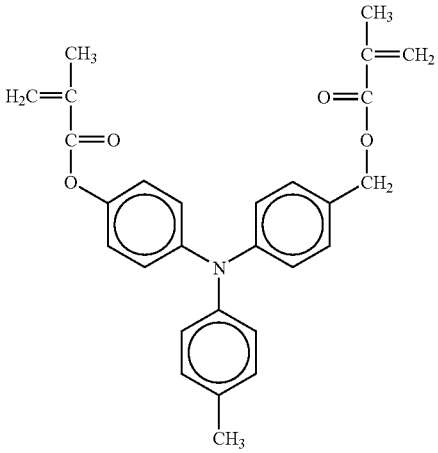
No. 304
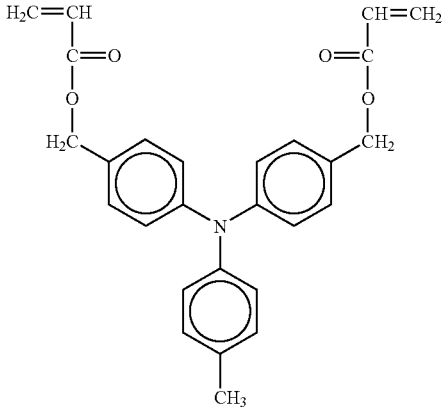

-continued
No. 305
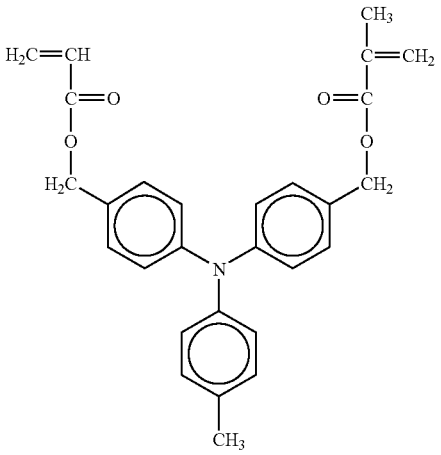
No. 306
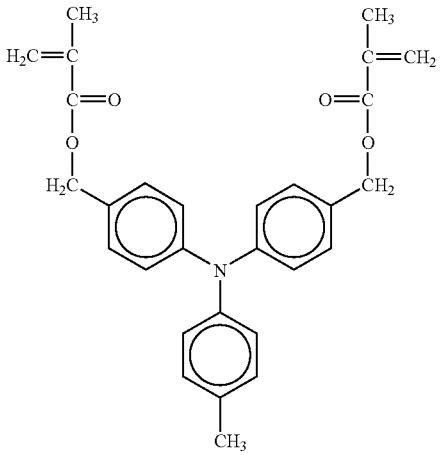
No. 307
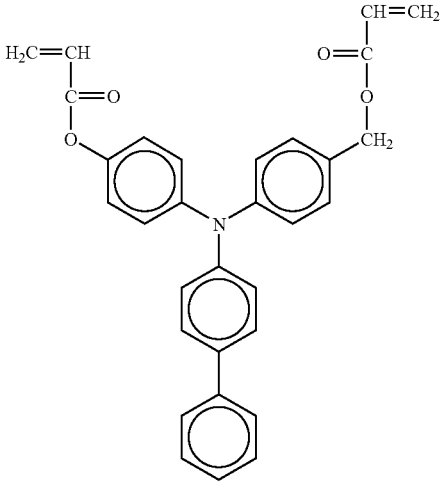
No. 308
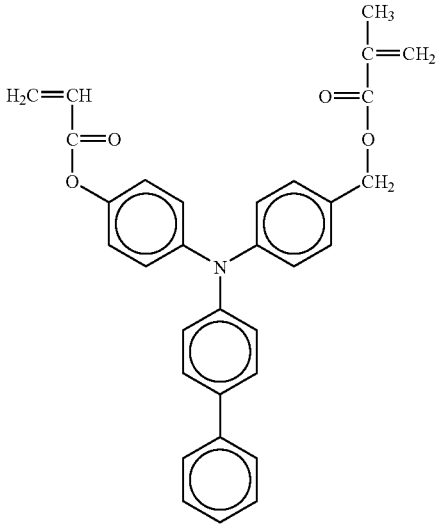
No. 309
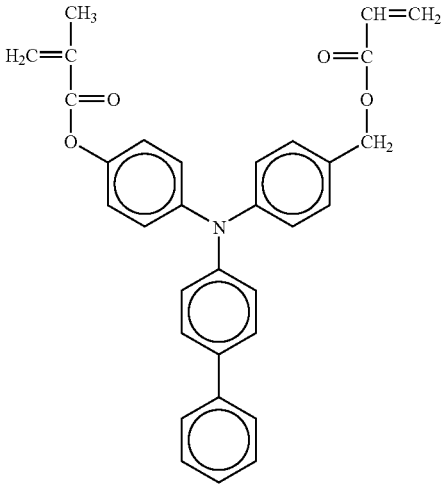
No. 310
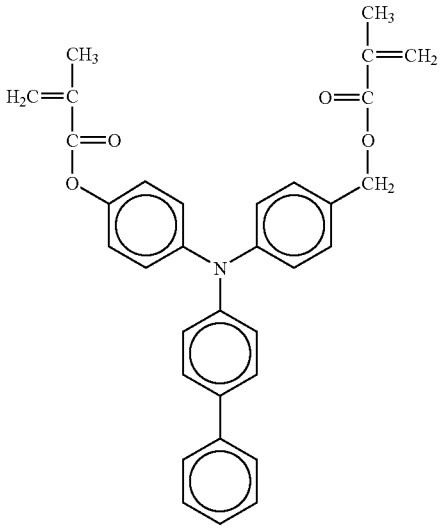

-continued
No. 311
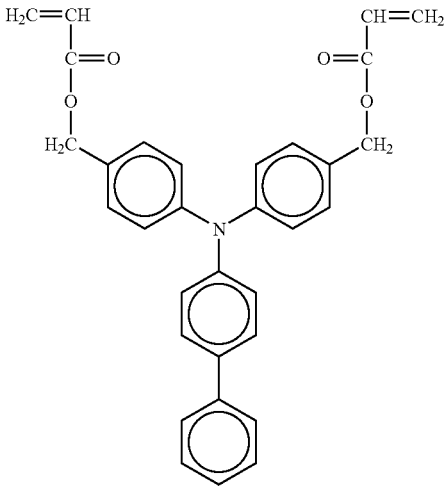
No. 312
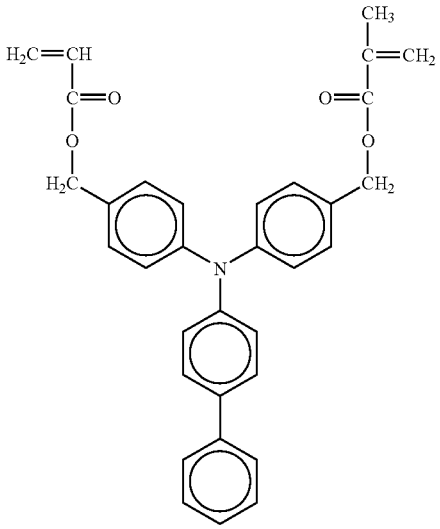
No. 313
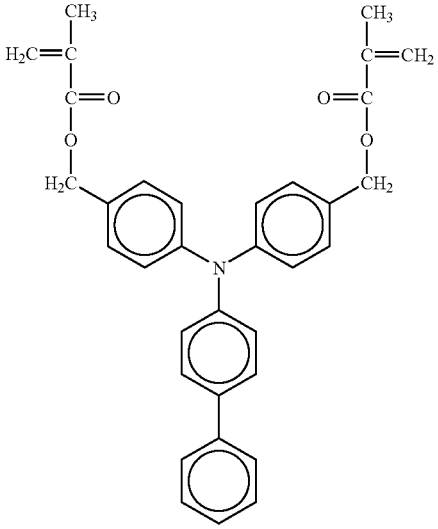
No. 314
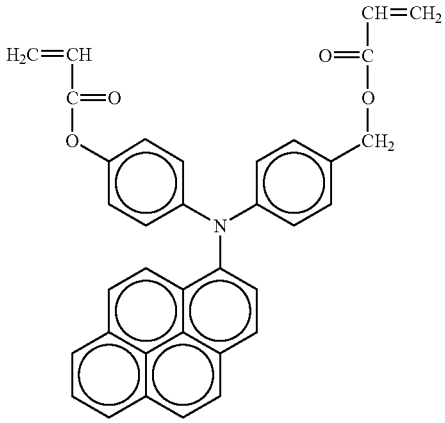
No. 315
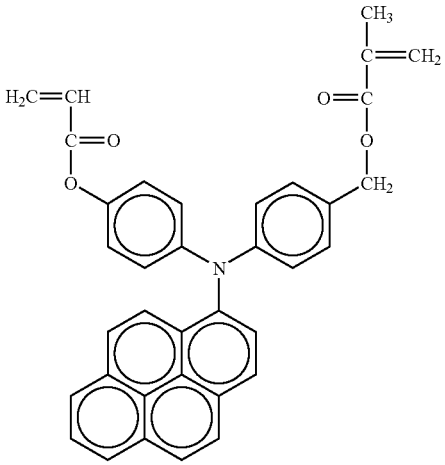
No. 316
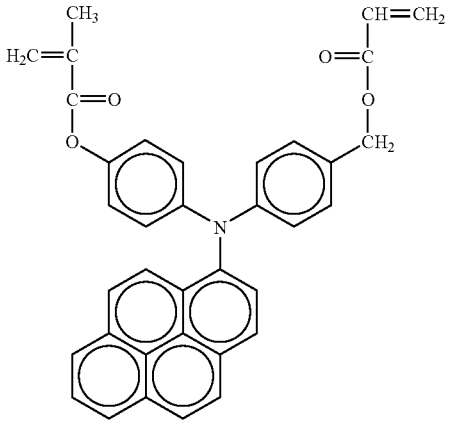

-continued
No. 317
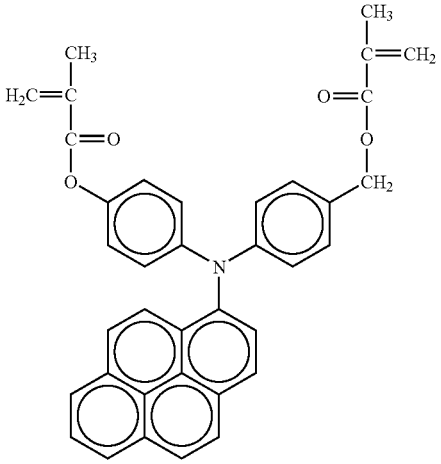
No. 318
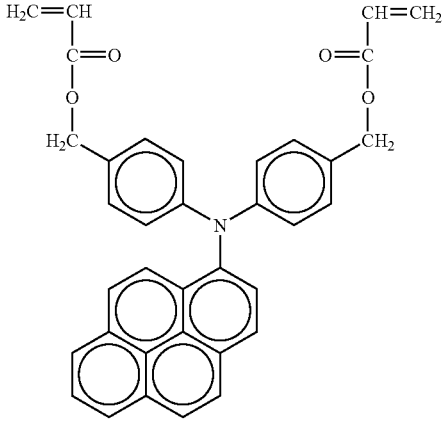
No. 319
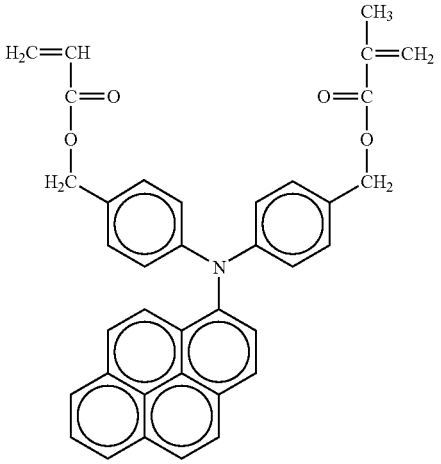
No. 320
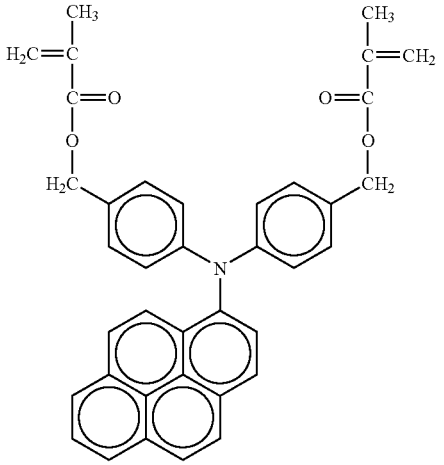
No. 321
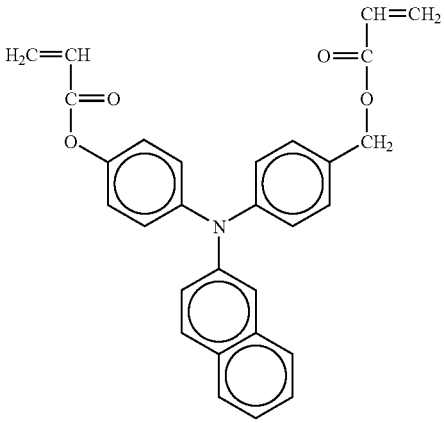
No. 322
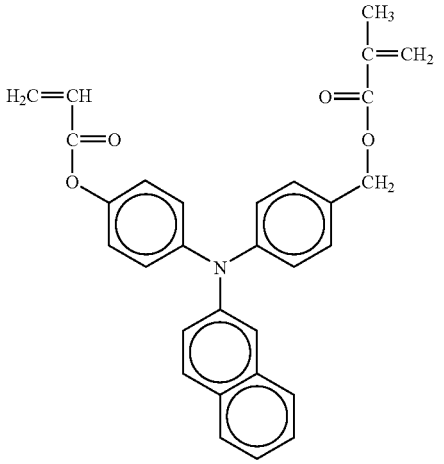

-continued
No. 323
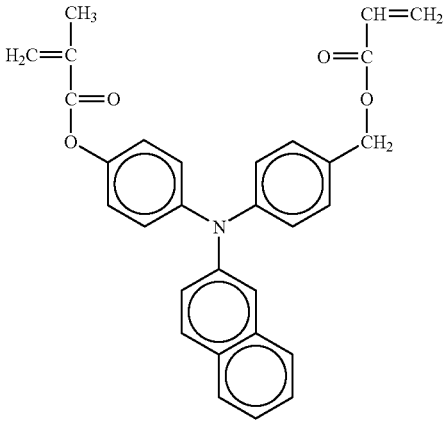
No. 324
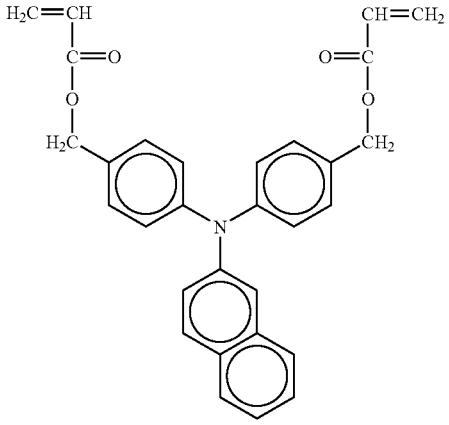
No. 325
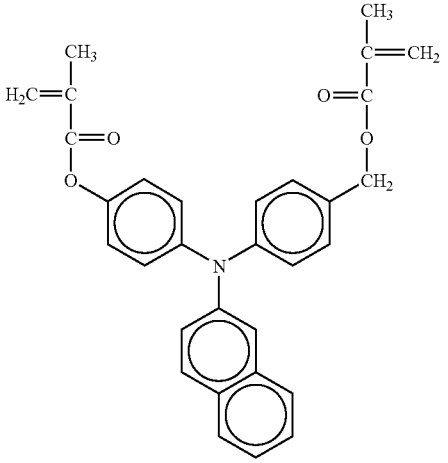
No. 326
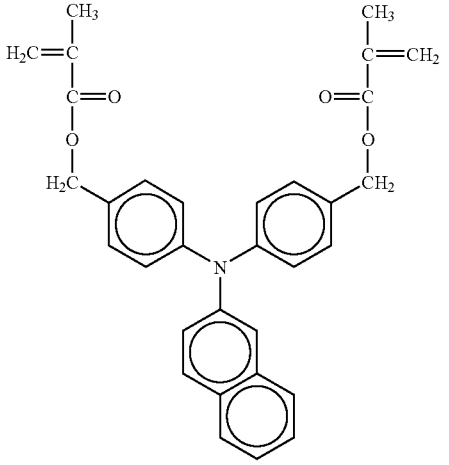
No. 327
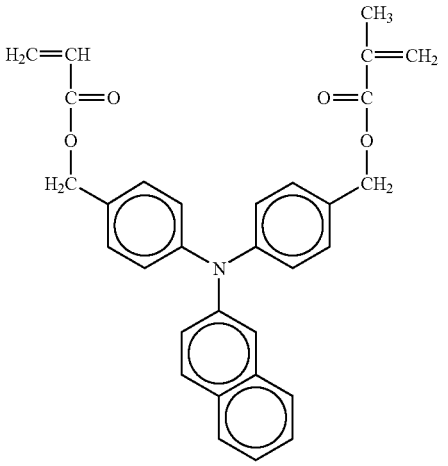
No. 328
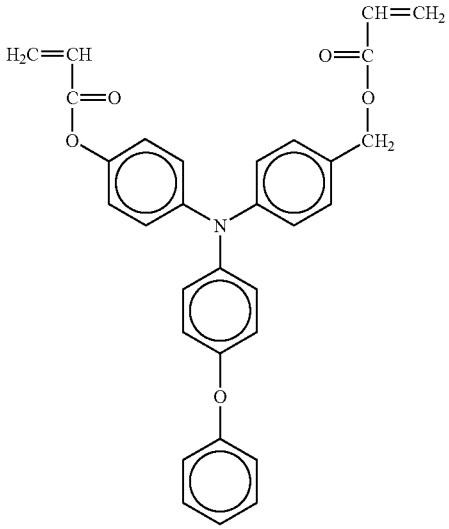

-continued
No. 329
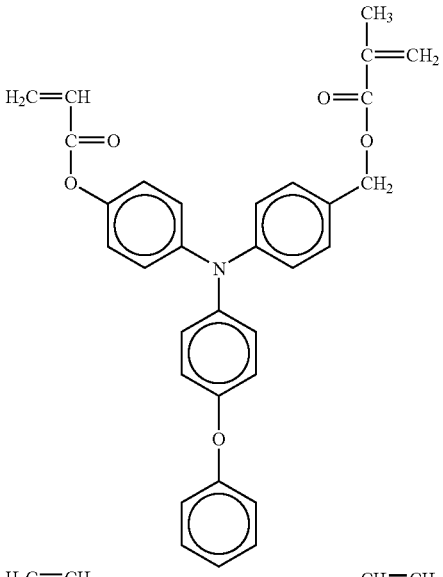
No. 330
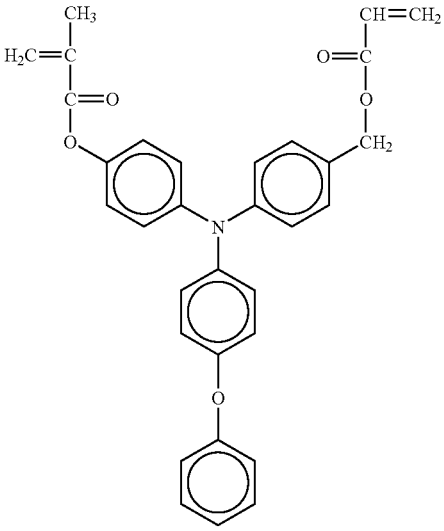
No. 331
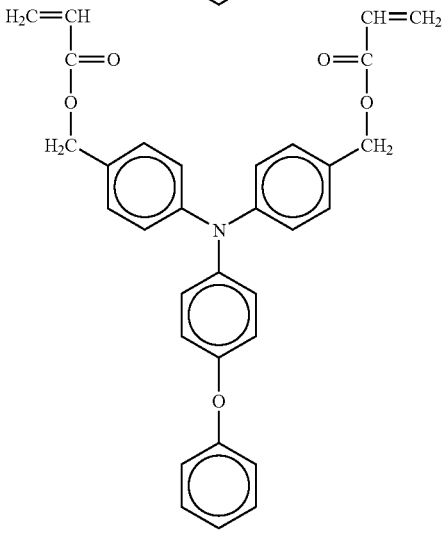
No. 332
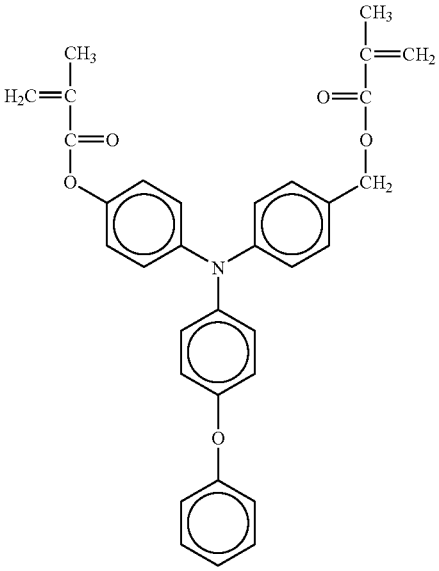
No. 333
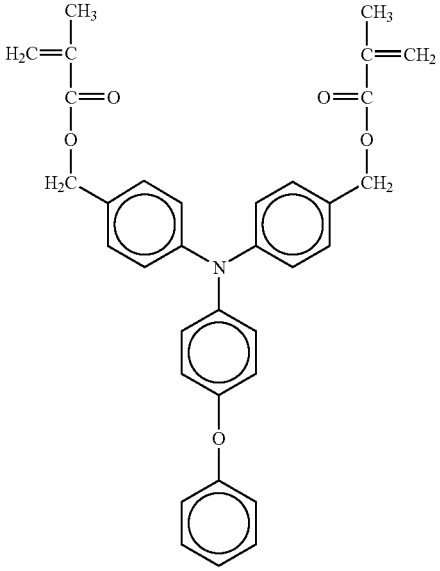
No. 334
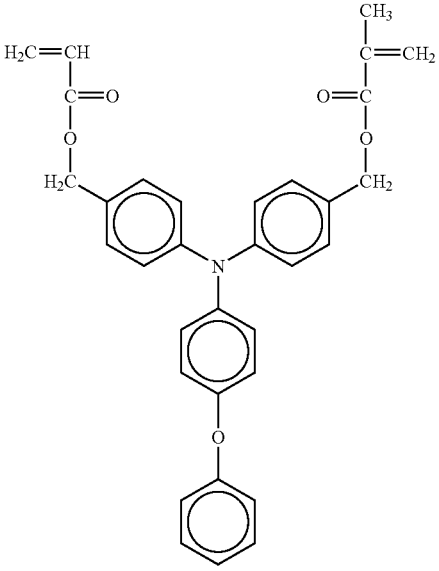

-continued
No. 335
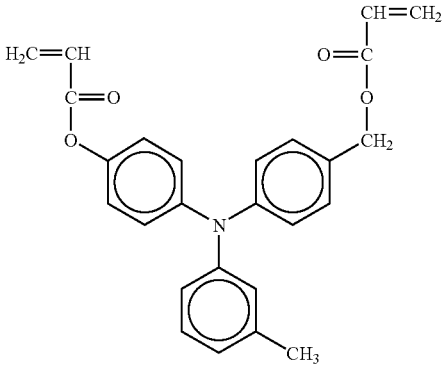
No. 336
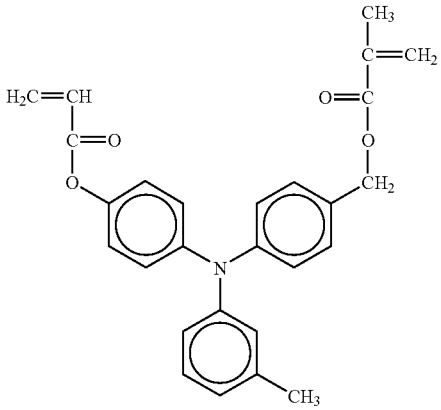
No. 337
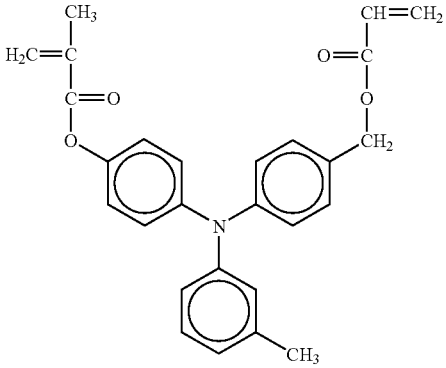
No. 338
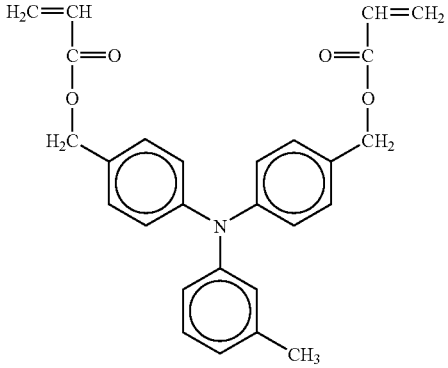
No. 339
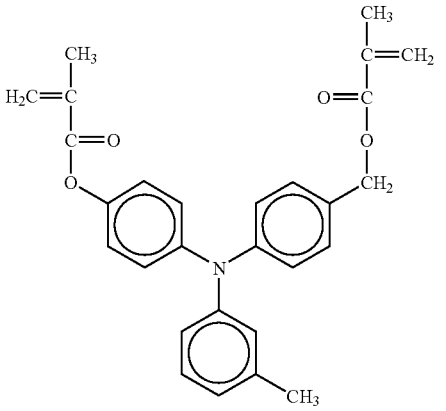
No. 340
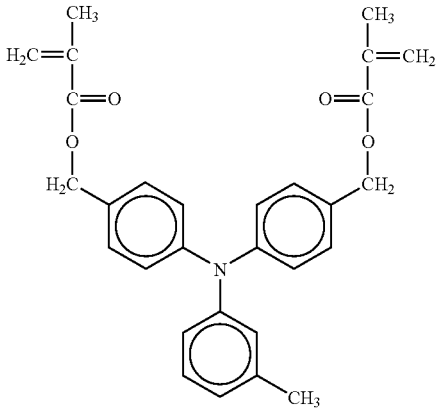
No. 341
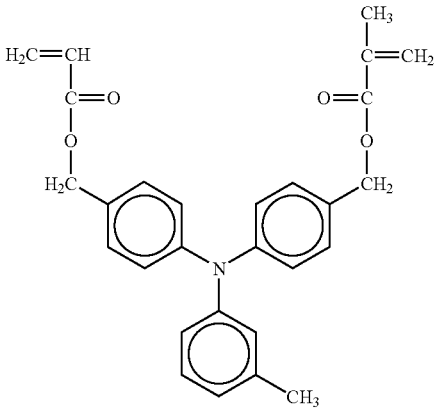
No. 342
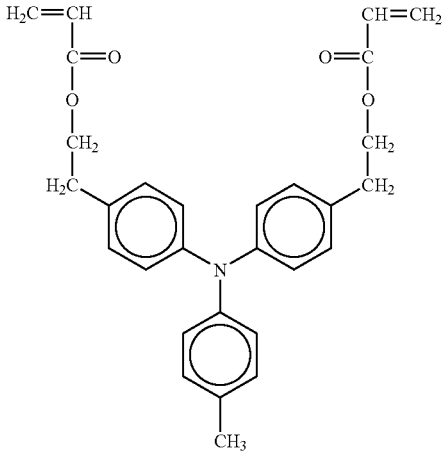

-continued
No. 343
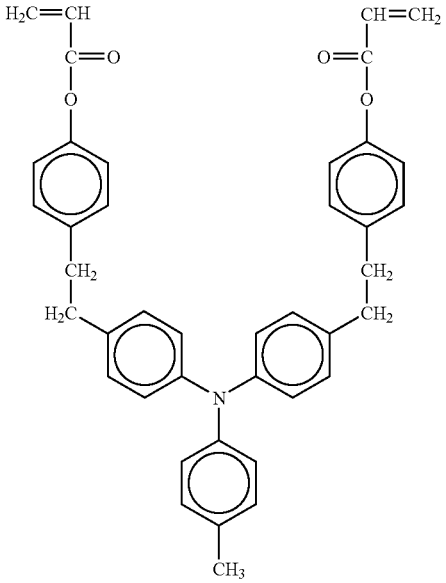
No. 344
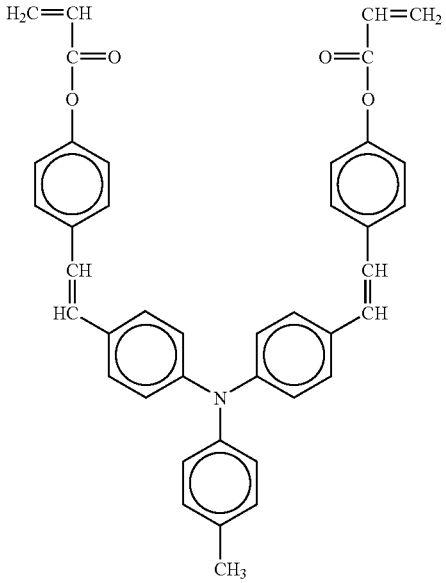
No. 345
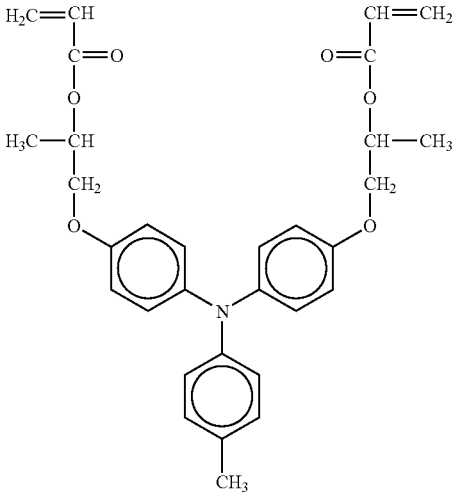
No. 346
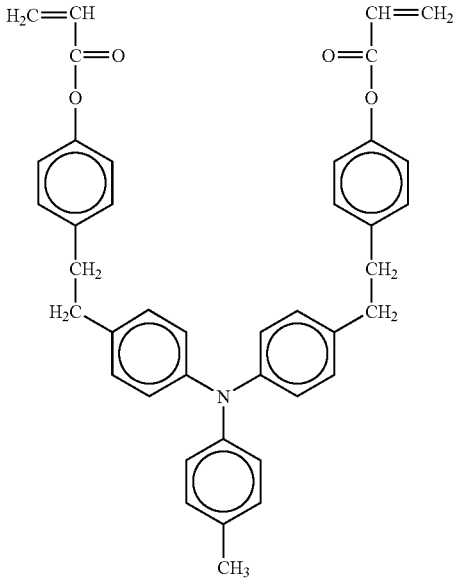
No. 347
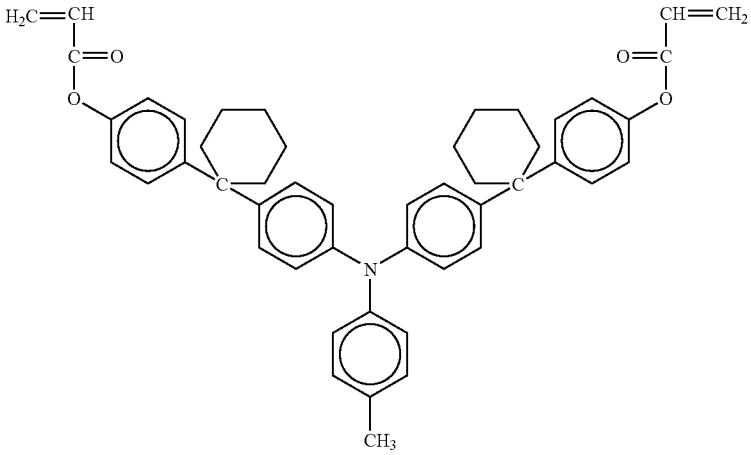

-continued
No. 348
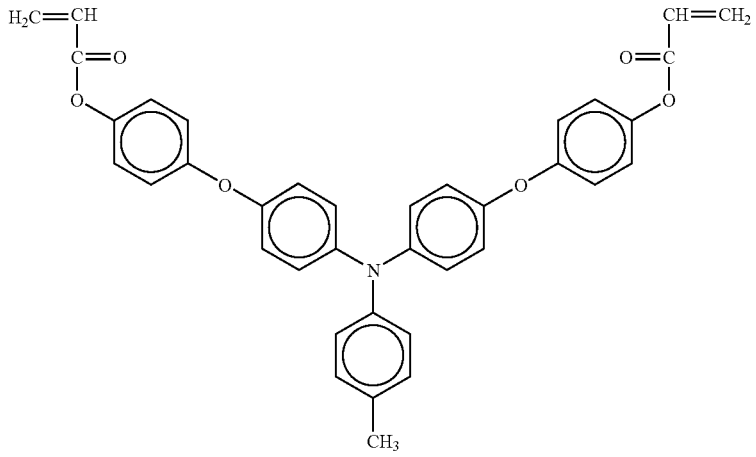
No. 349
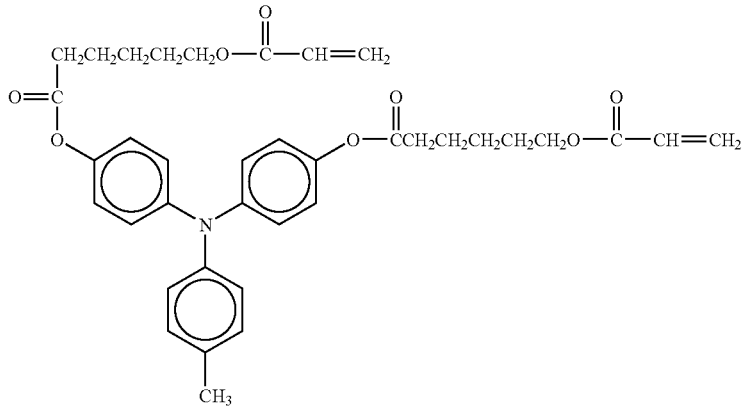
No. 350
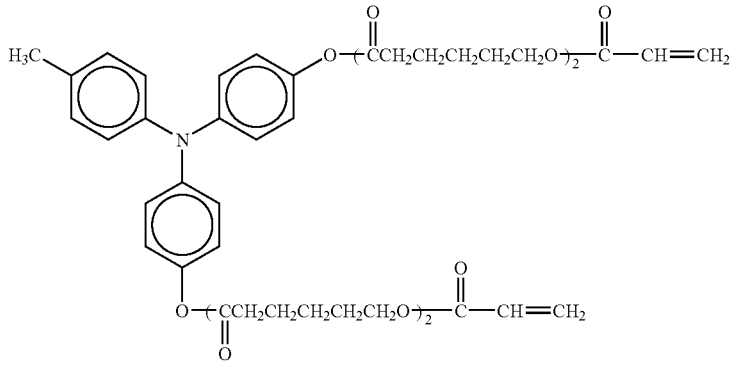

-continued
No. 351
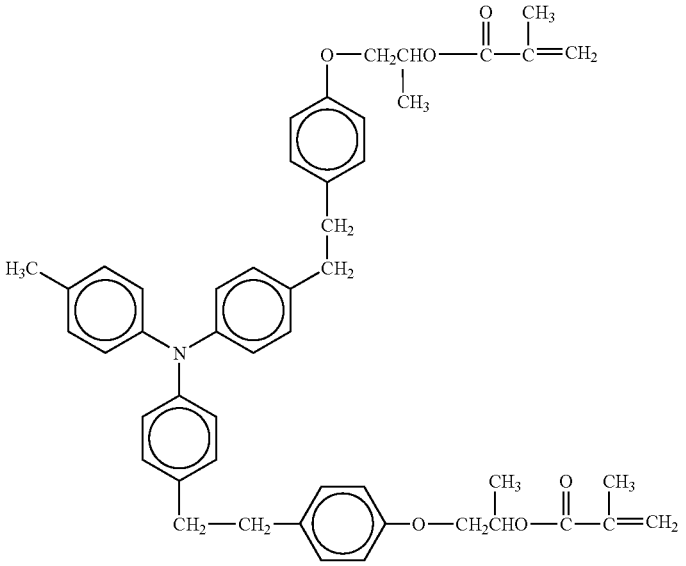
No. 352
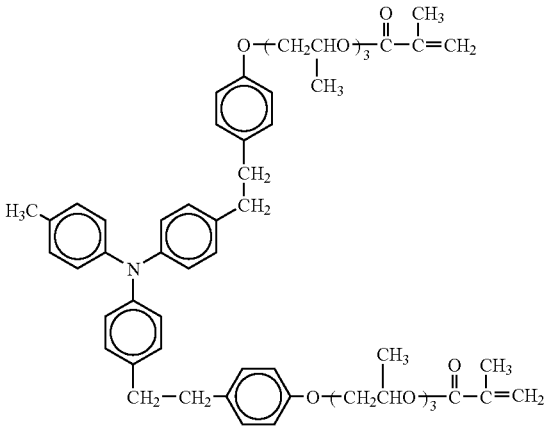
No. 353
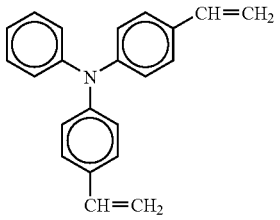
No. 354
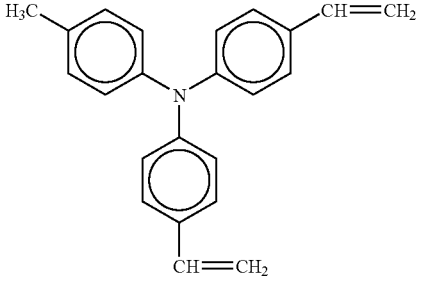
No. 355
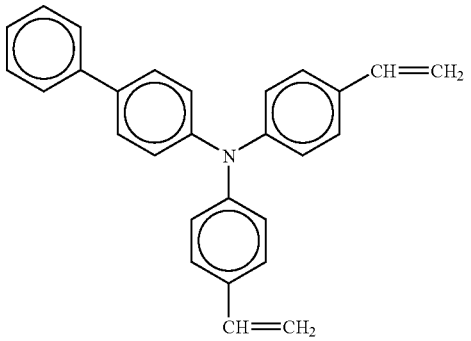

-continued
No. 356
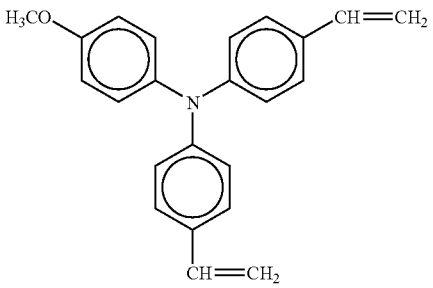
No. 357
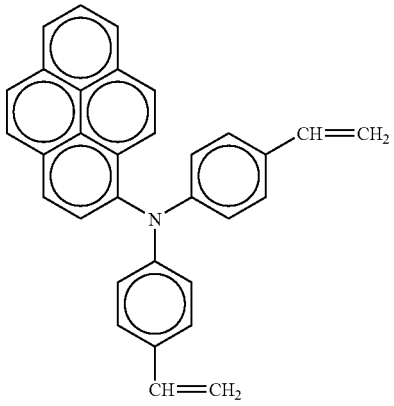
No. 358
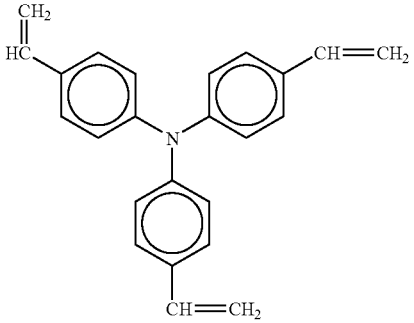
No. 359
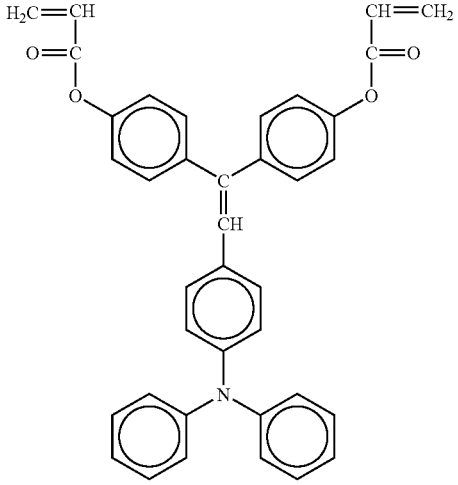
No. 360
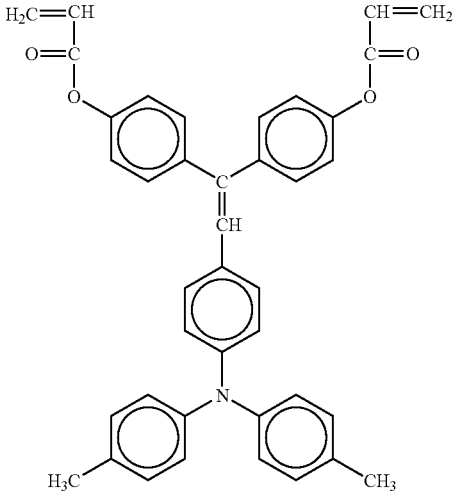
No. 361
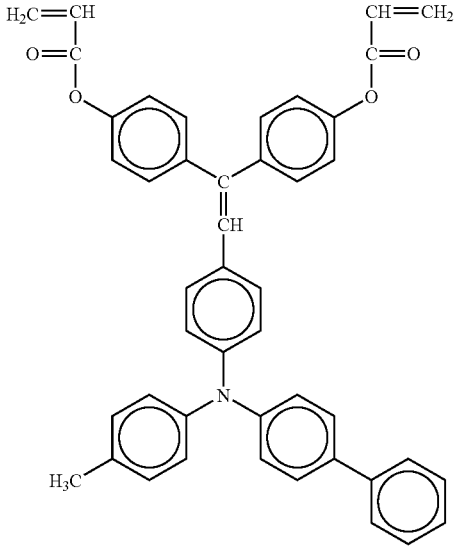

-continued
No. 362
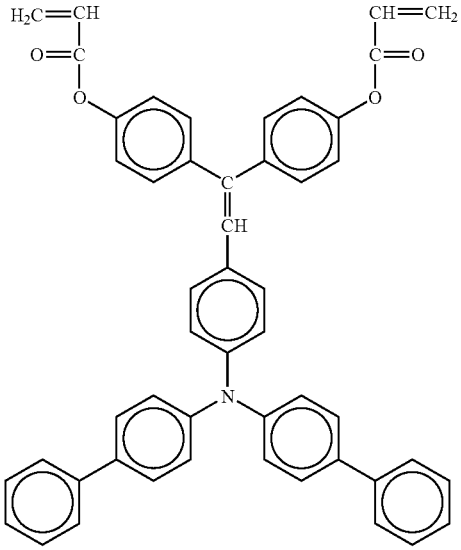
No. 363
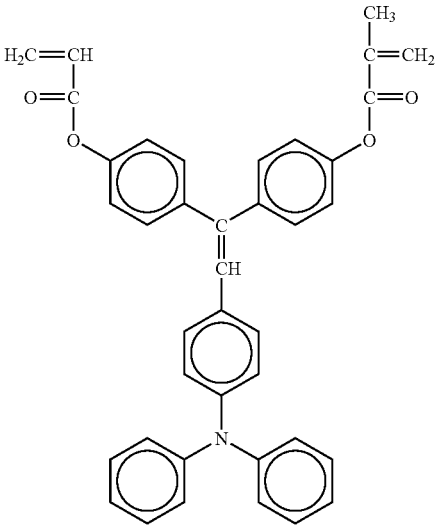
Specific examples of the radically polymerizable trifunctional compound having a charge transporting structure are described below, however, the radically polymerizable trifunctional compound having a charge transporting structure is not limited to compounds each having any one of the following structures.
No. 364
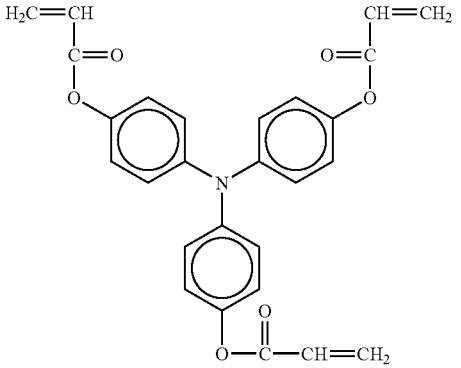
No. 365
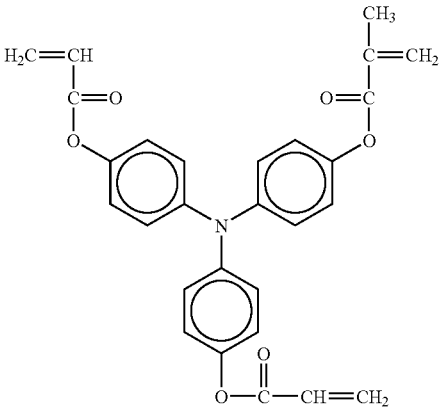
No. 366
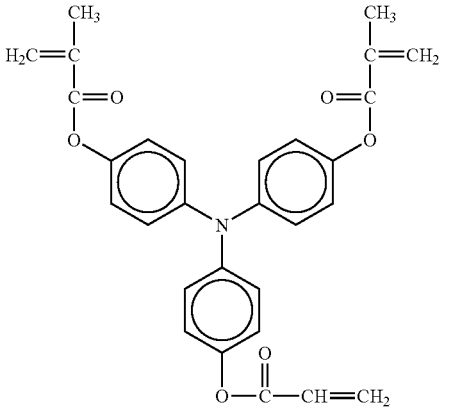
No. 367
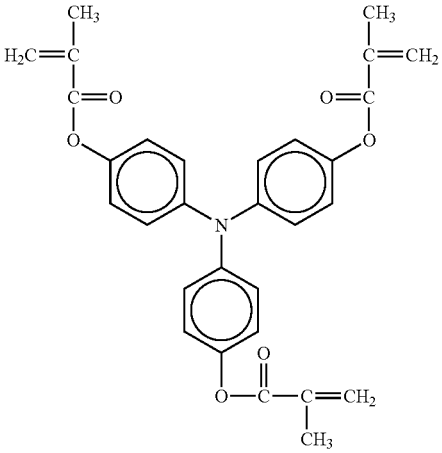

-continued
No. 368
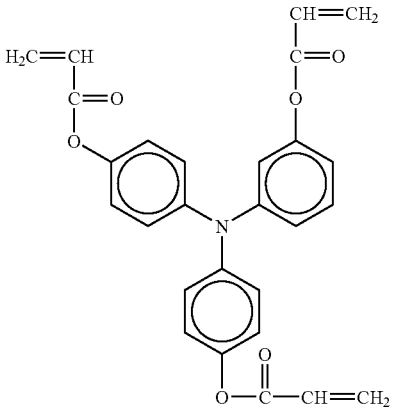
No. 369
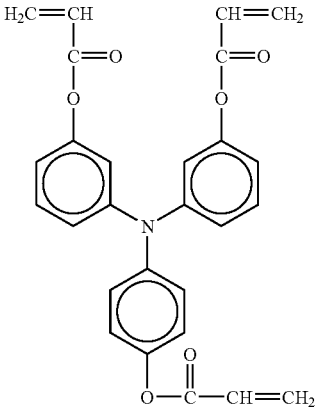
No. 370
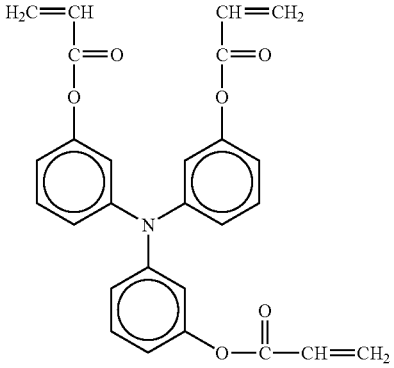
No. 371
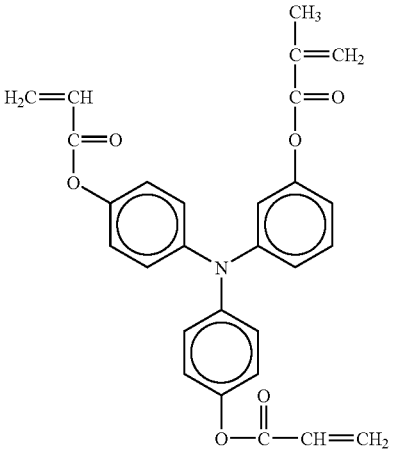
No. 372
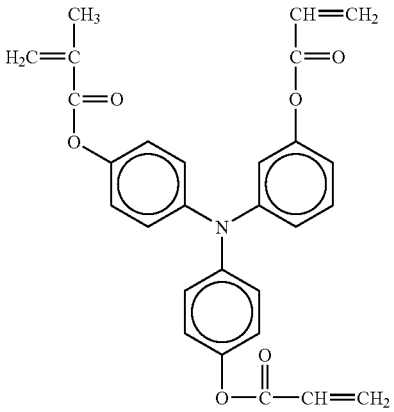
No. 373
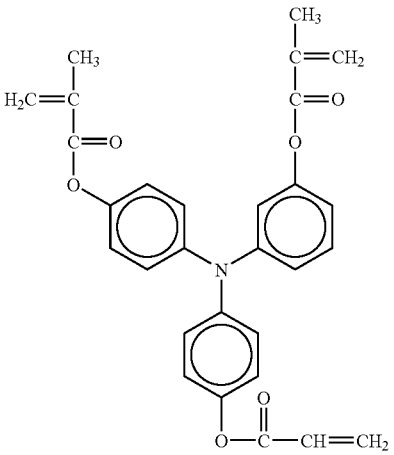

-continued
No. 374
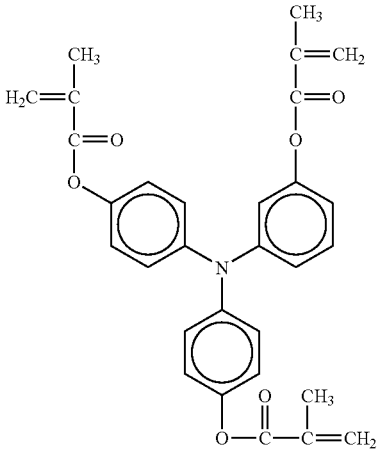
No. 375
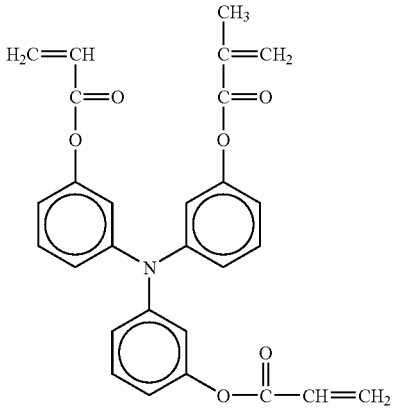
No. 376
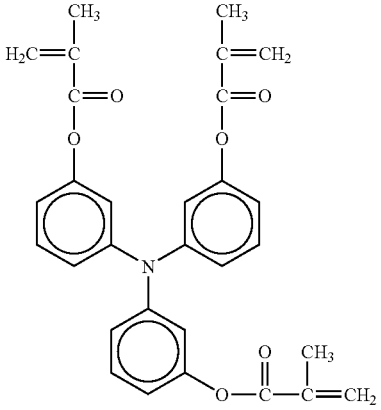
No. 377
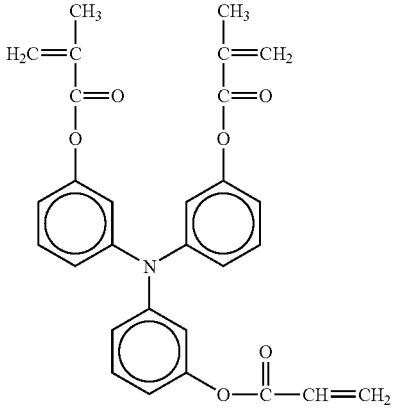
No. 378
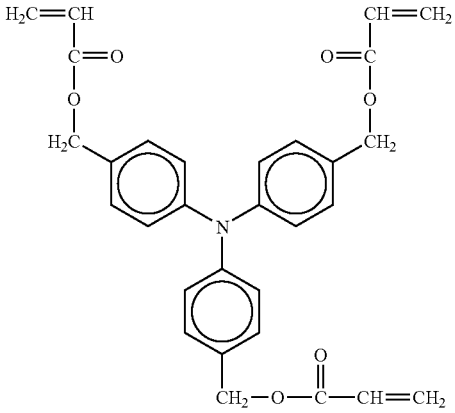
No. 379
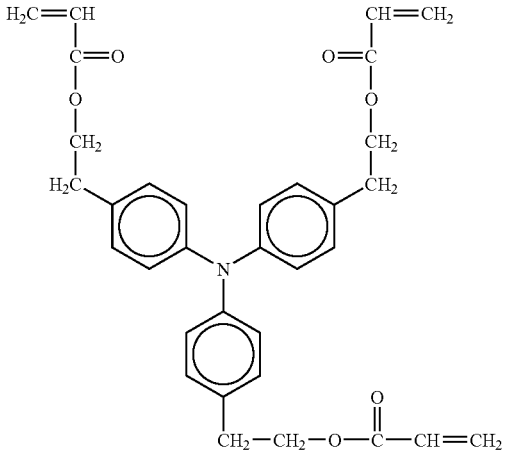

-continued
No. 380
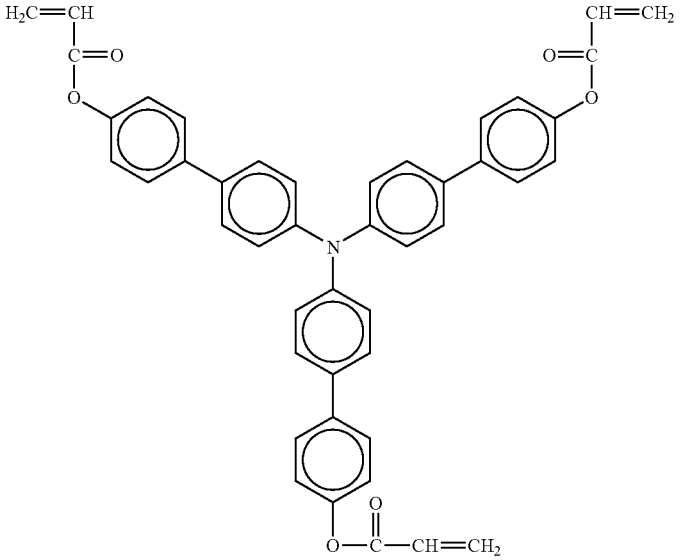
No. 381
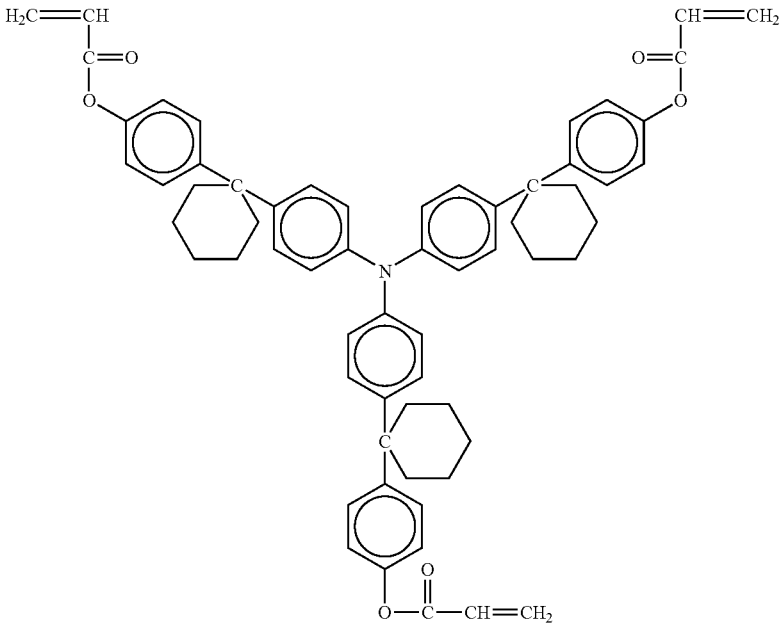

-continued

No. 382

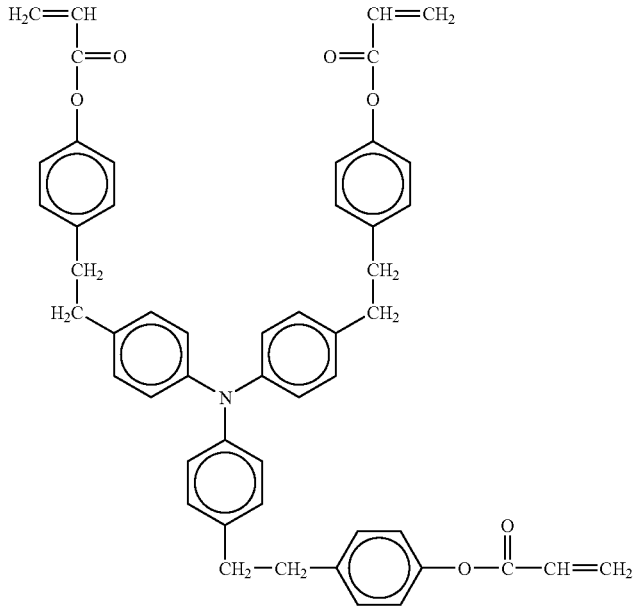

No. 383

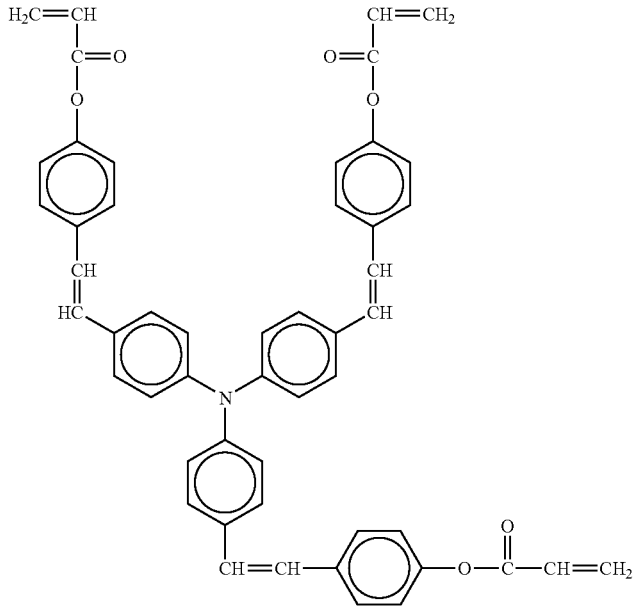

The use of the radical polymerizable compound having a charge transporting structure is important to impart charge transportability to the surface layer. The content of the radical polymerizable compound having charge transporting structure is preferably 20% by mass to 80% by mass relative to the total content of the surface layer, and more preferably 30% by mass to 70% by mass. When the content of the radical polymerizable compound having a charge transporting structure is less than 20% by mass, the charge transportability cannot be sufficiently retained at the surface layer, which may cause degradation of electric properties such as degradation of photosensitivity and increases in residual potential caused by repetitive use. When the content of the radical polymerizable compound having a charge transporting structure is more than 80% by mass, the content of the trifunctional radical polymerizable compound having no charge transporting structure is reduced, which may cause reduction in the crosslink density, and high-abrasion resistance may not be exerted.

—Present Invention A—Reactive Silicone Compound Having any One of an Acryloyloxy Group and a Methacryloyloxy Group—

The surface layer of an electrophotographic photoconductor in the present invention allows for preventing occurrences of degradation of images, in particular, occurrences of residual negative images by varying the concentration distribution of the reactive silicone compound having any one of an acryloyloxy group and a methacryloyloxy group in the depth direction of the surface layer between the surface part and the innerlayer part in the surface layer even with the use of a system which makes the surface layer worn away. The reason why the occurrences of residual negative images can be prevented is not clearly revealed, however, it can be considered that the occurrences of residual negative images can be prevented because the infusion of a positive charge generated by a transfer belt can be prevented by effect of the reactive silicone compound.

It is preferable that the concentration of the reactive silicone compound having any one of an acryloyloxy group and a methacryloyloxy group in the surface layer (in the depth direction of the surface layer) is more increased from the surface of the surface layer toward the inside of the surface layer. With such a configuration, the precipitation amount of the reactive silicone compound is increased in the inside of the surface layer in which electrostatic fatigue accumulates, and the effect of preventing occurrences of residual negative images is continued.

The concentration ratio of the reactive silicone compound having any one of an acryloyloxy group and a methacryloyloxy group between the surface part and the innerlayer part of the surface layer is not particularly limited and may be suitably adjusted in accordance with the intended use, however, the concentration ratio of surface part/innerlayer part is preferably 1/100 to 50/100.

When the concentration ratio is less than 1/100, residual negative images may occur in early stage of use, and when the concentration ratio is more than 50/100, the effect of preventing occurrences of residual negative images after the surface layer is worn away may be extremely small.

The reactive silicone compound having any one of an acryloyloxy group and a methacryloyloxy group is not particularly limited as long as it has any one of an acryloyloxy group and a methacryloyloxy group, and may be suitably selected in accordance with the intended use. Examples thereof include reactive silicone compounds each having one or more radial polymerizable functional groups. Examples of the radical polymerizable functional group include those exemplified for the trifunctional or more radical polymerizable compound having no charge transporting structure. Of these, a radical polymerizable functional group having at least an acryloyloxy group is particularly preferable from the perspective of the hardening rate and the solubility. With respect to the number of acryloyloxy groups, a reactive silicone compound having a monofunctional group can be preferably used as compared to a reactive silicone compound having a bifunctional or more group. Diacrylate bodies located at both terminal ends of the reactive silicone compound having a monofunctional group exert excellent properties.

For the reactive silicone compound having any one of an acryloyloxy group and a methacryloyloxy group, compounds represented by the following Structural Formula (4) or Structural Formula (5) are exemplified.

Structural Formula (4)

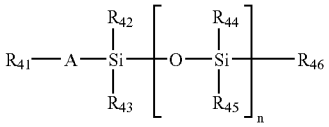

In the Structural Formula (4), $R_{41}$ represents any one of an acryloyloxy group and a methacryloyloxy group; $R_{42}$, $R_{43}$, $R_{44}$, $R_{45}$, and $R_{46}$ may be same to each other or different from each other and respectively represent a hydrogen atom or any one of an alkyl group having 1 to 12 carbon atoms and an aryl group having 1 to 12 carbon atoms; A represents any one of an alkylene group having 2 to 6 carbon atoms and a single bond; and "n" is an integer of 2 or more.

Structural Formula (5)

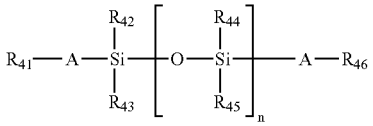

In the Structural Formula (5), $R_{41}$ and $R_{46}$ respectively represent any one of an acryloyloxy group and a methacryloyloxy group; $R_{42}$, $R_{43}$, $R_{44}$, and $R_{45}$ may be same to each other or different from each other and respectively represent a hydrogen atom or any one of an alkyl group having 1 to 12 carbon atoms and an aryl group having 1 to 12 carbon atoms; A represents any one of an alkylene group having 2 to 6 carbon atoms and a single bond; and "n" is an integer of 2 or more.

In the Structural Formulas (4) and (5), any one of the acryloyloxy group and the methacryloyloxy group is positioned at the terminal ends of a polysiloxane structure, however, in the reactive silicone compound, the positions of these functional groups are not limited to the terminal ends, and the side chain sites of a siloxane structure may be substituted.

The molecular mass of the reactive silicone compound having any one of an acryloyloxy group and a methacryloyloxy group is not particularly limited and may be suitably adjusted in accordance with the intended use, however, the molecular mass of the reactive silicone compound is preferably 20,000 or less, and more preferably 10,000 or less.

When the molecular mass of the reactive silicone compound is more than 20,000, the solubility between the trifunctional or more radical polymerizable compound having no charge transporting structure and the radical polymerizable monofunctional compound having a charge transporting structure is lowered, and the surface smoothness of the crosslinked film surface may be degraded.

The viscosity of the reactive silicone compound having any one of an acryloyloxy group and a methacryloyloxy group at a temperature of 25° C. is not particularly limited and may be suitably adjusted in accordance with the intended use, however, the viscosity is preferably 30 Pa·s or less and more preferably 20 Pa·s or less.

When the viscosity is more than 30 Pa·s and the addition concentration of the reactive silicone compound is high, the viscosity of a surface layer coating solution is high, and it may be difficult to treat the coating solution when applying the coating solution to form a surface layer. Besides, such a thick surface layer coating solution may cause coated film defects such as pin-holes and frothy small swollen bump to impair the surface smoothness of the coated film surface.

The addition concentration of the reactive silicone compound having any one of an acryloyloxy group and a methacryloyloxy group is not particularly limited and may be suitably selected in accordance with the intended use, however, it is preferably 0.5% by mass to 5% by mass relative to the total solid content of the surface layer coating solution.

When the addition concentration is less than 0.5% by mass, the effect of preventing occurrences of residual negative images may not be obtained, and when the addition concentration is more than 5% by mass, it may be adversely affect electric properties such as increases in residual electric potential.

The reactive silicone compound having any one of an acryloyloxy group and a methacryloyloxy group may be a commercially available product or a suitably synthesized one.

Examples of the commercially available product include X-22-164A (molecular mass: 860, manufactured by Shin-Etsu Chemical Co., Ltd.), and X-22-174 (molecular mass: 4,600, manufactured by Shin-Etsu Chemical Co., Ltd.).

For the method of synthesizing a reactive silicone compound having any one of an acryloyloxy group and a methacryloyloxy group, synthesis methods known in the art can be used. Examples of the synthesis methods include a method in which an ester between an acrylic acid or a methacrylic acid and an alkylene glycol is obtained, and the ester is condensation-reacted with a trimethylsilyl compound or a polydimethylsiloxane compound, and a method in which an ester between an acrylic acid or a methacrylic acid and an allyl alcohol is obtained, and the ester is condensation-reacted with a trimethylsilyl compound or a polydimethylsiloxane compound.

Next, with respect to a compound having both of a hindered phenol structure and a hindered amine structure used in the present invention B, the hindered amine structure is a structure in which a bulky atom group exists in the vicinity of an amino nitrogen atom. So-called aromatic amine, and aliphatic amine materials respectively have a structure corresponding to the hindered amine structure. The hindered phenol structure is a structure in which a bulky atom group exists at the ortho position of a phenolic hydroxyl group. Details of action mechanism of the compound having both of these structures are not clearly revealed, however, it is assumed that thermal vibrations of the amino nitrogen atom and phenolic hydroxyl group can be prevented by steric hindrance effect caused by the existence of the bulky atom group to thereby inhibit external influences such as active gas.

For the compound having both structures of a hindered amine structure and a hindered phenol structure, various conventional compounds are exemplified. In the present invention, these conventional compounds can be used. Of these, 1-[2-[3-(3,5-di-t-butyl-4-hydroxyphenyl)propionyloxy] ethyl]-4-[3-(3,5-di-t-butyl-4-hydroxyphenyl)propionyloxy]-2,2,6,6-tetramethyl pyridine is preferable.

residual negative images can be prevented is not clearly revealed, however, it can be considered that the occurrences of residual negative images can be prevented because the infusion of a positive charge caused by a transfer belt can be prevented by effect of both structures of the hindered phenol structure and the hindered amine structure. Specifically, by increasing the concentration of the compound having both of a hindered phenol structure and a hindered amine structure in the depth structure of the surface layer toward the inside of the surface layer, the precipitation amount of the compound having both of a hindered phenol structure and a hindered amine structure is increased in the inside of the surface layer in which electrostatic fatigue accumulates, and the effect of preventing occurrences of residual negative images is continued.

The concentration ratio of the compound having both of a hindered phenol structure and a hindered amine structure between the surface and the inside of the surface layer is preferably 1/99 to 50/50. When the concentration ratio of the compound having both of a hindered phenol structure and a hindered amine structure between the surface and the inside of the surface layer is less than 1/99, residual negative images occur in early stage of use of the photoconductor. When the concentration ratio is more than 50/50, the effect of preventing occurrences of residual negative images after the surface layer is worn away is extremely small.

The concentration distribution of a radical polymerizable compound having a charge transporting structure to be contained in the surface layer of an electrophotographic photoconductor of the present invention C is important to prevent occurrences of residual negative images, the prevention of occurrences of residual negative images is an issue of the present invention, though. It is preferable that the concentration of the radical polymerizable compound having a charge transporting structure to be used for the surface layer is reduced toward the inside of the surface layer. The content of the radical polymerizable compound having a charge transporting structure is preferably 50% by mass to 90% by mass Structural Formula (I)

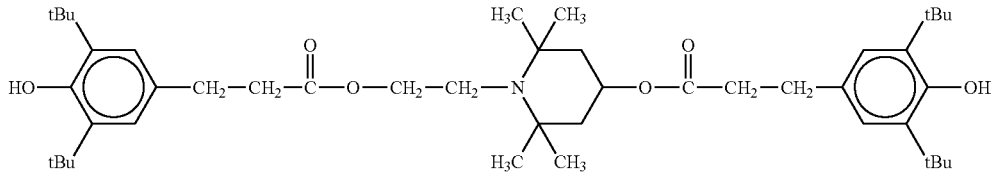

The addition concentration of the compound having both of a hindered phenol structure and a hindered amine structure is properly 0.5% by mass to 5% by mass relative to the total solid content of a coating solution for the surface layer. When the addition concentration is less than 0.5% by mass, the effect of preventing occurrences of residual negative images may not be obtained. When the addition concentration is more than 5% by mass, it may adversely affect electric properties such as increases in residual electric potential.

A surface layer of an electrophotographic photoconductor in the present invention allows for preventing occurrences of degradation of images, in particular, occurrences of residual negative images by varying the concentration distribution of the compound having both of a hindered phenol structure and a hindered amine structure in the depth direction of the surface layer even with the use of a system which make the surface layer worn away. The reason why the occurrences of at the surface part of the surface layer and 10% by mass to 50% by mass at the inside part of the surface layer, and more preferably 60% by mass to 80% by mass at the surface part of the surface layer and 20% by mass to 40% by mass at the inside of the surface layer. When the content of the radical polymerizable compound having a charge transporting structure at the surface part of the surface layer is less than 50% by mass, the electric properties such as residual electric potential of the electrophotographic photoconductor may degrade. When the content of the component at the surface part of the surface layer is more than 90% by mass, which causes degradation of crosslinking density, and high-abrasion resistance cannot be exerted. In the meanwhile, the content of the radical polymerizable compound having a charge transporting structure at the inside part of the surface layer is more than 50% by mass, residual negative images occur when the electrophotographic photoconductor is repeatedly used. When the content of the component at the inside part of the surface layer is less than 10% by mass, the electric properties such as residual electric potential may degrade. Further, it is preferable that the concentration distribution of the radical polymerizable compound having a charge transporting structure in the depth direction of the surface layer is constantly continuous.

The surface layer of the present invention A contains a hardened material containing at least a trifunctional or more radical polymerizable compound having no charge transporting structure, a radical polymerizable compound having a charge transporting structure, and a reactive silicone compound having any one of an acryloyloxy group and a methacryloyloxy group, however, a monofunctional radical monomer, a bifunctional radical monomer, and a radical polymerizable oligomer may be used together with the above-mentioned components for the purposes of controlling the viscosity when applying the surface layer coating solution, alleviating the stress of the surface layer, and imparting functionalities such as energizing the surface with low-energy and reduction of friction coefficient. For these radical polymerizable compounds and oligomers, those known in the art can be utilized.

The surface layer of the present invention B is a surface layer which is hardened by irradiating the surface applied with a coating solution containing at least a trifunctional or more radical polymerizable monomer having no charge transporting structure, and a radical polymerizable compound having a charge transporting structure with an optical energy through the use of an optical energy irradiation unit, however, a monofunctional radical polymerizable monomer, a bifunctional radical polymerizable monomer, and a radical polymerizable oligomer may be used together with the above-mentioned components for the purposes of controlling the viscosity when applying the surface layer coating solution, alleviating the stress of the crosslinked surface layer, and imparting functionalities such as energizing the surface with low-energy and reduction of friction coefficient. For these radical polymerizable monomers and oligomer, those known in the art can be used.

In the electrophotographic photoconductor of the present invention C, at least a photosensitive layer and a surface layer are formed in this order on a conductive substrate as described above. First, a surface layer coating solution is prepared which contains a trifunctional or more radical polymerizable compound having no charge transporting structure, a monofunctional or more radical polymerizable compound having a charge transporting structure. Next, a surface layer is formed by applying the surface layer coating solution to the surface of the photosensitive layer such that the concentration of the radical polymerizable compound having a charge transporting structure is varied in the film thickness direction of the surface layer and then the radical polymerizable compound is crosslinked by irradiating the surface layer coating solution with an optical energy to thereby harden the surface layer. Besides the above-mentioned components, another monofunctional radical polymerizable monomer, a bifunctional radical polymerizable monomer, and a radical polymerizable oligomer may be used together with the above-noted components for the purposes of controlling the viscosity when applying the surface layer coating solution, alleviating the stress of the crosslinked surface layer, and imparting functionalities such as energizing the surface with low-energy and reduction of friction coefficient. For these radical polymerizable compounds and oligomers, those known in the art can be utilized. For the irradiation with an optical energy, an optical energy irradiation unit capable of applying a light enabling radical polymerization such as metal halide lamp can be used.

Examples of the monofunctional monomer include 2-ethylhexyl acrylate, 2-hydroxyethyl acrylate, 2-hydroxypropyl acrylate, tetrahydroflufuryl acrylate, 2-ethylhexylcarbitol acrylate, 3-methoxybutyl acrylate, benzyl acrylate, cyclohexyl acrylate, isoamyl acrylate, isobutyl acrylate, metoxytriethylene glycol acrylate, phenoxytetraethylene glycol acrylate, cetyl acrylate, isostearyl acrylate, stearyl acrylate, and styrene monomer.

Examples of the bifunctional radical monomer include 1,3-butanediol diacrylate, 1,4-butanediol diacrylate, 1,4-butanediol dimethacrylate, 1,6-hexanediol diacrylate, 1,6-hexanediol dimethacrylate, diethyleneglycol diacrylate, neopentylglycol diacrylate, bisphenol A-EO-modified diacrylate, bisphenol F-EO-modified acrylate, and neopentylglycol diacrylate.

Examples of functional monomers include fluorine atom-substituted ones such as octafluoropentyl acrylate, 2-perfluorooctylethyl acrylate, 2-perfluorooctylethyl methacrylate, 2-perfluoroisononylethyl acrylate; acryloylpolydimethyl ethyl siloxane having siloxane repeating unit of 20 to 70 described in Japanese Patent Application Publication (JP-B) Nos. 5-60503 and 6-45770; vinyl monomers each having a polysiloxane group such as methacryloylpolydimethyl ethylsiloxane, acryloylpolydimethyl propylsiloxane, acryloylpolydimethyl butylsiloxane, and diacryloylpolydimethyl diethylsiloxane; acrylates, and methacrylates.

Examples of the radical polymerizable oligomers include epoxy acrylate-based oligomers, urethane acrylate-based oligomers, and polyester acrylate-based oligomers. However, when monofunctional and/or bifunctional radical polymerizable compounds and radical polymerizable oligomers are contained in a large amount, the three-dimensionally crosslinking density of the surface layer may be substantially reduced to cause reduction in abrasion resistance. For the reason, the content of these monomers and oligomers is preferably 50% by mass or less relative to 100 parts by mass of the trifunctional or more radical polymerizable compound, and more preferably 30% by mass or less.

The surface layer may further contain a photopolymerization initiator to efficiently progress a crosslinking reaction between the trifunctional or more radical polymerizable compound having no charge transporting structure, the radical polymerizable compound having a charge transporting structure, and the reactivate silicone having any one of an acryloyloxy group and a methacryloyloxy group.

Examples of the photopolymerization initiator include acetophenone-based or ketal-based photopolymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl) ketone, 2-benzyl-2-dimethylamino-1-(4-morpholinophenyl) butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl) [oxime]; benzoin ether-based photopolymerization initiators such as benzoin, benzoin methylether, benzoin ethylether, benzoin isobutylether, and benzoinisopropyl ether; benzophenone photopolymerization initiators such as benzophenone, 4-hydroxybenzophenone, o-methyl benzoylbenzoic acid, 2-benzoyl naphthalene, 4-benzoylbiphenyl, 4-benzoylphenylether, acrylated benzophenone, and 1,4-benzoyl benzene; thioxanthone-based photopolymerization initiators such as 2-isopropylthioxanthone, 2-chlorothioxanthone, 2,4-dimethylthioxanthone, 2,4-dethylthioxanthone, and 2,4-dichlorothioxanthone; and other photopolymerization initiators such as ethylanthraquinone, 2,4,6-trimethylbenzoyldiphenyl phosphine oxide, bis(2,4,6-trimethylbenzoyl)phenylphosphine oxide, bis(2,4-dimethoxybenzoyl)-2,4,4-trimethylpentyl phosphine oxide, methylphenyl glyoxyester, 9,10-phenanthrene, acrydine-based compounds, triazine-based compounds, and imidazole-based compounds. It is also possible to use a compound having photopolymerization accelerating effect alone or together with the above-noted photopolymerization initiators. Examples of the compound having photopolymerization accelerating effect include triethanolamine, methyldiethanolamine, ethyl 4-dimethylamino benzoate, isoamyl 4-dimethylamino benzoate, ethyl (2-dimethylamino)benzoate, and 4,4'-dimethylamino benzophenone. Each of these may be used alone or in combination with two or more.

The content of the photopolymerization initiator is preferably 0.5 parts by mass to 40 parts by mass relative to 100 parts by mass of the total content of the compounds each having radical polymerizability, and more preferably 1 part by mass to 20 parts by mass.

The surface layer may further contain various plasticizers in order to alleviate stress and improve adhesiveness, and additives such as low-molecular weight charge transporting material having no radical reactivity. For the additives, conventional additives may be used. For the plasticizers, those used for typical resins such as dibutyl phthalate, and dioctyl phthalate may be utilized. The used amount of the plasticizer is preferably 20% by mass or less relative to the total solid content of the surface layer coating solution, and more preferably 10% by mass or less.

The surface layer can be formed by applying a surface layer coating solution containing at least a trifunctional or more radical polymerizable compound having no charge transporting structure, a radical polymerizable compound having a charge transporting structure, and a reactive silicone compound having any one of an acryloyloxy group and a methacryloyloxy group to the surface of the photosensitive layer and hardening the surface layer coating solution applied thereon. When the radical polymerizable compound is a liquid, other components may be dissolved in the surface layer coating solution to coat the photosensitive layer surface therewith, or the surface layer coating solution may be diluted in a solvent where necessary to coat the photosensitive layer surface therewith.

The solvent is not particularly limited and may be suitably selected in accordance with the intended use. Examples thereof include alcohol-based solvents such as methanol, ethanol, propanol, and butanol; ketone-based solvents such as acetone, methylethylketone, methylisobutylketone, and cyclohexanone; ester-based solvents such as ethyl acetate, and butyl acetate; ether-based solvents such as tetrahydrofuran, dioxane, and propyl ether; halogen-based solvents such as dichloromethane, dichloroethane, trichloroethane, and chlorobenzene; aromatic solvents such as benzene, toluene, and xylene; cellosolve-based solvents such as methyl cellosolve, ethyl cellosolve, and cellosolve acetate. Each of these solvents may be used alone or in combination with two or more.

The dilution rate of the surface layer coating solution in the solvent may be suitably adjusted depending on the conditions such as solubility of the composition, coating method, and an intended film thickness.

Examples of the coating method used for the surface layer coating solution include immersion coating method, spray coating method, bead coating method, and ring coating method. Of these, spray coating method is particularly preferable in terms that productivity and quality stability can be easily ensured.

The photosensitive layer surface is preferably spray-coated more than once, and the reactive silicone compound concentrations in the surface layer coating solutions used for multiple spray-coating are preferably varied in the multiple spray-coating courses. Specifically, a surface layer of which the concentration of the reactive silicone compound at the inside of the surface layer is higher than the concentration at the surface of the surface layer can be obtained by spray-coating the photosensitive layer with a plurality of the surface layer coating solutions each having a different concentration of the reactive silicone compound in decreasing order of the concentrations of the reactive silicone compounds.

The thickness of the surface layer is not particularly limited and may be suitably selected in accordance with the intended use, however, it is preferably 1 μm to 20 μm, and more preferably 2 μm to 10 μm. When the thickness of the surface layer is less than 1 μm, the durability of the photoconductor may be sometimes varied due to nonuniformity of the thickness thereof. When the thickness is more than 20 μm, electric properties of the photoconductor may sometimes degrade.

The surface layer coating solution can be preferably hardened by externally applying an energy to the surface layer coating solution upon completion of all the spray-coating courses using the surface layer coating solutions. Examples of the external energy used at that time include heat, light, and radiation ray. Of these, an optical energy is preferably used, and the surface layer coating solution can be preferably hardened by means of an optical energy irradiation unit.

For the optical energy irradiation unit, a UV irradiation light source having emission wavelength primarily in ultraviolet rays such as high-pressure mercury lamp and metal halide lamp can be suitably utilized, and it is also possible to use a visible-light light source along with the absorption wavelengths of the used components having radical polymerizability and the used photopolymerization initiator. Besides, an optical energy irradiation unit using an electron beam as energy of radiation ray is also exemplified, however, the above-mentioned light energy irradiating unit is useful from the perspective of easy controlling of reaction rate, and simplified apparatus.

The irradiated quantity of light through the use of the optical energy irradiation unit is not particularly limited and may be suitably adjusted in accordance with the intended use, however, it is preferably 50 $mW/cm^2$ to 1,000 $mW/cm^2$.

When the irradiated quantity of light is less than 50 $mW/cm^2$, it may take a long time for a hardening reaction, and when the irradiated quantity of light is more than 1,000 $mW/cm^2$, the hardening reaction may sometimes progress nonuniformly, which may result in a rough surface of the obtained surface layer.

[Multi-Layered Photosensitive Layer]

The multi-layered photosensitive layer of the present invention has at least a charge generating layer and a charge transporting layer formed in this order and further has an intermediate layer and other layers in accordance with the necessity.

—Charge Generating Layer—

The charge generating layer contains at least a charge generating material having a charge generating function, and a binder resin and further contains other components in accordance with the necessity.

For the charge generating material, an inorganic material and an organic material can be used.

Examples of the inorganic material include crystallized selenium, amorphous-selenium, selenium-tellurium, selenium-tellurium-halogen, selenium-arsenic compounds, and amorphous-silicon. For the amorphous-silicone, danglingbond terminated ones with hydrogen atom or halogen atom, and the ones doped with boron atom or phosphorus atom are preferably used.

The organic material is not particularly limited and may be suitably selected from among those known in the art. Examples thereof include phthalocyanine pigments such as metal phthalocyanine, metal-free phthalocyanine, azulenium salt pigments, squaric acid methine pigments, azo pigments each having a carbazole skeleton, azo pigments each having a triphenylamine skeleton, azo pigments each having a diphenylamine skeleton, azo pigments each having a dibenzothiophene skeleton, azo pigments each having a fluorenone skeleton, azo pigments each having an oxadiazole skeleton, azo pigments each having a bisstilbene skeleton, azo pigments each having a distyryloxadiazole skeleton, azo pigments each having a distyrylcarbazole skeleton, perylene pigments, anthraquinone or polycyclic quinone pigments, quinoneimine pigments, dipehnylmethane and triphenylmethane pigments, benzoquinone and naphthoquinone pigments, cyanine and azomethine pigments, indigoid pigments, and bisbenzimidazole pigments. Each of these organic materials may be used alone or in combination with two or more.

Of these, phthalocyanines are preferable, and titanyl phthalocyanine is particularly preferable.

For the titanyl phthalocyanine, a titanyl phthalocyanine having a crystal form having major diffraction peaks specified by Bragg angle 2 θ of 9.6°±0.2°, 24.0°±0.2°, and 27.2°±0.2° is particularly preferable as a high-photosensitive material.

The binder resin is not particularly limited and may be suitably selected in accordance with the intended use. Examples thereof include polyamide resins, polyurethane resins, epoxy resins, polyketone resins, polycarbonate resins, silicone resins, acrylic resins, polyvinyl butyral resins, polyvinylformal resins, polyvinylketones resins, polystyrene resins, poly-N-vinyl carbazole resins, and polyacrylamide resins. Each of these binder resins may be used alone or in combination with two or more.

For the binder resin used for the charge generating layer, besides the binder resins set forth above, polymer charge transporting materials each having charge transportability such as (1) polymer materials such as polycarbonate, polyester, polyurethane, polyether, polysiloxane, and acrylic resin each having an arylamine skeleton, a benzidine skeleton, a hydrazone skeleton, a carbazole skeleton, a stilbene skeleton, a pyrazoline skeleton or the like, and (2) polymer materials each having a polysilane skeleton.

Specific examples of the polymer materials (1) include charge transporting polymer materials described in Japanese Patent Application Laid-Open (JP-A) Nos. 01-001728, 01-009964, 01-013061, 01-019049, 01-241559, 04-011627, 04-175337, 04-183719, 04-225014, 04-230767, 04-320420, 05-232727, 05-310904, 06-234836, 06-234837, 06-234838, 06-234839, 06-234840, 06-234841, 06-239049, 06-236050, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, and 09-328539.

Specific examples of the polymer materials (2) include polysilylene polymers described in Japanese Patent Application Laid-Open (JP-A) Nos. 63-285552, 05-19497, 05-70595, and 10-73944.

Further, the charge generating layer may contain a low-molecular weight charge transporting material.

The low-molecular weight charge transporting materials are classified broadly into electron hole transporting materials and electron transporting materials.

Examples of the electron transporting material include electron-accepting materials such as chloranil, bromanil, tetracyano ethylene, tetracyano quinodimethane, 2,4,7-trinitro-9-fluolenone, 2,4,5,7-tetranitro-9-fluolenone, 2,4,5,7-tetranitroxanthone, 2,4,8-trinitrothioxanthone, 2,6,8-trinitro-4H-indeno[1,2-b]thiophene-4-one, 1,3,7-trinitrodibnezothiophene-5,5-dioxide, and diphenoquinone derivatives. Each of these electron transporting materials may be used alone or in combination with two or more.

Examples of the electron hole transporting materials include electron-donating materials such as oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, and other conventional materials. Each of these electron hole transporting materials may be used alone or in combination with two or more.

For the method of forming the charge generating layer, vacuum thin-film forming method and casting method using a dispersion solution are roughly exemplified.

For the vacuum thin-film forming method, for example, vacuum evaporation method, glow discharge decomposition method, ion-plating method, sputtering method, reactive sputtering method, and CVD method can be used.

In the casting method, a charge generating layer can be formed by dispersing the inorganic or organic charge generating materials, and when necessary, the binder resin in a solvent such as tetrahydrofuran, dioxane, dioxolane, toluene, dichloromethane, monochlorobenzene, dichloroethane, cyclohexane, cyclopentanon, anisole, xylene, methylethylketone, acetone, ethyl acetate, butyl acetate using a ball mill, an attritor, a sand mill, or a bead mill and appropriately diluting the dispersion and applying the diluent over a surface of a photosensitive layer. In addition, in accordance with the necessity, leveling agents such as dimethyl silicone oil, methylphenyl silicone oil can be added to the dispersion. The diluted dispersion can be applied by immersion coating method, spray-coating method, bead-coating method, ring coating method, or the like.

The thickness of the charge generating layer is not particularly limited and may be suitably adjusted in accordance with the intended use, however, it is preferably 0.01 μm to 5 μm and more preferably 0.05 μm to 2 μm.

—Charge Transporting Layer—

The charge transporting layer is a layer having charge transportability to retain electrification charge and to transport an electric charge generated at and separated from the charge generating layer by means of exposure to thereby bind the electric charge with the electrification charge. To retain an electrification charge, high electric resistance is required. To obtain a high-surface electric potential with the use of the retained electrification charge, it requires a low-dielectric constant and excellent charge transportability.

The charge transporting layer contains at least a charge transporting material and a binder resin and further contains other components in accordance with the necessity.

Examples of the charge transporting material include electron hole transporting materials, electron transporting materials, and macromolecule charge transporting materials. For the electron transporting material, the same ones as described in the electron transporting materials, the electron hole transporting materials and the macromolecule charge transporting materials for the charge generating layer set forth above can be used. Of these, as described above, the macromolecule charge transporting materials are preferably used in terms that the solubility of layers disposed under the surface layer can be reduced when applying the surface layer coating solution.

Examples of the binder resin include thermoplastic or thermosetting resins such as polystyrene resins, styrene-acrylonitrile copolymers, styrene-butadiene copolymers, styrene-maleic acid anhydride copolymers, polyester resins, polyvinyl chloride-binyl acetate copolymers, polyvinyl acetate resins, polyvinylidene chloride resins, polyacrylate resins, phenoxy resins, polycarbonate resins, cellulose acetate resins, ethyl cellulose resins, polyvinyl butyral resins, polyvinyl formal resins, polyvinyl toluene resins, poly-N-vinyl carbazole resins, acrylic resins, silicone resins, epoxy resins, melamine resins, urethane resins, phenol resins, and alkyd resins. Each of these binder resins may be used alone or in combination with two or more.

The used amount of the charge transporting material is preferably 20 parts by mass to 300 parts by mass relative to 100 parts by mass of the binder resin, and more preferably 40 parts by mass to 150 parts by mass. When the macromolecule charge transporting material is used, the macromolecule charge transporting material may be used alone or together with the above-noted binder resin.

For a solvent or solvents used for forming the charge transporting layer by coating, the same one as described for the charge generating layer can be used, however, a solvent having excellent solubility between a charge transporting material and a binder resin is preferable. The solvents may be used alone or in combination with two or more. When forming the charge transporting layer, the same coating method as used for the charge generating layer can be used.

Further, a plasticizer and a leveling agent can also be added to the solvent in accordance with the necessity.

For the plasticizer, those used as plasticizer for typical resins, for example, dibutyl phthalate, and dioctyl phthalate can be directly used. The used amount of the plasticizer is preferably 30 parts by mass or less relative to 100 parts by mass of the binder resins.

For the leveling agent, for example, silicone oils such as a dimethyl silicone oil, a methyl phenyl silicone oil; or a polymer having perfluoroalkyl groups at side chains thereof or an oligomer having perfluoroalkyl groups at side chains thereof are used, and the used amount of the leveling agent is preferably 1 part by mass or less relative to 100 parts by mass of the binder resin.

The thickness of the charge transporting layer is not particularly limited and may be suitably adjusted in accordance with the intended use, however, it is preferably 5 μm to 40 μm, and more preferably 10 μm to 30 μm.

In case of a multi-layered photosensitive layer, a coating solution containing a radical polymerizable composition is applied over the surface of the charge transporting layer, and the charge transporting layer with the coating solution applied thereon is dried in accordance with the necessity, and then the coating solution is hardened by means of an optical energy irradiation unit to thereby form a surface layer. The thickness of the formed surface layer is preferably 1 μm to 20 μm, and more preferably 2 μm to 10 μm. When the thickness of the formed surface layer is less than 1 μm, the durability of the photoconductor may be sometimes varied due to nonuniformity of the thickness thereof. When the thickness of the surface layer is more than 20 μm, electric properties of the photoconductor may sometimes degrade.

[Single-Layered Photosensitive Layer]

The single-layered photosensitive layer of the present invention contains a charge generating material, a charge transporting material, and a binder resin and further contains other components in accordance with the necessity.

For the charge generating material, the charge transporting material, and the binder resin, the same materials as described for the multi-layered photosensitive layer can be used.

When a single-layered photosensitive layer is formed by casting method, in most cases, such a single-layered photosensitive layer can be formed by the following method. Specifically, a coating solution is prepared in which a charge generating material, low-molecular weight and macromolecule charge transporting materials are dissolved and dispersed in an appropriate solvent, and then the dispersion is applied over a surface of a substrate, followed by drying the substrate surface with the coating solution applied thereon. Further, to the single-layered photosensitive layer, a plasticizer can be added in accordance with the intended use. For a binder resin to be used in accordance with the necessity, the binder resins exemplified for the charge transporting layer can be directly used. Besides, the same binder resins as described for the charge generating layer may be mixed for use.

Further, a plasticizer, a leveling agent and the like can be added to the dispersion. For the dispersing method of the charge generating material, and the charge transporting material, the plasticizer, and the leveling agent, the same ones as described above for the charge generating layer and the charge transporting layer can be used. For the binder resin, besides the binder resins exemplified in the paragraph of the charge transporting layer set forth above, the binder resins exemplified in the paragraph for the charge generating layer may be mixed for use. The above-mentioned macromolecule charge transporting material can also be used and is useful in terms that such a macromolecule charge transporting material can reduce the amount of the photosensitive layer composition for the photosensitive layer, which is disposed under the surface layer, to be mixed in the surface layer.

The thickness of the single-layered photosensitive layer is not particularly limited and may be suitably adjusted in accordance with the intended use, however, it is preferably 5 μm to 30 μm, and more preferably 10 μm to 25 μm.

In case of a photoconductor having a single-layered photosensitive layer, a coating solution containing a radical polymerizable composition is applied over the surface of a photosensitive layer, and the photosensitive layer surface with the coating solution applied thereon is dried in accordance with the necessity, and then the coating solution is hardened by means of an optical energy irradiation unit to thereby form a surface layer. The thickness of the formed surface layer is preferably 1 μm to 20 μm, and more preferably 2 μm to 10 μm. When the thickness of the formed surface layer is less than 1 μm, the durability of the photoconductor may be sometimes varied due to nonuniformity of the thickness thereof. When the thickness is more than 20 μm, electric properties of the photoconductor may sometimes degrade.

The content of the charge generating material contained in the single-layered photosensitive layer is preferably 1% by mass to 30% by mass relative to the total content of the photosensitive layer. The content of the binder resin contained in the underlayer part of the photosensitive layer is preferably 20% by mass to 80% by mass relative to the total content of the single-layered photosensitive layer. The content of the charge transporting material is preferably 10 parts by mass to 70 parts by mass relative to 100 parts by mass of the binder resin.

[Substrate]

Material of the substrate is not particularly limited and may be suitably selected in accordance with the intended use, however, a material exhibiting conductivity of a volume resistivity $10^{10}$ Ω·cm or less is preferably used.

The material, shape, and size of the substrate are not particularly limited, and any one of a sheet-like substrate, a drum-like substrate, and belt-shaped substrate can be used. For example, it is possible to use the one that is prepared by coating a film-like or cylindrical plastic or paper with a metal oxide, for example, aluminum, nickel, chrome, nichrome, copper, gold, silver, platinum or the like by evaporation or sputtering; or a tube that is prepared by extruding a plate composed of aluminum, aluminum alloy, nickel, stainless alloy or the like to prepare a tube by drawing, and then subjecting the tube to a surface treatment such as cutting, superfinishing, and polishing. Further, an endless nickel belt, and an endless stainless alloy belt disclosed in Japanese Patent Application Laid-Open (JP-A) No. 52-36016 can also be used as the substrate.

Besides the above-mentioned materials, it is also possible to use the one that is prepared by dispersing a conductive powder in a proper binder resin to prepare a dispersion and applying the dispersion over the surface of the substrate to form a conductive layer on the substrate surface.

Examples of the conductive powder include carbon black, acetylene black; metal powders such as aluminum, nickel, iron, nichrome, copper, zinc and silver; or metal oxide powders such as conductive tin oxide and ITO. Examples of the binder resin used together with the conductive powder include thermoplastic or thermosetting or photo-setting resins such as polystyrene resins, styrene-acrylonitrile copolymers, styrene-butadiene copolymers, styrene-maleic acid anhydride copolymers, polyester resins, polyvinyl chloride resins, vinyl-chloride-vinyl acetate copolymers, polyvinyl acetate resins, polyvinylidene chloride resins, polyacrylate resins, phenoxy resins, polycarbonate resins, cellulose acetate resins, ethyl cellulose resins, polyvinyl butyral resins, polyvinyl formal resins, polyvinyl toluene resins, poly-N-vinylcarbazole, acrylic resins, silicone resins, epoxy resins, melamine resins, urethane resins, phenol resins, and alkyd resins.

The conductive layer can be formed by dispersing the conductive powder and the binder resin in a proper solvent such as tetrahydrofuran, dichloromethane, methylethylketone, and toluene and applying the dispersion over the substrate surface.

Further, as the substrate, a heat shrinkable tube having a conductive layer is also preferably used, which is prepared as follows. First, the above-noted conductive powder may be added in any one of a polyvinyl chloride resin, a polypropylene resin, a polyester resin, a polystyrene resin, a polyvinylidene chloride resin, a polyethylene resin, a chlorinated rubber, a polytetrafluoroethylene-based fluorine resin, and the mixture is applied over the surface of a cylindrical base to thereby form a heat shrinkable tube having a conductive layer.

An undercoat layer may be formed in between the substrate and the photosensitive layer in accordance with the necessity. Typically, such an undercoat layer contains a resin as the main component. In consideration that the undercoat layer composed primarily of a resin is usually coated with a photosensitive layer using a solvent, it is preferable to use a resin which is highly soluble in a typically used organic solvent to form an undercoat layer.

Examples of the resin include water-soluble resins such as polyvinyl alcohol, casein, and sodium polyacrylate; alcohol-soluble resins such as copolymer nylon, and methoxymethylated nylon; and hardened resins each forming a three-dimensional network such as polyurethane resins, melamine resins, phenol resins, alkyl-melamine reins, and epoxy resins.

In addition, to the undercoat layer, a fine powder pigment composed of a metal oxide may be added to prevent occurrences of moiré, reducing residual electric potential, and the like. For the metal oxide, titanium oxides, silica, alumina, zirconium oxides, tin oxides, and indium oxides are exemplified.

The undercoat layer can be formed by using a proper solvent and a proper coating method, which is same as for the photosensitive layer. Further, for the undercoat layer used in the present invention, a silane coupling agent, a titanium coupling agent, a chrome coupling agent, or the like can also be used. For the undercoat layer, a layer formed by anodic oxidization using $Al_2O_3$, and a layer formed by a vacuum thin-layer forming method using an organic material such as polyparaxylylene (parylene) or an inorganic material such as $SiO_2$, $SnO_2$, $TiO_2$, ITO, and $CeO_2$ can also be preferably used for the undercoat layer. Besides the above-mentioned materials, conventional undercoat layers can also be used.

The thickness of the undercoat layer is not particularly limited and may be suitably selected in accordance with the intended use, however, it is preferably 5 μm or less.

Further, in the latent electrostatic image bearing member, for the purpose of enhancing environmental resistance, in particular, for the purpose of preventing reductions in photosensitivity and increases in residual electric potential, antioxidants can be added to respective layers such as a surface layer, a photosensitive layer, a charge generating layer, a charge transporting layer, and an undercoat layer.

Examples of the antioxidants include phenol compounds, paraphenylenediamines, organic sulfur compounds, and organic phosphorous compounds.

Examples of the phenol compounds include 2,6-di-t-butyl-p-cresol, butylated hydroxyanisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-buthylidenebis-(3-methyl-6-t-butylphenol), 1,1,3-tris-(2-methyl-4-hydroxy-5-t-butylphenyl)butane, 1,3,5-trimethyl-2,4,6-tris (3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, and tocopherols.

Examples of the paraphenylenediamines include N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylene diamine, and N,N'-dimethyl-N,N'-di-t-butyl-p-phenylenediamine.

Examples of the hydroquinones include 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Examples of the organic sulfur compounds include dilauryl-3,3'-thiodipropyonate, distearyl-3,3'-thiodipropyonate, and ditetradecyl-3,3'-thiodipropyonate.

Examples of the organic phosphorus compounds include triphenyl phosphine, tri(nonylphenyl)phosphine, tri(dinonylphenyl)phosphine, tricresyl phosphine, and tri(2,4-dibutylphenoxy)phosphine.

These compounds are known as antioxidants used for rubbers, plastics, and fats and fatty oils, and commercial products thereof are easily available.

The added amount of the antioxidant is preferably 0.01% by mass to 10% by mass relative to the total mass of the layer to which the antioxidant is added.

The latent electrostatic image bearing member can be utilized in electrophotographic copiers but also can be widely used in electrophotographic application areas such as laser beam printers, CRT printers, LED printers, liquid crystal printers, and laser plate making.

Hereinafter, one example of a method of producing the above-mentioned latent electrostatic image bearing member is described. First, a plurality of surface layer coating solutions of which the concentration of a reactive silicone compound having any one of an acryloyloxy group and a methacryloyloxy group is varied are sequentially applied over the surface of a photosensitive layer in which an undercoat layer, a charge generating layer, a charge transporting layer are formed in this order in a laminate structure on a substrate of an aluminum cylinder or the like, by spray-coating in decreasing order of the concentrations of the reactive silicone compound. Then, the surface layer is hardened by means of an optical energy irradiation unit. After completion of the hardening, the surface layer is heated at 100° C. to 150° C. for 10 minutes to 30 minutes to reduce a residual solvent therein, thereby a latent electrostatic image bearing member can be obtained.

<Latent Electrostatic Image Forming and Latent Electrostatic Image Forming Unit>

In the latent electrostatic image forming, a latent electrostatic image is formed on a latent electrostatic image bearing member. The details of the latent electrostatic image bearing member are as described above.

The latent electrostatic image can be formed, for example, by uniformly charging the surface of the latent electrostatic image bearing member and then exposing the surface thereof imagewisely by means of the latent electrostatic image forming unit.

The latent electrostatic image forming unit is provided with at least a charger configured to uniformly charge the surface of the latent electrostatic image bearing member, and an exposer configured to expose the surface of the latent electrostatic image bearing member imagewisely.

The surface of the latent electrostatic image bearing member can be charged, for example, by applying a voltage to the latent electrostatic image bearing member surface using the charger.

The charger is not particularly limited, may be suitably selected in accordance with the intended use and examples thereof include contact chargers known in the art, for example, which are equipped with a conductive or semiconductive roller, a brush, a film, a rubber blade or the like, and non-contact chargers utilizing corona discharge such as corotoron and scorotoron.

For the shape of the charging member, besides rollers, any shapes may be employed, such as magnetic brush, and fur brush, and may be selected in accordance with specifications and configuration of the used electrophotographic apparatus. When a magnetic brush is used, for example, various ferrite particles such as Zn—Cu ferrite are used as a charging member, and the magnetic brush is usually constituted by a non-magnetic conductive sleeve used to support the magnetic brush, and a magnet roller with is incorporated into the non-magnetic conductive sleeve. When a brush is used as a charging member, for a material of the fur brush, for example, a fur that is subjected to a conductive treatment using carbon, copper sulfide, metal or metal oxide is used, the fur is wound around or attached to a metal or a cored bar that has been subjected to a conductive treatment to thereby use it for a charger.

The charger is not particularly limited to the contact chargers set forth above, however, it is preferable to use a contact charger because it is possible to obtain an image forming apparatus in which ozone generated from the charger is reduced.

It is preferable to use a charger of which the above-mentioned charger is arranged so as to be contact with or out of contact with a latent electrostatic image bearing member and is configured to charge the surface of the latent electrostatic image bearing member by superimposing a direct current voltage and an alternating-current voltage.

Further, the charger is preferably a charge roller which is arranged so as to be out of contact with and arranged in proximity to a latent electrostatic image bearing member via a gap tape and is configured to charge the surface of the latent electrostatic image bearing member by superimposing a direct current voltage and an alternating-current voltage.

The exposure can be carried out by exposing the surface of the latent electrostatic image bearing member imagewisely using the above-mentioned exposer.

The exposer is not particularly limited, provided that the surface of the electrophotographic photoconductor which has been charged by the charger can be exposed imagewisely by the use of the exposer, may be suitably selected in accordance with the intended use, and examples thereof include various types of exposers such as reproducing optical systems, rod lens array systems, laser optical systems, and liquid crystal shutter optical systems.

For a light source used for the exposer, light sources such as light-emitting diode (LED), semiconductor laser (LD), and electro luminescence (EL) can be used.

In the present invention, the back light method may be employed in which exposing is performed imagewisely from the back side of the electrophotographic photoconductor.

In the image forming apparatus and in the image forming method of the present invention, the linear velocity of the latent electrostatic image bearing member (photoconductor) is high when an image is formed. For example, the linear velocity of the latent electrostatic image bearing member is preferably 300 mm/sec or more, and more preferably 350 mm/sec or more. In the present invention, since the latent electrostatic image bearing member having the surface layer in which the concentration of the reactive silicone compound is varied in between the surface part of the surface layer and the innerlayer part of the surface layer is used, the effect of preventing occurrences of abnormal images can be observed when forming an image at high-linear velocities, and at a linear velocity exceeding 300 mm/sec, excellent effects can be observed.

<Developing and Developing Unit>

In the developing, the latent electrostatic image is developed using a toner or a developer to form a visible image.

The visible image can be formed by developing the latent electrostatic image using the toner or the developer by means of the developing unit.

The developing unit is not particularly limited as long as the developing unit is capable of developing a latent electrostatic image using a toner or a developer, and may be suitably selected from among those known in the art. Preferred examples thereof include a developing unit having at least an image developing device which is configured to house a toner or a developer therein and is capable of giving the toner or the developer to the latent electrostatic image either in contact or out of contact.

For the image developing device, a dry-developing process or a wet-developing process may be employed. It may be a monochrome color image developing device or a multi-color image developing device. Preferred examples of the image developing device include the one equipped with a stirrer by which the developer is frictionally stirred to be charged, and a rotatable magnet roller.

In the image developing device, for example, the toner and a carrier are mixed and stirred, the toner is charged by frictional force at that time to be held in a state where the toner is standing on the surface of the rotating magnet roller to thereby form a magnetic brush. Since the magnet roller is located near the latent electrostatic image bearing member (photoconductor), a part of the toner constituting the magnetic brush formed on the surface of the magnet roller moves to the surface of the latent electrostatic image bearing member (photoconductor) by electric attraction force. As the result, the latent electrostatic image is developed using the toner to form a visible toner image on the surface of the latent electrostatic image bearing member (photoconductor).

A developer to be housed in the developing apparatus may be a one-component developer or a two-component developer.

<Transferring and Transferring Unit>

In the transferring, the visible image is transferred onto a recording medium, and there are two aspects of transferring, i.e., an aspect in which the visible image is directly transferred onto a recording medium from the surface of the latent electrostatic image bearing member, and an aspect in which an intermediate transfer member is used, the visible image is primarily transferred to the intermediate transfer member and the visible image is secondarily transferred onto the recording medium. Any of the above-mentioned aspects may be preferably used.

The transferring can be carried out, for example, by charging a visible image formed on the surface of the latent electrostatic image bearing member (photoconductor) using a transfer-charger to transfer the visible image, and this is enabled by means of the transferring unit.

The transferring unit preferably has a function to exfoliate and charge the visible image formed on the latent electrostatic image bearing member to transfer the visible image onto a recording medium or an intermediate recording medium. For the transferring unit, a transfer roller, and a transfer belt are preferably exemplified. A transfer belt also provided with a conveying function to covey the recording medium (transfer-conveying belt) is preferable.

For the polarity of a charge to be applied to the transferring unit, usually, a positive charge is applied to the transferring unit, and it is necessary for the transferring unit to apply a positive electric potential to the latent electrostatic image bearing member in consideration of the charge polarity of the latent electrostatic image bearing member, the charge polarity of the toner, and in consideration that nega-posi developing method is a primarily used method in the art.

The intermediate recording medium is not particularly limited and may be suitably selected from among conventional recording media in accordance with the intended use. For example, a transfer sheet is preferably exemplified.

For the recording medium, typically, regular papers are used, however, the recording medium is not particularly limited as long as an unfixed image after developing can be transferred to the recording medium, and may be suitably selected in accordance with the intended use. For example, PET-base recording media for OHP can also be used.

<Fixing and Fixing Unit>

In the fixing, a visible image which has been transferred onto a recording medium is fixed by means of a fixing unit, and the image fixing may be performed every time each color toner is transferred onto the recording medium or at a time so that each of individual color toners are superimposed at a time.

The fixing unit is not particularly limited, may be suitably selected in accordance with the intended use, and heat-pressurizing units known in the art are preferably used. Examples of the heat-pressurizing unit include a combination of a heat roller and a pressurizing roller, and a combination of a heat roller, a pressurizing roller, and an endless belt.

The heating temperature in the heat-pressurizing unit is preferably 80° C. to 200° C.

—Charge Elimination and Charge Elimination Unit—

In the charge elimination, a charge-eliminating bias is applied to the latent electrostatic image bearing member to eliminate a charge thereon, and it can be suitably performed by means of a charge-eliminating unit.

The charge-eliminating unit is not particularly limited as long as the charge-eliminating unit is capable of applying a charge-eliminating bias to the latent electrostatic image bearing member, and may be suitably selected from among charge-eliminating units known in the art. For example, a charge-eliminating lamp or the like is preferably exemplified.

—Cleaning and Cleaning Unit—

In the cleaning, a residual toner remaining on the latent electrostatic image bearing member is removed, and the latent electrostatic image bearing member can be excellently cleaned by means of a cleaning unit.

The cleaning unit is not particularly limited, provided that the cleaning unit is capable of removing a residual toner remaining on the latent electrostatic image bearing ember, and may be suitably selected from among those known in the art. Examples of the cleaning unit include magnetic brush cleaners, electrostatic brush cleaners, magnetic roller cleaners, blade cleaners, brush cleaners, and web cleaners.

In the recycling, the toner that had been eliminated in the cleaning is recycled to the developing unit, and the recycling can be suitably carried out by means of a recycling unit.

The recycling unit is not particularly limited, and examples thereof include conveying units known in the art.

In the controlling, the respective steps can be controlled, and the controlling can be suitably carried out by means of a controlling unit.

The controlling unit is not particularly limited as long as the controlling unit can control the operations of the respective units, and examples thereof include equipment such as sequencers, and computers.

Figure 3:
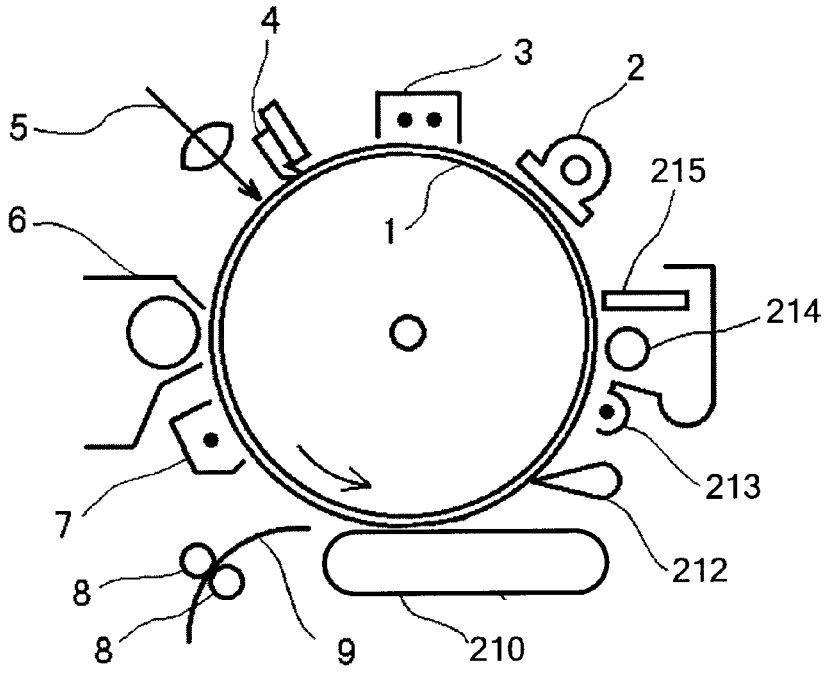
FIG. 3 is a schematic view showing one example of an image forming apparatus of the present invention.

Hereinafter, an aspect of the image forming method of the present invention using the image forming apparatus of the present invention will be described with reference to FIG. 3. FIG. 3 is a schematic view showing one example of an image forming apparatus of the present invention.

In the image forming apparatus shown in FIG. 3, a latent electrostatic image bearing member (photoconductor) has a substrate, and at least a photosensitive layer and a surface layer formed in this order on the substrate, wherein the surface layer contains a hardened material composed of at least a trifunctional or more radical polymerizable compound having no charge transporting structure, a radical polymerizable compound having a charge transporting structure, and a reactive silicone compound having any one of an acryloyloxy group and a methacryloyloxy group, and the concentration of the reactive silicone compound in the surface layer is varied in between the surface of the surface layer and the inside thereof.

For a unit to charge the photoconductor averagely, a charge charger 3 is used. For the charging unit, it is possible to use a corotoron device, a scorotoron device, a discharge device, a needle electrode device, a roller charge device, and a conductive brush device can be used, and a charging unit based on a known method can be used.

The configuration of the latent electrostatic image bearing member of the present invention is effective when using a charging unit which is configured such that the photoconductor composition can be chemically dissolved by effect of proximity discharge from a charging unit like a charger based on a contact charging method or a non-contact and proximity charging method. The contact charging method is a charging method in which a charge roller, a charge brush, a charge blade or the like directly makes contact with a photoconductor. In the meanwhile, the proximity charging method is a charging method in which a charging unit is arranged near a photoconductor and out of contact with the photoconductor such that a void having a size of 200 μm or less is ensured between the photoconductor surface and the charging unit.

The size of the void is preferably 10 μm to 200 μm, and more preferably 10 μm to 100 μm.

When the void size is exceedingly large, charging may be easily unstable, and when the void size is exceedingly small, the surface of a charging member may be contaminated when a residual toner remains on the photoconductor.

An image exposing unit 5 is used to form a latent electrostatic image on a uniformly charged latent electrostatic image bearing member (photoconductor) 1. For the light source, it is possible to use general illuminants, such as a fluorescent light, a tungsten lamp, a halogen lamp, a mercury vapor lamp, a sodium lamp, a light emitting diode (LED), a laser diode (LD) and an electro luminescence (EL). For exposing a light having only a desired wavelength, various filters, such as a sharp cut filter, a band pass filter, a near-infrared cutting filter, a dichroic filter, an interference filter and a color conversion filter can be used.

Next, for visualizing the electrostatic latent image formed on the photoconductor 1, a developing unit 6 is used. Examples of the developing method include a one-component developing and a two-component developing using a dry toner and a wet developing using a wet toner. By charging the photoconductor 1 positively (negatively) and by exposing the image on the photoconductor 1, a positive (negative) electrostatic latent image is formed on the surface of the photoconductor 1. Further, by developing the formed latent image with a negative (positive) toner (voltage-detecting fine particles), a positive image can be obtained and by developing the formed latent image with a positive (negative) toner, a negative image can be obtained.

Next, for transferring the visualized toner image on the photoconductor 1 onto a recording medium 9, a transfer belt 10 is used. A positive electric potential is applied to the photoconductor 1 by means of a transfer belt 10. For transferring the toner image more advantageously, a transferring pre-charger 7 may also be used. For the electrostatic transferring method, the above-noted charging unit can be utilized.

Next, as a unit for peeling a recording medium 9 from the photoconductor 1, a peeling blade 212 can be used. Examples of the other peeling units include electrostatic adsorption inducing peeling units, side belt peeling units, top grip conveying units, and curvature peeling units.

Next, for removing a residual toner remaining on the photoconductor 1 after the transferring, a fur brush 214 and a cleaning blade 215 are used. For removing the residual toner more effectively, a cleaning pre-charger 213 may be also used. Examples of the other cleaning units include web cleaning units, and magnetic brush cleaning units. Each of these cleaning units may be used individually or in combination with two or more.

Next, optionally for removing the latent image formed on the photoconductor 1, a charge-eliminating unit is used. For the charge-eliminating unit, a charge-eliminating lamp 2 or a charge eliminating charger is used. For the charge-eliminating lamp 2 and the charge-eliminating charger respectively, the above-mentioned exposing light source and charging unit can be used respectively.

Besides, for a document reading unit, a paper feeding unit, a fixing unit and a paper discharging unit each of which is arranged distantly from the photoconductor 1, conventional units may be used.

Figure 4:
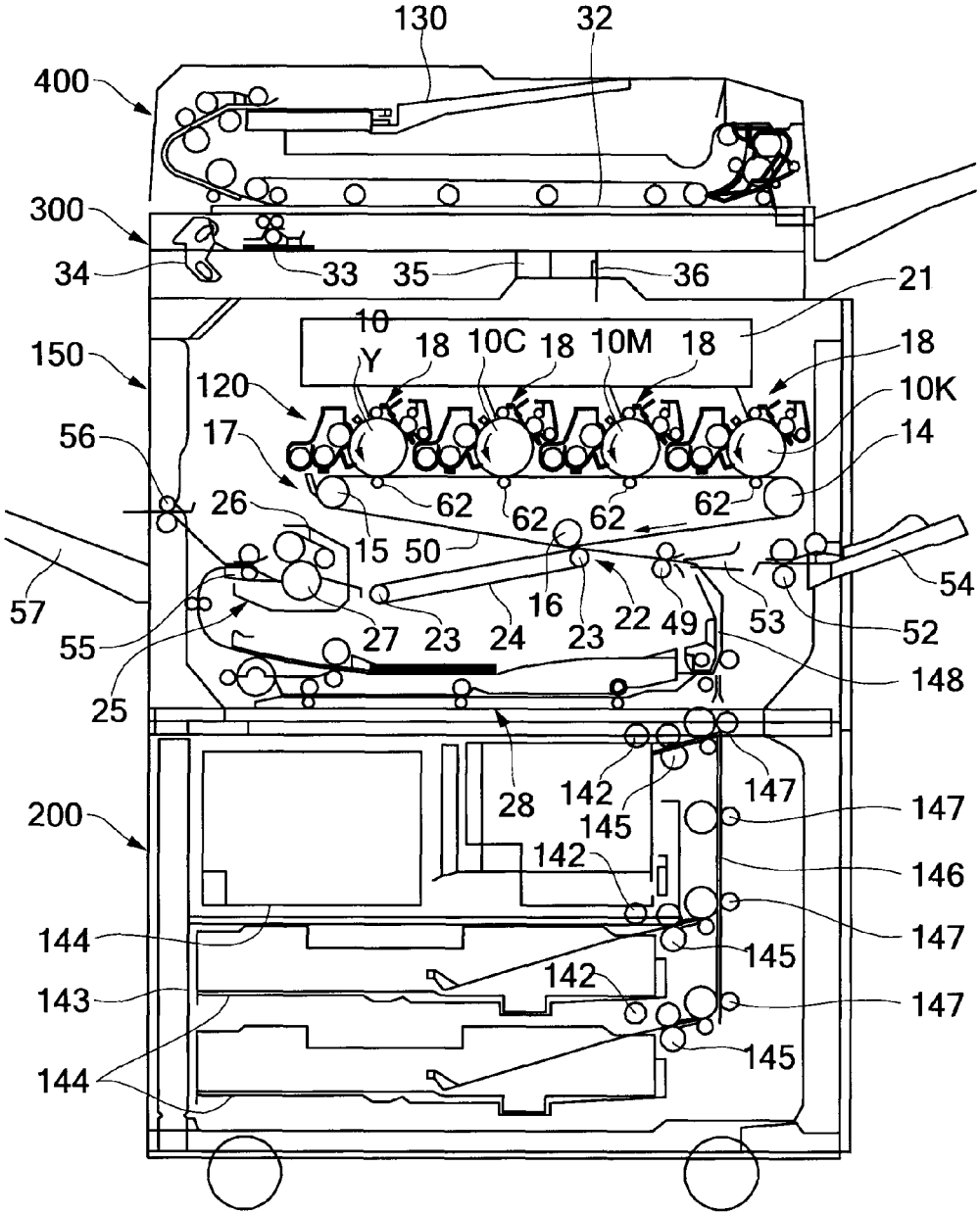
FIG. 4 is a schematic illustration for explaining one example to carry out an image forming method of the present invention through the use of an image forming apparatus (a tandem type color image forming apparatus) of the present invention.

Next, another aspect of carrying out the image forming method of the present invention using the image forming apparatus of the present invention will be described below with reference to FIG. 4. A tandem image forming apparatus shown in FIG. 4 is a tandem color image forming apparatus. The tandem image forming apparatus is provided with a copier main body 150, a sheet feeder table 200, a scanner 300, and an automatic document feeder (ADF) 400.

The copier main body 150 is provided with an endless belt intermediate transfer member 50 at its center part. The intermediate transfer member 50 is spanned over three support rollers 14, 15, and 16 and is capable of rotating and moving in a clockwise direction in FIG. 8. An intermediate image-transfer member cleaning device 17 is capable of removing residual toner from the intermediate transfer member 50 after the transferring and is arranged in the vicinity of the support roller 15. Above the intermediate transfer member 50 spanned between the support rollers of 14 and 15, yellow, cyan, magenta, and black image forming units 18, namely four image forming devices are arrayed in parallel in the moving direction of the intermediate transfer member 50 to thereby constitute the tandem image developing device 120. An exposer 21 is arranged in the vicinity of the tandem image developing device 120. A secondary image transferer 22 is arranged so as to face the tandem image developing device 120 with the interposition of the intermediate transfer member 50. The secondary image transferer 22 is provided with a secondary transfer endless belt 24 spanned over a pair of rollers 23. The transferring sheet transported in the vicinity of the secondary transfer belt 24 is capable of being in contact with the intermediate transfer member 50. An image fixing device 25 is arranged on the side of the secondary image-transferer 22. The image fixing device 25 is provided with a fixing endless belt 26 and a pressure roller 27 arranged to be pressed by the fixing belt 26.

In the tandem image forming apparatus, a sheet reverser 28 is arranged in the vicinity of the secondary image-transferer 22 and the image fixing device 25. The sheet reverser 28 is capable of reversing the transferring sheet so as to form images on both sides of the transferring sheet.

Hereinafter, the way a full-color image, i.e. color copy is formed by using the tandem image forming apparatus will be described. Initially, a document is placed on a document platen 130 of the automatic document feeder (ADF) 400. Alternatively, the automatic document feeder (ADF) 400 is opened, a document is placed on a contact glass 32 of the scanner 300, and the automatic document feeder (ADF) 400 is closed to press the document.

When pushing a starting switch (not shown), the document placed on the automatic document feeder 400 is transported onto the contact glass 32. When the document is initially place on the contact glass 32, the scanner 300 is immediately driven to operate a first carriage 33 and a second carriage 34.

A light is applied from a light source to the document by action of the first carriage 33, and the reflected light from the document is further reflected toward the second carriage 34. The reflected light is further reflected by a mirror of the second carriage 34 and passes through image-forming lens 35 into a read sensor 36 to read the color document, i.e. color image to thereby obtain black, yellow, magenta, and cyan image information.

Figure 5:
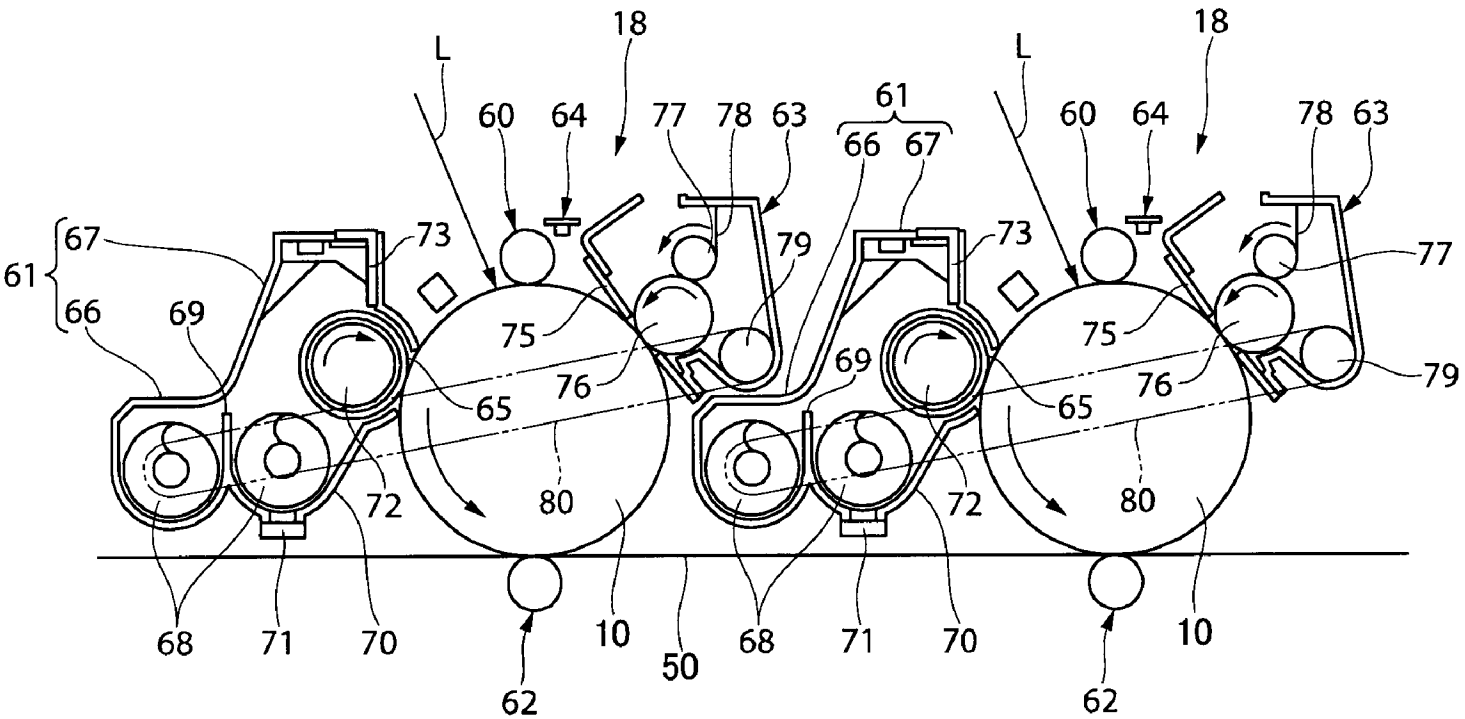
FIG. 5 is a partially enlarged schematic illustration of the image forming apparatus shown in FIG. 4.

Each of the black, yellow, magenta, and cyan image information is transmitted to each of the image forming devices 18, i.e. black, yellow, magenta, and cyan image forming devices in the tandem image forming apparatus to thereby form respective toner images in black, yellow, magenta, and cyan therein. Specifically, each of the image forming devices 18, i.e. black, yellow, magenta, and cyan image forming devices in the tandem image forming apparatus is provided with, as shown in FIG. 5, a photoconductors 10, i.e. a black photoconductor 10K, a yellow photoconductor 10Y, a magenta photoconductor 10M, and a cyan photoconductor 10C; a charger 60 configured to charge the photoconductor uniformly; an exposer configured to expose the photoconductor imagewisely so as to correspond to each color image based on each color image information, which is represented by L in FIG. 5, to form a latent electrostatic image on the photoconductor so as to correspond to each of the color images; an image developing device 61 configured to develop the latent electrostatic image using each of the color toners, i.e. black toner, yellow toner, magenta toner, and cyan toner to form a toner image which contains each of these color toners; a transfer charger 62 used for transferring the toner image onto the intermediate transfer member 60; a cleaning device 63 for cleaning the photoconductor, and a charge-eliminator 64 to thereby respectively form a monochrome image, i.e. a black image, a yellow image, a magenta image, and a cyan image based on the respective color image information. The black image, the yellow image, the magenta image, and the cyan image formed as above, i.e. the black image formed on the black photoconductor 10K, the yellow image formed on the yellow photoconductor 10Y, the magenta image formed on the magenta photoconductor 10M, and the cyan image formed on the cyan photoconductor 10C are sequentially transferred (primary transferring) onto the intermediate transfer member 50 which is rotated and shifted by the support rollers 14, 15, and 16. Then, the black image, the yellow image, the magenta image, and the cyan image are superimposed on the intermediate transfer member 50 to thereby form a composite color image, i.e. a transferred color image.

One of feeder rollers 142 in the feeder table 200 is selectively rotated, sheets or recording papers are ejected from one of multiple feeder cassettes 144 in a paper bank 143 and are separated by a separation roller 52 one by one into a feeder path 146 and are transported by a transport roller 147 into a feeder path 148 in the copier main body 150 and are bumped against a resist roller 49 and stopped. Alternatively, the feeder roller 142 is rotated to eject sheets or recording papers on a manual bypass tray 54, the sheets are separated one by one by the separation roller 145 into a manual bypass feeder path 53 and are bumped against the resist roller 49 and stopped. The resist roller 49 is generally grounded, however, may be used under the application of a bias to remove paper dust of sheets.

The resist roller 49 is rotated in synchronization with the movement of the composite color image, i.e. transferred color image on the intermediate transfer member 50 to transport the sheet or recording paper into between the intermediate transfer member 50 and the secondary image-transferer 22, and the composite color image, i.e. transferred color image is transferred onto the sheet by action of the secondary image-transferer 22 (secondary transferring) to thereby transfer the color image to the sheet or recording paper. Separately, the intermediate transfer member cleaning device 17 removes residual toner remaining on the intermediate transfer member 50 after the transferring.

The sheet or recording paper formed with the transferred color image is transported by the secondary image-transferer 22 into the image fixing device 25, is applied with heat and pressure in the image fixing device 25 to fix the composite color image, i.e. transferred color image on the sheet or recording paper. The sheet then changes its direction by action of a switch blade 55 and ejected by an ejecting roller 56 to be stacked on an output tray 57. Alternatively, the sheet changes its direction by action of the switch blade 55 into the sheet reverser 28, turns therein, is transported again to the transfer position, followed by image formation on the backside of the sheet. The sheet bearing images on both sides thereof is ejected through the ejecting roller 56 and then stacked onto the output tray 57.

(Process Cartridge)

The process cartridge of the present invention is provided with a latent electrostatic image bearing member, and at least one selected from a charging unit, a developing unit, a transferring unit, a cleaning unit, and a charge-eliminating unit, further provided with other units in accordance with the necessity so as to be detachably mounted to a main body of an image forming apparatus.

The details of the electrostatic image bearing member and the transferring unit are as described above, and the latent electrostatic image bearing member has a photosensitive layer and a surface layer formed in this order on a substrate, the surface layer contains a hardened material containing at least a trifunctional or more radical polymerizable compound having no charge transporting structure, a radical polymerizable compound having a charge transporting structure, and a reactive silicone compound having any one of an acryloyloxy group and a methacryloyloxy group, and the concentration of the reactive silicone compound in the surface layer is varied in between the surface part of the surface layer and the inner-layer part. The transferring unit is configured to apply a positive electric potential to a visible image formed on the latent electrostatic image bearing member via a recording medium.

Figure 6:
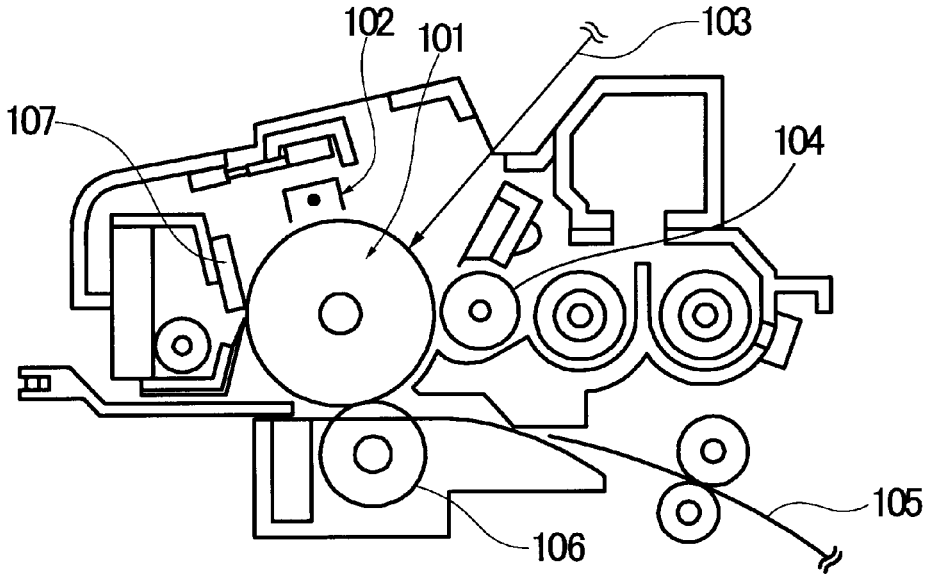
FIG. 6 is a schematic view showing one example of a process cartridge of the present invention.

Here, the process cartridge incorporates, as shown in FIG. 6, a photoconductor 101, and is provided with a charging unit 102, a developing unit 104, a transferring unit 106, a cleaning unit 107, and a charge-eliminating unit (not shown), and is detachably attached to the main body of the image forming apparatus.

Next, detailed processes of an image forming method using a process cartridge shown in FIG. 6 will be described below. A photoconductor 101 is charged by means of a charging unit 102 and exposed by means of an exposing unit 103 (not shown) while rotating in the direction indicated by the arrow in FIG. 6 to thereby form a latent electrostatic image corresponding to the exposed image on the surface of the photoconductor 101. The latent electrostatic image is developed by a developing unit 104 using a toner, and the toner image is transferred onto a recording medium 105 by a transferring unit 106 and then printed out. Next, the photoconductor surface after transferring the toner image is cleaned by a cleaning unit 107, and further, a charge remaining on the photoconductor surface is removed by a charge-eliminating unit (not shown), followed by repeating the above-noted operations.

In the image forming apparatus, the image forming method, and the process cartridge of the present invention, occurrences of abnormal images that would be caused by repetitive use can be prevented, and high-resolution images can be stably formed over a long period of time because a latent electrostatic image bearing member is used which is provided with a photosensitive layer having a surface layer allowing for preventing occurrences of abnormal images which are attributable to residual negative images that would be formed on the latent electrostatic image bearing member by effect of a bias applied from a transfer roller or a transfer belt.

EXAMPLES

Synthesis Example of Monofunctional Compound Having a Charge Transporting Structure The monofunctional compound having a charge transporting structure of the present invention can be synthesized by a method described in Japanese Patent (JP-B) No. 3164426. On example of the synthesis method will be described below.

(1) Synthesis of Hydroxy Group-Substituted Triarylamine Compound (Represented by the Following Structural Formula B)

In a vessel, 240 mL of sulfolane was added to 113.85 g (0.3 mol) of a methoxy group-substituted triarylamine compound (represented by the following Structural Formula A) and 138 g (0.92 mol) of sodium iodide, and the mixture solution was heated to 60° C. in a nitrogen stream. Into the mixture solution, 99 g (0.91 mol) of trimethylchlorosilane was delivered by drops for 1 hour, and the mixture solution was stirred at a temperature of about 60° C. for 4.5 hours, and then the reaction was stopped. To the reaction solution, about 1.5 L of toluene was added, and the reaction solution was cooled down to the room temperature, followed by repeatedly washing with water and a sodium carbonate aqueous solution. Thereafter, a solvent was removed from the toluene solution, and the solution was subjected to a column chromatography treatment (adsorption medium: silica gel, developing solvent: toluene: ethyl acetate=20:1) to purify the solution, thereby a light yellow oil was obtained. To the obtained light yellow oil, cyclohexane was added to thereby precipitate a crystal.

Through the above-noted processes, 88.1 g (yield=80.4%) of a white crystal represented by the following Structural Formula B was obtained. The melting point of the obtained compound was 64.0° C. to 66.0° C.

TABLE 1

| | Analyzed value of Atom (%) | | |
|---|---|---|---|
| | C | H | N |
| Actual measurement value | 85.06 | 6.41 | 3.73 |
| Calculated value | 85.44 | 6.34 | 3.83 |

Structural Formula A

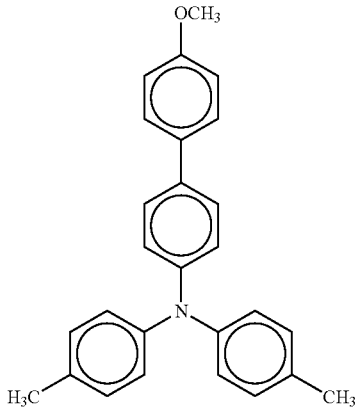

Structural Formula B

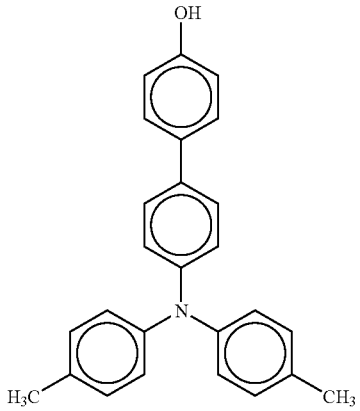

(2) Triarylamino Group-Substituted Acrylate Compound (Exemplified Compound No. 54 Described Above)

In a vessel, 82.9 g (0.227 mol) of the hydroxy group-substituted triarylamine compound (represented by Structural Formula B) obtained in the (1) described above is dissolved in 400 mL of tetrahydrofuran, and a sodium hydroxide aqueous solution (NaOH: 12.4 g, water: 100 mL) was delivered by drops into the dispersion in a nitrogen stream. The solution was cooled down to 5° C., and 25.2 g (0.272 mol) of acrylic acid chloride was delivered by drops to the solution for 40 minutes. Thereafter, the solution was stirred at 5° C. for 3 hours, and the reaction was stopped. The reaction solution was poured into water, and then an extract solution was obtained therefrom by using toluene. The extract solution was repeatedly washed with a sodium hydrogen carbonate aqueous solution and water. Thereafter, a solvent was removed from the toluene solution, and the solution was subjected to a column chromatography treatment (adsorption medium: silica gel, developing solvent: toluene: toluene) to purify the solution, thereby a colorless oil was obtained.

Then, n-hexane was added to the obtained colorless oil to precipitate a crystal. Consequently, 80.73 g (yield=84.8%) of a white crystal represented by Exemplified Compound No. 54 was obtained. The melting point of the obtained compound was 117.5° C. to 119.0° C.

TABLE 2

| | Analyzed Value of Atom (%) | | |
|---|---|---|---|
| | C | H | N |
| Actual measurement value | 83.13 | 6.01 | 3.16 |
| Calculated value | 83.02 | 6.00 | 3.33 |

(3) Synthesis of Exemplified Compound No. 105

A hydroxy group-substituted triarylamine compound was synthesized from a methoxy group-substituted triarylamine compound having an intended molecular structure in a synthesis procedure similarly to the synthesis of the Exemplified Compound No. 54, and the hydroxy group-substituted triarylamine compound was reacted with acrylic acid chloride to thereby synthesize a triarylamino group-substituted acrylate compound having a structure represented by the Exemplified Compound No. 105. It was confirmed that the triarylamino group-substituted acrylate compound was the intended compound based on the analyzed results of atoms therein.

Hereinafter, the present invention I will be further described in detail referring to specific Examples and Comparative Examples, however, the present invention I is not limited to the disclosed Examples. In the Examples and Comparative Examples, "part" or "parts" denotes "part by mass" or "parts by mass", and "%" denotes "% by mass".

Synthesis Example I-1

—Synthesis of Titanyl Phthalocyanine Pigment—

In a vessel, 292 g of 1,3-diiminoisoindoline was mixed with 2,000 mL of sulfolane, and 204 g of titanium tetrabuthoxide was delivered by drops into the mixture solution under a nitrogen stream. Upon completion of the dripping, the temperature of the mixture solution was gradually raised to 180° C., and the mixture solution was stirred for 5 hours while keeping the reaction temperature ranging from 170° C. to 180° C. to perform a reaction. After completion of the reaction, the reaction solution was left to cool, and then the obtained precipitate was filtered, and the filtered precipitate was washed with chloroform until the powder turned into blue color.

Next, the filtered precipitate was washed with methanol several times, further washed with hot water of 80° C. several times, and then dried to thereby obtain a coarse titanyl phthalocyanine.

The obtained titanyl phthalocyanine was dissolved in 20 times its volume of a concentrated sulfuric acid, and the titanyl phthalocyanine dissolution was delivered by drops into 100 times its volume of iced water with stirring to precipitate a crystal, and then the precipitated crystal was filtered. Next, the filtered crystal was repeatedly washed until the washing fluid was neutralized to thereby obtain a wet cake of a titanylphthalocyanine pigment. The obtained wet cake was washed thoroughly with ion exchange water.

In a vessel, 20 g of the obtained wet cake was added to 200 g of 1,2-dichloroethane, and the mixture solution was stirred for 4 hours. To the mixture solution, 1,000 g of methanol was added, and then the mixture solution was stirred for 1 hour, filtered and dried to thereby obtain a titanyl phthalocyanine powder. This was taken as "pigment 1".

The X-ray diffraction spectrum of the obtained titanyl phthalocyanine pigment was measured under the following conditions.

<Measurement Condition>

Figure 7:
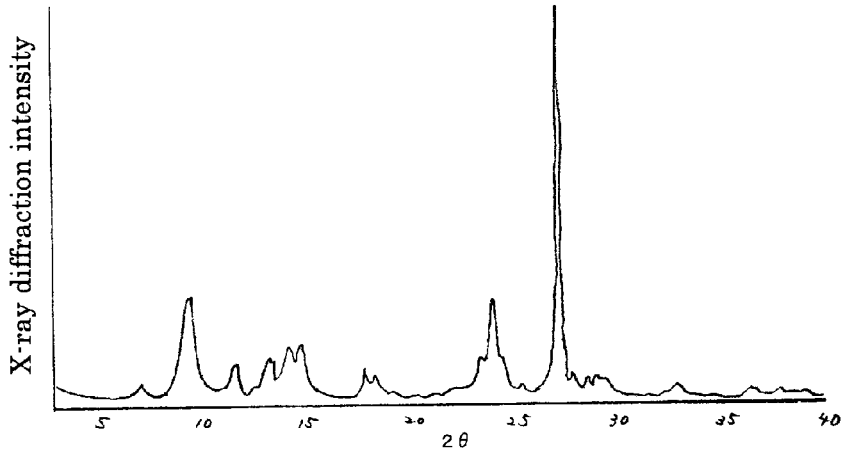
FIG. 7 is a graph showing an X-ray diffraction spectrum of the titanyl phthalocyanine used in Examples of the present invention.

X-ray tube: Cu
Voltage: 40 kV
Current: 20 mA
Scanning speed: 1°/min
Scanning coverage: 3° to 40°
Time constant: 2 seconds FIG. 7 shows the X-ray diffraction spectrum of the titanyl phthalocyanine obtained in the Synthesis Example I-1. The measurement result demonstrated that the obtained titanyl phthalocyanine pigment had a crystal form having major diffraction peaks specified by Bragg angle 2 θ of 9.6°±0.2°, 24.0°±0.2°, and 27.2°±0.2°.

Production Example I-1

—Preparation of Latent Electrostatic Image Bearing Member—

Over the surface of an aluminum cylinder having a diameter of 100 mm, an undercoat layer coating solution containing the following composition, a charge generating layer coating solution containing the following composition, and a charge transporting layer coating solution containing the following composition were sequentially applied and dried to thereby form an undercoat layer having a thickness of 3.5 μm, a charge generating layer having a thickness of 0.3 μm, and a charge transporting layer having a thickness of 23 μm on the cylinder.

Over the surface of the obtained charge transporting layer, a surface layer coating solution A and a surface layer coating solution B each containing the following composition were sequentially applied by spray-coating and then the cylinder surface with the surface layer coating solution A and the surface layer coating solution B applied thereon was irradiated with a light beam under the conditions of metal halide lamp: 160 W/cm, irradiation distance: 120 mm, irradiation intensity:
500 mW/cm$^2$, and irradiation time: 240 seconds.

Next, the cylinder surface was then dried at 130° C. for 20 minutes to thereby form a surface layer having a total thickness of 4 μm in which a crosslinked film having a thickness of 2 μm composed of the surface layer coating solution B was formed on a crosslinked film having a thickness of 2 μm composed of the surface layer coating solution A. Through the above-mentioned processes, a latent electrostatic image bearing member of Production Example I-1 was prepared.

| [Undercoat Layer Coating Solution] | |
|---|---|
| Alkyd resin (BECKOZOLE 1307-60-EL, manufactured by Dainippon Ink and Chemicals, Inc.) | 6 parts |
| Melamine resin (SUPER BECKAMINE G-821-60, manufactured by Dainippon Ink and Chemicals, Inc.) | 4 parts |
| Titanium oxide | 40 parts |
| Methylethylketone | 50 parts |

| [Charge Generating Layer Coating Solution] | |
|---|---|
| Titanyl phthalocyanine powder obtained in Synthesis Example I-1 | 4 parts |
| Polyvinyl butyral (ESLEC BM-S, manufactured by SEKISUI CHEMICAL CO., LTD.) | 2 parts |
| Methylethylketone | 150 parts |

| [Charge Transporting Layer Coating Solution] | |
|---|---|
| Bisphenol Z type polycarbonate (PANLIGHT TS-2050, manufactured by Teijin Chemicals, Ltd.) | 10 parts |
| Low-molecular weight charge transporting material (D-1) represented by the following Structural Formula (II) | 7 parts |
| Tetrahydrofuran | 100 parts |
| 1% silicone oil-dissolved tetrahydrofuran solution (KF50-100CS, manufactured by Shin-Etsu Chemical Co., Ltd) | 1 part |

Structural Formula (II)

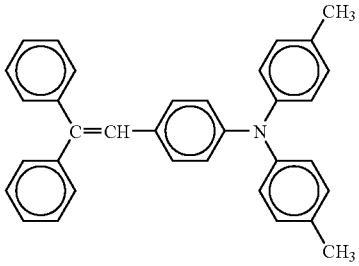

(D-1)

| [Surface Layer Coating Solution A] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) as a trifunctional or more radical polymerizable compound having no charge transporting structure | 10 parts |
| Monofunctional radical polymerizable compound having a charge transporting structure (the above-mentioned Exemplified Compound No. 54) | 10 parts |
| 1-hydroxy-cyclohexyl-phenyl-ketone (IRGACURE 184, manufactured by Chiba Specialty Chemicals K.K) as a photopolymerization initiator | 1 part |
| Reactive silicone oil compound represented by the following Structural Formula (III) (polysiloxane modified by methacrylic acid at both terminal ends, X-22-164A, manufactured by Shin-Etsu Chemical Co., Ltd.) | 1 part |
| Tetrahydrofuran | 100 parts |

Structural Formula (III)

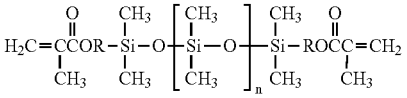

| [Surface Layer Coating Solution B] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) as a trifunctional or more radical polymerizable compound having no charge transporting structure | 10 parts |
| Monofunctional radical polymerizable compound having a charge transporting structure (the above-mentioned Exemplified Compound No. 54) | 10 parts |
| 1-hydroxy-cyclohexyl-phenyl-ketone (IRGACURE 184, manufactured by Chiba Specialty Chemicals K.K) as a photopolymerization initiator | 1 part |
| Reactive silicone oil compound represented by the Structural Formula (III) (polysiloxane modified by methacrylic acid at both terminal ends, X-22-164A, manufactured by Shin-Etsu Chemical Co., Ltd.) used for the surface layer coating solution A | 0.01 parts |
| Tetrahydrofuran | 100 parts |

-continued

Production Example I-2

A latent electrostatic image bearing member was produced in the same manner as in Production Example I-1 except that the added amount of the reactive silicone compound in the surface layer coating solution B was changed from 0.01 parts to 0.05 parts.

Production Example I-3

A latent electrostatic image bearing member was produced in the same manner as in Production Example I-1 except that the added amount of the reactive silicone compound in the surface layer coating solution B was changed from 0.01 parts to 0.1 parts.

Production Example I-4

A latent electrostatic image bearing member was produced in the same manner as in Production Example I-1 except that the added amount of the reactive silicone compound in the surface layer coating solution B was changed from 0.01 parts to 0.2 parts.

Comparative Production Example I-1

A latent electrostatic image bearing member was produced in the same manner as in Production Example I-1 except that only a surface layer coating solution C containing the following composition was used instead of the surface layer coating solutions A and B used in Production Example I-1, and the surface layer coating solution C was applied over the surface of a charge transporting layer by spray-coating to form a surface layer having a thickness of 4 μm.

| [Surface Layer Coating Solution C] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) as a trifunctional or more radical polymerizable compound having no charge transporting structure | 10 parts |
| Monofunctional radical polymerizable compound having a charge transporting structure (the above-mentioned Exemplified Compound No. 54) | 10 parts |
| 1-hydroxy-cyclohexyl-phenyl-ketone (IRGACURE 184, manufactured by Chiba Specialty Chemicals K.K) as a photopolymerization initiator | 1 part |
| Reactive silicone oil compound represented by the following Structural Formula (III) (polysiloxane modified by methacrylic acid at both terminal ends, X-22-164A, manufactured by Shin-Etsu Chemical Co., Ltd.) used for the surface layer coating solution A | 0.01 parts |
| Tetrahydrofuran | 100 parts |

Structural Formula (III)

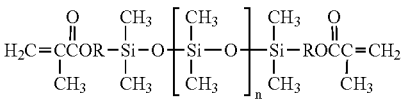

Examples I-1 to I-4 and Comparative Example I-1

<Paper-Passing Test>

A paper-passing test with 500,000 sheets of A4 size (MY PAPER, manufactured by NBS Ricoh Company Ltd.) was conducted for each of the latent electrostatic image bearing members (electrophotographic photoconductors) produced in Production Examples I-1 to I-4 and Comparative Example I-1 using an image forming apparatus (remodeled machine from IMAGIO NEO 751 manufactured by Ricoh Company Ltd., processing linear velocity: 350 mm/sec) under the condition of an electric charge potential of −800V at the starting time of the paper-passing test to evaluate each of the latent electrostatic image bearing members as to abrasion properties, electric potential in the image forming apparatus, and image properties based on the following methods.

—Abrasion Property—

With respect to the abrasion properties, the abrasion wear (μm) of each of the latent electrostatic image bearing members (electrophotographic photoconductors) was determined by measuring the film thickness thereof. As a film-thickness measurement device, an eddy current thicknessmeter (FISHERSCOPE) was used.

—Electric Potential in Image Forming Apparatus—

The electric potential in the image forming apparatus was determined from the surface electric potential at the time of outputting a white solid image with a grid voltage for the electric potential in the dark space fixed at −900 (V). The surface electric potential of each of the latent electrostatic image bearing members was measured using TREK MODEL344. The electric potential for exposed regions was determined from the surface electric potential at the time of outputting a black solid image after adjusting the grid electric potential such that the electric potential in the dark space was −800 (V).

—Image Property (Evaluation of Residual Negative Image)—

Figure 8:
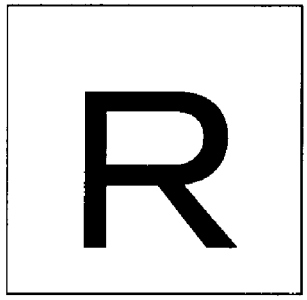
FIG. 8 is an original document used in the image evaluation in Examples of the present invention.
Figure 9:
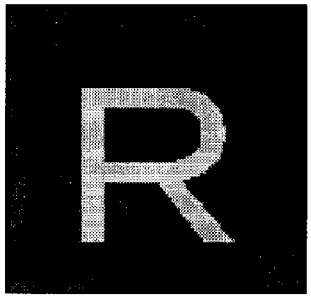
FIG. 9 is an residual negative image formed in a half tone image in the image evaluation in Examples of the present invention.

With respect to the image properties, the occurrence level of a residual negative image shown in FIG. 9 when outputting an image of an original document shown in FIG. 8 and then successively outputting halftone images thereof was evaluated. Table I-3 shows the evaluation results of abrasion property, Table I-4 shows the evaluation results of electric potential in the image forming apparatus, and Table I-5 shows the evaluation results of image properties.

TABLE I-3

| | Abrasion wear (μm) | |
|---|---|---|
| | No. of output sheets in succession: 100,000 | No. of output sheets in succession: 500,000 |
| Ex. I-1 | 0.6 | 3.1 |
| Ex. I-2 | 0.7 | 2.9 |
| Ex. I-3 | 0.7 | 3.1 |
| Ex. I-4 | 0.8 | 3.3 |
| Compara. Ex. I-1 | 0.6 | 3.0 |

TABLE I-4

| | Electric potential in image forming apparatus (−V) | | | | | |
|---|---|---|---|---|---|---|
| | Initial stage | | No. of output sheets in succession: 100,000 | | No. of output sheets in succession: 500,000 | |
| | Dark space | Exposed region | Dark space | Exposed region | Dark space | Exposed region |
| Ex. I-1 | 790 | 90 | 740 | 150 | 720 | 160 |
| Ex. I-2 | 790 | 100 | 740 | 160 | 720 | 170 |
| Ex. I-3 | 780 | 120 | 750 | 160 | 720 | 170 |
| Ex. I-4 | 800 | 130 | 760 | 160 | 740 | 180 |
| Compara. Ex. I-1 | 800 | 90 | 750 | 150 | 730 | 160 |

TABLE I-5

| | Image Property | | |
|---|---|---|---|
| | Initial stage | No. of output sheets in succession: 100,000 sheets | No. of output sheets in succession: 500,000 sheets |
| Ex. I-1 | A | A | A |
| Ex. I-2 | A | A | A |
| Ex. I-3 | A | A | A |
| Ex. I-4 | A | A | A |
| Compara. Ex. I-1 | A | B | C |

* Evaluation Criteria on residual negative images shown in Table I-5:
A: No residual negative images occurred.
B: A slightly amount of residual negative images occurred.
C: Residual negative images apparently occurred.

The results shown in Tables I-3 to I-5 verified that the latent electrostatic image bearing members of Examples I-1 to I-4 were excellent in abrasion resistance and electric potential in the image forming apparatus and allowed for forming excellent quality of images without causing residual negative images even after being subjected to a paper-passing test of 500,000 sheets. In contrast, with the use of the latent electrostatic image bearing member of Comparative Example I-1, a slightly amount of residual negative images occurred in the paper-passing test of 100,000 sheets, and residual negative images apparently occurred in the paper-passing test of 500,000 sheets, although the latent electrostatic image bearing member was excellent in abrasion resistance and electric potential in the image forming apparatus.

Production Example I-5

—Preparation of Latent Electrostatic Image Bearing Member—

Over the surface of an aluminum cylinder having a diameter of 100 mm, an undercoat layer coating solution containing the following composition, a charge generating layer coating solution containing the following composition, and a charge transporting layer coating solution containing the following composition were sequentially applied and dried to thereby form an undercoat layer having a thickness of 1.0 μm, a charge generating layer having a thickness of 0.3 μm, and a charge transporting layer having a thickness of 23 μm on the cylinder.

Over the surface of the obtained charge transporting layer, a surface layer coating solution D, a surface layer coating solution E, and a surface layer coating solution F each containing the following composition were applied by spray-coating and then the cylinder surface with the surface layer coating solution D, the surface layer coating solution E and the surface layer coating solution F applied thereon was irradiated with a light beam under the conditions of metal halide lamp: 160 W/cm, irradiation distance: 120 mm, irradiation intensity: 500 mW/cm$^2$, and irradiation time: 240 seconds. Next, the cylinder surface was then dried at 130° C. for 20 minutes to thereby form a surface layer having a total thickness of 4.2 μm in which a crosslinked film having a thickness of 1.4 μm composed of the surface layer coating solution D, a crosslinked film having a thickness of 1.4 μm composed of the surface layer coating solution E, and a crosslinked film having a thickness of 1.4 μm composed of the surface layer coating solution F were formed in a laminate structure. Through the above-mentioned processes, a latent electrostatic image bearing member of Production Example I-5 was prepared.

| [Undercoat Layer Coating Solution] | |
|---|---|
| Titanium oxide | 40 parts |
| Alcohol-soluble nylon | 32 parts |
| Methanol | 400 parts |
| Isopropanol | 160 parts |

| [Charge Generating Layer Coating Solution] | |
|---|---|
| Titanyl phthalocyanine powder synthesized in Synthesis Example I-1 | 4 parts |
| Polyvinylbutyral (ESLEC BM-S, manufactured by SEKISUI CHEMICAL CO., LTD.) | 2 parts |
| Methylethylketone | 150 parts |

| [Charge Transporting Layer Coating Solution] | |
|---|---|
| Bisphenol Z type polycarbonate (PANLIGHT TS-2050, manufactured by Teijin Chemicals, Ltd.) | 10 parts |
| Low-molecular weight charge transporting material (D-1) represented by the following Structural Formula (II) | 7 parts |
| Tetrahydrofuran | 100 parts |
| 1% silicone oil-dissolved tetrahydrofuran solution (KF50-100CS, manufactured by Shin-Etsu Chemical Co., Ltd.) | 1 part |

Structural Formula (II)

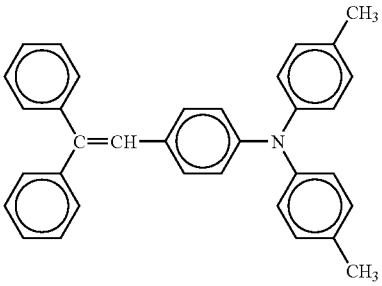

(D-1)

| [Surface Layer Coating Solution D] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) | 15 parts |

-continued

| [Surface Layer Coating Solution D] | |
|---|---|
| as a trifunctional or more radical polymerizable compound having no charge transporting structure | |
| Monofunctional radical polymerizable compound having a charge transporting structure (the above-mentiond Exemplified Compound No. 54) | 5 parts |
| 1-hydroxy-cyclohexyl-phenyl-ketone (IRGACURE 184, manufactured by Chiba Specialty Chemicals K.K) as a photopolymerization initiator | 1 part |
| Reactive silicone oil compound represented by the following Structural Formula (IV) (polysiloxane modified by methacrylic acid at one side terminal end, X-22-174DX, manufactured by Shin-Etsu Chemical Co., Ltd.) | 3 parts |
| Tetrahydrofuran | 100 parts |

Structural Formula (IV)

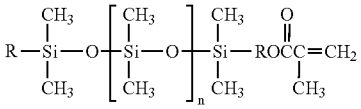

| [Surface Layer Coating Solution E] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) as a trifunctional or more radical polymerizable compound having no charge transporting structure | 10 parts |
| Monofunctional radical polymerizable compound having a charge transporting structure (the above-mentioned Exemplified Compound No. 105) | 10 parts |
| 1-hydroxy-cyclohexyl-phenyl-ketone (IRGACURE 184, manufactured by Chiba Specialty Chemicals K.K) as a photopolymerization initiator | 1 part |
| Reactive silicone oil compound represented by the Structural Formula (IV) (polysiloxane modified by methacrylic acid at one side terminal end, X-22-174DX, manufactured by Shin-Etsu Chemical Co., Ltd.) used in the surface layer coating solution D | 1 part |
| Tetrahydrofuran | 100 parts |

| [Surface Layer Coating Solution F] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) as a trifunctional or more radical polymerizable compound having no charge transporting structure | 5 parts |
| Monofunctional radical polymerizable compound having a charge transporting structure (the above-mentioned Exemplified Compound No. 105) | 15 parts |
| 1-hydroxy-cyclohexyl-phenyl-ketone (IRGACURE 184, manufactured by Chiba Specialty Chemicals K.K) as a photopolymerization initiator | 1 part |
| Reactive silicone oil compound represented by the Structural Formula (IV) (polysiloxane modified by methacrylic acid at one side terminal end, X-22-174DX, manufactured by Shin-Etsu Chemical Co., Ltd.) used in the surface layer coating solution D | 0.01 parts |
| Tetrahydrofuran | 100 parts |

Production Example I-6

A latent electrostatic image bearing member was produced in the same manner as in Example I-5 except that the added amount of the reactive silicone compound in the surface layer coating solution F was changed from 0.01 parts to 0.03 parts.

Production Example I-7

A latent electrostatic image bearing member was produced in the same manner as in Example I-5 except that the added amount of the reactive silicone compound in the surface layer coating solution F was changed from 0.01 parts to 0.05 parts.

Production Example I-8

A latent electrostatic image bearing member was produced in the same manner as in Example I-5 except that the added amount of the reactive silicone compound in the surface layer coating solution F was changed from 0.01 parts to 0.1 parts.

Comparative Production Example I-2

A latent electrostatic image bearing member was produced in the same manner as in Example I-5 except that only a surface layer coating solution G containing the following composition was used instead of the surface layer coating solutions D, E and F used in Production Example I-5, and the surface layer coating solution G was applied over the surface of a charge transporting layer by spray-coating to form a surface layer having a thickness of 4.2 μm.

| [Surface Layer Coating Solution G] | |
|---|---|
| Dipentaerythritol hexaacrylate (KAYARAD DPHA, manufactured by Nippon Kayaku Co., Ltd., molecular mass: 536, the number of functional groups:5.5, molecular mass/the number of functional groups = 97) as a trifunctional or more radical polymerizable compound having no charge transporting structure | 10 parts |
| Monofunctional radical polymerizable compound having a charge transporting structure (the above-mentioned Exemplified Compound No. 105) | 10 parts |
| 1-hydroxy-cyclohexyl-phenyl-ketone (IRGACURE 184, manufactured by Chiba Specialty Chemicals K.K) as a photopolymerization initiator | 1 part |
| Reactive silicone oil compound represented by the following Structural Formula (IV) (polysiloxane modified by methacrylic acid at one side terminal end, X-22-174DX, manufactured by Shin-Etsu Chemical Co., Ltd.) | 0.01 parts |
| Tetrahydrofuran | 100 parts |

Structural Formula (IV)

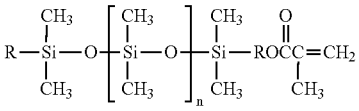

Comparative Production Example I-3

A latent electrostatic image bearing member was produced in the same manner as in Production Example I-5 except that only a surface layer coating solution H containing the following composition was used instead of the surface layer coating solutions D, E and F used in Production Example I-5, and the surface layer coating solution G was applied over the surface of a charge transporting layer by spray-coating to form a surface layer having a thickness of 4.2 μm.

| [Surface Layer Coating Solution H] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) as a trifunctional or more radical polymerizable compound having no charge transporting structure | 10 parts |
| Monofunctional radical polymerizable compound having a charge transporting structure (the above-mentioned Exemplified Compound No. 105) | 10 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

Examples I-5 to I-8 and Comparative Examples I-2 to I-3

<Paper-Passing Test>

A paper-passing test with 1,000,000 sheets of A4 size (MY PAPER, manufactured by NBS Ricoh Company Ltd.) was conducted for each of the thus produced latent electrostatic image bearing members (electrophotographic photoconductors) of Production Examples I-6 to I-8 and Comparative Production Examples I-2 to 1-3 using an image forming apparatus (remodeled machine from IMAGIO NEO 1050 PRO manufactured by Ricoh Company Ltd., processing linear velocity: 500 mm/sec) under the condition of an electric charge potential of −800V at the starting time of the paper-passing test to evaluate each of the latent electrostatic image bearing members as to abrasion properties, electric potential in the image forming apparatus, and image properties in the same manner as in Example I-1. Table I-6 shows the evaluation results of abrasion property, Table I-7 shows the evaluation results of electric potential in the image forming apparatus, and Table I-8 shows the evaluation results of image properties (evaluation results of residual negative images).

TABLE I-6

| | Abrasion wear (μm) | |
|---|---|---|
| | No. of output sheets in succession: 500,000 | No. of output sheets in succession: 1,000,000 |
| Ex. I-5 | 1.6 | 3.4 |
| Ex. I-6 | 1.7 | 3.6 |
| Ex. I-7 | 1.7 | 3.5 |
| Ex. I-8 | 1.9 | 3.7 |
| Compara. Ex. I-2 | 1.7 | 3.4 |
| Compara. Ex. I-3 | 1.6 | 3.6 |

TABLE I-7

| | Electric potential in image forming apparatus (−V) | | | | | |
|---|---|---|---|---|---|---|
| | Initial stage | | No. of output sheets in succession: 500,000 | | No. of output sheets in succession: 1,000,000 | |
| | Dark space | Exposed region | Dark space | Exposed region | Dark space | Exposed region |
| Ex. I-5 | 780 | 90 | 710 | 120 | 670 | 130 |
| Ex. I-6 | 780 | 110 | 730 | 120 | 680 | 140 |
| Ex. I-7 | 790 | 130 | 740 | 130 | 700 | 140 |

TABLE I-7-continued

| | Electric potential in image forming apparatus (−V) | | | | | |
|---|---|---|---|---|---|---|
| | Initial stage | | No. of output sheets in succession: 500,000 | | No. of output sheets in succession: 1,000,000 | |
| | Dark space | Exposed region | Dark space | Exposed region | Dark space | Exposed region |
| Ex. I-8 | 800 | 140 | 760 | 140 | 700 | 150 |
| Compara. Ex. I-2 | 780 | 160 | 700 | 120 | 680 | 130 |
| Compara. Ex. I-3 | 790 | 130 | 720 | 120 | 670 | 140 |

TABLE I-8

| | Image Properties | | |
|---|---|---|---|
| | Initial stage | No. of output sheets in succession: 500,000 sheets | No. of output sheets in succession: 1,000,000 sheets |
| Ex. I-5 | A | A | A |
| Ex. I-6 | A | A | A |
| Ex. I-7 | A | A | A |
| Ex. I-8 | A | A | B |
| Compara. Ex. I-2 | A | C | C |
| Compara. Ex. I-3 | B | C | C |

* Evaluation Criteria on residual negative images shown in Table I-8:
A: No residual negative images occurred.
B: A slightly amount of residual negative images occurred.
C: Residual negative images apparently occurred.

The results shown in Tables I-6 to I-8 verified that the latent electrostatic image bearing members of Examples I-5 to I-8 were excellent in abrasion resistance and electric potential in the image forming apparatus and allowed for forming excellent quality of images without causing residual negative images even after being subjected to a paper-passing test of 1,000,000 sheets. In contrast, with the use of the latent electrostatic image bearing members of Comparative Examples I-2 to I-3, degradation of image properties was observed, and residual negative images apparently occurred in the paper-passing test of 500,000 sheets, although the latent electrostatic image bearing members were excellent in abrasion resistance and electric potential in the image forming apparatus. Further, the latent electrostatic image bearing member caused a slightly amount of residual negative images even from the early stage of the paper-passing test because the surface layer did not contain the above-mentioned reactive silicone compound.

Hereinafter, the present invention II will be described in detail referring to specific Examples and Comparative Examples, however, the present invention II is not limited to the disclosed Examples. In the Examples and Comparative Examples, "part" or "parts" denotes "part by mass" or "parts by mass".

First, a specific synthesis example of titanylphthalocyanine pigment used in the Examples of the present invention will be described.

Synthesis Example II-1

—Synthesis of Titanyl Phthalocyanine Pigment—

In a vessel, 292 g of 1,3-diiminoisoindoline was mixed with 2,000 mL of sulfolane, and 204 g of titanium tetrabuthoxide was delivered by drops into the mixture solution under a nitrogen stream. Upon completion of the dripping, the temperature of the mixture solution was gradually raised to 180° C., and the mixture solution was stirred for 5 hours while keeping the reaction temperature ranging from 170° C. to 180° C. to perform a reaction. After completion of the reaction, the reaction solution was left to cool, and then the obtained precipitate was filtered, and the filtered precipitate was washed with chloroform until the powder turned into blue color.

Next, the filtered precipitate was washed with methanol several times, further washed with hot water of 80° C. several times, and then dried to thereby obtain a coarse titanyl phthalocyanine. The obtained titanyl phthalocyanine was dissolved in 20 times its volume of a concentrated sulfuric acid, and the titanyl phthalocyanine dissolution was delivered by drops into 100 times its volume of iced water with stirring to precipitate a crystal, and then the precipitated crystal was filtered. Next, the filtered crystal was repeatedly washed until the washing fluid was neutralized to thereby obtain a wet cake of a titanylphthalocyanine pigment. The obtained wet cake was washed thoroughly with ion exchange water.

In a vessel, 20 g of the obtained wet cake was added to 200 g of 1,2-dichloroethane, and the mixture solution was stirred for 4 hours. To the mixture solution, 1,000 g of methanol was added, and then the mixture solution was stirred for 1 hour, filtered and dried to thereby obtain a titanyl phthalocyanine powder. This was taken as "pigment 1".

The X-ray diffraction spectrum of the obtained titanyl phthalocyanine pigment was measured under the following conditions.

<Measurement Condition>

X-ray tube: Cu
Voltage: 40 kV
Current: 20 mA
Scanning speed: 1°/min
Scanning coverage: 3° to 40°
Time constant: 2 seconds FIG. 5 shows the X-ray diffraction spectrum of the titanyl phthalocyanine obtained in the Synthesis Example II-1. The measurement result demonstrated that the obtained titanyl phthalocyanine pigment had a crystal form having major diffraction peaks specified by Bragg angle 2 θ of 9.6°±0.2°, 24.0°±0.2°, and 27.2°±0.2°.

Example II-1

Over the surface of an aluminum cylinder having a diameter of 100 mm, an undercoat layer coating solution containing the following composition, a charge generating layer coating solution containing the following composition, and a charge transporting layer coating solution containing the following composition were sequentially applied and dried to thereby form an undercoat layer having a thickness of 3.5 μm, a charge generating layer having a thickness of 0.3 μm, and a charge transporting layer having a thickness of 23 μm on the cylinder.

Over the surface of the obtained charge transporting layer, a crosslinked surface layer coating solution A and a crosslinked surface layer coating solution B each containing the following composition were sequentially applied by spray-coating and then the cylinder surface with the crosslinked surface layer coating solution A and the crosslinked surface layer coating solution B applied thereon was irradiated with a light beam under the conditions of metal halide lamp: 160 W/cm, irradiation distance: 120 mm, irradiation intensity: 500 mW/cm$^2$, and irradiation time: 240 seconds. Next, the cylinder surface was then dried at 130° C.

for 20 minutes to thereby form a crosslinked surface layer having a total thickness of 4 μm in which a crosslinked film having a thickness of 2 μm composed of the crosslinked surface layer coating solution B was formed on a crosslinked film having a thickness of 2 μm composed of the crosslinked surface layer coating solution A. Through the above-mentioned processes, a latent electrostatic image bearing member of the present invention was prepared.

| [Undercoat Layer Coating Solution] | |
|---|---|
| Alkyd resin (BECKOZOLE 1307-60-EL, manufactured by Dainippon Ink and Chemicals, Inc.) | 6 parts |
| Melamine resin (SUPER BECKAMINE G-821-60, manufactured by Dainippon Ink and Chemicals, Inc.) | 4 parts |
| Titanium oxide | 40 parts |
| Methylethylketone | 50 parts |

| [Charge Generating Layer Coating Solution] | |
|---|---|
| Titanyl phthalocyanine powder obtained in Synthesis Example II-1 | 4 parts |
| Polyvinyl butyral (ESLEC BM-S, manufactured by SEKISUI CHEMICAL CO., LTD.) | 2 parts |
| Methylethylketone | 150 parts |

| [Charge Transporting Layer Coating Solution] | |
|---|---|
| Bisphenol Z type polycarbonate (PANLIGHT TS-2050, manufactured by Teijin Chemicals, Ltd.) | 10 parts |
| Low-molecular weight charge transporting material (D-1) represented by the following Structural Formula (II) | 7 parts |
| Tetrahydrofuran | 100 parts |

-continued

| [Charge Transporting Layer Coating Solution] | |
|---|---|
| 1% silicone oil-dissolved tetrahydrofuran solution (KF50-100CS, manufactured by Shin-Etsu Chemical Co., Ltd.) | 1 part |

Structural Formula (II)

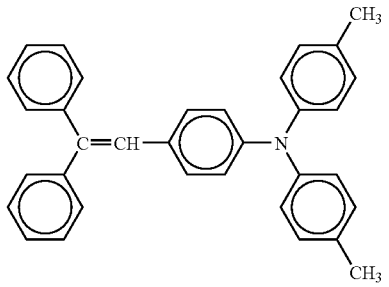

(D-1)

| [Crosslinked Surface Layer Coating Solution A used for the inside part of a crosslinked surface layer] | |
|---|---|
| Trimethylolpropane triacrylate (KAYARAD TMPTA, manufactured by Nippon Kayaku Co., Ltd., molecular mass: 296, the number of functional groups = 99) as a trifunctional or more radical polymerizable compound having no charge transporting structure | 10 parts |
| Monofunctional radical polymerizable compound having a charge transporting structure (the above-mentioned Exemplified Compound No. 54) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (compound having both structures of a hindered amine structure represented by the following Structural Formula (I) and a hindered phenol structure, manufactured by Sankyo Co., Ltd.) | |

Structure Formula (I)

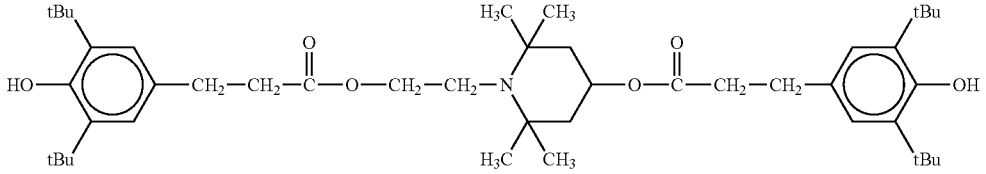

| | |
|---|---|
| Tetrahydrofuran | 100 parts |

| [Crosslinked Surface Layer Coating Solution B used for the surface part of a crosslinked surface layer] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) as a trifunctional or more radical polymerizable compound having no charge transporting structure | 10 parts |
| Monofunctional radical polymerizable compound having a charge transporting structure (the above-mentioned Exemplified Compound No. 54) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 0.01 parts |
| Tetrahydrofuran | 100 parts |

Example II-2

A latent electrostatic image bearing member was produced in the same manner as in Example II-1 except that the crosslinked surface layer coating solutions A and B were respectively changed to crosslinked surface layer coating solutions represented by the following compositions.

| [Crosslinked Surface Layer Coating Solution A] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) as a trifunctional or more radical polymerizable compound having no charge transporting structure | 10 parts |
| Monofunctional radical polymerizable compound having a charge transporting structure (the above-mentioned Exemplified Compound No. 54) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 1 part |
| Tetrahydrofuran | 100 parts |

| [Crosslinked Surface Layer Coating Solution B] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) as a trifunctional or more radical polymerizable compound having no charge transporting structure | 10 parts |
| Monofunctional radical polymerizable compound having a charge transporting structure (the above-mentioned Exemplified Compound No. 54) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 0.05 parts |
| Tetrahydrofuran | 100 parts |

Example II-3

A latent electrostatic image bearing member was produced in the same manner as in Example II-1 except that the crosslinked surface layer coating solutions A and B were respectively changed to crosslinked surface layer coating solutions represented by the following compositions.

| [Crosslinked Surface Layer Coating Solution A] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) as a trifunctional or more radical polymerizable compound having no charge transporting structure | 10 parts |
| Monofunctional radical polymerizable compound having a charge transporting structure (the above-mentioned Exemplified Compound No. 54) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 1 part |
| Tetrahydrofuran | 100 parts |

| [Crosslinked Surface Layer Coating Solution B] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) as a trifunctional or more radical polymerizable compound having no charge transporting structure | 10 parts |
| Monofunctional radical polymerizable compound having a charge transporting structure (the above-mentioned Exemplified Compound No. 54) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 0.1 parts |
| Tetrahydrofuran | 100 parts |

Example II-4

A latent electrostatic image bearing member was produced in the same manner as in Example II-1 except that the crosslinked surface layer coating solutions A and B were respectively changed to crosslinked surface layer coating solutions represented by the following compositions.

| [Crosslinked Surface Layer Coating Solution A] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) as a trifunctional or more radical polymerizable compound having no charge transporting structure | 10 parts |
| Monofunctional radical polymerizable compound having a charge transporting structure (the above-mentioned Exemplified Compound No. 54) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 1 part |
| Tetrahydrofuran | 100 parts |

| [Crosslinked Surface Layer Coating Solution B] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) as a trifunctional or more radical polymerizable compound having no charge transporting structure | 10 parts |
| Monofunctional radical polymerizable compound having a charge transporting structure (the above-mentioned Exemplified Compound No. 54) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 0.2 parts |
| Tetrahydrofuran | 100 parts |

Comparative Example II-1

A latent electrostatic image bearing member was produced in the same manner as in Example II-1 except that only a surface layer coating solution C containing the following composition was used instead of the crosslinked surface layer coating solutions A and B used in Example II-1, and the crosslinked surface layer coating solution C was applied over the surface of a charge transporting layer by spray-coating to form a surface layer having a thickness of 4 μm.

| [Crosslinked Surface Layer Coating Solution C] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) as a trifunctional or more radical polymerizable compound having no charge transporting structure | 10 parts |
| Monofunctional radical polymerizable compound having a charge transporting structure (the above-mentioned Exemplified Compound No. 54) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 0.1 parts |
| Tetrahydrofuran | 100 parts |

<Paper-Passing Test>

A paper-passing test with 500,000 sheets of A4 size (MY PAPER, manufactured by NBS Ricoh Company Ltd.) was conducted for each of the thus produced latent electrostatic image bearing members (electrophotographic photoconductors) of Examples II-1 to II-4 and Comparative Example II-1 using an image forming apparatus (remodeled machine from IMAGIO NEO 751 manufactured by Ricoh Company Ltd., processing linear velocity: 350 mm/sec) under the condition of an electric charge potential of −800V at the starting time of the paper-passing test to evaluate each of the latent electrostatic image bearing members as to abrasion properties, electric potential in the image forming apparatus, and image properties. With respect to the abrasion properties, the abrasion wear (μm) of each of the latent electrostatic image bearing members (electrophotographic photoconductors) was determined by measuring the film thickness thereof. As a film-thickness measurement device, an eddy current thicknessmeter (FISHERSCOPE) was used. The electric potential in the image forming apparatus was determined from the surface electric potential at the time of outputting a white solid image with a grid voltage for the electric potential in the dark space fixed at −900 (V). The surface electric potential of each of the latent electrostatic image bearing members was measured using TREK MODEL344. The electric potential for exposed regions was determined from the surface electric potential at the time of outputting a black solid image after adjusting the grid electric potential such that the electric potential in the dark space was −800 (V). With respect to the image properties, the occurrence level of a residual negative image shown in FIG. 9 when outputting an image of an original document shown in FIG. 8 and then successively outputting halftone images thereof was evaluated. Table II-6 shows the evaluation results of abrasion property, Table II-7 shows the evaluation results of electric potential in the image forming apparatus, and Table II-8 shows the evaluation results of image properties (evaluation results of residual negative images).

TABLE II-6

| | Abrasion wear (μm) | |
|---|---|---|
| | No. of output sheets: 100,000 | No. of output sheets: 500,000 |
| Ex. II-1 | 0.6 | 3.2 |
| Ex. II-2 | 0.6 | 2.8 |

TABLE II-6-continued

| | Abrasion wear (μm) | |
|---|---|---|
| | No. of output sheets: 100,000 | No. of output sheets: 500,000 |
| Ex. II-3 | 0.7 | 3.1 |
| Ex. II-4 | 0.8 | 3.2 |
| Compara. Ex. II-1 | 0.7 | 3.0 |

TABLE II-7

| | Electric potential in image forming apparatus (−V) | | | | | |
|---|---|---|---|---|---|---|
| | Initial stage | | No. of output sheets in succession: 500,000 | | No. of output sheets in succession: 1,000,000 | |
| | Dark space | Exposed region | Dark space | Exposed region | Dark space | Exposed region |
| Ex. II-1 | 790 | 90 | 750 | 150 | 720 | 160 |
| Ex. II-2 | 780 | 110 | 740 | 160 | 730 | 160 |
| Ex. II-3 | 780 | 120 | 740 | 150 | 720 | 170 |
| Ex. II-4 | 790 | 120 | 750 | 160 | 730 | 190 |
| Compara. Ex. II-1 | 800 | 90 | 750 | 150 | 730 | 160 |

TABLE II-8

| | Image Properties | | |
|---|---|---|---|
| | Initial stage | No. of output sheets in succession: 100,000 sheets | No. of output sheets in succession: 500,000 sheets |
| Ex. II-1 | A | A | A |
| Ex. II-2 | A | A | A |
| Ex. II-3 | A | A | A |
| Ex. II-4 | A | A | A |
| Compara. Ex. II-1 | A | B | C |

* Evaluation Criteria on residual negative images shown in Table II-8:
A: No residual negative images occurred.
B: A slightly amount of residual negative images occurred.
C: Residual negative images apparently occurred.

Example II-5

Over the surface of an aluminum cylinder having a diameter of 100 mm, an undercoat layer coating solution containing the following composition, a charge generating layer coating solution containing the following composition, and a charge transporting layer coating solution containing the following composition were sequentially applied and dried to thereby form an undercoat layer having a thickness of 1.0 μm, a charge generating layer having a thickness of 0.3 μm, and a charge transporting layer having a thickness of 23 μm on the cylinder.

Over the surface of the obtained charge transporting layer, a crosslinked surface layer coating solution D, a crosslinked surface layer coating solution E and a crosslinked surface layer coating solution F each containing the following composition were applied by spray-coating and then the cylinder surface with the crosslinked surface layer coating solutions D, E and F applied thereon was irradiated with a light beam under the conditions of metal halide lamp: 160 W/cm, irradiation distance: 120 mm, irradiation intensity: 500 mW/cm$^2$, and irradiation time: 240 seconds. Next, the cylinder surface was then dried at 130° C. for 20 minutes to thereby form a crosslinked surface layer having a total thickness of 4.2 μm in which a crosslinked film having a thickness of 1.4 μm composed of the crosslinked surface layer coating solution D, a crosslinked film having a thickness of 1.4 μm composed of the crosslinked surface layer coating solution E, and a crosslinked film having a thickness of 1.4 μm composed of the crosslinked surface layer coating solution F were formed in a laminate structure. Through the above-mentioned processes, a latent electrostatic image bearing member of the present invention was prepared.

| [Undercoat Layer Coating Solution] | |
|---|---|
| Titanium oxide | 40 parts |
| Alcohol-soluble nylon | 32 parts |
| Methanol | 400 parts |
| Isopropanol | 160 parts |

| [Charge Generating Layer Coating Solution] | |
|---|---|
| Titanyl phthalocyanine powder obtained in Synthesis Example II-1 | 4 parts |
| Polyvinyl butyral (ESLEC BM-S, manufactured by SEKISUI CHEMICAL CO., LTD.) | 2 parts |
| Methylethylketone | 150 parts |

| [Charge Transporting Layer Coating Solution] | |
|---|---|
| Bisphenol Z type polycarbonate (PANLIGHT TS-2050, manufactured by Teijin Chemicals, Ltd.) | 10 parts |
| Low-molecular weight charge transporting material (D-1) represented by the following Structural Formula (II) | 7 parts |
| Tetrahydrofuran | 100 parts |
| 1% silicone oil-dissolved tetrahydrofuran solution (KF50-100CS, manufactured by Shin-Etsu Chemical Co., Ltd.) | 1 part |

Structural Formula (II)

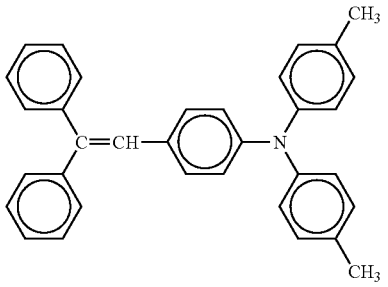

(D-1)

| [Crosslinked Surface Layer Coating Solution D] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) as a trifunctional or more radical polymerizable compound having no charge transporting structure | 10 parts |

-continued

| [Crosslinked Surface Layer Coating Solution D] | |
|---|---|
| Monofunctional radical polymerizable compound having a charge transporting structure (the above-mentioned Exemplified Compound No. 105) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 3 parts |
| Tetrahydrofuran | 100 parts |

| [Crosslinked Surface Layer Coating Solution E] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) as a trifunctional or more radical polymerizable compound having no charge transporting structure | 10 parts |
| Monofunctional radical polymerizable compound having a charge transporting structure (the above-mentioned Exemplified Compound No. 105) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 1 part |
| Tetrahydrofuran | 100 parts |

| [Crosslinked Surface Layer Coating Solution F] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) as a trifunctional or more radical polymerizable compound having no charge transporting structure | 10 parts |
| Monofunctional radical polymerizable compound having a charge transporting structure (the above-mentioned Exemplified Compound No. 105) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 0.01 parts |
| Tetrahydrofuran | 100 parts |

Example II-6

A latent electrostatic image bearing member was produced in the same manner as in Example II-5 except that the crosslinked surface layer coating solutions were changed to crosslinked surface coating solutions each containing the following composition.

| [Crosslinked Surface Layer Coating Solution D] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) as a trifunctional or more radical polymerizable compound having no charge transporting structure | 10 parts |
| Monofunctional radical polymerizable compound having a charge transporting structure (the above-mentioned Exemplified Compound No. 105) | 10 parts |

-continued

| [Crosslinked Surface Layer Coating Solution D] | |
|---|---|
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 3 parts |
| Tetrahydrofuran | 100 parts |

| [Crosslinked Surface Layer Coating Solution E] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) as a trifunctional or more radical polymerizable compound having no charge transporting structure | 10 parts |
| Monofunctional radical polymerizable compound having a charge transporting structure (the above-mentioned Exemplified Compound No. 105) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 1 part |
| Tetrahydrofuran | 100 parts |

| [Crosslinked Surface Layer Coating Solution F] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) as a trifunctional or more radical polymerizable compound having no charge transporting structure | 10 parts |
| Monofunctional radical polymerizable compound having a charge transporting structure (the above-mentioned Exemplified Compound No. 105) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 0.03 parts |
| Tetrahydrofuran | 100 parts |

Example II-7

A latent electrostatic image bearing member was produced in the same manner as in Example II-5 except that the crosslinked surface layer coating solutions were changed to crosslinked surface coating solutions each containing the following composition.

| [Crosslinked Surface Layer Coating Solution D] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) as a trifunctional or more radical polymerizable compound having no charge transporting structure | 10 parts |
| Monofunctional radical polymerizable compound having a charge transporting structure (the above-mentioned Exemplified Compound No. 105) | 10 parts |
| 1-hydroxy-cyclohexyl-phenyl-ketone (IRGACURE 184, manufactured by Chiba Specialty Chemicals K.K) as a photopolymerization initiator | 1 part |

-continued

| [Crosslinked Surface Layer Coating Solution D] | |
|---|---|
| SANOL LS2626 (manufactured by Sankyo Co., Ltd.) | 3 parts |
| Tetrahydrofuran | 100 parts |

| [Crosslinked Surface Layer Coating Solution E] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) as a trifunctional or more radical polymerizable compound having no charge transporting structure | 10 parts |
| Monofunctional radical polymerizable compound having a charge transporting structure (the above-mentioned Exemplified Compound No. 105) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 1 part |
| Tetrahydrofuran | 100 parts |

| [Crosslinked Surface Layer Coating Solution F] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) as a trifunctional or more radical polymerizable compound having no charge transporting structure | 10 parts |
| Monofunctional radical polymerizable compound having a charge transporting structure (the above-mentioned Exemplified Compound No. 105) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 0.05 parts |
| Tetrahydrofuran | 100 parts |

Example II-8

A latent electrostatic image bearing member was produced in the same manner as in Example II-5 except that the crosslinked surface layer coating solutions were changed to crosslinked surface coating solutions each containing the following composition.

| [Crosslinked Surface Layer Coating Solution D] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) as a trifunctional or more radical polymerizable compound having no charge transporting structure | 10 parts |
| Monofunctional radical polymerizable compound having a charge transporting structure (the above-mentioned Exemplified Compound No. 105) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 3 parts |
| Tetrahydrofuran | 100 parts |

| [Crosslinked Surface Layer Coating Solution E] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) as a trifunctional or more radical polymerizable compound having no charge transporting structure | 10 parts |
| Monofunctional radical polymerizable compound having a charge transporting structure (the above-mentioned Exemplified Compound No. 105) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 1 part |
| Tetrahydrofuran | 100 parts |

| [Crosslinked Surface Layer Coating Solution F] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) as a trifunctional or more radical polymerizable compound having no charge transporting structure | 10 parts |
| Monofunctional radical polymerizable compound having a charge transporting structure (the above-mentioned Exemplified Compound No. 105) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 0.1 parts |
| Tetrahydrofuran | 100 parts |

Comparative Example II-2

A latent electrostatic image bearing member was produced in the same manner as in Example II-5 except that only a crosslinked surface layer coating solution G containing the following composition was used instead of the surface layer coating solutions D, E and F used in Example II-5, and the surface layer coating solution G was applied over the surface of a charge transporting layer by spray-coating to form a crosslinked surface layer having a thickness of 4.2 μm.

| [Crosslinked Surface Layer Coating Solution G] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) as a trifunctional or more radical polymerizable compound having no charge transporting structure | 10 parts |
| Monofunctional radical polymerizable compound having a charge transporting structure (the above-mentioned Exemplified Compound No. 105) | 10 parts |
| 1-hydroxy-cyclohexyl-phenyl-ketone (IRGACURE 184, manufactured by Chiba Specialty Chemicals K.K) as a photopolymerization initiator | 1 part |
| SANOL LS2626 (manufactured by Sankyo Co., Ltd.) | 0.01 parts |
| Tetrahydrofuran | 100 parts |

<Paper-Passing Test>

A paper-passing test with 1,000,000 sheets of A4 size (MY PAPER, manufactured by NBS Ricoh Company Ltd.) was conducted for each of the thus produced latent electrostatic image bearing members (electrophotographic photoconductors) of Examples II-5 to II-8 and Comparative Example II-2 using an image forming apparatus (remodeled machine from IMAGIO NEO 1050 PRO manufactured by Ricoh Company Ltd., processing linear velocity: 500 mm/sec) under the condition of an electric charge potential of −800V at the starting time of the paper-passing test to evaluate each of the latent electrostatic image bearing members as to abrasion properties, electric potential in the image forming apparatus, and image properties. With respect to the abrasion properties, the abrasion wear (μm) of each of the latent electrostatic image bearing members (electrophotographic photoconductors) was determined by measuring the film thickness thereof. As a film-thickness measurement device, an eddy current thicknessmeter (FISHERSCOPE) was used. The electric potential in the image forming apparatus was determined from the surface electric potential at the time of outputting a white solid image with a grid voltage for the electric potential in the dark space fixed at −900 (V). The surface electric potential of each of the latent electrostatic image bearing members was measured using TREK MODEL344. The electric potential for exposed regions was determined from the surface electric potential at the time of outputting a black solid image after adjusting the grid electric potential such that the electric potential in the dark space was −800 (V). With respect to the image properties, the occurrence level of a residual negative image shown in FIG. 9 when outputting an image of an original document shown in FIG. 8 and then successively outputting halftone images thereof was evaluated. Table II-9 shows the evaluation results of abrasion property, Table II-10 shows the evaluation results of electric potential in the image forming apparatus, and Table II-11 shows the evaluation results of image properties (evaluation results of residual negative images).

TABLE II-9

| | Abrasion wear (μm) | |
|---|---|---|
| | No. of output sheets: 500,000 | No. of output sheets: 1,000,000 |
| Ex. II-5 | 1.5 | 3.5 |
| Ex. II-6 | 1.6 | 3.6 |
| Ex. II-7 | 1.7 | 3.6 |
| Ex. II-8 | 1.8 | 3.7 |
| Compara. Ex. II-2 | 1.7 | 3.3 |

TABLE II-10

| | Electric potential in image forming apparatus (−V) | | | | | |
|---|---|---|---|---|---|---|
| | Initial stage | | No. of output sheets in succession: 500,000 | | No. of output sheets in succession: 1,000,000 | |
| | Dark space | Exposed region | Dark space | Exposed region | Dark space | Exposed region |
| Ex. II-5 | 790 | 90 | 720 | 120 | 670 | 130 |
| Ex. II-6 | 780 | 110 | 740 | 130 | 680 | 130 |
| Ex. II-7 | 790 | 120 | 740 | 130 | 700 | 150 |
| Ex. II-8 | 800 | 140 | 760 | 140 | 710 | 150 |
| Compara. Ex. II-2 | 780 | 160 | 690 | 120 | 680 | 130 |

TABLE II-11

| | Image Properties | | |
|---|---|---|---|
| | Initial stage | No. of output sheets in succession: 500,000 sheets | No. of output sheets in succession: 1,000,000 sheets |
| Ex. II-5 | A | A | A |
| Ex. II-6 | A | A | A |
| Ex. II-7 | A | A | A |
| Ex. II-8 | A | A | B |
| Compara. Ex. II-2 | A | C | C |

* Evaluation Criteria on residual negative images shown in Table II-11:
A: No residual negative images occurred.
B: A slightly amount of residual negative images occurred.
C: Residual negative images apparently occurred.

Hereinafter, the present invention III will be further described in detail referring to specific Examples and Comparative Examples, however, the present invention III is not limited to the disclosed Examples. In the Examples and Comparative Examples, "part" or "parts" denotes "part by mass" or "parts by mass".

A radical polymerizable compound having a charge transporting structure used in preparation of a crosslinked surface layer coating solution for the following Examples and Comparative Examples was synthesized as follows.

Synthesis Example III-1

<Synthesis of Exemplified Compound No. 54>

The exemplified compound No. 54 was synthesized as follows.

(1) Synthesis of Hydroxy Group-Substituted Triarylamine Compound

In a vessel, 240 mL of sulfolane was added to 113.85 g (0.3 mol) of a methoxy group-substituted triarylamine compound represented by the following Structural Formula (A) and 138 g (0.92 mol) of sodium iodide, and the mixture solution was heated at 60° C. under a nitrogen stream.

Structural Formula (A)

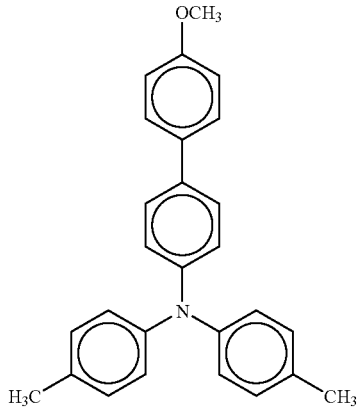

To the mixture solution, 99 g (0.91 mol) of trimethylchlorosilane was delivered by drops for 1 hour, the mixture solution was then stirred for 4. 5 hours at a temperature of about 60° C., and then the reaction was stopped.

About 1.5 L of toluene was added to the reaction solution, the reaction solution was cooled down to the room temperature, and the reaction solution was repeatedly washed with water and a sodium carbonate aqueous solution. Thereafter, a solvent was removed from the toluene solution, and the solution was subjected to a column chromatography treatment (adsorption medium: silica gel, developing solvent: toluene: ethyl acetate=20:1) to purify the solution, thereby a light yellow oil was obtained. To the obtained light yellow oil, cyclohexane was added to thereby precipitate a crystal.

In this way, a hydroxy group-substituted triarylamine compound represented by the following Structural Formula (B) was obtained.

Structural Formula (B)

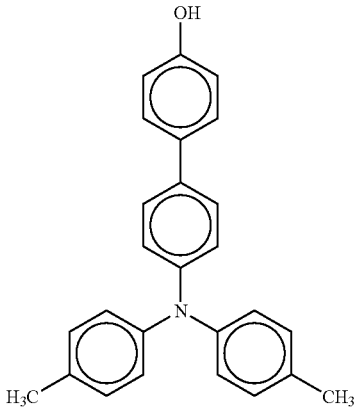

Through the above-noted processes, 88.1 g (yield=80.4%) of a hydroxy group-substituted triarylamine compound was obtained, which was a white crystal represented by the following Structural Formula B. The melting point of the obtained compound was 64.0° C. to 66.0° C. Table III-1 shows the analyzed results of atoms in the compound. It was confirmed that the actual measurement values of the obtained hydroxy group-substituted triarylamine compound were substantially agreed with the calculated value, and the obtained compound was the intended compound based on the analyzed results of atoms therein.

TABLE III-1

| | Analyzed Value of Atom (%) | | |
|---|---|---|---|
| | C | H | N |
| Actual measurement value | 85.06 | 6.41 | 3.73 |
| Calculated value | 85.44 | 6.34 | 3.83 |

(2) Synthesis of Triarylamino Group-Substituted Acrylate Compound (Exemplified Compound No. 54)

In a vessel, 82.9 g (0.227 mol) of the hydroxy group-substituted triarylamine compound represented by the Structural Formula (B) obtained in the above (1) was dissolved in 400 mL of tetrahydrofuran, and then a sodium hydroxide aqueous solution (NaOH: 12.4 g, water: 100 mL) was delivered by drops to the hydroxy group-substituted triarylamine compound solution under a nitrogen stream. The solution was cooled down to 5° C., and then 25.2 g (0.272 mol) of acrylic acid chloride was delivered by drops to the solution for 40 minutes. Thereafter, the solution was stirred at 5° C. for 3 hours, and then the reaction was stopped. The reaction solution was poured into water, and then an extract solution was obtained therefrom by using toluene. The extract solution was repeatedly washed with a sodium hydrogen carbonate aqueous solution and water. Thereafter, a solvent was removed from the toluene solution, and the solution was subjected to a column chromatography treatment (adsorption medium: silica gel, developing solvent: toluene: toluene) to purify the solution, thereby a colorless oil was obtained. Then, n-hexane was added to the obtained colorless oil to precipitate a crystal. Consequently, 80.73 g (yield=84.8%) of a white crystal represented by Exemplified Compound No. 54 was obtained. The melting point of the obtained compound was 117.5° C. to 119.0° C. Table III-2 shows the analyzed results of atoms in the compound. It was confirmed that the actual measurement values of the obtained hydroxy group-substituted triarylamine compound were substantially agreed with the calculated value, and the obtained compound was the intended compound based on the analyzed results of atoms therein.

TABLE III-2

| | Analyzed Value of Atom (%) | | |
|---|---|---|---|
| | C | H | N |
| Actual measurement value | 83.13 | 6.01 | 3.16 |
| Calculated value | 83.02 | 6.00 | 3.33 |

Synthesis Example III-2

<Synthesis of Exemplified Compound No. 105>

A hydroxy group-substituted triarylamine compound was synthesized from a methoxy group-substituted triarylamine compound having an intended molecular structure in a synthesis procedure similarly to the synthesis of the Exemplified Compound No. 54, and the hydroxy group-substituted triarylamine compound was reacted with acrylic acid chloride to thereby synthesize a triarylamino group-substituted acrylate compound having a structure represented by the Exemplified Compound No. 105. It was confirmed that the triarylamino group-substituted acrylate compound was the intended compound based on the analyzed results of atoms therein.

A titanylphthalocyanine pigment used in the preparation of a charge generation layer coating solution for the following Examples and Comparative Examples was synthesized as follows.

Synthesis Example III-3

<Synthesis of Titanyl Phthalocyanine Pigment>

In a vessel, 292 g of 1,3-diiminoisoindoline was mixed with 2,000 mL of sulfolane, and 204 g of titanium tetrabuthoxide was delivered by drops into the mixture solution under a nitrogen stream. Upon completion of the dripping, the temperature of the mixture solution was gradually raised to 180° C., and the mixture solution was stirred for 5 hours while keeping the reaction temperature ranging from 170° C. to 180° C. to perform a reaction. After completion of the reaction, the reaction solution was left to cool, and then the obtained precipitate was filtered, and the filtered precipitate was washed with chloroform until the powder turned into blue color. Next, the filtered precipitate was washed with methanol several times, further washed with hot water of 80° C. several times, and then dried to thereby obtain a coarse titanyl phthalocyanine. The obtained titanyl phthalocyanine was dissolved in 20 times its volume of a concentrated sulfuric acid, and the titanyl phthalocyanine dissolution was delivered by drops into 100 times its volume of iced water with stirring to precipitate a crystal, and then the precipitated crystal was filtered. Next, the filtered crystal was repeatedly washed until the washing fluid was neutralized to thereby obtain a wet cake of a titanylphthalocyanine pigment. The obtained wet cake was washed thoroughly with ion exchange water until ions could not be detected from the wash fluid.

In a vessel, 20 g of the obtained wet cake was added to 200 g of 1,2-dichloroethane, and the mixture solution was stirred for 4 hours. To the mixture solution, 1,000 g of methanol was added, and then the mixture solution was stirred for 1 hour, filtered and dried to thereby obtain a titanyl phthalocyanine powder.

The X-ray diffraction spectrum of the obtained titanyl phthalocyanine pigment was measured under the following conditions.

<Measurement Condition>

X-ray tube: Cu
Voltage: 40 kV
Current: 20 mA
Scanning speed: 1°/min
Scanning coverage: 30 to 400
Time constant: 2 seconds FIG. 7 shows the X-ray diffraction spectrum of the titanyl phthalocyanine obtained in the synthesis described above. The measurement result demonstrated that the obtained titanyl phthalocyanine pigment had a crystal form having major diffraction peaks specified by Bragg angle 2 θ of 9.6°±0.2°, 24.0°±0.2°, and 27.2°±0.2°.

Example III-1

—Preparation of Electrophotographic Photoconductor—

Over the surface of an aluminum cylinder having a diameter of 100 mm, an undercoat layer coating solution containing the following composition, a charge generating layer coating solution containing the following composition, and a charge transporting layer coating solution containing the following composition were sequentially applied and dried to thereby form an undercoat layer having a thickness of 3.5 μm, a charge generating layer having a thickness of 0.3 μm, and a charge transporting layer having a thickness of 23 μm on the cylinder.

Over the surface of the obtained charge transporting layer, a crosslinked surface layer coating solution A and a crosslinked surface layer coating solution B each containing the following composition were sequentially applied by spray-coating and then the cylinder surface with the crosslinked surface layer coating solution A and the crosslinked surface layer coating solution B applied thereon was irradiated with a light beam under the conditions of metal halide lamp: 160 W/cm, irradiation distance: 120 mm, irradiation intensity: 500 mW/cm$^2$, and irradiation time: 240 seconds. Next, the cylinder surface was then dried at 130° C. for 20 minutes to thereby form a crosslinked surface layer having a total thickness of 4 μm in which a crosslinked film having a thickness of 2 μm composed of the surface layer coating solution B was formed on a crosslinked film having a thickness of 2 μm composed of the crosslinked surface layer coating solution A. Through the above-mentioned processes, an electrostatic photoconductor of the present invention was prepared.

| [Undercoat Layer Coating Solution] | |
|---|---|
| Alkyd resin (BECKOZOLE 1307-60-EL, manufactured by Dainippon Ink and Chemicals, Inc.) | 6 parts |
| Melamine resin (SUPER BECKAMINE G-821-60, manufactured by Dainippon Ink and Chemicals, Inc.) | 4 parts |

-continued

| [Undercoat Layer Coating Solution] | |
|---|---|
| Titanium oxide | 40 parts |
| Methylethylketone | 50 parts |

| [Charge Generating Layer Coating Solution] | |
|---|---|
| Titanyl phthalocyanine powder obtained in Synthesis Example III-1 | 4 parts |
| Polyvinyl butyral (ESLEC BM-S, manufactured by SEKISUI CHEMICAL CO., LTD.) | 2 parts |
| Methylethylketone | 150 parts |

| [Charge Transporting Layer Coating Solution] | |
|---|---|
| Bisphenol Z type polycarbonate (PANLIGHT TS-2050, manufactured by Teijin Chemicals, Ltd.) | 10 parts |
| Low-molecular weight charge transporting material represented by the following Structural Formula (D-1) | 7 parts |
| Tetrahydrofuran | 100 parts |
| 1% silicone oil-dissolved tetrahydrofuran solution (KF50-100CS, manufactured by Shin-Etsu Chemical Co., Ltd.) | 1 part |

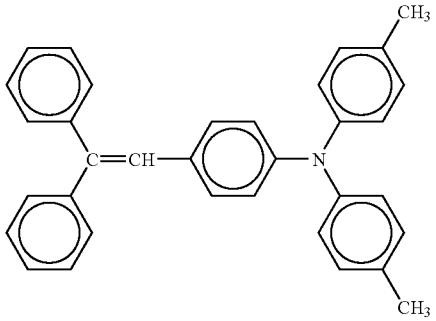

Structural Formula (D-1)

| [Crosslinked Surface Layer Coating Solution A] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) (*) | 15 parts |
| Radical polymerizable compound (the above-mentioned Exemplified Compound No. 54) (**) | 5 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

(*) Trifunctional or more radical polymerizable compound having no charge transporting structure
(**) Monofunctional radical polymerizable compound having a charge transporting structure Hereinafter, the explanations for (*) and (**) are omitted because they are the same as described above.

| [Crosslinked Surface Layer Coating Solution B] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) (*) | 5 parts |
| Radical polymerizable compound (the above-mentioned Exemplified Compound No. 54) (**) | 15 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

Example III-2

An electrophotographic photoconductor according to the present invention was prepared in the same manner as in Example III-1 except that the crosslinked surface layer coating solutions A and B were changed to crosslinked surface layer coating solutions each containing the following composition to thereby form a crosslinked surface layer on a charge transporting layer.

| [Crosslinked Surface Layer Coating Solution A] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) (*) | 14 parts |
| Radical polymerizable compound (the above-mentioned Exemplified Compound No. 54) (**) | 6 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

| [Crosslinked Surface Layer Coating Solution B] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) (*) | 6 parts |
| Radical polymerizable compound (the above-mentioned Exemplified Compound No. 54) (**) | 14 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

Example III-3

An electrophotographic photoconductor according to the present invention was prepared in the same manner as in Example III-1 except that the crosslinked surface layer coating solutions A and B were changed to crosslinked surface layer coating solutions each containing the following composition to thereby form a crosslinked surface layer on a charge transporting layer.

| [Crosslinked Surface Layer Coating Solution A] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) (*) | 13 parts |
| Radical polymerizable compound (the above-mentioned Exemplified Compound No. 54) (**) | 7 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

| [Crosslinked Surface Layer Coating Solution B] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) (*) | 7 parts |
| Radical polymerizable compound (the above-mentioned Exemplified Compound No. 54) (**) | 13 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

Example III-4

An electrophotographic photoconductor according to the present invention was prepared in the same manner as in Example III-1 except that the crosslinked surface layer coating solutions A and B were changed to crosslinked surface layer coating solutions each containing the following composition to thereby form a crosslinked surface layer on a charge transporting layer.

| [Crosslinked Surface Layer Coating Solution A] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) (*) | 12 parts |
| Radical polymerizable compound (the above-mentioned Exemplified Compound No. 54) (**) | 8 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

| [Crosslinked Surface Layer Coating Solution B] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) (*) | 8 parts |
| Radical polymerizable compound (the above-mentioned Exemplified Compound No. 54) (**) | 12 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

Comparative Example III-1

An electrophotographic photoconductor of Comparative Example III-1 was prepared in the same manner as in Example III-1 except that only a crosslinked surface layer coating solution C was used instead of the crosslinked surface layer coating solutions A and B, and the crosslinked surface layer coating solution C was applied over the surface of a charge transporting layer by spray-coating and then irradiated with a light beam, and heat-dried to thereby form a crosslinked surface layer having a film thickness of 4 μm.

| [Crosslinked Surface Layer Coating Solution C] | |
|---|---|
| Trimethylolpropane triacrylate (KAYARAD TMPTA, manufactured by Nippon Kayaku Co., Ltd., molecular mass: 296, the number of functional groups: 3, molecular mass/the number of functional groups = 99) (*) | 10 parts |
| Radical polymerizable compound (the above-mentioned Exemplified Compound No. 54) (**) | 10 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

<Paper-Passing Test>

A paper-passing test with 500,000 sheets of A4 size (MY PAPER, manufactured by NBS Ricoh Company Ltd.) was conducted for each of the electrophotographic photoconductors produced in Examples III-1 to III-4 and Comparative Example III-1 using an image forming apparatus (remodeled machine from IMAGIO NEO 751 manufactured by Ricoh Company Ltd., processing linear velocity: 350 mm/sec) under the condition of an electric charge potential of −800V at the starting time of the paper-passing test to evaluate each of the electrophotographic photoconductors as to abrasion properties, electric potential in the image forming apparatus, and image properties based on the following methods.

With respect to the abrasion properties, the abrasion wear (μm) of each of the electrophotographic photoconductors was determined by measuring the film thickness thereof. As a film-thickness measurement device, an eddy current thicknessmeter (FISHERSCOPE) was used.

The electric potential in the image forming apparatus was determined from the surface electric potential at the time of outputting a white solid image with a grid voltage for the electric potential in the dark space fixed at −900 (V). The surface electric potential of each of the electrophotographic photoconductors was measured using TREK MODEL344. The electric potential for exposed regions was determined from the surface electric potential at the time of outputting a black solid image after adjusting the grid electric potential such that the electric potential in the dark space was −800 (V).

With respect to the image properties, the occurrence level of a residual negative image shown in FIG. 9 when outputting an image of an original document shown in FIG. 8 and then successively outputting halftone images thereof was evaluated. Table III-3 shows the evaluation results of abrasion property, Table III-4 shows the evaluation results of electric potential in the image forming apparatus, and Table III-5 shows the evaluation results of image properties.

TABLE III-3

| | Abrasion wear (μm) | |
|---|---|---|
| | No. of output sheets in succession: 100,000 | No. of output sheets in succession: 500,000 |
| Ex. III-1 | 1.0 | 3.1 |
| Ex. III-2 | 0.9 | 2.9 |
| Ex. III-3 | 0.8 | 3.1 |
| Ex. III-4 | 0.6 | 3.0 |
| Compara. Ex. III-1 | 0.6 | 3.0 |

TABLE III-4

| | Electric potential in image forming apparatus (−V) | | | | | |
|---|---|---|---|---|---|---|
| | Initial stage | | No. of output sheets in succession: 100,000 | | No. of output sheets in succession: 500,000 | |
| | Dark space | Exposed region | Dark space | Exposed region | Dark space | Exposed region |
| Ex. III-1 | 780 | 80 | 800 | 160 | 820 | 170 |
| Ex. III-2 | 790 | 100 | 780 | 160 | 800 | 170 |
| Ex. III-3 | 790 | 110 | 780 | 150 | 790 | 170 |
| Ex. III-4 | 800 | 130 | 760 | 150 | 720 | 160 |
| Compara. Ex. III-1 | 800 | 140 | 750 | 150 | 690 | 160 |

TABLE III-5

| | Image Property | | |
|---|---|---|---|
| | Initial stage | No. of output sheets in succession: 100,000 sheets | No. of output sheets in succession: 500,000 sheets |
| Ex. III-1 | A | A | A |
| Ex. III-2 | A | A | A |
| Ex. III-3 | A | A | A |
| Ex. III-4 | A | A | A |
| Compara. Ex. III-1 | A | B | C |

* Evaluation Criteria on residual negative images shown in Table III-5:
A: No residual negative images occurred.
B: A slightly amount of residual negative images occurred.
C: Residual negative images apparently occurred.

Example III-5

—Preparation of Electrophotographic Photoconductor—

Over the surface of an aluminum cylinder having a diameter of 100 mm, an undercoat layer coating solution containing the following composition, a charge generating layer coating solution containing the following composition, and a charge transporting layer coating solution containing the following composition were sequentially applied and dried to thereby form an undercoat layer having a thickness of 1.0 μm, a charge generating layer having a thickness of 0.3 μm, and a charge transporting layer having a thickness of 23 μm on the cylinder. Over the surface of the obtained charge transporting layer, a crosslinked surface layer coating solution D, a crosslinked surface layer coating solution E and a crosslinked surface layer coating solution F each containing the following composition were applied by spray-coating and then the cylinder surface with the crosslinked surface layer coating solutions D, E, and F applied thereon was irradiated with a light beam under the conditions of metal halide lamp: 160 W/cm, irradiation distance: 120 mm, irradiation intensity: 500 mW/cm$^2$, and irradiation time: 240 seconds. Next, the cylinder surface was then dried at 130° C. for 20 minutes to thereby form a crosslinked surface layer having a total thickness of 4.2 μm in which a crosslinked film having a thickness of 1.4 μm composed of the surface layer coating solution D, a crosslinked film having a thickness of 1.4 μm composed of the crosslinked surface layer coating solution E, and a crosslinked film having a thickness of 1.4 μm composed of the crosslinked surface layer coating solution F were formed in a laminate structure. Through the above-mentioned processes, an electrostatic photoconductor of the present invention was prepared.

| [Undercoat Layer Coating Solution] | |
|---|---|
| Titanium oxide | 40 parts |
| Alcohol-soluble nylon | 32 parts |
| Methanol | 400 parts |
| Isopropanol | 160 parts |

| [Charge Generating Layer Coating Solution] | |
|---|---|
| Titanyl phthalocyanine powder obtained in Synthesis Example III-1 | 4 parts |
| Polyvinyl butyral (ESLEC BM-S, manufactured by SEKISUI CHEMICAL CO., LTD.) | 2 parts |
| Methylethylketone | 150 parts |

| [Charge Transporting Layer Coating Solution] | |
|---|---|
| Bisphenol Z type polycarbonate (PANLIGHT TS-2050, manufactured by Teijin Chemicals, Ltd.) | 10 parts |
| Low-molecular weight charge transporting material represented by the following Structural Formula (D-1) | 7 parts |
| Tetrahydrofuran | 100 parts |
| 1% silicone oil-dissolved tetrahydrofuran solution (KF50-100CS, manufactured by Shin-Etsu Chemical Co., Ltd.) | 1 part |

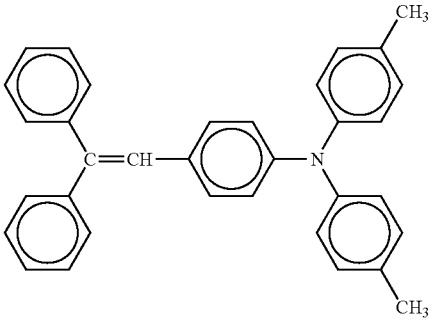

Structural Formula (D-1)

| [Crosslinked Surface Layer Coating Solution D] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) (***) | 15 parts |

-continued

| [Crosslinked Surface Layer Coating Solution D] | |
|---|---|
| Radical polymerizable compound (the above-mentioned Exemplified Compound No. 105) (****) | 5 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

(***) Trifunctional or more radical polymerizable compound having no charge transporting structure
(**) Monofunctional radical polymerizable compound having a charge transporting structure Hereinafter, the explanations for (*) and (****) are omitted because they are the same as described above.

| [Crosslinked Surface Layer Coating Solution E] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) (***) | 10 parts |
| Radical polymerizable compound (the above-mentioned Exemplified Compound No. 105) (****) | 10 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

| [Crosslinked Surface Layer Coating Solution F] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) (***) | 5 parts |
| Radical polymerizable compound (the above-mentioned Exemplified Compound No. 105) (****) | 15 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

Example III-6

An electrophotographic photoconductor according to the present invention was prepared in the same manner as in Example III-5 except that the crosslinked surface layer coating solutions D, E, and F were changed to crosslinked surface layer coating solutions each containing the following composition to thereby form a crosslinked surface layer on a charge transporting layer.

| [Crosslinked Surface Layer Coating Solution D] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) (***) | 14 parts |
| Radical polymerizable compound (the above-mentioned Exemplified Compound No. 105) (****) | 6 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

| [Crosslinked Surface Layer Coating Solution E] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) (***) | 10 parts |
| Radical polymerizable compound (the above-mentioned Exemplified Compound No. 105) (****) | 10 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

| [Crosslinked Surface Layer Coating Solution F] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) (***) | 6 parts |
| Radical polymerizable compound (the above-mentioned Exemplified Compound No. 105) (****) | 14 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

Example III-7

An electrophotographic photoconductor according to the present invention was prepared in the same manner as in Example III-5 except that the crosslinked surface layer coating solutions D, E, and F were changed to crosslinked surface layer coating solutions each containing the following composition to thereby form a crosslinked surface layer on a charge transporting layer.

| [Crosslinked Surface Layer Coating Solution D] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) (***) | 13 parts |
| Radical polymerizable compound (the above-mentioned Exemplified Compound No. 105) (****) | 7 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

| [Crosslinked Surface Layer Coating Solution E] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) (***) | 10 parts |
| Radical polymerizable compound (the above-mentioned Exemplified Compound No. 105) (****) | 10 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

| [Crosslinked Surface Layer Coating Solution F] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) (***) | 7 parts |
| Radical polymerizable compound (the above-mentioned Exemplified Compound No. 105) (****) | 13 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

Example III-8

An electrophotographic photoconductor according to the present invention was prepared in the same manner as in Example III-5 except that the crosslinked surface layer coating solutions D, E, and F were changed to crosslinked surface layer coating solutions each containing the following composition to thereby form a crosslinked surface layer on a charge transporting layer.

| [Crosslinked Surface Layer Coating Solution D] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) (***) | 12 parts |
| Radical polymerizable compound (the above-mentioned Exemplified Compound No. 105) (****) | 8 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

| [Crosslinked Surface Layer Coating Solution E] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) (***) | 10 parts |
| Radical polymerizable compound (the above-mentioned Exemplified Compound No. 105) (****) | 10 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

| [Crosslinked Surface Layer Coating Solution F] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) (***) | 8 parts |
| Radical polymerizable compound (the above-mentioned Exemplified Compound No. 105) (****) | 12 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

Comparative Example III-2

An electrophotographic photoconductor according to the present invention was prepared in the same manner as in Example III-5 except that only a crosslinked surface layer coating solution G was used instead of the crosslinked surface layer coating solutions D, E, and F, and the crosslinked surface layer coating solution G was applied to the surface of a charge transporting layer and irradiated with a light beam and heat-dried to thereby form a crosslinked surface layer having a film thickness of 4.2 μm.

| [Crosslinked Surface Layer Coating Solution G] | |
|---|---|
| Dipentaerythritol hexaacrylate (KAYARAD DPHA, manufactured by Nippon Kayaku Co., Ltd., molecular mass: 536, the number of functional groups: 5.5, molecular mass/the number of functional groups = 97) (***) | 10 parts |
| Radical polymerizable compound (the above-mentioned Exemplified Compound No. 105) (****) | 10 parts |
| 1-hydroxy-cyclohexyl-phenyl-ketone (IRGACURE 184, manufactured by Chiba Specialty Chemicals K.K) as a photopolymerization initiator | 1 part |
| Tetrahydrofuran | 100 parts |

<Paper-Passing Test>

A paper-passing test with 1,000,000 sheets of A4 size (MY PAPER, manufactured by NBS Ricoh Company Ltd.) was conducted for each of the thus produced electrophotographic photoconductors of Examples III-5 to III-8 and Comparative Example III-2 using an image forming apparatus (remodeled machine from IMAGIO NEO 1050 PRO manufactured by Ricoh Company Ltd., processing linear velocity: 500 mm/sec) under the condition of an electric charge potential of −800V at the starting time of the paper-passing test to evaluate each of the electrophotographic photoconductors as to abrasion properties, electric potential in the image forming apparatus, and image properties.

With respect to the abrasion properties, the abrasion wear (μm) of each of the electrophotographic photoconductors was determined by measuring the film thickness thereof. As a film-thickness measurement device, an eddy current thicknessmeter (FISHERSCOPE) was used.

The electric potential in the image forming apparatus was determined from the surface electric potential at the time of outputting a white solid image with a grid voltage for the electric potential in the dark space fixed at −900 (V). The surface electric potential of each of the electrophotographic photoconductors was measured using TREK MODEL344. The electric potential for exposed regions was determined from the surface electric potential at the time of outputting a black solid image after adjusting the grid electric potential such that the electric potential in the dark space was −800 (V).

With respect to the image properties, the occurrence level of a residual negative image shown in FIG. 9 when outputting an image of an original document shown in FIG. 8 and then successively outputting halftone images thereof was evaluated. Table III-6 shows the evaluation results of abrasion property, Table III-7 shows the evaluation results of electric potential in the image forming apparatus, and Table III-8 shows the evaluation results of image properties (evaluation results of residual negative images).

TABLE III-6

| | Abrasion wear (μm) | |
|---|---|---|
| | No. of output sheets: 500,000 | No. of output sheets: 1,000,000 |
| Ex. III-5 | 2.2 | 3.6 |
| Ex. III-6 | 2.0 | 3.6 |
| Ex. III-7 | 1.9 | 3.7 |
| Ex. III-8 | 1.9 | 3.7 |
| Compara. Ex. III-2 | 1.8 | 3.6 |

TABLE III-7

| | Electric potential in image forming apparatus (−V) | | | | | |
|---|---|---|---|---|---|---|
| | Initial stage | | No. of output sheets in succession: 500,000 | | No. of output sheets in succession: 1,000,000 | |
| | Dark space | Exposed region | Dark space | Exposed region | Dark space | Exposed region |
| Ex. III-5 | 780 | 90 | 790 | 140 | 800 | 160 |
| Ex. III-6 | 780 | 110 | 790 | 160 | 780 | 170 |
| Ex. III-7 | 780 | 130 | 780 | 160 | 760 | 180 |
| Ex. III-8 | 790 | 140 | 750 | 170 | 730 | 180 |
| Compara. Ex. III-2 | 800 | 160 | 730 | 180 | 680 | 200 |

TABLE III-8

| | Image Properties | | |
|---|---|---|---|
| | Initial stage | No. of output sheets in succession: 500,000 sheets | No. of output sheets in succession: 1,000,000 sheets |
| Ex. III-5 | A | A | A |
| Ex. III-6 | A | A | A |
| Ex. III-7 | A | A | A |
| Ex. III-8 | A | A | B |
| Compara. Ex. III-2 | A | C | C |

* Evaluation Criteria on residual negative images shown in Table III-8:
A: No residual negative images occurred.
B: A slightly amount of residual negative images occurred.
C: Residual negative images apparently occurred.

The evaluation results described above demonstrated that images could be output in stable conditions with keeping high-resistance to abrasion and without causing residual negative images and without causing abnormal images even when repeatedly used at high-speed by forming a surface layer on a photosensitive layer, the surface layer in which a trifunctional or more radical polymerizable compound having no charge transporting structure and a monofunctional or more radical polymerizable compound having a charge transporting structure were crosslinked to each other, and the concentration of the radical polymerizable compound having a charge transporting structure in the hardened resin was varied so as to be small from the surface part of the surface layer toward the inside of the surface layer in the film thickness direction. In other words, with a configuration in which the concentration of the radical polymerizable compound having a charge transporting structure is varied in between the surface part and the inside part of the surface layer, occurrences of residual negative images can be substantially prevented to minimize side effects caused by residual negative images. Consequently, with the use of an image forming apparatus or a process cartridge equipped with the electrophotographic photoconductor of the present invention, high-quality images can be formed in stable conditions over a long period of time.

The image forming apparatus, the image forming method, and the process cartridge of the present invention are preferably used for full-color copiers, full-color laser printers, and full-color regular paper facsimiles each based on a direct or an indirect electrophotographic developing method for multicolor images.

What is claimed is:

1. An image forming apparatus, comprising:

a latent electrostatic image bearing member, a latent electrostatic image forming unit configured to form a latent electrostatic image on the latent electrostatic image bearing member, a developing unit configured to develop the latent electrostatic image with a toner to form a visible image, a transferring unit configured to transfer the visible image on a recording medium, and a fixing unit configured to fix the transferred image on the recording medium, wherein the transferring unit is configured to apply a positive electric potential to the visible image formed on the latent electrostatic image bearing member via the recording medium, the latent electrostatic image bearing member has a layer configuration in which at least a photosensitive layer, a first surface layer and a second surface layer are formed in this order in a laminate structure on a substrate, each of the first and second surface layer comprises a hardened material which is hardened by irradiating at least (i) a trifunctional or more radical polymerizable monomer having no charge transporting structure and (ii) a monofunctional radical polymerizable compound having a charge transporting structure through the use of an optical energy irradiation unit, and the concentration of (ii) the monofunctional radical polymerizable compound having a charge transporting structure to form the hardened material comprised in the first surface layer is lower than the concentration of (ii) the monofunctional radical polymerizable compound having a charge transporting structure to form the hardened material comprised in the second surface layer, wherein (i) the trifunctional or more radical polymerizable monomer having no charge transporting structure included in the first surface layer and (i) the trifunctional or more radical polymerizable monomer having no charge transporting structure included in the second surface layer are the same material, wherein (ii) the monofunctional radical polymerizable compound having a charge transporting structure included in the first surface layer and (ii) the monofunctional radical polymerizable compound having a charge transporting structure included in the second surface layer are the same material, wherein the concentration of (ii) the monofunctional radical polymerizable compound having a charge transporting structure in the first surface layer is 24% by mass to 38% by mass relative to the total mass of the first surface layer, wherein the concentration of (ii) the monofunctional radical polymerizable compound having a charge transporting structure in the second surface layer is 57% by mass to 71% by mass relative to total mass of the second surface layer, wherein (ii) the monofunctional radical polymerizable compound having a charge transporting structure is a compound represented by the following Formula:

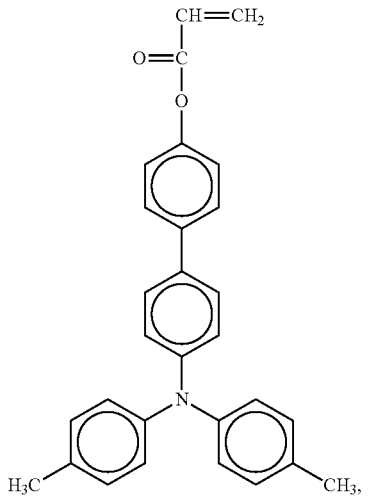

wherein the concentration of (i) the trifunctional or more polymerizable monomer having no charge transporting structure in the first surface layer is 57% by mass to 71% by mass relative to the total mass of the first surface layer wherein the concentration of (i) the trifunctional or more radical polymerizable monomer having no charge transporting structure in the second surface layer is 24% by mass to 38% by mass relative to the total mass of the second surface layer, and wherein (i) the trifunctional or more radical polymerizable monomer having no charge transporting structure is trimethylolpropane triacrylate.

2. The image forming apparatus of claim 1, wherein at least one of the photosensitive layer, the first surface layer and the second surface comprise an antioxidant.

3. The image forming apparatus of claim 2, wherein the antioxidant is a phenol compound, a paraphenylenediamine, an organic sulfur compound, an organic phosphorous, or mixtures thereof.

4. The image forming apparatus of claim 1, wherein an undercoat layer is located between the first surface layer and the photosensitive layer.

5. The image forming apparatus of claim 4, wherein the undercoat layer comprises a resin selected from the group consisting of a water soluble resin, an alcohol soluble resin, and a hardened resin which forms a three-dimensional network.

6. The image forming apparatus of claim 4, wherein the undercoat layer further comprises a fine powder pigment comprising a metal oxide.

7. The image forming apparatus of claim 6, wherein the metal oxide is at least one selected from the group consisting of titanium oxide, silica, alumina, zirconium oxide, tin oxide, and indium oxide.

* * * * *